US012799721B2

(12) United States Patent
Edmonds et al.

(10) Patent No.: US 12,799,721 B2
(45) Date of Patent: Nov. 17, 2026

(54) WEAR ASSEMBLY

(71) Applicant: Bradken Resources Pty Limited, New South Wales (AU)

(72) Inventors: Christopher David Edmonds, New South Wales (AU); Terry L. Briscoe, Portland, OR (US); Lauren Gillan, New South Wales (AU); Dean Ellis, New South Wales (AU); Adam Scriven, New South Wales (AU)

(73) Assignee: Bradken Resources Pty Limited, New South Wales (AU)

( * ) Notice: Subject to any disclaimer, the term of this patent is extended or adjusted under 35 U.S.C. 154(b) by 214 days.

(21) Appl. No.: 18/568,576

(22) PCT Filed: Jun. 9, 2022

(86) PCT No.: PCT/AU2022/050571
§ 371 (c)(1),
(2) Date: Dec. 8, 2023

(87) PCT Pub. No.: WO2022/256874
PCT Pub. Date: Dec. 15, 2022

(65) Prior Publication Data

US 2025/0122698 A1 Apr. 17, 2025

(30) Foreign Application Priority Data

| | | |
|---|---|---|
| Jun. 9, 2021 | (AU) | 2021901737 |
| Jun. 9, 2021 | (AU) | 2021901738 |
| Aug. 25, 2021 | (AU) | 2021221837 |

(51) Int. Cl.
*E02F 9/28* (2006.01)

(52) U.S. Cl.
CPC ..... *E02F 9/2825* (2013.01)

(58) Field of Classification Search
CPC ..... E02F 9/2808; E02F 9/2816; E02F 9/2825; E02F 9/2858; E02F 9/2875
See application file for complete search history.

(56) References Cited

U.S. PATENT DOCUMENTS

| | | | |
|---|---|---|---|
| 4,611,418 | A | 9/1986 | Launder |
| 7,171,771 | B2 | 2/2007 | Briscoe |

(Continued)

FOREIGN PATENT DOCUMENTS

| | | | |
|---|---|---|---|
| AU | 1998061534 | B2 | 10/1998 |
| AU | 1998076292 | B2 | 2/1999 |

(Continued)

OTHER PUBLICATIONS

International Search Report and Written Opinion dated Aug. 31, 2022, directed to International Application No. PCT/AU2022/050571; 28 pages.

(Continued)

*Primary Examiner* — Jamie L McGowan
(74) *Attorney, Agent, or Firm* — Morrison & Foerster LLP

(57) ABSTRACT

A wear assembly for excavation equipment includes a wear member with bearing surfaces formed on its internal surface for bearing against at least one corresponding surface of a support structure. The wear member may include a locking hole for receiving a lock. The wear assembly may include a lock that is movable within the locking hole to secure the wear member with the support structure.

22 Claims, 70 Drawing Sheets

(56) References Cited

U.S. PATENT DOCUMENTS

| | | | | |
|---|---|---|---|---|
| 2002/0023375 | A1 | 2/2002 | Pippins | |
| 2007/0227051 | A1* | 10/2007 | Carpenter | E02F 9/2883 37/452 |
| 2014/0360062 | A1* | 12/2014 | Marchand | E02F 9/2858 37/455 |
| 2015/0013134 | A1 | 1/2015 | Zenier et al. | |
| 2016/0083935 | A1 | 3/2016 | Edmonds | |
| 2017/0226718 | A1 | 8/2017 | Snyder | |
| 2018/0266085 | A1 | 9/2018 | Cheyne et al. | |
| 2023/0323639 | A1 | 10/2023 | Hymas et al. | |
| 2023/0392356 | A1 | 12/2023 | Edmonds et al. | |
| 2024/0011257 | A1 | 1/2024 | Wells et al. | |

FOREIGN PATENT DOCUMENTS

| | | | |
|---|---|---|---|
| AU | 1999019109 | B2 | 7/1999 |
| AU | 2000020497 | B2 | 7/2000 |
| AU | 2000076651 | B2 | 5/2001 |
| AU | 2001040270 | B2 | 5/2001 |
| AU | 2000072240 | B2 | 6/2001 |
| AU | 2001054094 | B2 | 1/2002 |
| AU | 2002048865 | B2 | 8/2002 |
| AU | 2003301453 | B8 | 5/2004 |
| AU | 2002300640 | B2 | 10/2005 |
| AU | 2002303692 | B2 | 4/2006 |
| AU | 2004200257 | B2 | 6/2006 |
| AU | 2002304999 | B2 | 2/2007 |
| AU | 2002320130 | B2 | 6/2007 |
| AU | 2004265631 | B2 | 7/2007 |
| AU | 2003265731 | B2 | 9/2008 |
| AU | 2007202390 | B2 | 5/2009 |
| AU | 2004236651 | B2 | 7/2009 |
| AU | 2003292898 | B2 | 2/2010 |
| AU | 2005201274 | B2 | 2/2010 |
| AU | 2006206066 | B2 | 6/2010 |
| AU | 2008207392 | B2 | 6/2010 |
| AU | 2010100656 | A4 | 7/2010 |
| AU | 2003275124 | B2 | 9/2010 |
| AU | 2007261586 | B2 | 9/2010 |
| AU | 2010101088 | A4 | 11/2010 |
| AU | 2007309015 | B2 | 12/2010 |
| AU | 2008251706 | B2 | 3/2011 |
| AU | 2009210367 | B2 | 3/2011 |
| AU | 2006326918 | B2 | 9/2011 |
| AU | 2009217468 | B2 | 2/2012 |
| AU | 2006333406 | B2 | 3/2012 |
| AU | 2011201408 | B1 | 5/2012 |
| AU | 2012100453 | B4 | 6/2012 |
| AU | 2011207111 | A1 | 8/2012 |
| AU | 2010202915 | B2 | 10/2012 |
| AU | 2011201135 | B2 | 11/2012 |
| AU | 2012211506 | B2 | 11/2012 |
| AU | 2010202916 | B2 | 12/2012 |
| AU | 2008234400 | B2 | 2/2013 |
| AU | 2008234401 | B2 | 5/2013 |
| AU | 2010330673 | B2 | 5/2013 |
| AU | 2012201781 | B2 | 6/2013 |
| AU | 2008258217 | C1 | 7/2013 |
| AU | 2012268800 | A1 | 7/2013 |
| AU | 2013202751 | B2 | 7/2013 |
| AU | 2013202717 | B2 | 8/2013 |
| AU | 2010319943 | B2 | 9/2013 |
| AU | 2006252273 | B2 | 10/2013 |
| AU | 2007284549 | C1 | 10/2013 |
| AU | 2013202228 | B2 | 10/2013 |
| AU | 2005203574 | C1 | 11/2013 |
| AU | 2007243386 | C1 | 2/2014 |
| AU | 2011299514 | B2 | 4/2014 |
| AU | 2006319766 | C1 | 5/2014 |
| AU | 2008202834 | C1 | 6/2014 |
| AU | 2008341192 | B2 | 8/2014 |
| AU | 2008207519 | B2 | 10/2014 |
| AU | 2010302883 | B2 | 11/2014 |
| AU | 2014202635 | A1 | 1/2015 |
| AU | 2004318061 | C1 | 2/2015 |
| AU | 2009238226 | C1 | 4/2015 |
| AU | 2012370301 | B2 | 4/2015 |
| AU | 2013200161 | B2 | 4/2015 |
| AU | 2013200178 | B2 | 4/2015 |
| AU | 2013200179 | B2 | 4/2015 |
| AU | 2015100447 | A4 | 5/2015 |
| AU | 2013206156 | B2 | 8/2015 |
| AU | 2013235642 | B2 | 8/2015 |
| AU | 2011214909 | B2 | 10/2015 |
| AU | 2013205320 | B2 | 10/2015 |
| AU | 2011340794 | B2 | 11/2015 |
| AU | 2013204294 | B2 | 11/2015 |
| AU | 2011243017 | B2 | 12/2015 |
| AU | 2015268613 | A1 | 1/2016 |
| AU | 2012318298 | B2 | 2/2016 |
| AU | 2013202229 | B2 | 3/2016 |
| AU | 2013205223 | B2 | 3/2016 |
| AU | 2013205251 | B2 | 3/2016 |
| AU | 2013211524 | B2 | 3/2016 |
| AU | 2013204854 | B2 | 4/2016 |
| AU | 2013204873 | B2 | 4/2016 |
| AU | 2013204892 | B2 | 4/2016 |
| AU | 2014319938 | A1 | 4/2016 |
| AU | 2014259539 | A1 | 5/2016 |
| AU | 2016202743 | A1 | 5/2016 |
| AU | 2011245070 | B2 | 6/2016 |
| AU | 2013204833 | B2 | 6/2016 |
| AU | 2016203506 | A1 | 6/2016 |
| AU | 2013200107 | B2 | 7/2016 |
| AU | 2009251045 | B2 | 8/2016 |
| AU | 2015200892 | B2 | 8/2016 |
| AU | 2013202351 | B2 | 10/2016 |
| AU | 2013205263 | B2 | 10/2016 |
| AU | 2016231542 | A1 | 10/2016 |
| AU | 2012315731 | B2 | 11/2016 |
| AU | 2016253640 | A1 | 11/2016 |
| AU | 2013200283 | B2 | 12/2016 |
| AU | 2013204602 | B2 | 12/2016 |
| AU | 2016200257 | B2 | 1/2017 |
| AU | 2016200757 | B2 | 1/2017 |
| AU | 2012350166 | B2 | 2/2017 |
| AU | 2013203553 | B2 | 2/2017 |
| AU | 2015100239 | B4 | 2/2017 |
| AU | 2017200709 | A1 | 2/2017 |
| AU | 2012260425 | C1 | 3/2017 |
| AU | 2013318670 | B2 | 3/2017 |
| AU | 2015382413 | B2 | 3/2017 |
| AU | 2012352504 | B2 | 4/2017 |
| AU | 2014281002 | A1 | 4/2017 |
| AU | 2015396851 | B2 | 5/2017 |
| AU | 2017203398 | A1 | 6/2017 |
| AU | 2017203399 | A1 | 6/2017 |
| AU | 2014245831 | B2 | 7/2017 |
| AU | 2011372710 | B2 | 8/2017 |
| AU | 2013311371 | B2 | 8/2017 |
| AU | 2012307065 | B2 | 10/2017 |
| AU | 2014268636 | B2 | 11/2017 |
| AU | 2014274037 | B2 | 11/2017 |
| AU | 2014323143 | B2 | 11/2017 |
| AU | 2017272237 | A1 | 1/2018 |
| AU | 2017272238 | A1 | 1/2018 |
| AU | 2014287429 | B2 | 2/2018 |
| AU | 2014296674 | B2 | 3/2018 |
| AU | 2017225135 | A1 | 3/2018 |
| AU | 2017202334 | B2 | 5/2018 |
| AU | 2018203046 | A1 | 5/2018 |
| AU | 2017261598 | A1 | 6/2018 |
| AU | 2016346003 | A2 | 8/2018 |
| AU | 2015206710 | B2 | 9/2018 |
| AU | 2015270772 | B2 | 10/2018 |
| AU | 2014336970 | B2 | 12/2018 |
| AU | 2014366895 | B2 | 12/2018 |
| AU | 2015259731 | B2 | 12/2018 |
| AU | 2016264705 | B2 | 12/2018 |
| AU | 2017264498 | A1 | 12/2018 |
| AU | 2017264500 | A1 | 12/2018 |
| AU | 2017264501 | A1 | 12/2018 |
| AU | 2017277559 | A1 | 1/2019 |

(56) References Cited

FOREIGN PATENT DOCUMENTS

| | | | |
|---|---|---|---|
| AU | 2018214058 | A1 | 2/2019 |
| AU | 2015222171 | B2 | 3/2019 |
| AU | 2018264144 | A1 | 7/2019 |
| AU | 2019205028 | A1 | 8/2019 |
| AU | 2016333778 | B2 | 11/2019 |
| AU | 2017264874 | B2 | 11/2019 |
| AU | 2017264880 | B2 | 3/2020 |
| AU | 2015308757 | B2 | 4/2020 |
| AU | 2016330932 | B2 | 4/2020 |
| AU | 2017224039 | B2 | 4/2020 |
| AU | 2018385223 | A1 | 6/2020 |
| AU | 2020203270 | A1 | 6/2020 |
| AU | 2020200344 | A1 | 8/2020 |
| AU | 2020210254 | A1 | 8/2020 |
| AU | 2019218558 | A1 | 9/2020 |
| AU | 2015355305 | B2 | 10/2020 |
| AU | 2020233769 | A1 | 10/2020 |
| AU | 2019252777 | A1 | 11/2020 |
| AU | 2020264339 | A1 | 12/2020 |
| AU | 2020270490 | A1 | 12/2020 |
| AU | 2020270501 | A1 | 12/2020 |
| AU | 2018430194 | A1 | 1/2021 |
| AU | 2016247936 | B2 | 2/2021 |
| AU | 2016408397 | B2 | 2/2021 |
| AU | 2019314699 | A1 | 2/2021 |
| AU | 2017274298 | B2 | 5/2021 |
| AU | 2016281454 | B2 | 7/2021 |
| AU | 2019228868 | B2 | 7/2021 |
| AU | 2020255269 | A1 | 11/2021 |
| AU | 2021250890 | A1 | 11/2021 |
| AU | 2020285568 | A1 | 12/2021 |
| AU | 2020316238 | A1 | 1/2022 |
| AU | 2021282515 | A1 | 1/2022 |
| AU | 2021282516 | A1 | 1/2022 |
| AU | 2021290263 | A1 | 1/2022 |
| AU | 2017218608 | B2 | 2/2022 |
| AU | 2016359272 | B2 | 3/2022 |
| AU | 2016385458 | B2 | 3/2022 |
| AU | 2020371560 | A1 | 3/2022 |
| AU | 2021215097 | A1 | 3/2022 |
| AU | 2022201123 | A1 | 3/2022 |
| AU | 2022201506 | A1 | 3/2022 |
| AU | 2020365389 | A1 | 4/2022 |
| AU | 2021221771 | A1 | 4/2022 |
| AU | 2022202309 | A1 | 4/2022 |
| AU | 2020345426 | B2 | 6/2022 |
| AU | 2020380145 | A1 | 6/2022 |
| AU | 2020383256 | A1 | 6/2022 |
| AU | 2020385107 | A1 | 6/2022 |
| AU | 2017280012 | B2 | 7/2022 |
| AU | 2022204364 | A1 | 7/2022 |
| AU | 2022204400 | A1 | 7/2022 |
| AU | 2017217225 | B2 | 8/2022 |
| AU | 2020424076 | A1 | 8/2022 |
| AU | 2020432001 | A1 | 8/2022 |
| AU | 2021/217678 | A1 | 9/2022 |
| AU | 2021215706 | A1 | 9/2022 |
| AU | 2022215294 | A1 | 9/2022 |
| AU | 2022228108 | A1 | 9/2022 |
| AU | 2022228120 | A1 | 9/2022 |
| AU | 2017261340 | B2 | 10/2022 |
| AU | 2021236300 | A1 | 10/2022 |
| AU | 2016419981 | B2 | 1/2023 |
| AU | 2016430503 | B2 | 2/2023 |
| AU | 2020260070 | B2 | 6/2023 |
| AU | 2017378396 | B2 | 8/2023 |
| AU | 2017378397 | B2 | 8/2023 |
| AU | 2020261262 | B2 | 8/2023 |
| AU | 2020334785 | B2 | 10/2023 |
| AU | 2020261737 | B2 | 11/2023 |
| AU | 2017375472 | B2 | 12/2023 |
| WO | 2008/051966 | A2 | 5/2008 |
| WO | 2011/053624 | A1 | 5/2011 |
| WO | 2011/088511 | A1 | 7/2011 |
| WO | 2013/009952 | A1 | 1/2013 |
| WO | 2013004858 | A1 | 1/2013 |
| WO | 2013090254 | A1 | 6/2013 |
| WO | 2014037780 | A1 | 3/2014 |
| WO | 2014153591 | A1 | 10/2014 |
| WO | 2014189979 | A1 | 11/2014 |
| WO | 2014194159 | A1 | 12/2014 |
| WO | 2014204700 | A1 | 12/2014 |
| WO | 2015006326 | A1 | 1/2015 |
| WO | 2015017169 | A1 | 2/2015 |
| WO | 2015/036936 | A1 | 3/2015 |
| WO | 2015040101 | A1 | 3/2015 |
| WO | 2015054741 | A1 | 4/2015 |
| WO | 2015089565 | A1 | 6/2015 |
| WO | 2015108822 | A1 | 7/2015 |
| WO | 2015128439 | A1 | 9/2015 |
| WO | 2015/165505 | A1 | 11/2015 |
| WO | 2015175144 | A1 | 11/2015 |
| WO | 2015185425 | A1 | 12/2015 |
| WO | 2016033428 | A1 | 3/2016 |
| WO | 2016089669 | A1 | 6/2016 |
| WO | 2016130135 | A1 | 8/2016 |
| WO | 2016167965 | A1 | 10/2016 |
| WO | 2016195712 | A1 | 12/2016 |
| WO | 2016209146 | A1 | 12/2016 |
| WO | 2017059009 | A1 | 4/2017 |
| WO | 2017091367 | A1 | 6/2017 |
| WO | 2017120034 | A1 | 7/2017 |
| WO | 2017139257 | A1 | 8/2017 |
| WO | 2017144305 | A1 | 8/2017 |
| WO | 2017/193067 | A1 | 11/2017 |
| WO | 2017/196518 | A1 | 11/2017 |
| WO | 2017/196521 | A1 | 11/2017 |
| WO | 2017/197169 | A1 | 11/2017 |
| WO | 2017196520 | A1 | 11/2017 |
| WO | 2017204809 | A1 | 11/2017 |
| WO | 2018187972 | A1 | 10/2018 |
| WO | 2019045911 | A1 | 3/2019 |
| WO | 2019045918 | A1 | 3/2019 |
| WO | 2019/115379 | A1 | 6/2019 |
| WO | 2019118102 | A1 | 6/2019 |
| WO | 2019132311 | A1 | 7/2019 |
| WO | 2019/155095 | A1 | 8/2019 |
| WO | 2019200210 | A1 | 10/2019 |
| WO | 2020/000013 | A1 | 1/2020 |
| WO | 2020007958 | A1 | 1/2020 |
| WO | 2020018205 | A1 | 1/2020 |
| WO | 2020/025831 | A2 | 2/2020 |
| WO | 2020055363 | A3 | 4/2020 |
| WO | 2020068489 | A1 | 4/2020 |
| WO | 2020092844 | A1 | 5/2020 |
| WO | 2020093106 | A1 | 5/2020 |
| WO | 2020096749 | A1 | 5/2020 |
| WO | 2020096750 | A1 | 5/2020 |
| WO | 2020096922 | A1 | 5/2020 |
| WO | 2020101581 | A1 | 5/2020 |
| WO | 2020106456 | A1 | 5/2020 |
| WO | 2020113261 | A1 | 6/2020 |
| WO | 2020131939 | A1 | 6/2020 |
| WO | 2020163831 | A1 | 8/2020 |
| WO | 2020176932 | A1 | 9/2020 |
| WO | 2020178462 | A1 | 9/2020 |
| WO | 2020178466 | A1 | 9/2020 |
| WO | 2020/201418 | A1 | 10/2020 |
| WO | 2020201587 | A1 | 10/2020 |
| WO | 2020214590 | A1 | 10/2020 |
| WO | 2020219171 | A1 | 10/2020 |
| WO | 2020219172 | A1 | 10/2020 |
| WO | 2020/237326 | A1 | 12/2020 |
| WO | 2020243598 | A1 | 12/2020 |
| WO | 2020247140 | A1 | 12/2020 |
| WO | 2020247141 | A1 | 12/2020 |
| WO | 2020247142 | A1 | 12/2020 |
| WO | 2020257209 | A1 | 12/2020 |
| WO | 2021/011993 | A1 | 1/2021 |
| WO | 2021011994 | A1 | 1/2021 |
| WO | 2021034433 | A1 | 2/2021 |
| WO | 2021/074250 | A1 | 4/2021 |
| WO | 2021/077165 | A1 | 4/2021 |
| WO | 2021/091652 | A1 | 5/2021 |

(56) References Cited

FOREIGN PATENT DOCUMENTS

| | | | |
|---|---|---|---|
| WO | 2021/096622 | A1 | 5/2021 |
| WO | 2021/096682 | A1 | 5/2021 |
| WO | 2021/150351 | A1 | 7/2021 |
| WO | 2021/155434 | A1 | 8/2021 |
| WO | 2021/159003 | A1 | 8/2021 |
| WO | 2021/170237 | A1 | 9/2021 |
| WO | 2021/183834 | A1 | 9/2021 |
| WO | 2021195139 | A1 | 9/2021 |
| WO | 2021207788 | A1 | 10/2021 |
| WO | 2021211234 | A1 | 10/2021 |
| WO | 2021216259 | A1 | 10/2021 |
| WO | 2021219557 | A1 | 11/2021 |
| WO | 2021221803 | A1 | 11/2021 |
| WO | 2021221864 | A1 | 11/2021 |
| WO | 2021226004 | A1 | 11/2021 |
| WO | 2021246814 | A1 | 12/2021 |
| WO | 2022010642 | A1 | 1/2022 |
| WO | 2022010643 | A1 | 1/2022 |
| WO | 2022010723 | A1 | 1/2022 |
| WO | 2022010729 | A1 | 1/2022 |
| WO | 2022012819 | A1 | 1/2022 |
| WO | 2022018513 | A1 | 1/2022 |
| WO | 2022020635 | A1 | 1/2022 |
| WO | 2022046796 | A1 | 3/2022 |
| WO | 2022058468 | A1 | 3/2022 |
| WO | 2022075295 | A1 | 4/2022 |
| WO | 2022075296 | A1 | 4/2022 |
| WO | 2022082252 | A1 | 4/2022 |
| WO | 2022082253 | A1 | 4/2022 |
| WO | 2022090411 | A1 | 5/2022 |
| WO | 2022090412 | A1 | 5/2022 |
| WO | 2022090992 | A1 | 5/2022 |
| WO | 2022093525 | A1 | 5/2022 |
| WO | 2022108688 | A1 | 5/2022 |
| WO | 2022108858 | A1 | 5/2022 |
| WO | 2022108859 | A1 | 5/2022 |
| WO | 2022115912 | A1 | 6/2022 |
| WO | 2022120412 | A1 | 6/2022 |
| WO | 2022126201 | A1 | 6/2022 |
| WO | 2022132515 | A1 | 6/2022 |
| WO | 2022159220 | A1 | 7/2022 |
| WO | 2022165259 | A1 | 8/2022 |
| WO | 2022171910 | A1 | 8/2022 |
| WO | 2022173306 | A1 | 8/2022 |
| WO | 2022173585 | A1 | 8/2022 |
| WO | 2022173586 | A1 | 8/2022 |
| WO | 2022173702 | A1 | 8/2022 |
| WO | 2022/203942 | A1 | 9/2022 |
| WO | 2022180224 | A1 | 9/2022 |
| WO | 2022192073 | A1 | 9/2022 |
| WO | 2022193033 | A1 | 9/2022 |
| WO | 2022196839 | A1 | 9/2022 |
| WO | 2022200383 | A1 | 9/2022 |

OTHER PUBLICATIONS

International Search Report and Written Opinion dated Nov. 4, 2021, directed to International Application No. PCT/AU2021/050972; 26 pages.

Edmonds et al., U.S. Office Action dated Mar. 20, 2026, directed to U.S. Appl. No. 18/032,983; 8 pages.

Edmonds et al., U.S. Office Action dated Oct. 7, 2025, directed to U.S. Appl. No. 18/032,983; 18 pages.

* cited by examiner

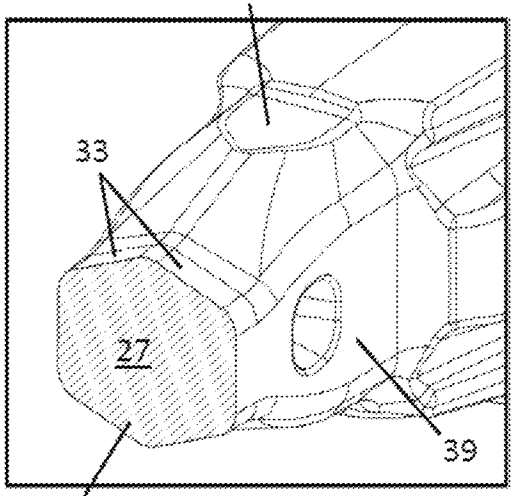
Fig. 4a
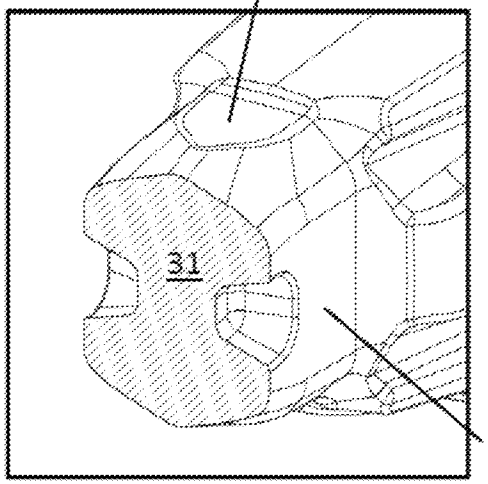
Fig. 4b
Fig. 4c

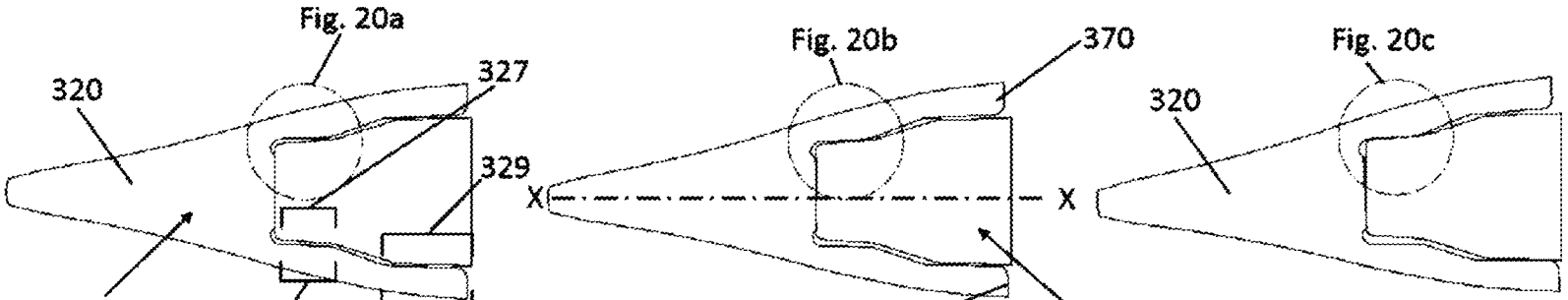
Fig. 19a
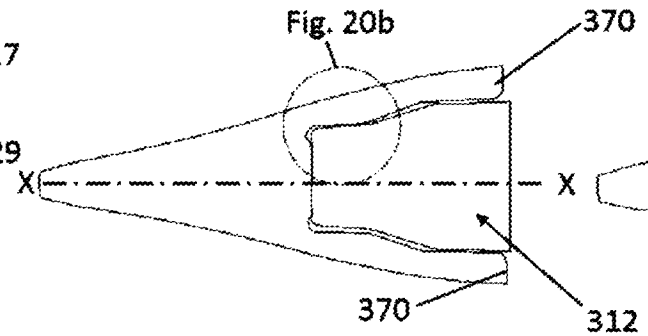
Fig. 19b
Fig. 19c
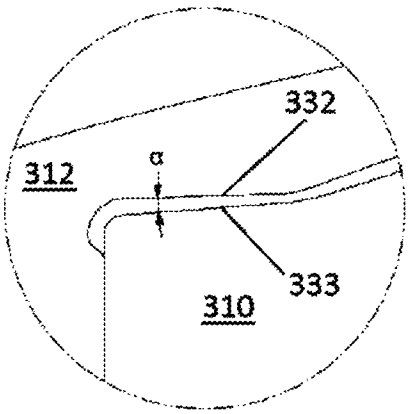
Fig. 20a
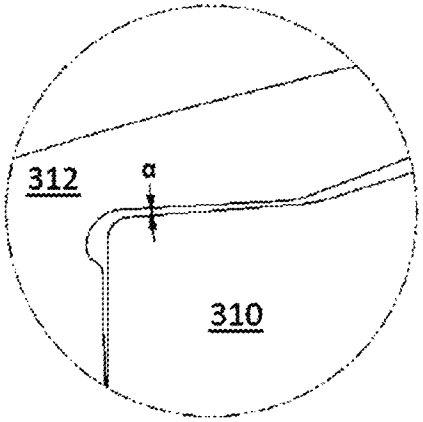
Fig. 20b
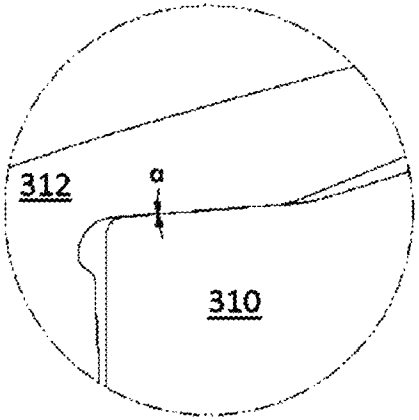
Fig. 20c

WEAR ASSEMBLY

CROSS-REFERENCE TO RELATED APPLICATIONS

This application is a national stage application under 35 USC 371 of International Application No. PCT/AU2022/050571, filed Jun. 9, 2022, which claims the priority of Australian Application No. 2021901738, filed Jun. 9, 2021, Australian Application No. 2021901737, filed Jun. 9, 2021, and Australian Application No. 2021221837, filed Aug. 25, 2021. The entire contents of each priority application is incorporated herein by reference.

FIELD OF THE DISCLOSURE

This disclosure relates to excavation wear assemblies, wear members for use in such wear assemblies and components of such excavation wear assemblies. The disclosure has application in earth working equipment such as land-based digging equipment and is herein described in that context. However, it is to be appreciated that the disclosure has broader application for example in waterborne excavation equipment such as dredgers and is therefore not limited to that application.

BACKGROUND OF THE DISCLOSURE

Wear members are provided on the digging edge of various pieces of digging equipment such as the buckets of front end loaders. The wear assembly is often formed of a number of parts, commonly a wear member, a support structure and a lock. The support structure is typically fitted to the excavation equipment and the wear member fits over the support system and is retained in place by the lock. In some instances, one or more intermediate parts may be also included between the wear member and the support structure.

For ease of description it is to be understood that, unless the context requires otherwise, the term "support structure" used in this specification includes both the support structure arranged to be fitted to, or forming an integral part of, the excavation equipment or, if one or more intermediate parts are provided, to that intermediate part(s) or to the combination of the support structure and the intermediate part(s).

The reason that the wear assembly is formed of a number of parts is to avoid having to discard the entire wear assembly when only parts of the wear member, in particular the ground engaging part of the wear assembly (i.e. the wear member) is worn or broken.

When the wear member is fitted over the support structure and placed under load in-use, the wear member typically experiences wear, i.e. material loss, at regions of the wear member that contact the support structure. When the wear member is under load, small clearance gaps between the wear member and the support structure can allow movement of the two components relative to each other. This movement results in non-uniform wear of the wear member surfaces that contact the support structure in-use. Depending on the in-use scenario, the locations of this wear on the wear member can vary.

Various types of locks, wear members and support structures are known. However, there is a continuing aim to design new wear assemblies and components thereof to take into account installation, performance and manufacturing considerations.

It is to be understood that, if any prior art is referred to herein, such reference does not constitute an admission that the prior art forms a part of the common general knowledge in the art, in Australia or any other country.

SUMMARY OF THE DISCLOSURE

Disclosed is a wear assembly for excavation equipment, the wear assembly comprising a wear member, the wear member including a digging end for ground penetration and a cavity defined by an internal surface that opens into a rear of the wear member extending along a longitudinal axis from an open end to a front end and for receiving a correspondingly shaped support structure of the excavation equipment, the wear member further comprising a locking hole for receiving a lock within the locking hole, and the wear assembly further comprises a lock movable within the locking hole to secure the wear member with the support structure.

In some forms, the internal surface of the wear member further comprising an upper wall and a lower wall each extending in the direction of the longitudinal axis from the open end to the front end; and a front portion positioned adjacent the front end; at least one of the upper wall and the lower wall of the front portion including bearing surfaces for bearing against corresponding surfaces of the support structure, the front portion including: two bearing surfaces being inclined relative to one another and extending from one another, the bearing surfaces extending in substantially the same direction as the longitudinal axis of the wear member.

In some forms, the internal surface further comprising an upper wall and a lower wall each extending in the direction of the longitudinal axis from the open end to the front end; and a rear portion positioned adjacent the open end; a rear portion of the cavity including opposing bearing surfaces for bearing against the support structure, the bearing surfaces extending substantially in the direction of the longitudinal axis; side surfaces extending from the rear portion to the front portion, wherein the upper wall and the lower wall are spaced apart by the side bearing surfaces.

In some forms, the internal surface further comprising an upper wall and a lower wall and a front portion positioned adjacent the front end and a rear portion positioned adjacent the open end; and the front portion including less bearing surfaces than the rear portion and the front portion including a fewer total number of surfaces than the rear portion.

In some forms, the internal surface further comprises an upper wall and a lower wall each extending in the direction of the longitudinal axis from the open end to the front end; and a front portion positioned adjacent the front end and a rear portion positioned adjacent the open end, the front portion including surfaces having a hexagonal shape in cross-section, the rear portion including surfaces having an octagonal shape in cross-section.

In some forms, the internal surface further comprises an upper wall and a lower wall each extending in the direction of the longitudinal axis from the open end to the front end; and a front portion positioned adjacent the front end and a rear portion positioned adjacent the open end, the rear portion having more surfaces than the front portion.

In some forms, the internal surface further comprises an upper wall and a lower wall each extending in the direction of the longitudinal axis from the open end to the front end; a front portion positioned adjacent the front end and a rear portion positioned adjacent the open end; the front portion and the rear portion including bearing surfaces for bearing against corresponding surfaces of the support structure; the front portion including more bearing surfaces than the rear portion, and the front portion including fewer total number of surfaces than the rear portion.

In some forms, the internal surface further comprises an upper wall and a lower wall each extending in the direction of the longitudinal axis from the open end to the front end; and a front portion positioned adjacent the front end and a rear portion positioned adjacent the open end; at least one of the upper wall and the lower wall of the front portion including bearing surfaces for bearing against corresponding surfaces of the support structure, wherein the cavity is symmetrical about the longitudinal axis such that the wear member is mountable to the support structure in more than one orientation.

In some forms, the internal surface further comprises an upper wall and a lower wall each extending in the direction of the longitudinal axis from the open end to the front end; and a front portion positioned adjacent the front end and a rear portion positioned adjacent the open end, the front portion including two bearing surfaces being inclined relative to one another and extending from one another, the bearing surfaces extending in substantially the same direction as the longitudinal axis of the wear member; and the rear portion including two bearing surfaces inclined relative to one another.

In some forms. the internal surface further comprising at least one bearing surface formed on the internal surface for bearing against at least one corresponding surface of the support structure, and when the wear member is installed on the support structure prior to ground penetration the at least one bearing surface of the cavity is configured to be angularly offset from the corresponding at least one bearing surface of the support structure.

In some forms, the internal surface further comprising at least one bearing surface being formed on the internal surface for bearing against at least one corresponding surface of the support structure, and when the wear member is installed on the support structure prior to ground penetration, the at least one bearing surface of the cavity and the at least one corresponding bearing surface of the support structure are juxtaposed and have a variable clearance from one another across those surfaces.

In some forms, the wear assembly further comprising a correspondingly shaped support structure.

In some forms, the locking hole is disposed in the wear member extending to the internal surface of the cavity.

In some forms, the locking hole extends from an exterior of the wear member to the cavity.

In some forms, the lock further comprises a lock body extending along a lock body axis and at least one latch is disposed on the lock body and has a detent movable transverse to the lock body axis and being arranged in use to restrain movement of the lock in the locking hole.

In some forms, the lock further comprises a lock body extending along a lock body axis and a retaining arrangement operative to resist movement of the lock in the wear member under loading in the direction of the lock body axis, the retaining arrangement comprising: an engaging structure on an exterior surface of the lock body which is arranged to engage with a complementary engaging structure disposed on an interior wall defining at least part of the locking hole, and one or more retainers operative to provide torsional resistance of the lock body in the locking hole, wherein the engaging structure is operative to inhibit axial movement of the lock body when the lock body is restrained from rotating in the locking hole.

In some forms, the lock further comprises a lock body extending along a lock body axis and a retaining arrangement operative to resist movement of the lock in the wear member the retaining arrangement comprising a plurality of retainers angularly spaced apart about the lock body axis when the lock is in a locked position.

In some forms, the lock further comprises a lock body extending along a lock body axis and a retaining arrangement operative to resist lateral movement of the lock body within the locking hole.

In some forms, the locking hole is defined by an interior wall surface that incorporates at least one engaging structure arranged to engage with a complementary engaging structure disposed on an exterior surface of the lock to resist movement of the lock in the wear member under loading in the direction of the hole axis.

In some forms, the lock comprises a lock body extending along a lock body axis and the lock body comprises a body region incorporating an engaging structure provided on an exterior surface of the lock and a complementary engaging structure is disposed on an interior wall defining at least part of the locking hole, the engaging structures forming at least part of a retaining arrangement operative to engage to resist movement of the lock in the wear member under loading in the direction of the hole axis.

In some forms, the engaging structure provides the primary retention arrangement of the locking arrangement to resist any axial loading induced on the lock body which may cause the lock body to be ejected from the locking hole.

In some forms, the retaining arrangement further comprising a retainer to restrain movement of the lock in the wear member when the engaging structures are in engagement.

In some forms, the lock and the wear member further including respective bearing surfaces that are in opposing relation when the lock is in a locked position, the bearing surfaces being arranged to be angularly offset from one another when the wear assembly is not under loaded conditions.

In some forms, when in loaded condition, the lock is biased to move relative to the wear member to cause the opposing bearing surfaces to move to reduce the angular offset so as to provided increased surface engagement between the bearing surfaces.

In a further aspect, the disclosure is directed to improved latch and/or biasing arrangements for use in locks for ground engagement equipment. Whilst the latch or biasing arrangement and associated lock have particular application to the wear member assemblies disclosed herein, it is to be appreciated that they have broader application and are not limited to such arrangements. The present disclosure relates generally to locks, wear members and wear assemblies. In some embodiments, the wear member is secured to the support structure that is fixed to a bucket lip or other digging edge. The support structure may be part of an adapter or may be integrally formed to the digging edge. However, it is understood that embodiments of the present disclosure may be applied to excavation tooth assemblies in which the wear member is mounted to an intermediate member (which may also be referred to as a support structure or an adapter) that in turn is mounted to a nose that forms part of the digging edge or to the nose of a further support structure that is mounted to the digging edge. In the present disclosure, locking assemblies are used to secure the wear member to the support structure, however, the locking assemblies disclosed herein may also be used to secure any member that makes up the excavation wear assemblies to one another.

Accordingly, the wear member in that arrangement might be an intermediate member which in turn locates within a further member which is exposed to wear.

BRIEF DESCRIPTION OF THE FIGURES

Embodiments will now be described by way of example only, with reference to the accompanying drawings in which

FIGS. 4*a*-4*c* are cross-sectional perspective views of the support structure of FIGS. 3*a* & 3*b;*

FIGS. 19*a*, 19*b* and 19*c* are a side cross-sectional view of a fifth embodiment of a wear assembly;

FIGS. 20*a*, 20*b* and 20*c* are a close-up view of the respective areas shown in FIGS. 19*a*, 19*b* and 19*c*.

FIGS. 42*a* to 41*e* is an installation sequence (showing both section and exterior views) of a lock assembly being a variation of the lock assembly of FIGS. 37*a* to 37*i*.

DETAILED DESCRIPTION OF THE DISCLOSURE

Figure 1:
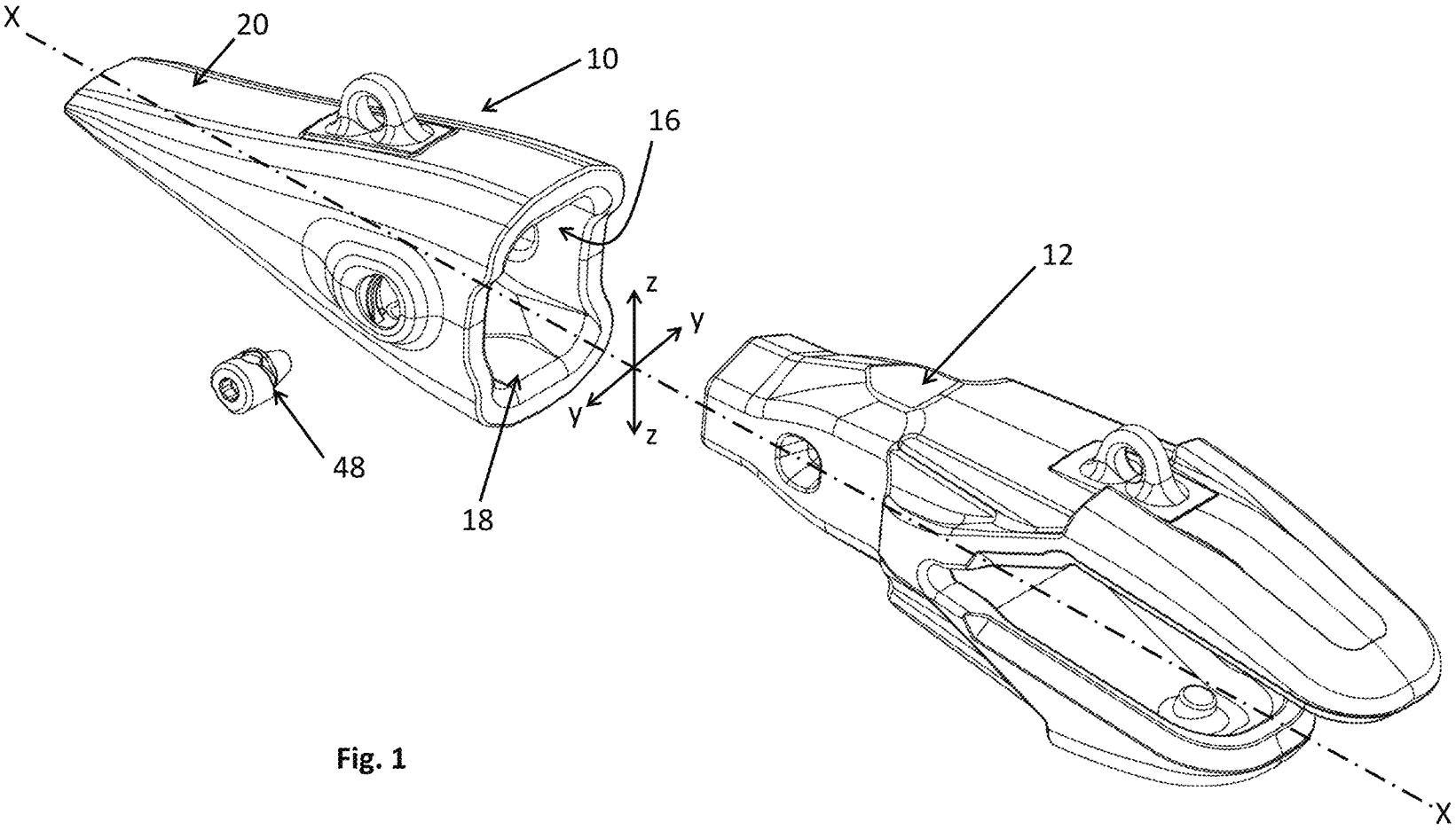
FIG. 1 is an exploded view of a first embodiment of a wear assembly.

In the following detailed description, reference is made to accompanying drawings which form a part of the detailed description. The illustrative embodiments described in the detailed description, depicted in the drawings and defined in the claims, are not intended to be limiting. Other embodiments may be utilised, and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

The present disclosure relates generally to wear assemblies for earth working equipment and to components of such assemblies including locks, wear members and support structures and to methods associated with those assemblies.

Disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end, the internal surface of the cavity comprising: an upper wall and a lower wall each extending in the direction of the longitudinal axis from the open end to the front end; and a front portion positioned adjacent the front end; at least one of the upper wall and the lower wall of the front portion including bearing surfaces for bearing against corresponding surfaces of the support structure, the front portion including: two bearing surfaces being inclined relative to one another and extending from one another, the bearing surfaces extending in substantially the same direction as the longitudinal axis of the wear member. In some forms, the inclined bearing surfaces are arranged so as to support load transfer from the corresponding surfaces of the support structure in more than one direction relative to the direction of the longitudinal axis.

In some forms, the bearing surfaces meet at an arcuate transition region. The bearing surfaces are contact surfaces for transferring load between the support structure and wear member. In some forms, the bearing surfaces are flat surfaces. This facilitates manufacturing and gauging plus increases wear life of the wear member.

In some forms, the inclined bearing surfaces are angled relative to each other to form an arcuate transition, for example, an apex between the inclined surfaces in the front portion having one or more radii that extends the length of one side of each of the bearing surfaces. It is an advantage that the surfaces are inclined surfaces and meet at the arcuate transition region so as to centre the cavity of the wear member about corresponding inclined surfaces of the support structure. Centring the wear member and support structure can maximise the lifespan of a wear member by evenly distributing loads across the bearing surfaces.

The inclined surfaces may support loads that comprise at least two force components, e.g. a vertical force and a horizontal force. The load path may be more complex and include more than two force components. The inclined bearing surfaces may provide stability to the wear member during, e.g. digging operations of the excavation equipment.

In some forms, the fit faces of the nose are flat making manufacture, gauging and repair simpler and easier.

In some forms, the front fits are angled which are designed to position the nose inside the point to stabilise it against lateral movement when under horizontal load. This may reduce movement of the butt face contact and therefore reduce wear on the butt face.

In some forms, the wear member further comprising an end bearing surface generally laterally extending across the front end. In some forms, the end bearing surface extends generally perpendicular to the longitudinal axis.

In some forms, the fit faces are generally perpendicular to the butt face with casting draft only and are active at the extreme fore and aft positions of nose fits. This provides the best point stability for variances in butt face wear and point pin position.

In some forms, the end bearing surface is an arcuate bearing surface.

In some embodiments, the wear member further comprises a rear portion positioned adjacent the open end and side bearing surfaces extending from the rear portion to the front portion, wherein the upper wall and the lower wall are spaced apart by the side bearing surfaces.

In some forms, the side bearing surfaces extend continuously from the rear portion to the front portion.

In some forms, both the upper wall and the lower wall include the two inclined bearing surfaces.

Also disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end the internal surface comprising: an upper wall and a lower wall each extending in the direction of the longitudinal axis from the open end to the front end; and a rear portion positioned adjacent the open end; a rear portion of the cavity including opposing bearing surfaces for bearing against the support structure, the bearing surfaces extending substantially in the direction of the longitudinal axis; and side bearing surfaces extending from the rear portion to the front portion, wherein the upper wall and the lower wall are spaced apart by the side bearing surfaces.

In some forms, the opposing bearing surfaces include at least one bearing surface positioned in the upper wall that opposes at least one bearing surface positioned in the lower wall. The upper wall may include one or more bearing surfaces that oppose one or more bearing surfaces of the lower wall. In some forms, the internal surface of the cavity comprises three sets of opposing bearing surfaces.

In some embodiments, disclosed are inclined surfaces extending away from a central rear surface and the inclined surfaces contacting on four sides of the central rear surface. Two of the inclined surfaces form part of the rear portion and two of the inclined surfaces form part of the intermediation portion. At least one of the inclined and/or the central rear surface are bearing surfaces. At least one of the inclined and/or the central rear surface are non-bearing surfaces. In some forms, the upper wall includes the central bearing surface and the two rear inclined bearing surfaces, and the lower wall includes the central bearing surface and the rear inclined bearing surfaces extending from the central bearing surface. In some forms, the central rear surface is a non-bearing bearing and the inclined surfaces are bearing surfaces extending from the central surface, and inclined surfaces are bearing surfaces.

In some embodiments, the rear bearing surfaces are flat surfaces having sides. Each rear bearing surface includes the rear inclined surfaces and the intermediate inclined surfaces extending from four of the opposed bearing surface sides. One rear bearing surface may be in the upper wall and one rear bearing surface may be in the lower wall.

In some forms, the rear inclined surfaces and the intermediate inclined surfaces are non-bearing surfaces. Non-bearing surfaces are corresponding surfaces of the support structure and wear member wherein no contact is made between the surfaces. The non-bearing surfaces space apart the corresponding surfaces of the support structure and wear member.

In some forms, the rear inclined surfaces are bearing surfaces. In some forms, all the surfaces of the rear portion are bearing surfaces, which further disperses the load transfer and support and thus provided increased stability and prolong the life of the wear part.

In some forms, the rear bearing surface extending in between the rear inclined surfaces generally has a pentagonal shape. The pentagonal shape can be a five-sided shape wherein all sides of the shape are either equal length, or not-equal length and the internal angles of the shape are either equal, or not equal.

In some forms, the rear inclined surfaces that may also be bearing surfaces are a trapezoidal shape.

It is understood that any one of the bearing surfaces may be any suitable shape.

Also disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end, the internal surface of the cavity further comprising: an upper wall and a lower wall each extending in the direction of the longitudinal axis from the open end to the front end; and a front portion positioned adjacent the front end and a rear portion positioned adjacent the open end; at least one of the upper wall and the lower wall of the front portion including bearing surfaces for bearing against corresponding surfaces of the support structure, the front portion including: two front bearing surfaces being inclined relative to one another, the bearing surfaces extending in substantially the same direction as the longitudinal axis of the wear member, wherein the inclined bearing surfaces are arranged so as to support load transfer from the corresponding surfaces of the support structure in more than one direction relative to the direction of the longitudinal axis; and the rear portion including: a rear bearing surface extending in a different plane and spaced from the inclined front bearing surfaces, the bearing surface extending substantially in the direction of the longitudinal axis; side surfaces extend between the front portion and rear portion, the side surfaces being bearing surfaces.

In some forms, the two front bearing surfaces extend away from one another. In some forms, the two front bearing surfaces meet at an arcuate transition region.

In some forms, the rear bearing surface is spaced from the front bearing surfaces in the lateral and/or the longitudinal directions.

In some forms, the rear bearing surface being positioned longitudinally along the same line as the arcuate transition region so as to be centred relative to longitudinal axis. The rear bearing surface may also be centred in the lateral direction which extends in the direction from one side surface to an opposing side surface of the wear member.

In some forms, the rear portion further comprises rear inclined bearing surfaces extending away from the rear bearing surfaces. In some forms, the rear inclined bearing surfaces are inclined relative to one another and extend in different planes than the front bearing surfaces. In some forms, the rear inclined bearing surfaces extend at a different angle to the front bearing surfaces.

In some forms, the cavity is symmetrical about the longitudinal axis. The symmetrical cavity may centre the wear member under vertical loads. This allows the wear member to be installed onto the support structure in an inverse orientation, i.e. rotated 180 degrees about the longitudinal axis X-X. It is an advantage to invert the wear member during servicing of the member. In this way, the wear member can be arranged on the support structure to allow for access to the all exterior surfaces of the wear member. Providing this access for servicing can maximise the service life of the wear member.

In some forms, the wear member comprises an intermediate portion extending between the front and rear portions, at least one of the upper wall and the lower wall of the intermediate portion including: at least one non-bearing surface for spacing apart the upper wall and/or the lower wall of the cavity from the support structure; and side surfaces for bearing against corresponding side walls of the support structure.

In some forms, the at least one non-bearing surface includes two non-bearing surfaces being inclined relative to one another and meeting at an arcuate transition region.

In some forms, both the top wall and the bottom wall include the bearing surfaces.

In some forms, the wear member comprises an end bearing surface generally laterally extending across the front end. In some forms, the end bearing surface extends generally perpendicular to the longitudinal axis in the lateral direction. In some forms, the end bearing surface is an arcuate surface.

In some forms, the side surfaces are bearing surfaces that extend from the rear portion to the front portion. In some forms, the side bearing surfaces extend continuously from the rear portion to the front portion. In some forms, the intermediate portion includes the side bearing surfaces. In some forms, the side bearing surfaces are interrupted. In some embodiments, the side bearing surfaces extend between the upper wall and the lower wall. In some embodiments, the side bearing surfaces are flat surfaces. In some embodiments, the side bearing surfaces extend in a vertical direction.

Also disclosed is a wear assembly for use on excavation equipment, the assembly comprising a support structure for receiving a wear member on the excavation equipment, and the wear member having a digging end for ground penetration, the wear member including a cavity defined by an internal surface opening in a rear of the wear member, the cavity being configured for receiving a correspondingly shaped support structure of the excavation equipment and extending along a longitudinal axis from an open end to a front end, the internal surface of the cavity further comprising: an upper wall and a lower wall and a front portion positioned adjacent the front end and a rear portion positioned adjacent the open end; and the front portion including more bearing surfaces than the rear portion and the front portion including a fewer total number of surfaces than the rear portion; and the bearing surfaces of the front and rear portion including opposing side surfaces extending between the front portion and the rear portion; and a locking hole extending through at least one of the side surfaces to the exterior surface for receiving a lock within the locking hole.

The total number of surfaces refers to the bearing and non-bearing surfaces. Other surfaces, including chamfers and radii applied to edges between meeting bearing and/or non-bearing surfaces are not considered surfaces for the purposes of this disclosure.

In some forms, the lock comprises: a lock body extending along a lock body axis and having a first end region for engaging with the support structure to allow securing of the wear member with the excavation equipment; and at least one latch disposed on the lock body in-use to restrain movement of the lock in the locking hole.

Also disclosed is a wear assembly for use on excavation equipment, the assembly comprising a support structure for receiving a wear member on the excavation equipment, and the wear member having a digging end for ground penetration, the wear member including a cavity defined by an internal surface opening in a rear of the wear member, the cavity being configured for receiving a correspondingly shaped support structure of the excavation equipment and extending along a longitudinal axis from an open end to a front end, the internal surface further comprising: an upper wall and a lower wall and a front portion positioned adjacent the front end and a rear portion positioned adjacent the open end; and the front portion including less bearing surfaces than the rear portion and the front portion including a fewer total number of surfaces than the rear portion; and the bearing surfaces of the front and rear portion including opposing side surfaces extending between the front portion and the rear portion; and a locking hole extending through at least one of the side surfaces to the exterior surface for receiving a lock within the locking hole.

Also disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end, the internal surface further comprising: an upper wall and a lower wall each extending in the direction of the longitudinal axis from the open end to the front end; and a front portion positioned adjacent the front end and a rear portion positioned adjacent the open end, the front portion including surfaces having a hexagonal shape in cross-section; and the rear portion including surfaces having an octagonal shape in cross-section.

The hexagonal and octagonal shapes are six- and eight-sided shapes, respectively. The shapes are may have different lengths of sides, and the internal angles of the shapes may be different. In this way, the hexagon and octagon may be irregular in nature. In alternative embodiments, the shapes may have equal length sides and internal angles.

In some forms, the surfaces of the front portion include bearing surfaces and an end bearing surface generally laterally extending across the front end. In some forms, the surfaces of the rear portion include bearing surfaces.

In some forms, the end bearing surface has a hexagonal shape. In some forms, the end bearing surface is an arcuate bearing surface.

In some forms, the surfaces of the upper and lower wall of the rear portion include opposing bearing surfaces extending in a different plane from the front bearing surfaces of the upper and lower wall.

In some forms, the front and rear portions are spaced apart by an intermediate portion, the intermediate portion being a hexagonal shape in cross-section.

Also disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end, the internal surface further comprising: an upper wall and a lower wall each extending in the direction of the longitudinal axis from the open end to the front end; and a front portion positioned adjacent the front end and a rear portion positioned adjacent the open end, the front portion including surfaces having a hexagonal shape in cross-section; and the rear portion including surfaces having an octagonal shape in cross-section, wherein all the front portion surfaces and all the rear portion surfaces are bearing surfaces.

Also disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end, the internal surface further comprising: an upper wall and a lower wall each extending in the direction of the longitudinal axis from the open end to the front end; and a front portion positioned adjacent the front end and a rear portion positioned adjacent the open end, the rear portion having more surfaces than the front portion, wherein all the front portion surfaces and all the rear portion surfaces are bearing surfaces.

Also disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end, the internal surface further comprising: an upper wall and a lower wall each extending in the direction of the longitudinal axis from the open end to the front end; a front portion positioned adjacent the front end and a rear portion positioned adjacent the open end; the front portion and the rear portion including bearing surfaces for bearing against corresponding surfaces of the support structure; and the front portion including more bearing surfaces than the rear portion and the front portion including fewer total number of surfaces than the rear portion.

In some forms, the upper and/or lower wall further comprise non-bearing surfaces which do not contact surfaces of the support structure, the upper and/or lower wall of the internal surface of the cavity having more bearing surfaces than non-bearing surfaces.

In some forms, the front and rear portions further comprise side bearing surfaces extending from the rear portion to the front portion. In some forms, the side bearing surfaces extend continuously from the rear portion to the front portion. In some forms, the side bearing surfaces are interrupted between the rear portion and the front portion.

In some forms, the wear member further comprises an intermediate portion extending between the front portion and the rear portion, wherein the intermediate portion includes more non-bearing surfaces than bearing surfaces.

Also disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end, the internal surface of the cavity further comprising: an upper wall and a lower wall each extending in the direction of the longitudinal axis from the open end to the front end; and a front portion positioned adjacent the front end and a rear portion positioned adjacent the open end; at least one of the upper wall and the lower wall of the front portion including bearing surfaces for bearing against corresponding surfaces of the support structure, wherein the cavity is symmetrical about the longitudinal axis such that the wear member is mountable to the support structure in more than one orientation. A symmetrical wear member may centre the wear member under vertical load transfer.

In some embodiments, the wear member is mountable to the support structure in one orientation, and in an inverse orientation. In the inverse orientation, the wear member is rotated 180 degrees about the longitudinal axis X-X relative to the support structure. It is an advantage to invert the wear member during servicing of the member. In this way, the wear member may be arranged on the support structure to allow for access to the all exterior surfaces of the wear member. Providing this access for servicing can maximise the service life of the wear member.

In some embodiments, the upper wall and the lower wall are identical and in opposing orientation. In some embodiments, the cavity is symmetrical about a central longitudinal plane (i.e., vertical plane) and about a central lateral plane (i.e., horizontal plane).

Also disclosed is a support structure for excavation equipment, the support structure being configured for receiving a cavity defined by an internal surface of a wear member of the excavation equipment, the wear member comprising a digging end for ground penetration, the support structure extending along a longitudinal axis from a rear end to a front end, the support structure comprising: an upper wall and a lower wall each extending in the direction of the longitudinal axis from the rear end to the front end; and a front portion positioned adjacent the front end; at least one of the upper wall and the lower wall of the front portion including bearing surfaces for bearing against corresponding surfaces of the cavity, the front portion including: two bearing surfaces being inclined relative to one another and extending from one another, the bearing surfaces extending in substantially the same direction as the longitudinal axis of the wear member, wherein the inclined bearing surfaces are arranged so as to support load transfer from the corresponding surfaces of the cavity in more than one direction relative to the direction of the longitudinal axis.

In some forms, the inclined bearing surfaces meet at an arcuate transition region.

In some forms, a rear portion is positioned adjacent the rear end, the rear portion comprises two bearing surfaces being inclined relative to one another and extending from a central bearing surface, the bearing surfaces extending in substantially the same direction as the longitudinal axis of the wear member, wherein the inclined bearing surfaces are arranged so as to support load transfer from the corresponding surfaces of the cavity in more than one direction relative to the direction of the longitudinal axis.

Also disclosed is a support structure for excavation equipment, the support structure being configured for receiving a cavity defined by an internal surface of a wear member of the excavation equipment, the wear member comprising a digging end for ground penetration, the support structure extending along a longitudinal axis from a rear end to a front end, the support structure comprising: an upper wall and a lower wall each extending in the direction of the longitudinal axis from the rear end to the front end; and a front portion positioned adjacent the front end; at least one of the upper wall and the lower wall of the front portion including bearing surfaces for bearing against corresponding surfaces of the cavity, the rear portion comprises two bearing surfaces being inclined relative to one another and extending from a central bearing surface, the bearing surfaces extending in substantially the same direction as the longitudinal axis of the wear member, wherein the inclined bearing surfaces are arranged so as to support load transfer from the corresponding surfaces of the cavity in more than one direction relative to the direction of the longitudinal axis.

Also disclosed is a support structure for excavation equipment, the support structure being configured for receiving a cavity defined by an internal surface of a wear member of the excavation equipment, the wear member comprising a digging end for ground penetration, the support structure extending along a longitudinal axis from a rear end to a front end, the support structure comprising: an upper wall and a lower wall each extending in the direction of the longitudinal axis from the rear end to the front end; and a rear portion positioned adjacent the rear end; at least one of the upper wall and the lower wall of the front portion including bearing surfaces for bearing against corresponding surfaces of the cavity, a rear portion of the support structure including opposing bearing surfaces for bearing against the corresponding surfaces of the cavity, the bearing surfaces extending substantially in the direction of the longitudinal axis; and side bearing surfaces extending from the rear portion to the front portion, wherein the upper wall and the lower wall are spaced apart by the side bearing surfaces.

In some embodiments, the side bearing surfaces extend between the upper wall and the lower wall. In some embodiments, the side bearing surfaces are flat surfaces.

Also disclosed is a support structure for excavation equipment, the support structure being configured for receiving a cavity defined by an internal surface of a wear member of the excavation equipment, the wear member comprising a digging end for ground penetration, the support structure extending along a longitudinal axis from a rear end to a front end, the support structure comprising: an upper wall and a lower wall each extending in the direction of the longitudinal axis from the rear end to the front end; and a front portion positioned adjacent the front end and a rear portion positioned adjacent the rear end; at least one of the upper wall and the lower wall of the front portion including bearing surfaces for bearing against corresponding surfaces of the cavity; the front portion including: two front bearing surfaces being inclined relative to one another and meeting at an arcuate transition region, the bearing surfaces extending in substantially the same direction as the longitudinal axis of the wear member, wherein the inclined bearing surfaces are arranged so as to support load transfer from the corresponding surfaces of the support structure in more than one direction relative to the direction of the longitudinal axis; and the rear portion including: a rear bearing surface extending in a different plane and spaced from the inclined front bearing surfaces, the bearing surface extending substantially in the direction of the longitudinal axis.

In some embodiments, the support structure further comprises side surfaces extending between the front portion and rear portion, the side surfaces being bearing surfaces.

Also disclosed is a wear assembly for use on excavation equipment, the assembly comprising a support structure being configured for receiving a cavity defined by an internal surface of a wear member of the excavation equipment, and the wear member having a digging end for ground penetration, the support structure being configured for mating with the cavity of the wear member, the support structure extending along a longitudinal axis between a rear end and a front end, and the support structure including an upper wall and a lower wall and a front portion positioned adjacent the front end and a rear portion positioned adjacent the rear end; and the front portion including more bearing surfaces than the rear portion and the front portion including fewer total number of surfaces than the rear portion; and the bearing surfaces of the front and rear portion including opposing side surfaces extending between the front portion and the rear portion; at least one recess extending in a lateral direction into the support structure, the at least one recess being defined in at least one of the side surfaces for receiving a lock being arranged to be movable into the at least one recess.

In some embodiments, the at least one recess in the form of two recesses extending from each side surface into the support structure in the lateral direction. In some embodiments, the at least one recess in the form of two recesses which form a passage, and the passage extending through the support structure between the side surfaces.

Also disclosed is a support structure for excavation equipment, the support structure being configured for receiving a cavity defined by an internal surface of a wear member of the excavation equipment, the wear member comprising a digging end for ground penetration, the support structure extending along a longitudinal axis from a rear end to a front end, the support structure comprising: an upper wall and a lower wall each extending in the direction of the longitudinal axis from the rear end to the front end; and a front portion positioned adjacent the front end and a rear portion positioned adjacent the rear end; the front portion including surfaces having a hexagonal shape in cross-section, and the rear portion including surfaces having an octagonal shape in cross-section.

In some embodiments, the surfaces of the front portion include bearing surfaces and an end bearing surface generally laterally extending across the front end. In some forms, the end bearing surface is an arcuate surface.

In some embodiments, the surfaces of the rear portion include opposing bearing surfaces extending in a different plane from the front bearing surfaces.

In some embodiments, the front and rear portions are spaced apart by an intermediate portion, the intermediate portion being a hexagonal shape in cross-sectional.

Also disclosed is a support structure for excavation equipment, the support structure being configured for receiving a cavity defined by an internal surface of a wear member of the excavation equipment, the wear member comprising a digging end for ground penetration, the support structure extending along a longitudinal axis from a rear end to a front end, the support structure comprising: an upper wall and a lower wall each extending in the direction of the longitudinal axis from the rear end to the front end; and a front portion positioned adjacent the front end and a rear portion positioned adjacent the rear end; the support structure including bearing surfaces for bearing against corresponding surfaces of the support structure, and the front portion including more bearing surfaces than the rear portion and the front portion including fewer total number of surfaces than the rear portion.

Also disclosed is a support structure for excavation equipment, the support structure being configured for receiving a cavity defined by an internal surface of a wear member of the excavation equipment, the wear member comprising a digging end for ground penetration, the support structure extending along a longitudinal axis from a rear end to a front end, the support structure comprising: an upper wall and a lower wall each extending in the direction of the longitudinal axis from the rear end to the front end; and a front portion positioned adjacent the front end and a rear portion positioned adjacent the rear end; the support structure is symmetrical about the longitudinal axis such that the wear member is mountable to the support structure in more than one orientation. A symmetrical wear member may centre the wear member under vertical load transfer.

In some embodiments, the wear member is mountable to the support structure in one orientation, and in an inverse orientation. In the inverse orientation, the wear member is rotated 180 degrees about the longitudinal axis X-X relative to the support structure. It is an advantage to invert the wear member during servicing of the member. In this way, the wear member may be arranged on the support structure to allow for access to the all exterior surfaces of the wear member. Providing this access for servicing can maximise the service life of the wear member.

In some embodiments, the upper wall and the lower wall are identical and in an opposing orientation. In some embodiments, the support structure is symmetrical about a central longitudinal plane (i.e., vertical plane). In some embodiments, the support structure is symmetrical about a central lateral plane (i.e., horizontal plane).

The symmetrical support structure may centre the wear member under vertical loads. This allows the wear member to be installed onto the support structure in an inverse orientation, i.e. rotated 180 degrees about the longitudinal axis X-X. It is an advantage to invert the wear member during servicing of the member. In this way, the wear member can be arranged on the support structure to allow for access to the all exterior surfaces of the wear member. Providing this access for servicing can maximise the service life of the wear member.

Also disclosed is a wear assembly for excavation equipment, the wear assembly comprising a wear member and a correspondingly shaped support structure, the wear member including a digging end for ground penetration and a cavity defined by an internal surface that opens into a rear of the wear member extending along a longitudinal axis from an open end to a front end and for receiving the correspondingly shaped support structure of the excavation equipment, the internal surface of the cavity comprising at least one bearing surface formed on the internal surface for bearing against at least one corresponding surface of the support structure; the support structure comprising the at least one corresponding bearing surface formed on an external surface; wherein, when the wear member is installed on the support structure prior to ground penetration, the at least one bearing surface of the internal surface of the cavity and the at least one corresponding bearing surface of the support structure are angularly offset from one another, and when load conditions are placed on the wear assembly from ground penetration, the at least one bearing surface of the internal surface of the cavity is biased to increase surface area bearing contact with the at least one corresponding bearing surface of the support structure.

The term corresponding as used herein can include opposing surfaces which are offset from one another under certain conditions.

The at least one bearing surface being biased to increase surface area bearing contact with the at least one corresponding bearing surface of the support structure may reduce point loading, reduce high stress for less breakage, and provide increased bearing surface area contact to reduce premature wear on the components.

In some forms, the support structure is formed of a softer material than the wear member. By increasing surface area bearing contact, the support structure according to the present disclosure has a lower wear rate than some prior art support structures, and as a result, a longer wear life. This reduces maintenances costs and increases productivity by reducing downtime.

Also disclosed is a wear member for excavation equipment, the wear member comprising a digging end for ground penetration and a cavity defined by an internal surface that opens to a rear of the wear member; the cavity being configured for receiving a correspondingly shaped support structure of the excavation equipment and extending along a longitudinal axis from an open end to a front end, the internal surface of the cavity further comprising at least one bearing surface formed on the internal surface for bearing against at least one corresponding bearing surface of the support structure, wherein, when the wear member is installed on the support structure prior to ground penetration, the at least one bearing surface of the internal surface of the cavity is configured to be angularly offset from the corresponding at least one bearing surface of the support structure, and when load conditions are placed on the wear assembly from ground penetration, the at least one bearing surface of the internal surface of the cavity is arranged to be biased into bearing contact with the at least one bearing surface of the support structure.

Also disclosed is a wear assembly for excavation equipment, the wear assembly comprising a wear member and a correspondingly shaped support structure, the wear member including a digging end for ground penetration and a cavity defined by an internal surface that opens into a rear of the wear member extending along a longitudinal axis from an open end to a front end and for receiving the correspondingly shaped support structure of the excavation equipment, the internal surface of the cavity comprising at least one bearing surface formed on the internal surface for bearing against at least one corresponding surface of the support structure; the support structure comprising the at least one corresponding bearing surface formed on an external surface; wherein, when the wear member is installed on the support structure prior to ground penetration, the at least one bearing surface of the cavity and the at least one corresponding bearing surface of the support structure are juxtaposed and have a variable clearance from one another across those surfaces, and when load conditions are placed on the wear assembly from ground penetration, the at least one bearing surface of the internal surface of the cavity is biased to move relative to support structure to increase surface area bearing contact with the at least one corresponding bearing surface of the support structure.

Also disclosed is a wear member for excavation equipment, the wear member comprising a digging end for ground penetration and a cavity defined by an internal surface that opens into a rear of the wear member extending along a longitudinal axis from an open end to a front end and for receiving a support structure of the excavation equipment, the internal surface of the cavity comprising at least one bearing surface formed on the internal surface for bearing against at least one corresponding bearing surface of the support structure, wherein, when the wear member is installed on the support structure prior to ground penetration, the at least one bearing surface of the internal surface of the cavity and the at least one corresponding bearing surface of the support structure are spaced apart such that the surfaces have a variable clearance from one another, and when load conditions are placed on the wear assembly from ground penetration, the at least one bearing surface of the internal surface of the cavity is biased to move relative to support structure to increase surface area bearing contact with the at least one corresponding bearing surface of the support structure.

Also disclosed is a wear member for excavation equipment, the wear member comprising a digging end for ground penetration and a cavity defined by an internal surface that opens into a rear of the wear member extending along a longitudinal axis from an open end to a front end and for receiving a correspondingly shaped support structure of the excavation equipment, the internal surface of the cavity comprising: an upper wall and a lower wall each extending in the direction of the longitudinal axis from the open end to the front end; and a rear portion positioned adjacent the open end; a rear portion of the internal surface of the cavity including opposing bearing surfaces for bearing against the support structure, the bearing surfaces extending substantially in the direction of the longitudinal axis; and side bearing surfaces extending from the rear portion to the front portion, wherein the upper wall and the lower wall are spaced apart by the side bearing surfaces.

Also disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end, the internal surface of the cavity further comprising an upper wall and a lower wall each extending in the direction of the longitudinal axis from the open end to the front end; and a front portion positioned adjacent the front end and a rear portion positioned adjacent the open end, the front portion including surfaces having a hexagonal shape in cross-section; and the rear portion including surfaces having an octagonal shape in cross-section.

In some forms, positioned in the top and/or the bottom wall, the rear portion includes at least two bearing surfaces being inclined relative to one another, the bearing surfaces extending in substantially the same direction as the longitudinal axis of the wear member.

In some forms, positioned in the top and/or the bottom wall, the front portion includes two bearing surfaces being inclined relative to one another and extending from one another, the bearing surfaces extending in substantially the same direction as the longitudinal axis of the wear member.

In some forms, the rear portion further includes a central surface positioned between the inclined bearing surfaces, and the inclined bearing surfaces extend from the central surface.

In some forms, the central surface is a bearing surface.

In some forms, the internal surface of the cavity further comprising side surfaces extending between the upper wall and the lower wall, and extending between the front portion and the rear portion in the longitudinal direction, and the side surfaces being bearing surfaces.

Also disclosed is a wear member for excavation equipment, the wear member comprising a digging end for ground penetration and a cavity defined by an internal surface that opens into a rear of the wear member, the cavity being configured for receiving a correspondingly shaped support structure of the excavation equipment and extending along a longitudinal axis from an open end to a front end, the internal surface of the cavity further comprising an upper wall and a lower wall each extending in the direction of the longitudinal axis from the open end to the front end; and a front portion positioned adjacent the front end and a rear portion positioned adjacent the open end, the front portion including: two bearing surfaces being inclined relative to one another and extending from one another, the bearing surfaces extending in substantially the same direction as the longitudinal axis of the wear member; and the rear portion including: two bearing surfaces inclined relative to one another.

Also disclosed is a method of assembling a wear member onto a support structure of earth working equipment, the method comprising:

providing the wear member as part of a wear member assembly incorporating the wear member and a lock secured to the wear member, the lock being disposed in a locking hole formed in the wear member in a transport position where a first end region of the lock projects into a cavity of the wear member shaped to receive the support structure and;

mounting the wear member onto the support structure so that the support structure is received into the cavity; and causing the support structure to engage the lock during the mounting, and wherein under continued movement of the wear member onto the support structure, the lock is caused to retract into the locking hole so that the wear member can be fully mounted onto the support structure.

It is understood that any of the features according to any of the aspects may be equally applied to the other aspects. This includes any features disclosed in relation to a wear member aspect are equally disclosed in relation to another wear member aspect. This also includes any features disclosed in relation to the wear member cavity may be equally applied to the support structure. As discussed above, the cavity and the support structure have a corresponding shape.

It is also understood that various combinations of bearing surfaces and non-bearing surfaces are disclosed herein. For example, in the upper wall and/or the lower wall, the rear portion may include a central bearing surface and inclined non-bearing surfaces extending from the central bearing surfaces, a central bearing surface and inclined bearing surfaces extending from the central bearing surfaces, a central non-bearing surface and inclined bearing surfaces extending from the central non-bearing surfaces. The side surfaces may also be bearing or non-bearing surfaces.

Also disclosed are various locks design that are able to be used in conjunction with the wear member and support structure in any form described above to secure the members together during operation. In some forms, the lock is able to be installed in the wear member for transport and to aid easy of installation.

Also disclosed is a lock for securing a wear member to a support structure, the wear member having a body that incorporates a cavity configured to receive the support structure, and a locking hole extending to the cavity. The lock is arranged to be movable within the locking hole and includes a lock body extending along a lock body axis and having a first end region for engaging with the support structure to allow securing of the wear member with the support structure. At least one latch is disposed on the lock body and has a detent movable transverse to the lock body axis and being arranged in use to restrain movement of the lock in the locking hole.

In some forms, the locking hole may extend from the exterior of the wear member body to the cavity.

In some forms, the detent is movable to a position where it projects from the lock body. In some forms, the at least one latch further comprises a resilient member operative to allow transverse movement of the detent on deforming of the resilient member.

In some forms, the lock body includes a bore extending transverse to the lock body axis, and wherein the at least one latch is disposed in the bore. In some forms, the latch is movable within the bore to allow movement of the detent.

In some forms, the bore is a blind hole and the latch is located within the blind hole such that the detent is disposed at the opening of the bore. In some forms, the detent is arranged to project from the bore when the resilient member is in an undeformed state and is able to retract inwardly when the resilient member is compressed.

In some forms, the pin to adapter hole angular offset ensures best life of adapter for the pin when it swings into contact during service loads. This provides line contact as opposed to point contact on the outside edge.

In some forms, the bore has first and second openings angularly spaced around the lock body axis. In some forms, the at least one latch includes two detents which are arranged to project from respective ones of the first and second openings.

In some forms, the resilient member is disposed between the detents and deforming of the resilient member varies the spacing between the detents. In some forms, the length of the latch between the detents is greater than the length of the bore when the resilient member is in its neutral, undeformed state.

In some forms, the latch is movable through the bore between the first and second openings.

In some forms, the lock body comprises a body region incorporating a component of an engaging structure on an exterior surface thereof which is arranged to engage with a complementary component of the engaging structure disposed on an interior wall defining at least part of the locking hole, the engaging structure being at least part of a retaining arrangement operative to resist movement of the lock in the wear member under loading in the direction of the lock body axis.

In some forms the engaging structure is helical, or part helical. In this way the lock may be axially advanced or retracted in the locking hole, whilst the components of the engaging structure is engaged, by rotation of the lock body. In some forms, the body region terminates at a second end region of the lock body, and the second end region includes a drive arrangement to receive a tool to impart rotation to the lock body.

In some forms, the engaging structure is operative to resist movement of the lock in the wear member under loading in the direction of the lock axis.

In some forms, the retaining arrangement is operative to resist axial movement of the lock body by the combined operation of the latch and the engaging structure, the latch being operative to provide torsional resistance to the lock body in the locking hole and the engaging structure operative to inhibit axial movement of the lock body when the lock body is restrained from rotating in the locking hole.

In some forms, the engaging structure is helical or part helical and has a pitch that is quite steep to promote rotation and axial movement of the lock body under loading on the lock body in the direction of the lock body axis.

In some forms, where the engaging structure is operative to resist movement of the lock in the wear member under loading in the direction of the lock axis, the pitch is quite flat.

In some forms, the body region is generally cylindrical and the engaging structure is recessed into the body. In some forms, the latch is disposed on the body region. In some forms, the first end region tapers towards the first end of the lock body.

In some forms, the latch and the engaging structure are configured and positioned relative to each other such that the latch does not cross the complementary component of the engaging structure on the inner wall of the wear member on operation of the lock.

Also disclosed is a lock for securing a wear member to a support structure, the wear member having a body that incorporates a cavity configured to receive the support structure, and a locking hole extending to the cavity, the lock being arranged to be movable within the locking hole and comprising: a lock body extending along a lock body axis and having a first end region for engaging with the support structure to allow securing of the wear member with the support structure; and a retaining arrangement operative to resist movement of the lock in the wear member under loading in the direction of the lock body axis, the retaining arrangement comprising: an a component of an engaging structure on an exterior surface of the lock body which is arranged to engage with a complementary component of the engaging structure disposed on an interior wall defining at least part of the locking hole, and one or more retainers operative to provide torsional resistance of the lock body in the locking hole, wherein the engaging structure is operative to inhibit axial movement of the lock body when the lock body is restrained from rotating in the locking hole.

The locking hole may extend from the exterior of the wear member body to the cavity.

In some forms, the at least one retainer is in the form of the latch as described above. In other forms, the at least one retainer is a separate component that may be installed in the locking hole and may be in the form of a compressible member, collar, clip, sleeve or the like, or combination thereof, that provides rotational resistance to the lock body.

In some forms, the separate retainer is in the form of a compressible member that is arranged to apply a bias to the lock body in a direction that is transverse to the lock axis.

In some forms, the separate retainer is in the form of a compressible member that is arranged to at least partially surround the lock body and applies a radial force that is exerted over at least a substantial portion of the circumference of the lock body.

In some forms, a plurality of retainers are provided, for example a latch as described above and a separate retainer.

In some forms, the plurality of retainers are arranged to be angularly spaced apart about the lock body axis when the lock is in a locked position. In some forms, a first retainer is arranged to be disposed at an angle of between 75 and 115 degrees to a second retainer and preferably substantially at right angles.

Also disclosed is a lock for securing a wear member to a support structure, the wear member having a body that incorporates a cavity configured to receive the support structure, and a locking hole extending in the body to the cavity, the lock being arranged to be movable within the locking hole and comprising: a lock body extending along a lock body axis and having a first end region for engaging with the support structure to allow securing of the wear member with the support structure; and a retaining arrangement operative to resist movement of the lock in the wear member, the retaining arrangement comprising a plurality of retainers angularly spaced apart about the lock body axis when the lock is in a locked position.

In some forms, a separate retainer is provided and includes a resilient member that is arranged to compress under load. In some forms, the separate retainer is arranged to bear against the lock body to resist pivoting of the lock body in the locking hole which may otherwise occur under operational load. In some forms, the separate retainer provides some shock absorbing capability to the lock body when installed. This shock absorbing capability may be in addition to, or instead of, the torsional resistance required as part of the retaining arrangement.

Also disclosed is a lock for securing a wear member to a support structure, the wear member having a body that incorporates a cavity configured to receive the support structure, and a locking hole extending in the body to the cavity, the lock being arranged to be movable within the locking hole and comprising: a lock body extending along a lock body axis and having a first end region for engaging with the support structure to allow securing of the wear member with the support structure; and a retaining arrangement operative to resist lateral movement of the lock body within the locking hole.

In some forms, the retainer is formed at least in part as a resilient member that provides a damping force to the lock body to resist lateral movement.

In some forms, the lateral movement is translation of the lock body within the locking hole and/or pivoting of the lock body in the locking hole.

Also disclosed is a lock for securing a wear member to a support structure, the wear member having a body that incorporates a cavity configured to receive the support structure, and a locking hole extending to the cavity, the lock being arranged to be insertable within the locking hole and comprising: a lock body extending along a lock axis and having a first end region for engaging with the support structure to allow securing of the wear member with the support structure; and a retainer arranged to engage with and apply a torsional resistance to the lock body.

In some forms, the locking hole extends from an exterior of the wear member to the cavity.

In some forms, the retainer comprises a body that is resiliently flexed when the lock body is engaged therein, so as to apply the torsional resistance to the lock body in use.

In some forms, the retainer body comprises at least one detent that is adapted on an exterior surface thereof, the detent being arranged in use to restrain a rotational movement of the retainer about the lock axis within the locking hole. In some forms, the at least one detent has a gradual curved transition on its outer profile.

In some forms, the retainer body at least partially encircles the lock body. In some forms, the retainer body is C-shaped having opposing arms that are able to flex relative to each other.

In some forms, the retainer body is annular. In some forms, the retainer body is comprised of a plurality of segments that are angularly spaced about the lock body.

In some forms, the retainer is manufactured so that the body of the retainer is formed having the required shape to provide the torsional resistance through engagement with the lock body. In other forms, the body of the retainer undergoes a post formation shaping process to adopt the required shape to provide the torsional resistance through engagement with the lock body.

In some forms, the wear member as disclosed in any form above, may be further modified to include lock designs as disclosed herein.

Also disclosed is a wear member for attaching to a support structure of earth working equipment, the wear member comprising a body comprising a first end, an opposite second end that incorporates a cavity configured to receive the support structure, and a locking hole extending in the body to the cavity, the locking hole being arranged to receive a lock to secure the wear member to the support structure and being defined by an interior wall surface that incorporates at least one component of an engaging structure arranged to engage with a complementary component of the engaging structure disposed on an exterior surface of the lock.

The locking hole may extend from the exterior of the wear member to the cavity.

In some forms, the component of the engaging structure is formed as one or more ribs that projects into the locking hole. In some forms the engaging structure is helical, or part helical. The engaging structure may be continuous or may be formed of spaced components that track the helical path.

In some forms, the interior wall surface further comprising at least one notch operative to receive a detent on the lock to inhibit rotation of the lock in the locking hole. In some forms, this notch (or at least one of a plurality of notches if there is more than one corresponding detent on the latch) is located to correspond to a position wherein the lock is in engagement with the support structure to secure the wear member to that support structure. In some forms, the interior wall surface may comprise two or more notches which are spaced apart in the direction of the hole axis and which are arranged to engage with one or more detents of the lock to inhibit the rotation of the lock when the lock is in two or more discrete positions within the wear member.

Alternatively, in some forms, the interior wall surface comprises one or more detents or other latching structures to inter-engage with a complementary latching structure of the lock to locate the lock in one or a plurality of positions in locking hole. These positions may correspond to any of a locking, retracted and transport position.

In some forms, the interior wall surface further comprises a channel that terminates at the exterior surface of the wear member and is arranged to facilitate installation of the lock into the wear member.

In some forms, the interior wall surface further comprises at least one holding formation adjacent the exterior surface of the wear member and is arranged to receive a complementary engaging formation of a holder that is arranged to inhibit release of the lock body from the locking hole.

In some forms, the at least one holding formation is in the form of a re-entrant surface.

In some forms, the interior wall surface forms part of a lock receiving arrangement that includes and the locking hole and further comprises a lock cavity to receive a retainer to provide resistance to the lock body, preferably torsional resistance. In some forms, the lock cavity is in the form of a slot that extends from the locking hole in a direction that is transverse (radial) to an axis of locking hole.

Also disclosed is a wear member for attaching to a support structure of earth working equipment, the wear member comprising a body comprising a first end, an opposite second end that incorporates a cavity configured to receive the support structure, and a lock receiving arrangement defined by an interior wall surface that comprises a locking hole extending along a lock axis in the body to the cavity, and a lock cavity that extends from the locking hole transverse to the lock axis, the locking hole being arranged to receive a lock body to secure the wear member to the support structure.

In some forms, the lock cavity is arranged to receive a retainer for engaging with the lock body.

In some forms, the lock includes a latch that is mountable to the lock body and the lock cavity is arranged to provide an access to facilitate installation of the latch in the lock body when disposed in the locking hole.

In some forms, the slot is multi-purpose and arranged to facilitate installation of the latch in the lock body and to receive a separate retainer for engaging with the lock body.

In some forms, the lock body is rotatable in the locking hole. In some forms, the lock receiving arrangement further comprises at least one component of an engaging structure arranged to engage with a complementary component of the engaging structure disposed on an exterior surface of the lock body.

In some forms, the interior wall surface of the locking hole is formed from the wear member. In one form, the interior wall is cast with the appropriate profile on casting of the wear member. However, if need be, the profile may be finished in a post casting process such as milling or the like.

Alternatively, or in addition, least part of the interior wall surface is formed on an insert locatable in the locking hole. The insert may be cast into the wear member (if that member is cast), or may be mechanically secured through welding or other fixings, or may otherwise be captured in position (for example by being locatable in place from within the cavity and thereby captured in place when mounted onto the support structure).

In some forms, the wear member is formed as a casting and at least a portion of the interior wall defining the locking hole, or a component disposed with that locking hole, is formed from an insert cast into the wear member.

In some forms, the component formed from the cast insert is the component of the at least one engaging structure. In one form, the cast insert may form at least part of a retainer that is arranged to engage with and apply a torsional resistance to a lock body of a lock locatable within the locking hole.

Also disclosed is a cast wear member for attaching to a support structure of earth working equipment, the wear member comprising a body comprising a first end, an opposite second end that incorporates a cavity configured to receive the support structure, and a lock receiving arrangement defined by an interior wall surface that is arranged to receive a lock for securing the wear member to the support structure, wherein at least a portion of the interior wall defining the lock receiving arrangement, or a component disposed with that arrangement, is formed from an insert cast into the wear member.

Also disclosed is a wear member for attaching to a support structure of earth working equipment, the wear member comprising a body comprising a first end, an opposite second end that incorporates a cavity configured to receive the support structure, and a locking hole extending in the body to the cavity, the locking hole being arranged to receive a lock to secure the wear member to the support structure, the locking hole including retaining structure to receive a retainer within the locking hole.

In some forms, the locking hole extends from an exterior of the wear member to the cavity.

In some forms, the retaining structure comprise a ledge that faces the cavity.

In some forms, the retaining structure comprises a ledge that faces towards the exterior of the wear member.

In some forms, the retaining structure comprises at least one abutment formation that is arranged in use to contact the retainer to prevent rotation of the retainer within the locking hole. In some forms, the abutment formation comprises at least one recessed region formed in the locking hole that is arranged to receive a complementary shaped portion of the retainer. In some forms, the recessed region forms a pocket in the locking hole intermediate the exterior of the wear member and the cavity.

In some forms, the abutment formation comprises at least one projection that forms an interruption to the wall of the locking hole.

In some forms, the wall defining the locking hole comprise a first component of at least one engaging structure arranged to engage with a complementary component disposed on the lock.

In some forms, the wear member is formed as a casting and at least a portion of the interior wall defining the locking hole, or a component disposed with that locking hole, is formed from an insert cast into the wear member.

In some forms, the component formed from the cast insert is the component of the at least one engaging structure. In one form, the cast insert may form at least part of a retainer that is arranged to engage with and apply a torsional resistance to a lock body of a lock locatable within the locking hole.

Also disclosed is a cast wear member for attaching to a support structure of earth working equipment, the wear member comprising a body comprising a first end, an opposite second end that incorporates a cavity configured to receive the support structure, and a locking hole extending through the body from an exterior of the wear member to the cavity, the locking hole being arranged to receive a lock to secure the wear member to the support structure, and a retainer defining at least a portion of the locking hole, wherein at least a portion of the retainer is formed from an insert cast into the wear member.

In this latter arrangement, at least a portion of the locking hole is defined by the retainer insert as the insert itself includes at least a portion of the interior wall that defines the locking hole with the wear member being in turn, cast around that insert.

In some forms, the retainer may be multipart with one part or portion incorporated as a cast insert and another part or portion disposed in the resulting locking hole. According to a further aspect, there is disclosed a wear member assembly for attaching to a support structure of earth working equipment comprising: a wear member comprising a body having a first end, an opposite second end that incorporates a cavity configured to receive the support structure, and a locking hole extending in the body to the cavity; and a lock for securing the wear member to a support structure and being arranged to be movable within the locking hole.

In some forms, the lock has a first end region for engaging with the support structure to allow securing of the wear member with the support structure.

The locking hole may extend from the exterior of the wear member to the cavity.

In some forms, a component of an engaging structure is provided on an exterior surface of the lock and a complementary component of the engaging structure is disposed on an interior wall defining at least part of the locking hole, the engaging structure forming at least part of a retaining arrangement operative to resist movement of the lock in the wear member under loading in the direction of the hole axis. In some forms, the engaging structure provides the primary retention arrangement of the locking arrangement to resist any axial loading induced on the lock body which may cause the lock body to be ejected from the locking hole or disengage from the support structure.

In some forms, the engaging structure is helical, or part helical. In this way the lock may be axially advanced or retracted in the locking hole, whilst the engaging structure is engaged, by rotation of the lock body.

In some forms, the retaining arrangement further comprising at least one retainer to restrain movement of the lock in the wear member when the engaging structure is in engagement.

In some forms, the retaining arrangement is operative to resist axial movement of the lock body by the combined operation of the retainer and the engaging structure, the retainer being operative to provide torsional resistance of the lock body in the locking hole and the engaging structure operative to inhibit axial movement of the lock body when the lock body is restrained from rotating in the locking hole.

In some form, the wear member assembly further comprises a latch arrangement to restrain movement of the lock in the wear member when the engaging structure is in engagement. In some forms, the latch arrangement is arranged to inhibit rotation of the lock when the lock is disposed in one or more positions. Further the latch arrangement may provide more general frictional resistance to rotation outside these one or more positions to prevent play in the lock and to allow more controlled movement of the lock in the locking hole.

In some forms, the latch arrangement functions as the retainer of the retaining arrangement. In some forms, the latch and retainer may be separate components.

In some forms, a plurality of retainers are provided. One retainer may be in the form of a latch arrangement. In some forms, a further latch arrangement may be provided.

In some forms, a separate retainer is provided and includes a resilient member that is arranged to compress under load. In some forms, the separate retainer is arranged to bear against the lock body to resist lateral movement (being translation and or pivoting of the lock body in the locking hole) which may otherwise occur under operational load. In some forms, the separate retainer provides some shock absorbing capability to the lock body when installed. This shock absorbing capability may be in addition to, or instead of, the torsional resistance required as part of the retaining arrangement.

In some forms, the plurality of retainers are arranged to be angularly spaced apart about the lock body axis when the lock is in a locked position. In some forms, a first retainer is arranged to be disposed at an angle of between 75 and 115 degrees to a second retainer and preferably substantially at right angles.

In some forms, the wear assembly further comprises a holder to secure the lock to the wear member independently of the engaging structures. In some forms, the holder is frangible and therefore single use. In other forms, the holder may remain intact, in either an active, or inactive state, throughout the movement of the lock in the locking hole.

In some forms, the lock is secured to the wear member in a transport position where the combination of the wear member and lock is arranged to be provided to site. In some forms, when in the transport position, the lock is positioned so as to allow the wear member to be installed on the support member. In other forms, when in the transport position, the first end region extends into the cavity and prevents installation of the wear member onto the support structure. In this later form, the lock needs to be moved from the transport position to allow for installation.

In some forms, the holder is arranged to secure the lock to the wear member in the transport position.

In some forms, the wear member assembly is arranged such that when in the transport position, the first end region extends into the cavity and prevents installation of the wear member onto the support structure. In some forms, the holder permits sufficient movement of the lock in the locking hole to enable movement of the lock from the transport position to a position where the first end region of the lock is sufficiently clear of the cavity to permit installation of the wear member onto the support structure.

In some forms, where the above transport position is provided, the first end region may include an angled, or camming surface that under the application of a force to that surface in a direction normal to the axis of the hole, the lock is biased to retract into the locking hole.

In some forms, the lock and the wear member have respective bearing surfaces that are in opposing relation when the lock is in a locked position, the bearing surfaces being arranged to be angularly offset from one another when the wear assembly is not under loaded conditions. In some forms, when in loaded condition, the lock body is biased to move relative to the wear member to cause the opposing bearing surfaces to move to reduce the angular offset so as to provided increased surface engagement between the bearing surfaces.

Also disclosed are wear member assemblies that include a wear member in any form disclosed above, and locks that may also be in any form disclosed above.

Disclosed a wear member assembly for attaching to a support structure of earth working equipment comprising: a wear member comprising a body having a first end, an opposite second end that incorporates a cavity configured to receive the support structure, and a locking hole extending in the body to the cavity; and a lock for securing the wear member to a support structure and being arranged to be movable within the locking hole to a locked position, the lock and the wear member have respective bearing surfaces that are in opposing relation when the lock is in the locked position, the bearing surfaces being arranged to be angularly offset from one another when the wear assembly is not under loaded conditions and arranged, under in-use loading conditions, to be biased to move to reduce the angular offset so as to provided increased surface engagement between the bearing surfaces under the in-use loading conditions.

Also disclosed is a wear member assembly for attaching to a support structure of earth working equipment comprising: a wear member comprising a body having a first end, an opposite second end that incorporates a cavity configured to receive the support structure, and a locking hole extending in the body to the cavity; a lock for securing a wear member to a support structure and being arranged to be insertable within the locking hole, the lock comprising a lock body having a first end region for engaging with the support structure, and a retainer arranged to engage with, and apply a torsional resistance to, the lock body.

The wear assembly as described in any form above may include any of the forms of lock or wear member as described in the earlier aspects disclosed above.

Methods of assembling a wear member that includes a lock in one or more of the form disclosed herein onto a support structure are also disclosed.

In a further aspect, there is disclosed a method of assembling a wear member onto a support structure of earth working equipment, the method comprising: providing the wear member as part of a wear member assembly incorporating the wear member and a lock secured to the wear member, the lock being disposed in a locking hole formed in the wear member in a transport position where a first end region of the lock projects into a cavity of the wear member shaped to receive the support structure and; mounting the wear member onto the support structure so that the support structure is received into the cavity; and causing the support structure to engage the lock during the mounting, and wherein under continued movement of the wear member onto the support structure, the lock is caused to retract into the locking hole so that the wear member can be fully mounted onto the support structure.

Also disclosed is a method of assembling a lock body to a wear member of earth working equipment, the method comprising: providing a retainer within, or defining, a locking hole of the wear member; and inserting a lock body into the locking hole and through the retainer, the retainer being arranged to resiliently deform to apply a torsional resistance to the lock body.

In some forms, the retainer is inserted within the locking hole prior to insertion of the lock body.

In some forms, the retainer is provided by being cast into the wear member.

Also disclosed is a method of installing a lock into a wear member of earth working equipment comprising: providing the wear member with a lock receiving arrangement comprising a locking hole and a lock cavity projecting from the locking hole; installing a lock body of the lock into the locking hole; subsequently mounting a first retainer into the lock body installed in the locking hole via the cavity; and installing a second retainer into the lock cavity.

The drawings disclose wear members, locks, wear member assemblies and methods of installation according to embodiments of the disclosure for excavation equipment. The excavation equipment includes an excavator bucket. The wear member, support structure, lock, and wear assembly in the embodiments shown with reference to the drawings are configured to be mounted to the excavator bucket.

Referring to FIG. 1, a wear member 10 and a support structure 12 are shown. The wear member 10 comprises an exterior surface (i.e., a digging end) for ground penetration and is configured to assemble to a support structure 12 for mounting the wear member to the excavator bucket. In some forms, the support structure is arranged to be fitted to, or forms an integral part of, the excavation equipment. When the support structure forms an integral part of the excavation equipment the wear member is mounted directly to the excavation equipment.

The wear member 10 is configured to mate to the support structure 12. The wear member 10 includes a cavity 16 defined by an internal surface that opens into a rear of the wear member for receiving the wear member 10. The cavity extends along a longitudinal axis x-x from an open end 18 of the cavity 16 to a front end 20 of the cavity 16. The cavity 16 of the wear member is shaped corresponding to the support structure 12.

Figure 2B:
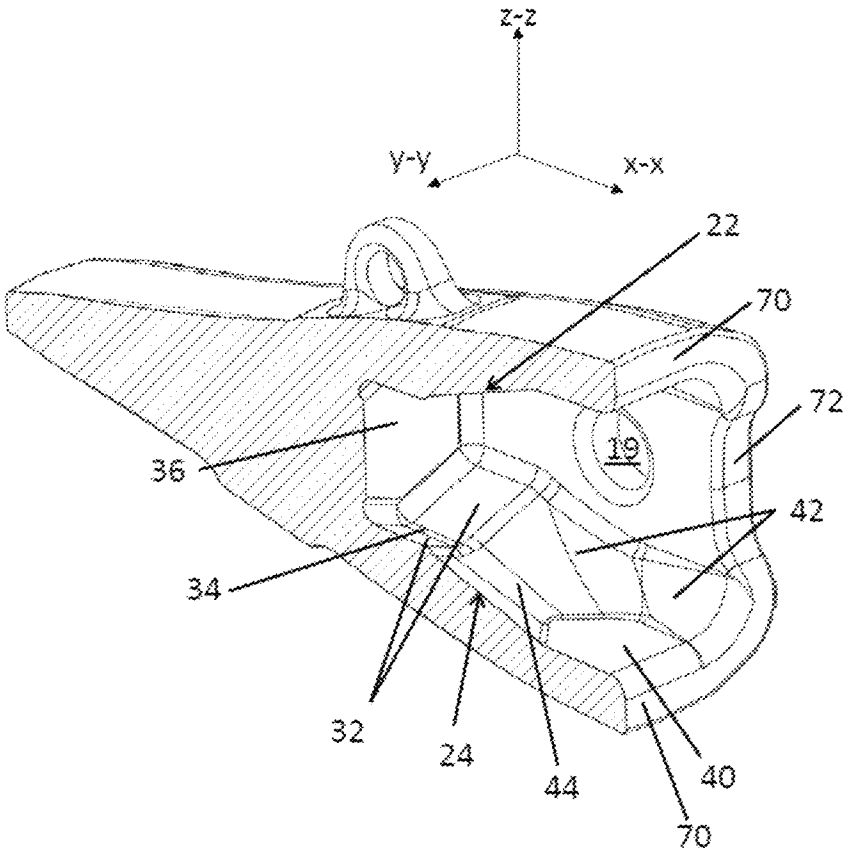
FIGS. 2*a* & 2*b* are cross-sectional perspective views of the wear member of FIG. 1.
Figure 2A:
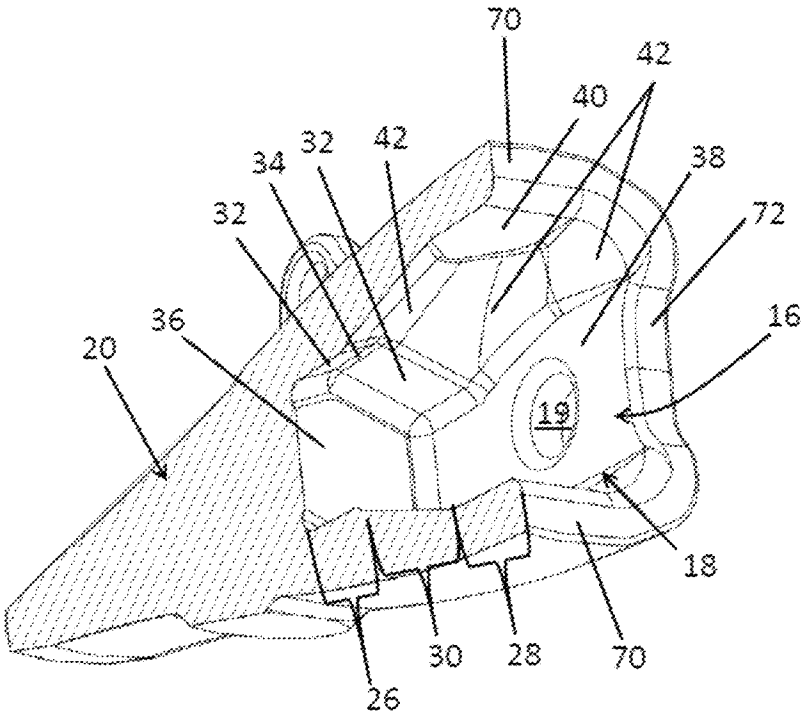

Referring now to FIGS. 2*a* and 2*b*, the internal surface of the cavity 16 comprises an upper wall 22 and a lower wall 24. The upper wall 22 and lower wall 24 are spaced from each other along a vertical axis z-z and extend generally in the direction of the longitudinal axis x-x from the open end 18 to the front end 20. A front portion 26 of the cavity is positioned adjacent the front end 20 and a rear portion 28 of the cavity is positioned adjacent the open end 18. In the illustrated embodiment, an intermediate portion 30 extends between the front portion 26 and rear portion 28.

At least one of the upper wall 22 and the lower wall 24 including bearing surfaces. Likewise, at least one of the front portion 26 and the rear portion 28 include bearing surfaces. The bearing surfaces are for bearing against corresponding surfaces of the support structure 12 to transfer load between the support structure 12 and wear member 10. In the embodiment shown in FIGS. 2 to 3, the bearing surfaces on the support structure 12 and cavity are flat surfaces. The flat surfaces are simpler to manufacture than curved surfaces. The flat surfaces may also be used for gauging.

The front portion 26 of the cavity includes an end bearing surface 36, side surfaces 38 and two bearing surfaces 32 arranged on opposing upper and lower walls of the front end. The end bearing surface 36 extends generally laterally across the front end 20. The side bearing surfaces 38 are spaced from each other in a lateral direction y-y and extend from the rear portion 28 to the front portion 26. The side bearing surfaces 38 space apart the upper wall 22 and the lower wall 24. The two bearing surfaces 32 are inclined relative to one another and meet at an arcuate transition region 34.

The two bearing surfaces 32, (i.e. the inclined front surfaces), extend in substantially the same direction as the longitudinal axis x-x of the wear member 10. The inclined surfaces may be provided at a small angle relative to the longitudinal axis, narrowing towards the end bearing surface 36 to assist with aligning and mating the support structure into the cavity of the wear member. The angle of the inclined surfaces may be approximately 2° to the longitudinal axis. In alternative embodiments, the angle of the inclined surfaces relative to the longitudinal axis may be in the range of 0 to 10°.

Furthermore, the angle between the front bearing surfaces is an obtuse angle measured through the cavity, which may be approximately 140°, but can vary. Alternatively, the angle of the front bearing surfaces can be measured relative to the side bearing surfaces, wherein each front bearing surface 32 is approximately 110° to the side surfaces 38. In alternative embodiments the obtuse angle may be in the range of 100° to 175°. Between the inclined bearing surfaces is the arcuate transition region. The arcuate transition region provides a smooth transition between the bearing surfaces so as to enhance the strength of the wear member, rather than the bearing surfaces meeting at a right angle which may create an area of weakness. Further, the arcuate transition region generally extends in line with the longitudinal axis, and thus each inclined bearing surface is positioned on either side of the central longitudinal axis. In alternative embodiments, the front surfaces may meet along a line forming an edge.

In the form shown in FIGS. 2*a* and 2*b*, the inclined bearing surfaces 32 of the upper wall 22 and the lower wall 24 are arranged to support load transfer from the corresponding surfaces of the support structure 12 in more than one direction relative to the direction of the longitudinal axis. That is, the inclined surfaces can absorb loads that comprise at least two force components, e.g., a vertical force and a horizontal force. This can provide stability to the wear member during e.g. digging operations of the excavation equipment.

Furthermore, the inclined surfaces centralise the support structure 12 in the cavity 16 of the wear member 10. In addition to helping with alignment when mounting the wear member onto the support structure, centralising the wear member improves both the strength and wear characteristics of the assembly. For example, centralising the points of contact, i.e. the bearing surfaces, can help to more evenly distribute loads between the bearing surfaces. This can help prevent uneven wear, wherein wear on some bearing surfaces is greater than other bearing surfaces.

The inclined bearing surfaces 32 include a minimum surface area that disperses the load transfer between the wear member and the support structure so as to prevent failure of the wear assembly. The surface area optimises the load transfer, which overall increases the efficiency and performance of the excavation equipment, and specifically extends the life of the wear member and the support structure, which may be replaceable when worn. In some forms, the inclined surfaces 32 have a surface area of approximately 17 cm2. The surface area of the inclined surfaces may change according to the size of the wear assembly required for a particular application of excavating equipment, and as a result may be larger or smaller than the surface area indicated for the illustrated embodiment. For example, larger wear assemblies may be required for heavy duty applications.

The end bearing surface 36 extends generally laterally across the front end 20 (i.e., generally perpendicular to the direction of the longitudinal axis). The end bearing surface 36 is able to transfer load generally in the longitudinal direction between the support structure and the exterior surface of the wear member. The end bearing surface 36 is generally a hexagonal shape, meaning the end bearing surface 36 includes six sides. The length of the sides may vary and do not need to be equal. Likewise, the internal angles between the sides may vary and do not need to be equal. The length of the sides and angle of the sides relative to one another corresponds to the inclined surfaces of the upper and lower walls and the side surfaces. The surface area of the end bearing surface 36 is approximately 71.5 cm2, which promotes performance of the wear member and load transfer between the wear member and the support structure. It is understood that the surface area of the end bearing surface will vary depending on the size of the wear assembly required for a particular application of excavating equipment, and as a result may be larger or smaller than the surface area indicated for the illustrated embodiment. For example, larger wear assemblies may be required for heavy duty applications. In the illustrated embodiment, the end bearing surface is a flat surface. In alternative embodiments described in relation to FIGS. 21*a* to 21*c*, the end bearing surface is an arcuate surface.

The side bearing surfaces 38 of the front portion 26 extend the length of the cavity to the rear portion 28. In the illustrated embodiment, the side bearing surfaces 38 are continuous (including a locking hole 50 to receive a lock positioned in the intermediate portion 30). The side bearing surfaces converge from the rear portion 28 towards the front portion 26. The converging side bearing surfaces 38 assists in installation and removal of the wear member on the support structure. The taper of the converging side bearing surfaces 38 also assists with manufacturing, allowing the casting to be removed from the mould. The side bearing surfaces 38 extend generally at an angle of 2° relative to the longitudinal axis. In alternative embodiments, the side bearing surfaces 38 may extend at an angle in the range of 0° to 10° relative to the longitudinal axis.

The rear portion 28 of the cavity includes rear bearing surfaces 40 and the side bearing surfaces 38, each for bearing against corresponding surfaces of the support structure 14. As shown in FIGS. 2*a* and 2*b*, the rear bearing surfaces 40 are positioned on opposing sides of the cavity 16 (i.e., one rear bearing surface is defined in the upper wall and the other rear bearing surface is defined in the lower wall) and extend in the direction of the longitudinal axis x-x. In the illustrated embodiment each rear bearing surface extends at an angle of 2° to the longitudinal axis.

The rear bearing surfaces 40 are arranged to extend in a different plane to the front inclined bearing surfaces, including the inclined front bearing surfaces 32 and side bearing surfaces 38. The rear portion is both taller (z-axis relative to the longitudinal x-x axis) and wider (y-axis relative to the longitudinal x-x axis) relative to the front portion. As a result, the upper wall of the rear portion is more spaced apart from the lower wall of the rear portion than the upper wall of the front portion is spaced apart from the lower wall of the front portion. In this way, the rear bearing surfaces are spaced further apart in the z-direction than the inclined front bearing surfaces so that they are positioned further from the longitudinal axis x-x than the inclined front bearing surfaces.

The rear bearing surfaces 40 are also spaced rearwardly (in the longitudinal direction) from the inclined front bearing surfaces 32, i.e. towards the rear of the cavity. In some forms, the rear bearing surface 40 is positioned longitudinally along the same line as the arcuate transition region 34 so as to be centred relative to the inclined front bearing surfaces 32.

The rear bearing surfaces 40 can have surfaces areas of approximately 36 cm2. The surface area of the rear bearing surface may change according to the size of the wear assembly required for a particular application of excavating equipment.

In the form best shown in FIG. 2*a*, the rear bearing surfaces 40 are shaped with five sides to have a pentagonal shape. The rear bearing surfaces 40 are positioned such that a side of the pentagonal shape is in line with the open end of the wear member, an opposing point of the pentagonal shape extends is in line with the longitudinal axis closer to the front portion. In some forms the sides of the pentagonal shape can be linear, and in other forms they can be curvilinear, or a combination of linear and curvilinear sides can be provided. In some forms the angles between each side of the pentagonal shape are equal, and in other forms, the angles are not equal. A particular configuration of the sides can be determined by an arrangement of surfaces extending from the rear bearing surfaces 40.

The rear portion 28 additionally includes inclined surfaces 42 extending away from each of the opposing rear bearing surfaces 40. In the form shown in FIG. 2*a*/2*b*, the inclined surfaces 42 meet on four sides of each rear bearing surface 40. In each of the upper wall 22 and the lower wall 24, two of the inclined surfaces 42 form part of the rear portion 28 and two inclined surfaces 42 form part of the intermediate portion 30. In this form, four sides of the rear bearing surface meet with a corresponding inclined surface. One side of the rear bearing surface 40 meets an exterior rear bearing surface 70 at an arcuate transition region. The inclined surfaces 42 are non-bearing surfaces to allow for installation and removal of the wear member relative to the support structure.

An exterior rear bearing surface 70 extends in the z-direction between the upper wall 22 and the exterior surface of the wear member 10. The exterior rear bearing surfaces 70 defines the cavity 16 of the wear member and extends at least part way around the open end 18 of the cavity. A second exterior rear bearing surface 70 extends in the z-direction between the lower wall 24 and the exterior surface of the wear member 10. The second exterior rear bearing surfaces 70 also extend part way around the open end of the cavity. The exterior rear bearing surfaces 70 are shaped to bear against a corresponding surface of the support structure.

Between the exterior rear bearing surfaces 70 are exterior rear non-bearing surfaces 72. The exterior rear non-bearing surfaces 72 are inset in a different lateral plane (towards the front end) from the exterior rear bearing surfaces 70 so as to accommodate a side protrusion of a side surface extending rearward on either side of the support structure 12. An s-shaped transition region joins the exterior rear surface and provides a smooth transition.

The exterior rear bearing surfaces 70 bear against a corresponding surface of the support structure or a wear cap 164 in use. The wear cap 164 will be discussed in more detail below. The exterior rear bearing surfaces 70 and transition regions between proximal surfaces such as interior surfaces of the cavity (e.g., the rear bearing surfaces) provides a pry surface(s). The pry surface(s) may assist and minimise effort required in removing the wear member from the support structure. The pry surface(s) is positioned along the centreline (in line with the longitudinal axis).

The intermediate portion 30 of the cavity is positioned between the front portion and the rear portion. The intermediate portion also includes inclined surfaces 42. In the embodiment shown in FIGS. 2*a* and 2*b*, in each of the upper wall and lower wall, two inclined surfaces extend from the rear bearing surface 40 towards the front portion of the cavity to meet with the inclined front bearing surfaces 32. The two inclined surfaces 42 meet one another at an intermediate arcuate transition region 44 aligning with the corresponding arcuate transition region 34 of the front portion 26. The intermediate arcuate transition region 44 generally extends in line with the longitudinal axis. The arcuate transition region between the inclined surfaces of the intermediate portion generally extend at an obtuse angle relative to the longitudinal axis. In alternative embodiments, and depending on the size of the wear member, the angle may be in the range of 1400 to 1700.

Figure 8B:
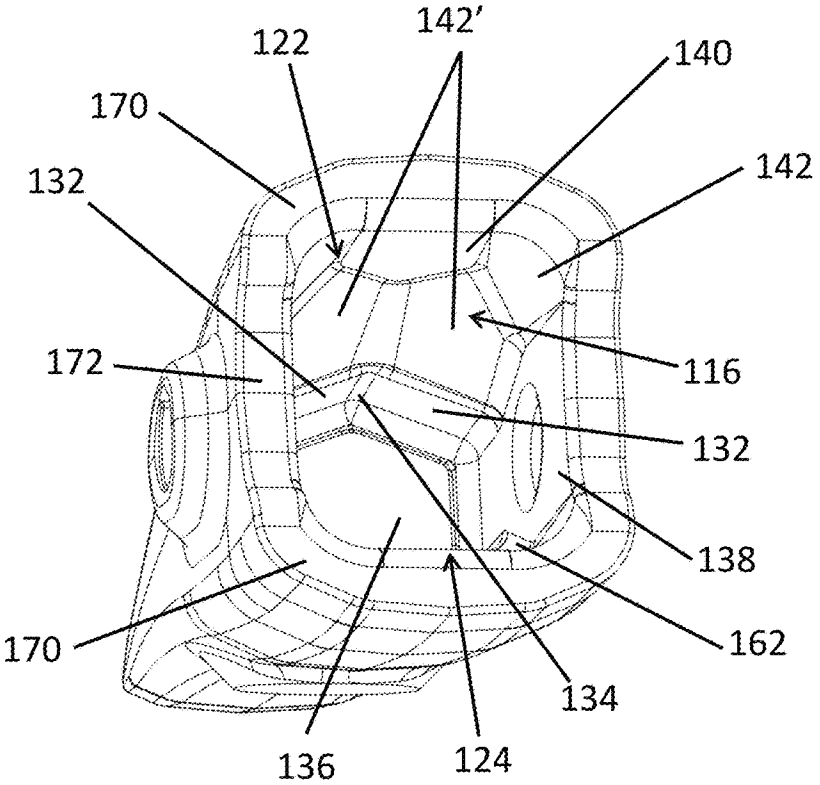
FIGS. 8*a* & 8*b* are perspective views of a second embodiment of a wear member.
Figure 8A:
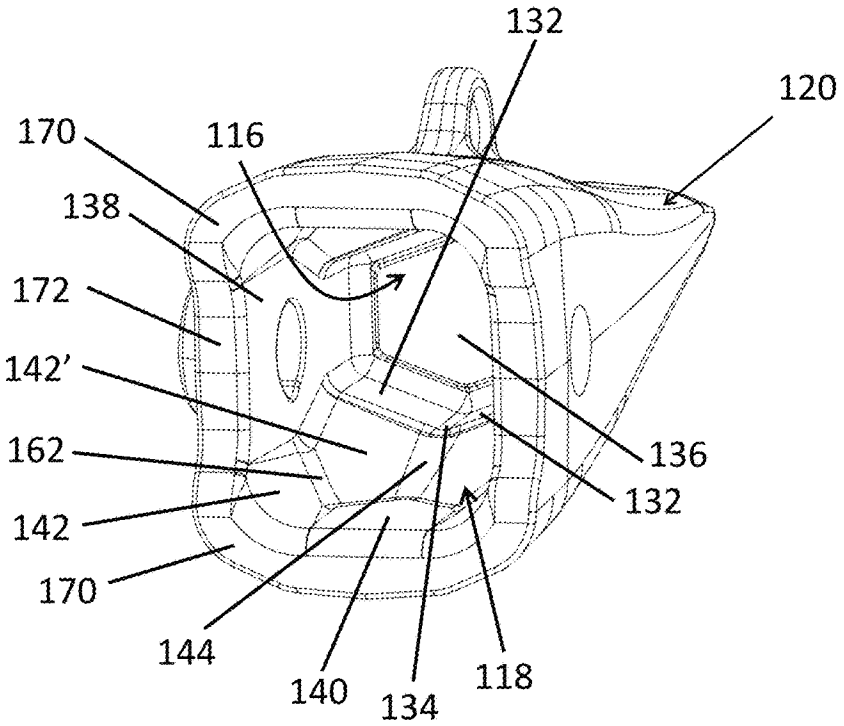
Figure 9B:
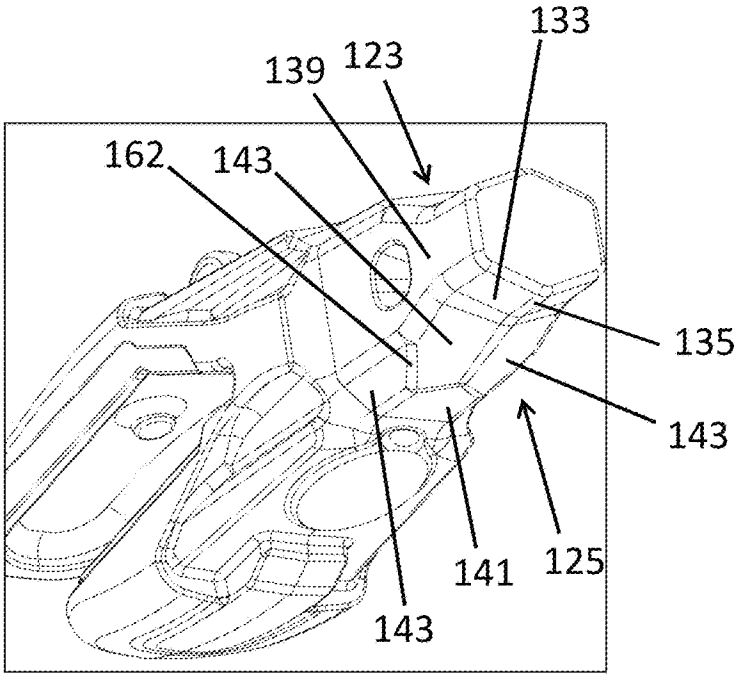
FIGS. 9*a* & 9*b* are perspective views of a second embodiment of a support structure.
Figure 9A:
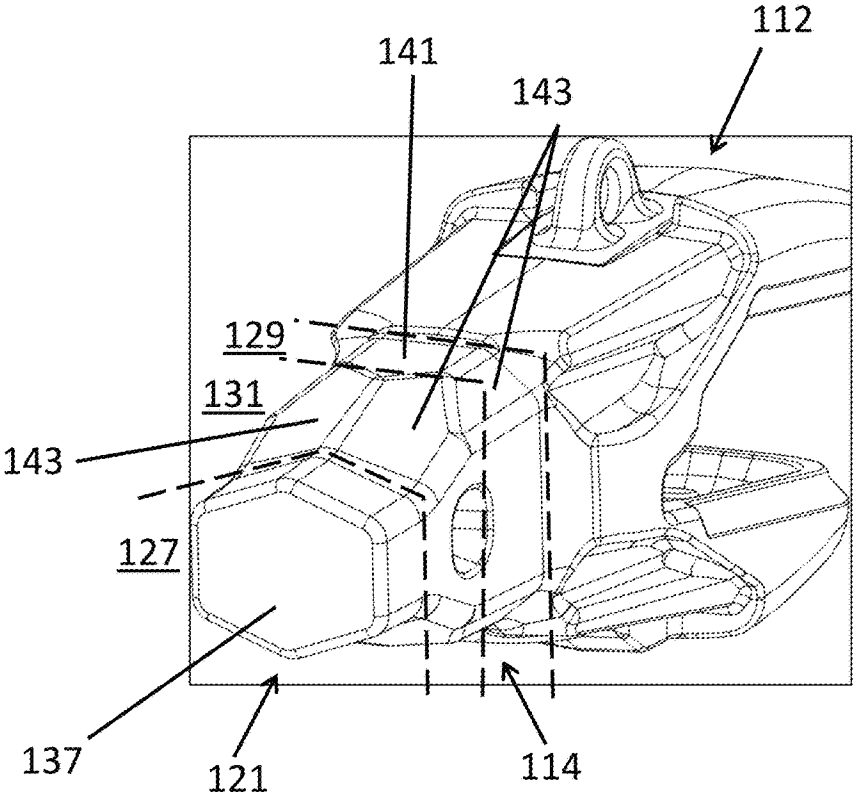

In the embodiment shown in FIGS. 1-5, the inclined surfaces of both the rear portion and the intermediate portion includes smooth transitions (i.e., are blended) to form a continuous inclined surface extending in the rear portion and the intermediate portion. Parts of the inclined surfaces may be flat, and parts may be arcuate or radiused. Referring specifically to the embodiment shown in FIGS. 7 to 11, wireframe lines can be seen on the drawing of the cavity (in FIG. 8 and support structure in FIG. 9). The wireframe lines indicate the boundaries of the surfaces but are not breaks in the surfaces. The inclined surfaces of the rear portion and intermediate portion are not defined surfaces, rather, a single surface flowing continuously along the longitudinal axis.

The inclined surfaces 42 of both the rear portion 28 and intermediate portion 30 are non-bearing surfaces and are spaced from the corresponding surfaces of the support structure. By providing non-bearing, spaced apart surfaces, the wear member is more easily fit to the support structure when compared to a wear member having all surfaces of the cavity as bearing surfaces. Spacing the non-bearing surfaces of the member from the support structure isolates the contacting surfaces, and therefore, directs the transfer of loads to the defined bearing surfaces.

The intermediate portion 30 also includes the side bearing surfaces 38 that extend into the rear portion 28 and front portion 26. The side bearing surfaces 38 extend continuously from the rear portion 28 to the front portion 26. Positioned in each of the side bearing surfaces 38 is the locking hole 50 for receiving a lock body in the form of a locking pin (discussed below). In alternative embodiments the side surfaces may be interrupted and may include non-bearing surfaces or parts.

Figure 3B:
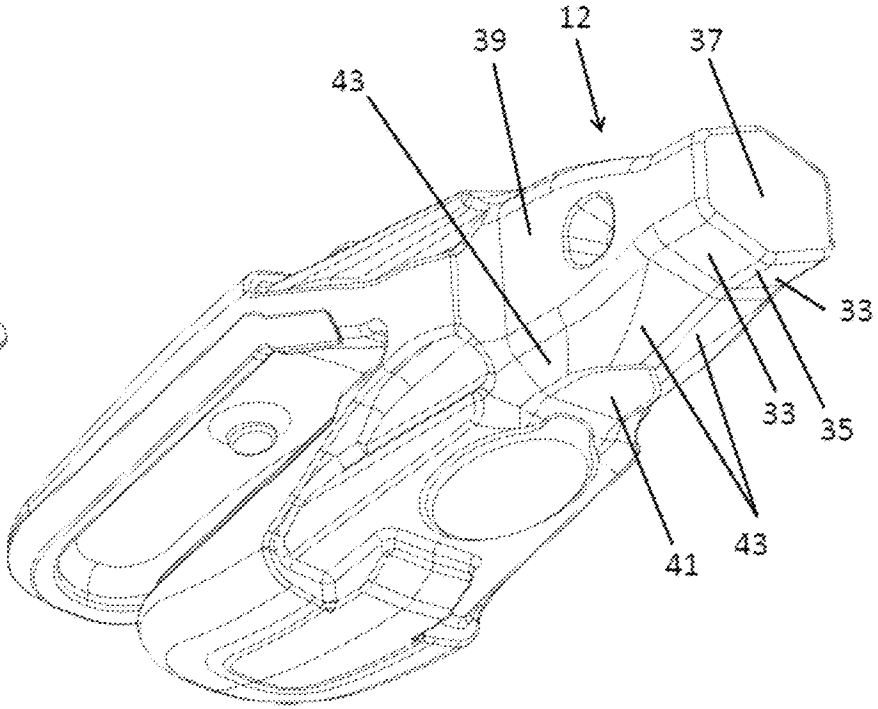
FIGS. 3*a* & 3*b* are perspective views of an embodiment of a support structure of the wear assembly of FIG. 1.
Figure 3A:
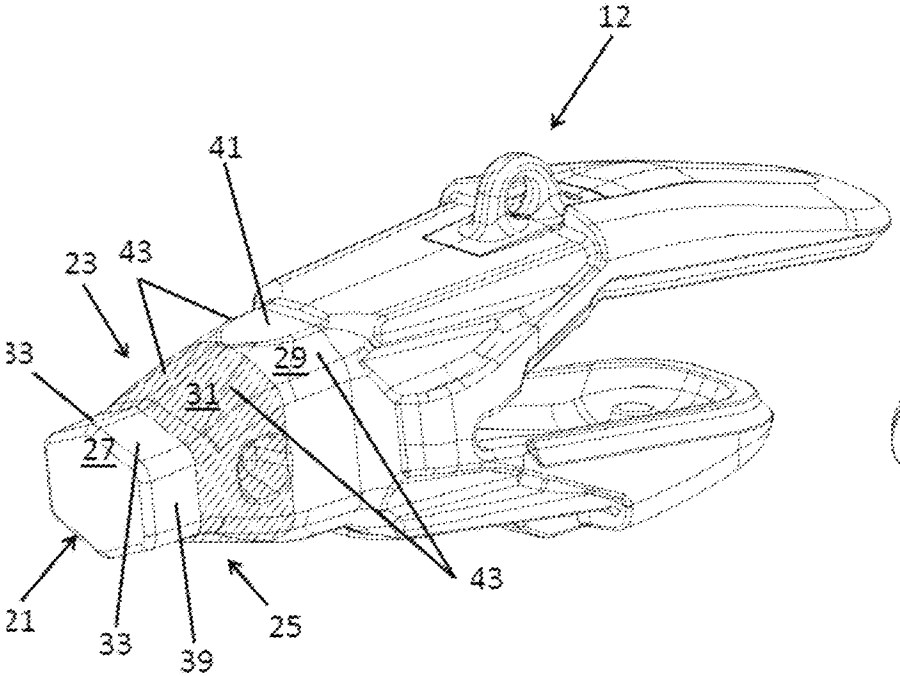

Referring now to the support structure 12 shown in FIGS. 3*a* and 3*b*. The cavity and the support structure include corresponding surfaces and thus are of complementary shapes. All the features discussed above in relation to the cavity of the wear member may be equally applied to the support structure. The support structure 12 comprises an upper wall 23 and a lower wall 25. The upper wall and lower wall extend generally in the direction of the longitudinal axis x-x from a rear portion 29 to a front portion 27. In the illustrated embodiment, an intermediate portion 31 extends between the front portion 27 and rear portion 29.

The front portion 27 of the support structure includes an end bearing surface 37, side bearing surfaces 39 and two bearing surfaces 33 arranged on opposing upper and lower walls. The end bearing surface 37 extends laterally across a front end 21 of the front portion. The side bearing surfaces 39 extend from the rear portion 29 to the front portion 27 and space apart the upper wall 23 and the lower wall 25. The two bearing surfaces 33 are inclined relative to one another and meet at an arcuate transition region 35.

The intermediate portion 31 of the support structure is positioned between the front portion and the rear portion and includes side bearing surfaces 39. The intermediate portion also includes inclined surfaces 43. The inclined surfaces can be non-bearing surfaces for spacing the support structure from the cavity.

The rear portion 29 of the cavity includes rear bearing surfaces 41 and the side bearing surfaces 39, each for bearing against corresponding surfaces of the cavity 16. As shown in FIGS. 3*a* & 3*b*, the rear bearing surfaces 41 are positioned on opposing sides of the support structure 12 and extend in the direction of the longitudinal axis x-X.

As best illustrated in FIG. 1, the support structure and cavity are symmetrically shaped. The support structure and cavity are symmetrical about the lateral plane and about the longitudinal plane. This allows the wear member to be installed onto the support structure in an inverse orientation, i.e. rotated 180 degrees about the longitudinal axis x-x. It is an advantage to invert the wear member during servicing of the member. In this way, the wear member can be arranged on the support structure to allow for access to the all exterior surfaces of the wear member. Providing this access for servicing can maximise the service life of the wear member.

Referring now to FIGS. 4*a* to 4*c*, a schematic representation of the support structure is shown in various sectional views. The sectional views illustrate a cross-sectional profile of the cavity and the support structure in relation to the arrangement of the surfaces. While the support structure is used as a reference in this form, the cavity of the wear member comprises a corresponding arrangement of surfaces and therefore reference to the surfaces of the support structure applies equally to the surfaces of the cavity.

Referring to FIG. 4*a*, a section is taken through the rear portion of the support structure, corresponding to the rear portion 29 of the cavity. The rear portion has an octagonal shape in cross-section, i.e., has eight sides.

Referring to FIG. 4*b*, a section is made through the intermediate portion of the support structure, corresponding to the intermediate portion 31 of the cavity. The intermediate portion takes on a generally hexagonal shape in cross-section, i.e., has six sides.

Referring to FIG. 4*c*, a section is made through the front portion of the support structure, corresponding to the front portion 27 of the cavity. The front portion takes on a hexagonal shape in cross-section, i.e. has six sides. It follows that the end bearing surface 37 of the front portion takes a hexagonal shape.

It can be seen in FIGS. 3*a* and 3*b*, in addition to FIGS. 4*a* to 4*c*, that the front portion includes more bearing surfaces than the rear portion. This is best illustrated in the embodiment shown in FIGS. 9*a* and 9*b*, in addition to FIGS. 10*a* to 10*c*. That is, the front portion comprises six bearing surfaces, including: the two inclined front bearing surfaces 32, 132 in the upper wall 22, 122 the two inclined front bearing surfaces 32,132 in the lower wall 24,124 and the two side bearing surfaces 38,138. The rear portion comprises four bearing surfaces, including: the side bearing surfaces 38,138 and the two opposing rear bearing surfaces 40,140.

Figure 10A:
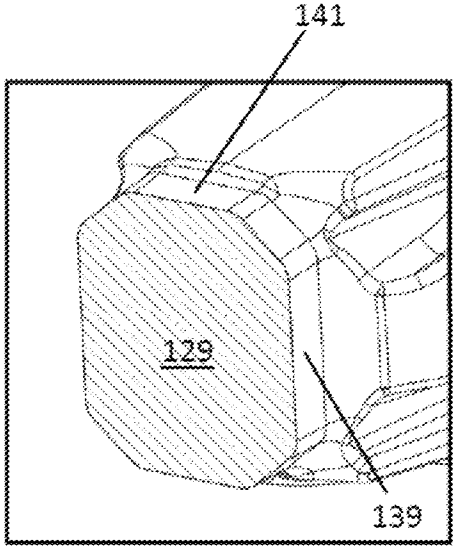
FIGS. 10*a*-10*c* are cross-sectional perspective views of a second embodiment of a support structure.
Figure 10B:
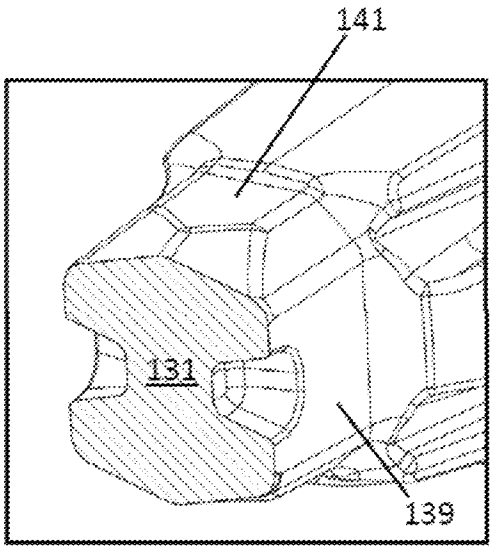
Figure 10C:
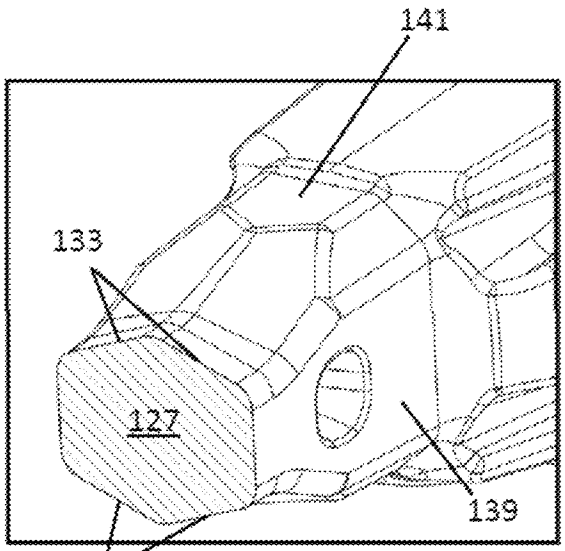

Also shown in FIGS. 4*a* to 4*c* and in the embodiment shown in FIGS. 10*a* to 10*c*, the front portion of the support structure and cavity includes fewer total number of surfaces than the rear portion. That is, there is a total of six surfaces in the front portion and a total of eight surfaces in the rear portion.

The intermediate portion of the support structure and cavity comprise more non-bearing surfaces than bearing surfaces. In this embodiment, the majority of load transfer between the support structure and wear member is directed through the front and rear portions. This can help ensure the front and rear ends are stable to prevent e.g. rocking of the wear member about the support structure, in-use.

For the purposes of this disclosure, transition regions, i.e. rounds, chamfers, radiused surfaces, etc, are not considered surfaces substantially contributing to the interaction of the wear member and support structure. In this way, the total numbers of surfaces referred to above only refer to the bearing and non-bearing surfaces previously discussed.

Figure 5B:
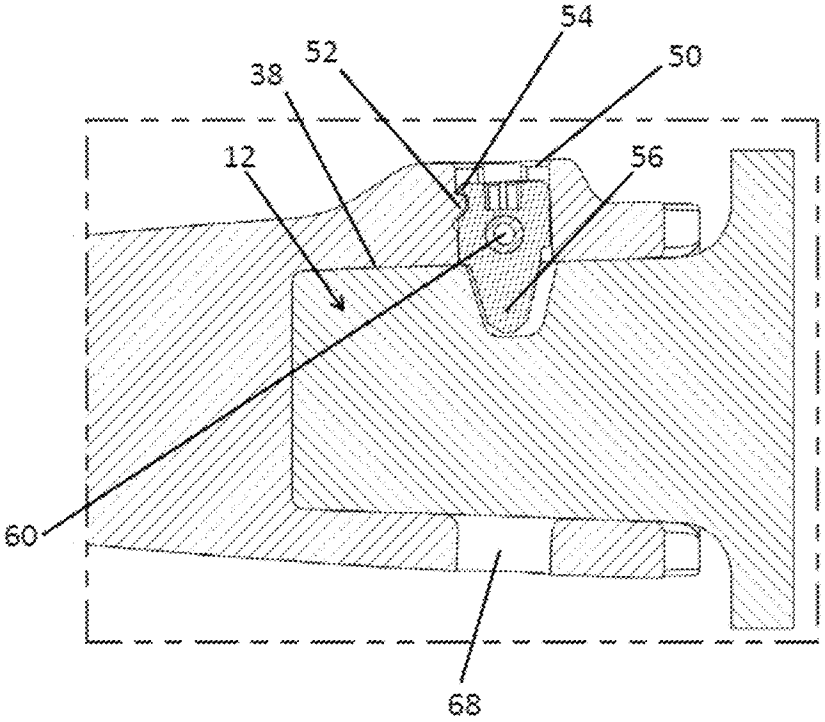
FIGS. 5*a* & 5*b* are a cross-sectional side views of a wear assembly.
Figure 5A:
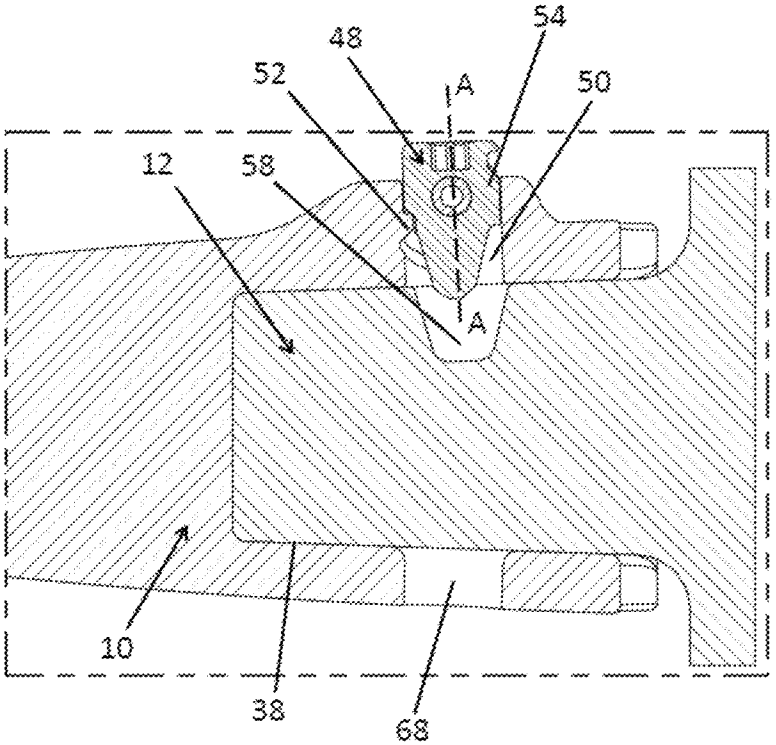

Referring now to FIGS. 5*a* and 5*b*, the wear member can be secured to the support structure of the support structure with a locking pin 48. A locking hole 50 extends through a side of the exterior surface of the wear member to the side bearing surface of the wear member cavity to receive the locking pin 48 for securing to the support structure 14. The locking pin is arranged to be movable within the locking hole.

An interior surface of the locking hole comprises an engaging structure 52 for engaging with a complementary engaging structure 54 formed on the locking pin. In the form shown in FIGS. 5*a* and 5*b*, the engaging structures are helical, i.e. threaded arrangements. On rotation of the pin the helical arrangements allow axial movement of the pin 48 relative to the wear member 10.

The locking pin extends along a pin axis A-A and includes a first end 56 for engaging with the support structure 14. The first end of the pin is arranged to extend into a recess 58 of the support structure 12 so as to secure the wear member 10 to the excavation equipment.

The locking pin 48 further includes a latching arrangement 60. The latching arrangement retains the pin in a predetermined axial position primarily by inhibiting rotation of the pin when the helical engaging structures are engaged.

The support structure 12 includes the recess 58 on both side bearing surfaces 38. It is an advantage that providing the recess on both sides allows the wear member to be secured to the support structure in an inverted orientation, i.e. rotated 180 degrees about the longitudinal axis z-z.

In addition to engaging with the first end of the pin 56, once the pin 56 is removed, the interior surfaces of the locking hole 50 and the recess 58 also provide pry-points for removing the wear member from the support structure 12. The recess 58 includes a base surrounded by a side wall(s). The pry-point may be located towards the base of the recess at the transition region between the base and the side wall(s). An interior side surface of the locking hole 50 also includes a pry-point. A pry may be inserted into the locking hole 50 to the base of the recess 58. A pry may contact both pry-points of the recess 58 and the locking hole 50 to assist in removing the wear member from the support structure once it is worn. This minimises the effort required to remove the wear member.

In some forms, the recesses 58 are arranged in the intermediate portion towards the front portion of the support structure. This can prevent overloading the locking pin 48 under certain digging actions.

The wear member further comprises a sight hole 68 for viewing through the wear member during both manufacture and service of the wear member.

In a second embodiment, as shown in FIGS. 7 to 12, like reference numerals denote similar or like parts with the addition of 100 to allow distinguishing between embodiments.

Referring now to FIGS. 7 to 12, a second embodiment the wear member and the support structure is shown. The second embodiment primarily differs from the first embodiment in that the inclined surfaces of the cavity 142,142' (and the inclined surfaces 143,143' of the support structure) of the rear 128 and intermediate 126 portions meet at a more distinct arcuate transition region to form distinct surfaces and the transition between the surfaces is not smooth to form a continuous surface.

Figure 11:
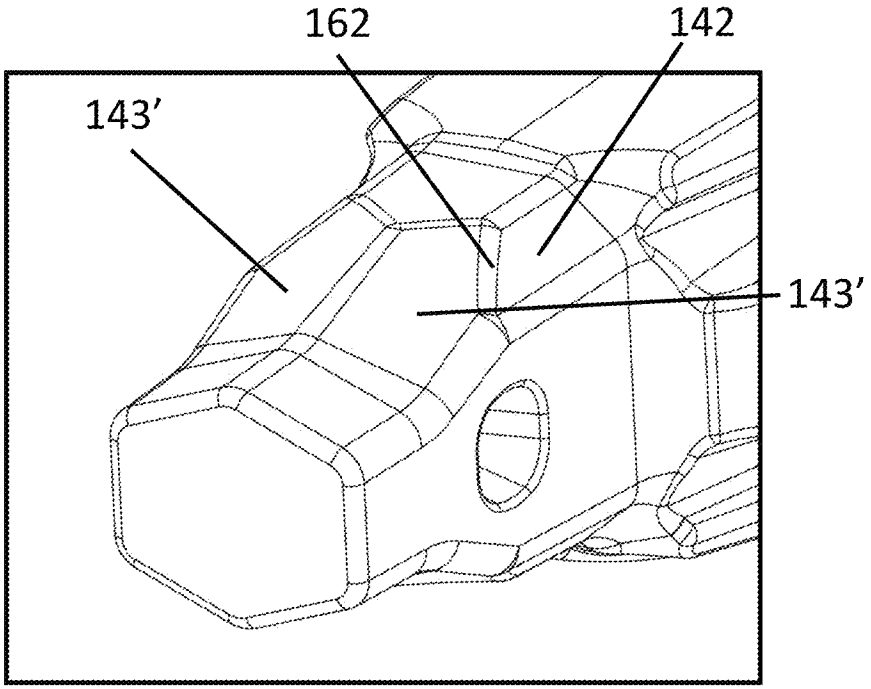
FIG. 11 is a perspective view of a second embodiment of a support structure.

Referring specifically to FIG. 11, the inclined surface 143 of the rear portion takes a distinct four-sided shape. The inclined surface at the intermediate portion 143' takes a distinct five-sided shape. The inclined surface of the rear portion meets the inclined surface of the intermediate portion at a vertex 162.

Referring now to FIGS. 12 to 16, a third embodiment of a wear assembly is illustrated. The third embodiment primarily differs from the first embodiment in that the wear assembly includes one or more wear caps 164 mountable to the support structure. Like reference numerals are used for like features with the first embodiment.

The one or more wear caps 164 protect the support structure 12 from wear and are removable and replaceable when worn. The one or more wear caps 164 may be particularly useful to protect the top and bottom of the support structure 12 on high-impact and high-abrasions applications. This extends the life of the support structure 12.

Figure 12:
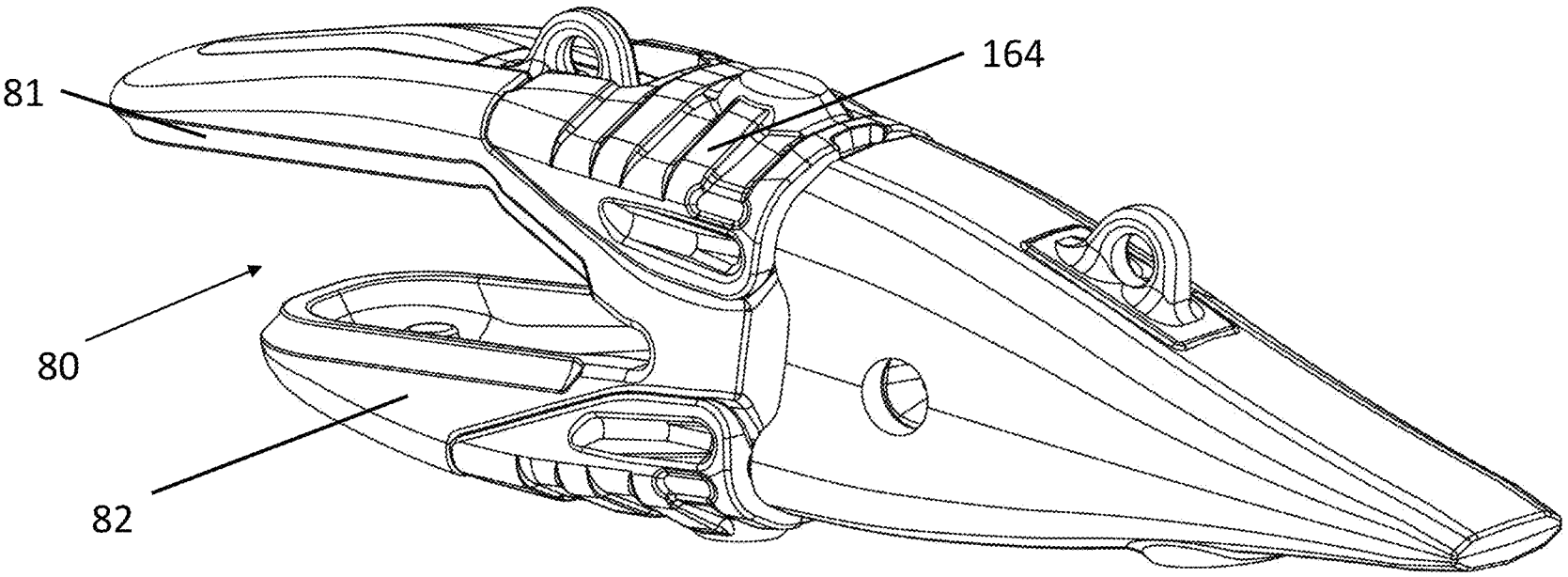
FIG. 12 is a perspective view of a third embodiment of an assembled wear assembly.

As shown in FIG. 12, the support structure 12 includes an attachment structure 80 to secure the support structure 12 to the excavator equipment, for example a base edge (or lip) of a bucket of other work implement. The attachment structure 80 includes two legs (an upper leg 81 and a lower leg 82) extending rearward from the wear member towards the excavator equipment in use. The legs 81, 82 are bifurcated to define an interior recess between the upper leg 81 and the lower leg 82. The recess is shaped to receive the lip of the bucket. The recess and the lip of the bucket may be complementary. The upper leg 81 is positioned relative to the upper surface of the lip and the lower leg 82 is positioned relative to the lower surface of the lip.

Figure 13:
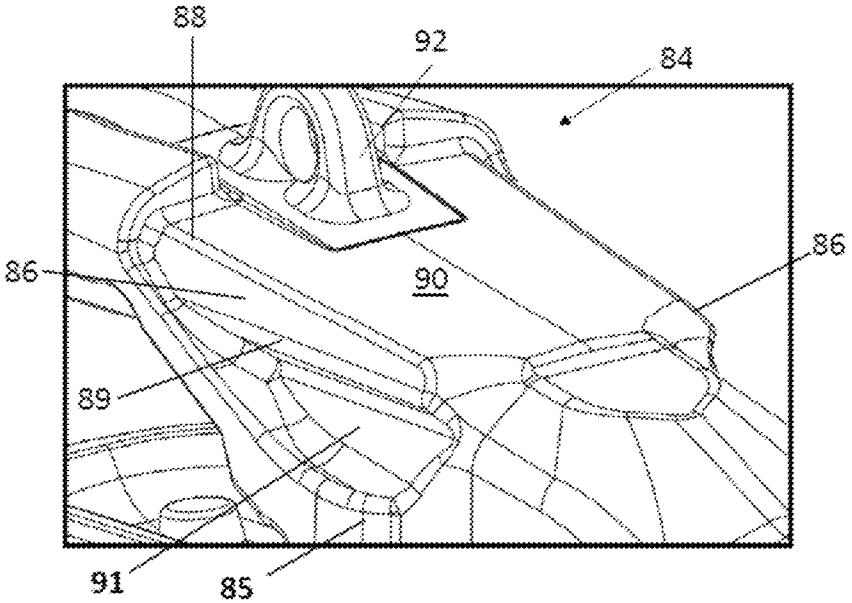
FIG. 13 is a perspective view of a third embodiment of a support structure of the wear assembly of FIG. 12.
Figure 15:
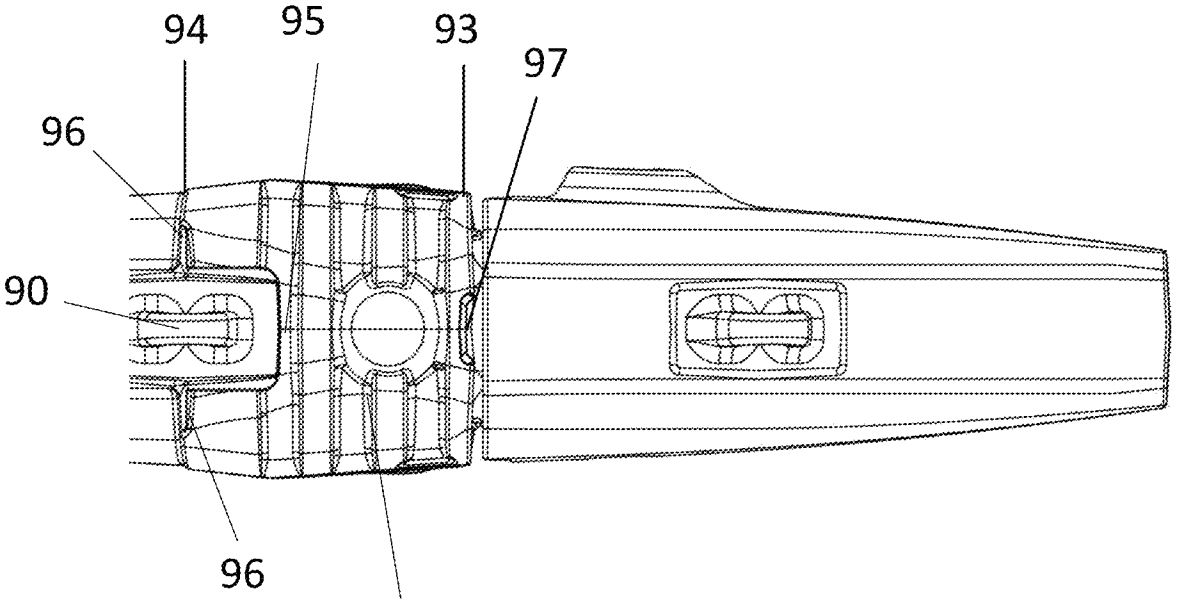
FIG. 15 is a plan view of the wear assembly of FIG. 12.

The wear assembly also includes a mounting structure 84 for mounting the one or more wear caps 164 to the support structure 12. Referring to FIG. 13, the legs 81, 82 also define an exterior surface which extends to the upper wall 23, the lower wall 23 and the side surfaces 39 of the support structure. The legs 81, 82 include a part of the mounting structure 84 defined in the exterior surface. The mounting structure 84 may be formed in relation to an upper exterior surface of the upper leg and/or a lower exterior surface of the lower leg. Side surfaces 85 extend between the upper exterior surface and the lower exterior surface.

The mounting structure 84 includes one or more flanges 86 extending in the longitudinal direction and corresponding recesses 87 for receiving the one or more flanges. In the illustrated embodiment, the flanges 86 are defined in the exterior surface of the support structure 12 and the corresponding recesses 87 are defined in an interior surface of the wear cap 164. It is understood that the one or more flanges may be defined in relation to the wear cap and the corresponding recesses may be defined in relation to the support structure.

In the illustrated embodiment, the upper exterior surface of the upper leg 81 includes two flanges 86 spaced apart and positioned on either side of the upper exterior surface. The flanges 86 are generally rectangular in cross-sectional profile (best shown in FIG. 14) and include an upper shoulder 88 and a lower shoulder 89 extending the length of the flange. The lower shoulder 89 may protrude more than the upper shoulder. In this way the profile of each flange may be asymmetrical. The flanges 86 protrude relative to the surrounding surfaces of the upper exterior surface. The flanges 86 of the upper exterior surface are angled relative to an upper mating face 90. The flanges 86 are angled in opposing directions to secure the wear cap 164 in an assembled position relative to the support structure. The flanges 86 may taper along their width in the longitudinal direction to allow for easy installation and removal of the wear cap 164.

The upper mating face 90 extends between the flanges. The upper mating face 90 may be planar and correspond to an interior mating face of the wear cap 164. The upper mating face 90 of the mounting structure 84 is close in alignment with the rear bearing surface 41 of the rear portion of the support structure. This feature minimises the change in section which reduces the peak stress in the support structure under vertical loading of the wear member.

A depressed portion 91 is formed on either side of the flanges 86 between each flange 86 and the side surface 85 of the support structure for receiving complementary protrusions 92 of the wear cap 164. The depressed portion 91 includes a base and side walls. The base may be a planar surface at its base which transitions to side walls through an arcuate transition region. The base is inclined relative to the upper mating face and the side surface. The depressed portion 91 includes generally a rectangular cross-sectional profile which tapers as it extends rearward along the support structure from the wear member.

The base of the depressed portion 91 is close in alignment to the inclined surface 43 of the rear portion of the support structure. This feature minimises the change in section which reduces the peak stress in the support structure under vertical and lateral loading of the wear member.

The upper exterior surface also includes a lifting lug 92 positioned so it is spaced apart from the support structure and to facilitate easy mounting of the support structure 12 to the lip of the bucket. The lifting lug 92 may be attached to a tool that assists in lifting the wear assembly onto the lip of the bucket.

The lower exterior surface includes the part of the mounting structure 84 as described above in relation to the upper exterior surface. The primary difference is that the lower exterior surface does not include the lifting lug.

Figure 14:
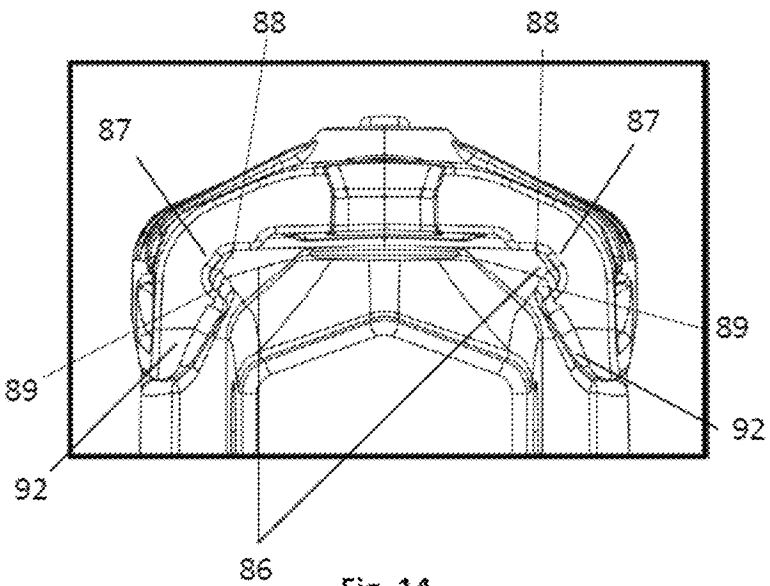
FIG. 14 is an end view of a third embodiment of a support structure including an embodiment of two wear caps of the wear assembly of FIG. 12.

Now referring to FIGS. 12 and 14, the one or more wear caps 164 will be discussed in more detail. The wear cap 164 is designed to protect the support structure 12 of the wear assembly and extend the life of the support structure 12. Whilst the support structure is removable from the lip of the bucket, it is more efficient and easier to remove the wear member and wear cap when they are worn (not necessarily at the same time). The wear cap 164 is shaped to wrap around the upper and lower exterior surface of the support structure, respectively an upper wear cap and a lower wear cap. In this way, the wear cap 164 is a C- or U-shape.

The wear cap 164 includes a part of the mounting structure 84. The mounting structure includes an interior surface of the wear cap 164 shaped to mate with the part of the mounting structure 84 of the support structure.

The interior surface defines the one or more interior recesses 87 complementary to the one or more flanges 86 of the support structure. Likewise, the interior surface defines the protrusion 92 at either side of the wear cap to mate with the depressed portions 92. Lastly, the wear cap 164 includes an inner mating face which is complementary to the upper mating face 90.

The wear cap 164 also extends longitudinally between ends 93, 94. When assembled, a first end 93 is positioned proximal the wear member (and the rear exterior bearing surface 70 of the wear member). When assembled a second end 94 is positioned away from the wear member, and in the case of the upper wear cap, towards the lifting lug.

The wear cap 164 also includes pry surfaces that minimise the force and effort required to remove the wear member and the wear cap from the support structure. Now referring to FIG. 15, a plan view of the wear assembly is shown including the upper wear cap. The upper wear cap may also include a cut-out 95 at the second end 94 to accommodate the lifting lug 90. Proximal either side of the cut-out 95 at the second end 94 are prying surfaces 96. The prying surfaces 96 are inset from the end edge 94 to provide a clearance to allow for insertion of a prying tool between the prying surfaces and the support structure. The prying surfaces 96 of the second end assist in removing the wear cap from the support structure.

The wear cap 164 also includes an inset pry surface 97 at the first end 93. The pry surface 97 of the first end 93 is positioned along the centreline of the wear cap 164 and accommodates a prying tool to assist in removing the wear member from the support structure.

The lower wear cap also includes similar pry surfaces. The prying surfaces of the second end may be in the form of one prying surface positioned on the longitudinal axis where there is no lifting lug to accommodate.

The wear cap 164 also includes an exterior surface that generally aligns with the profile of the wear member. This feature streamlines the profile of the wear member and the wear cap which results in a highly effective and efficient digging tool.

Figure 16:
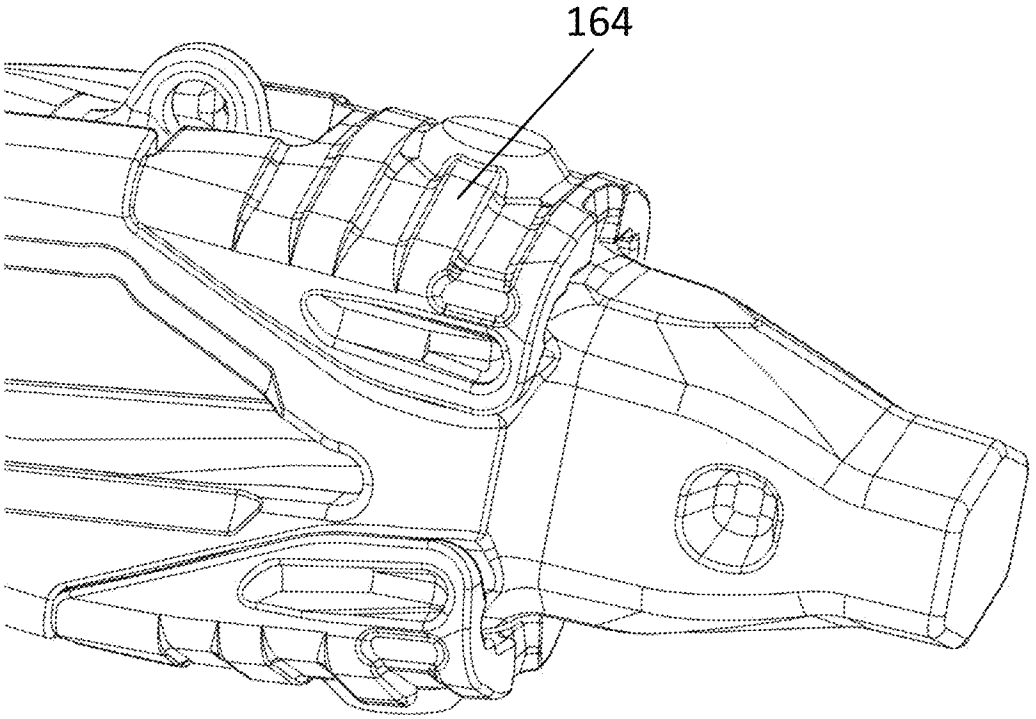
FIG. 16 is a side perspective view of the support structure of FIG. 12 including two wear caps before removal of one of the wear caps.
Figure 17:
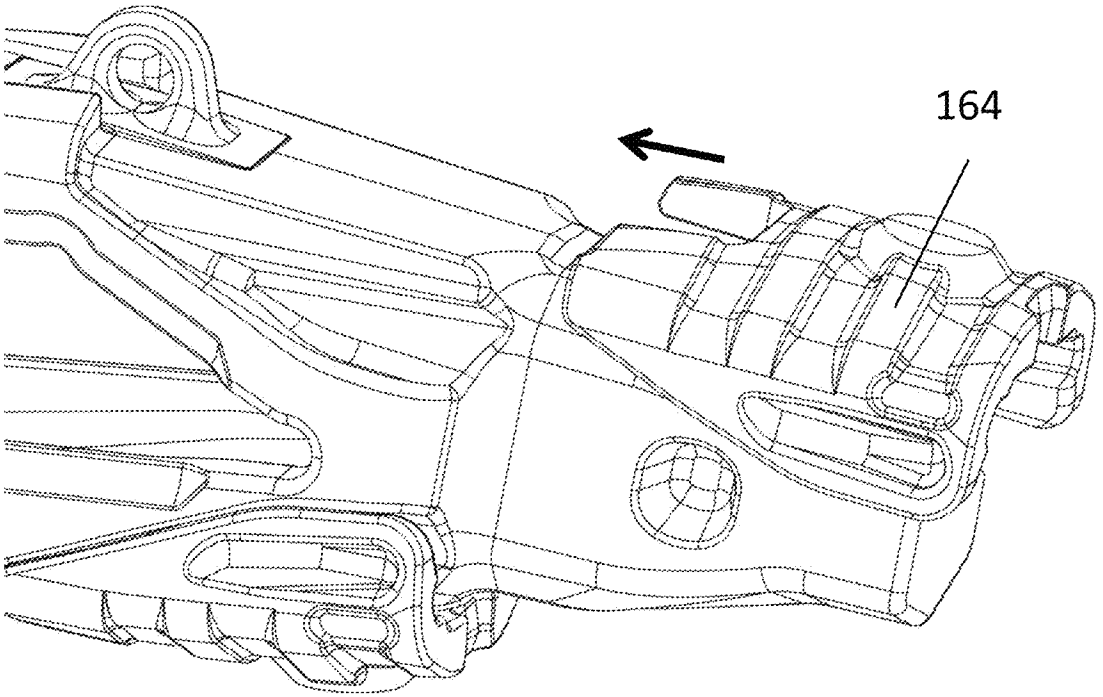
FIG. 17 is a side perspective view of the support structure of FIG. 12.

FIGS. 16 and 17 illustrate the disassembly and assembly of the wear cap on the support structure. In the illustrated embodiment, to disassemble the wear cap from the support structure, the operator slides the wear cap in the longitudinal direction towards the support structure. The wear member must be removed before the wear cap is removed.

FIG. 17 shows assembly of the wear cap on the support structure. The opposite sliding movement is performed, and the operator slides the wear cap onto the support structure in the longitudinal direction towards the legs of the support structure. Once the wear cap is assembled to the support structure, the wear member may be assembled to the support structure.

The upper and lower wear caps have the same mating geometry and the same exterior profile, thus both having the same streamlined benefits with the support structure and the wear member.

Figure 18:
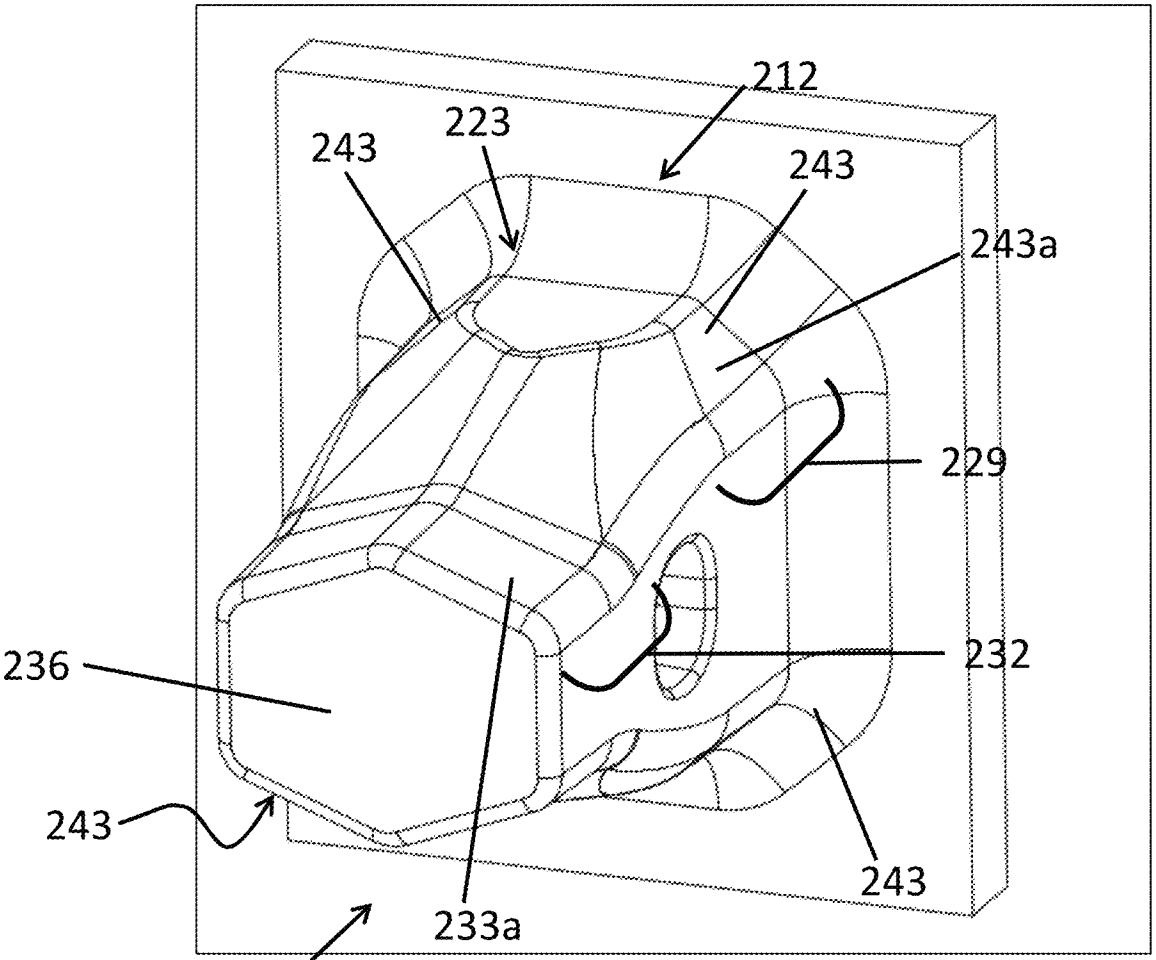
FIG. 18 is a perspective view of a fourth embodiment of a support structure.

In a fourth embodiment, as shown in FIG. 18, like reference numerals denote similar or like parts with the addition of 200 to allow distinguishing between embodiments.

Referring now to FIG. 18, a fourth embodiment of the support structure 212 is shown. The fourth embodiment primarily differs from the first embodiment in that the rear portion 229 of the support structure 212 comprises an additional four bearing surfaces, i.e. two bearing surfaces 243 arranged on opposing upper 223 and lower 225 walls. In other words, the rear portion 229 includes more bearing surfaces than the front portion.

As for previous embodiments, the surfaces of the support structure in the fourth embodiment correspond with surfaces of a fourth embodiment of a cavity in a wear member (not shown). Thus, the cavity and support structure are of complementary shape. In particular, the bearing surfaces of the cavity are for bearing against corresponding bearing surfaces of the support structure to transfer load between the support structure and the wear member.

It follows that all the features discussed above in relation to the support structure 212 may be equally applied to the cavity of the wear member. That is, the fourth embodiment of the cavity of the wear member comprises an additional four bearing surfaces when compared to the first embodiment: the cavity of the fourth embodiment comprising two bearing surfaces arranged on upper walls and two bearing surfaces arranged on lower walls. Further, in non-illustrated alternative embodiments, the rear portion includes a central rear surface that is non-bearing and rear inclined surfaces that are bearing. In further non-illustrated alternative embodiments, the side surfaces are non-bearing.

The inclined bearing surfaces 243 in the rear portion extend in substantially the same direction as the longitudinal axis of the wear member. The surfaces 243 may be provided at a small angle relative to the longitudinal axis, narrowing towards the end bearing surface 236 to assist with aligning and mating the support structure into the cavity of the wear member.

In the form shown in FIG. 18, the inclined bearing surfaces 243 in the rear portion 229 of the support structure are flat surfaces. The inclined bearing surfaces in the rear portion of the cavity are arranged to support load transfer from the corresponding bearing surfaces 243 of the support structure in more than one direction relative to the direction of the longitudinal axis. That is, the inclined surfaces can absorb loads that comprise at least two force components, e.g., a vertical force and a horizontal force. This can provide greater stability in the rear portion of the wear member during e.g. digging operations of the excavation equipment.

The inclined bearing surfaces 243 in the rear portion 229 are arranged to extend in a different plane to the inclined bearing surfaces of the front portion 232. For example, inclined bearing surface 243*a* in the rear portion is angled about the longitudinal axis relative to the inclined bearing surface 233*a* in the front portion. In some embodiments the surfaces 243 in the rear portion 229 are angled at 20° relative to the surfaces 233 in the front portion.

Providing inclined bearing surfaces at different angles, i.e. angled at 200, can improve the stability of the support structure 212 within the cavity. The inclined surfaces in the front portion can absorb different load paths compared to the inclined surfaces in the rear portion. For example, the inclined surfaces in the rear portion, being angled at 200 closer to the horizontal (than the inclined surfaces of the front portion) can more effectively absorb load paths which have a greater horizontal component than vertical component. Similarly, the inclined surfaces in the front portion, being angled at 200 closer to the vertical (than the inclined surfaces of the rear portion) can more effectively absorb load paths which have a greater vertical component than horizontal component.

The additional inclined bearing surfaces provided in the fourth embodiment can also improve the distribution of loads between the wear member and the support structure when compared to the first embodiment. In the fourth embodiment the loads applied between the wear member and the support structure are divided across more surfaces, i.e. eight, than in the first embodiment (which has four surfaces). In this way, each bearing surface in the rear portion of the fourth embodiment receives less loading than in the first embodiment.

Reducing the loading on each bearing surface of the support structure and cavity can improve both the strength and wear characteristics of the assembly. For example, this can help prevent uneven wear on the bearing surfaces and thereby prolong the life of the wear member and support structure.

In a fifth embodiment, as shown in FIGS. 19 and 20, like reference numerals denote similar or like parts with the addition of 100 to allow distinguishing between embodiments.

Referring now to FIGS. 19 and 20, a fifth embodiment of the wear member 310 and the support structure 312 is shown. The fifth embodiment primarily differs from the first embodiment in that at least one bearing surface defined by an internal surface of the cavity is configured to be angularly offset from at least one corresponding bearing surface defined by an external surface of the support structure when the wear member is installed on the support structure without any load transfer on the wear assembly from ground penetration. In use, when the wear assembly is performing a digging operation load is being transferred to the wear assembly which biases the at least one bearing surface of the cavity into engagement with the at least one corresponding bearing surface of the support structure. The surface area contact is increased under the bias of the load transfer. The profile of the at least one bearing surface of the cavity may be planar or include a radius or radii of curvature so the surface is arcuate. The clearance between the surfaces in the installed position (i.e., the wear assembly is not under load conditions from being in use) is variable. Any or all of the bearing surfaces of the cavity and the support structure may be angularly offset in the installed but not in use position including bearing surface of the front portion, the bearing surfaces of the rear portion, the end surface extending laterally across the front end and the side surfaces.

The bearing surfaces in the front portion and the end bearing surface experience the most wear. In the illustrated embodiment, the bearing surfaces 332 of the upper walls of the front portion 326 of the cavity of the wear member are angularly offset relative to the corresponding bearing surfaces of the support structure when the wear member is installed on the support structure prior to ground penetration. When a load is placed on the wear assembly from ground penetration in use, the bearing surfaces 332 of the cavity are biased into increased surface engagement with the bearing surfaces 333 of the upper walls of the front portion of the support structure.

As for previous embodiments, the surfaces of the support structure in the fifth embodiment correspond with surfaces of a fifth embodiment of a cavity in a wear member. In particular, the bearing surfaces of the cavity are for bearing against corresponding bearing surfaces of the support structure to transfer load between the support structure and the wear member.

After the bearing surfaces of the wear member and the support structure are orientated in a substantially parallel alignment when load is transferred to the wear assembly, the surfaces are considered to be in an increased bearing contact state. In this state, subsequent loading applied to the wear member can be evenly distributed across the bearing surfaces.

In some forms of the wear member, the weight of the wear member itself can be sufficient to move the bearing surfaces 333 of the support structure towards increased surface area engagement with the bearing surfaces 332. The load conditions created by the ground penetration of the wear assembly bias the corresponding bearing surfaces into increased surface area engagement.

Referring to FIGS. 19*a* to 19*c* and 20*a* to 20*c*, the wear member and support structure are shown in a sequence (from left to right) that depicts the bearing surfaces being biased into alignment, and the relative angles between them, as the wear member moves relative to the support structure.

While FIGS. 19 and 20 show the upper walls of the front portion of the wear member moving into increased bearing contact, the wear member can be configured such that any of the bearing surfaces move into parallel alignment once the wear member is mounted to the support structure and placed under a loading condition.

It is an advantage to configure the bearing surfaces of the front portion of the wear member including the end surface as angularly offset from the corresponding bearing surface of the support structure in the installed position as the front bearing surfaces experience more wear than other bearing surfaces, i.e. the rear bearing surfaces, during use.

The bearing surfaces of the cavity in the front portion are inclined surfaces relative to the longitudinal axis such that they are angularly offset from the corresponding bearing surfaces of the support structure. The bearing surfaces of the cavity narrow towards the end bearing surface 36. The angle of the bearing surfaces may be approximately 2° to the longitudinal axis. In alternative embodiments, the angle of the inclined surfaces relative to the longitudinal axis may be in the range of 0 to 10°.

The side bearing surfaces 38 extend generally at an angle of 2° relative to the longitudinal axis. In alternative embodiments, the side bearing surfaces 38 may extend at an angle in the range of 0° to 10° relative to the longitudinal axis.

In the illustrated embodiment each rear bearing surface extends at an angle of 2° to the longitudinal axis.

Comparing the fifth embodiment with the other embodiments, there is less stress and loading concentration between the corresponding bearing surfaces and the load is distributed over a greater surface area. Point loading is reduced as well as high stress areas are reduced. Bearing surface area increase allows for reducing premature wear of the components, and for example, extending the wear life of the support structure. The lower wear rate allows for a new wear member to be installed onto the existing support structure to replace a worn wear member. The support structure as disclosed herein allows a longer time between complete replacement of the components which saves maintenances costs and increases productivity by reducing downtime.

In alternative non-illustrated embodiments, the wear assembly may be manufactured to suit a particular digging application. For example, specific bearing surfaces may be predetermined to be angularly offset relative to the corresponding support structure bearing surfaces in the installed position. These are the surfaces that are anticipated to wear the most in the particular digging application, and it may be any combination of corresponding bearing surfaces.

Figure 21C:
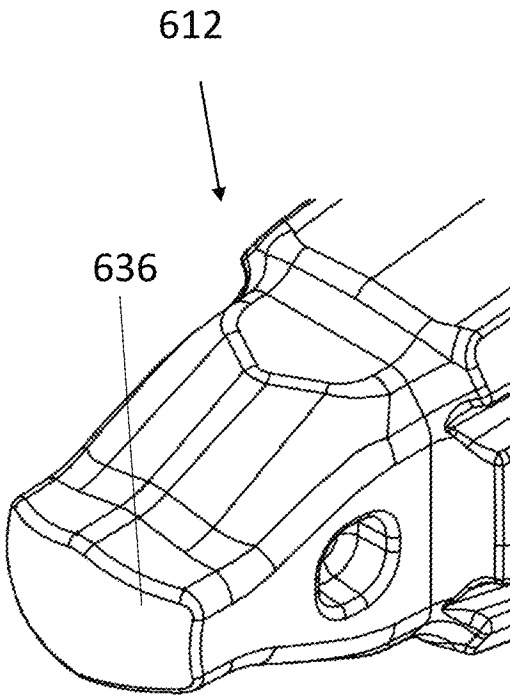
FIGS. 21*a*, 21*b* and 21*c* illustrate three further embodiments of an end surface of a support structure.
Figure 21B:
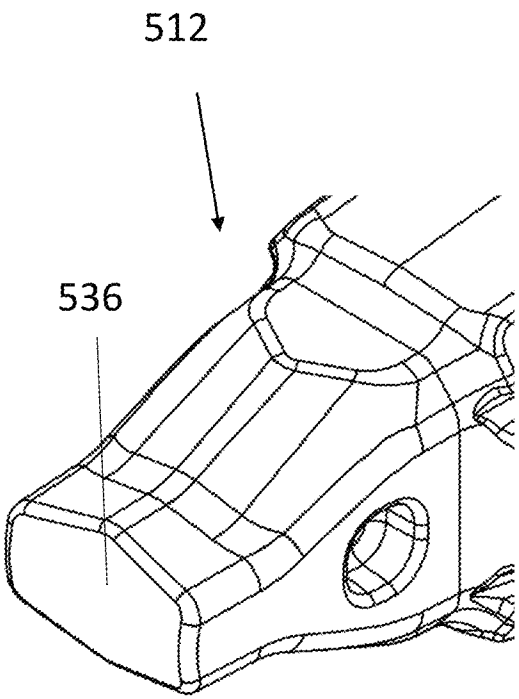
Figure 21A:
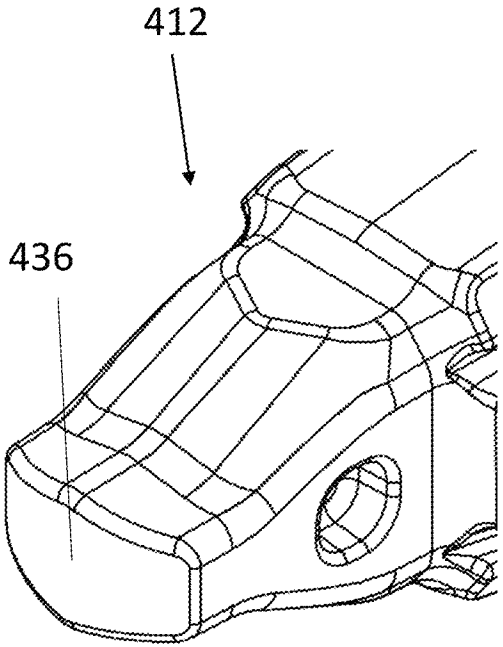

Now referring to FIGS. 21*a*, 21*b* and 21*c* which illustrate three further embodiments of a support structure, 412, 512, 612. Like reference numerals are used for like features. The primary difference between the embodiments of the support structure shown in FIGS. 21*a*, 21*b* and 21*c* and the previous embodiments of the support structure is that the end bearing surface 436, 536, 636 is an arcuate surface all generally extending in the lateral direction.

In FIG. 21*a*, the end bearing surface 436 is curved in the lateral plane (i.e., the y-y direction). In FIG. 21*b*, the end bearing surface 436 is curved in the vertical plane (i.e., the z-z direction). In FIG. 21*c*, the end bearing surface 536 is curved in multiple planes (e.g., the y-y direction and the z-z direction). The arcuate end bearing surface 436, 536, 636 of the support structure 412, 512, 612 (and opposing arcuate end surface of the cavity) allows the wear member to move (e.g., rotate) relative to the support structure 412, 512, 612 (e.g., like a ball and cavity joint). This relative movement reduces wear and/or damage that a flat end surface may experience during the small relative movements between the components under load cycling. Furthermore, the arcuate end surface 436, 536, 636 centres the wear member on the support structure 412, 512, 612, limiting overall wear and/or damage of other components (e.g., other bearing faces), especially in combination with the fifth embodiment of the support structure shown in FIGS. 19*a* to 20*c*.

Variations and modifications may be made to the parts previously described without departing from the spirit or ambit of the disclosure. For example, different size components are disclosed which may be appropriate for different applications of ground engaging tools. In this way, the dimensions and angles disclosed above may vary depending on the size of the components.

Further, various combinations of bearing and non-bearing surfaces are disclosed. In the upper wall and/or the lower wall, the rear portion may include a central bearing surface and inclined non-bearing surfaces extending from the central bearing surfaces, a central bearing surface and inclined bearing surfaces extending from the central bearing surfaces, a central non-bearing surface and inclined bearing surfaces extending from the central non-bearing surfaces. The side surfaces may also be bearing or non-bearing surfaces.

In general, the embodiments of the wear members, the support structures and the wear assemblies disclosed herein allow fits between the surfaces of the cavity of the wear member and the opposing surfaces of the support structure that extend the wear life of the components. Wear is reduced, and high stress areas are reduced. The tolerances between the opposing surfaces are also optimal for components that allow the components to be easily assembled.

Figure 6:
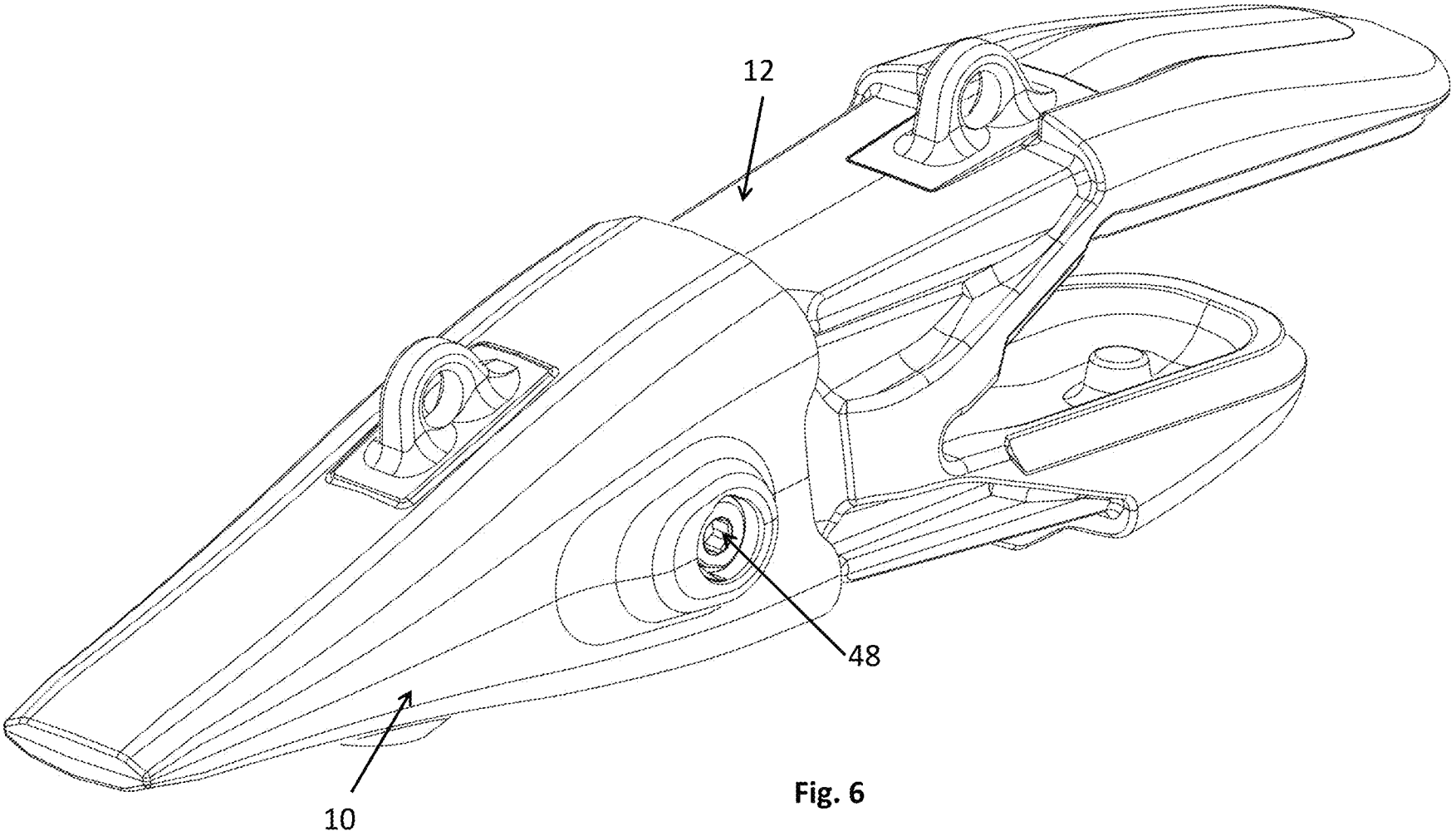
FIG. 6 is a perspective view of an assembled wear assembly.
Figure 7:
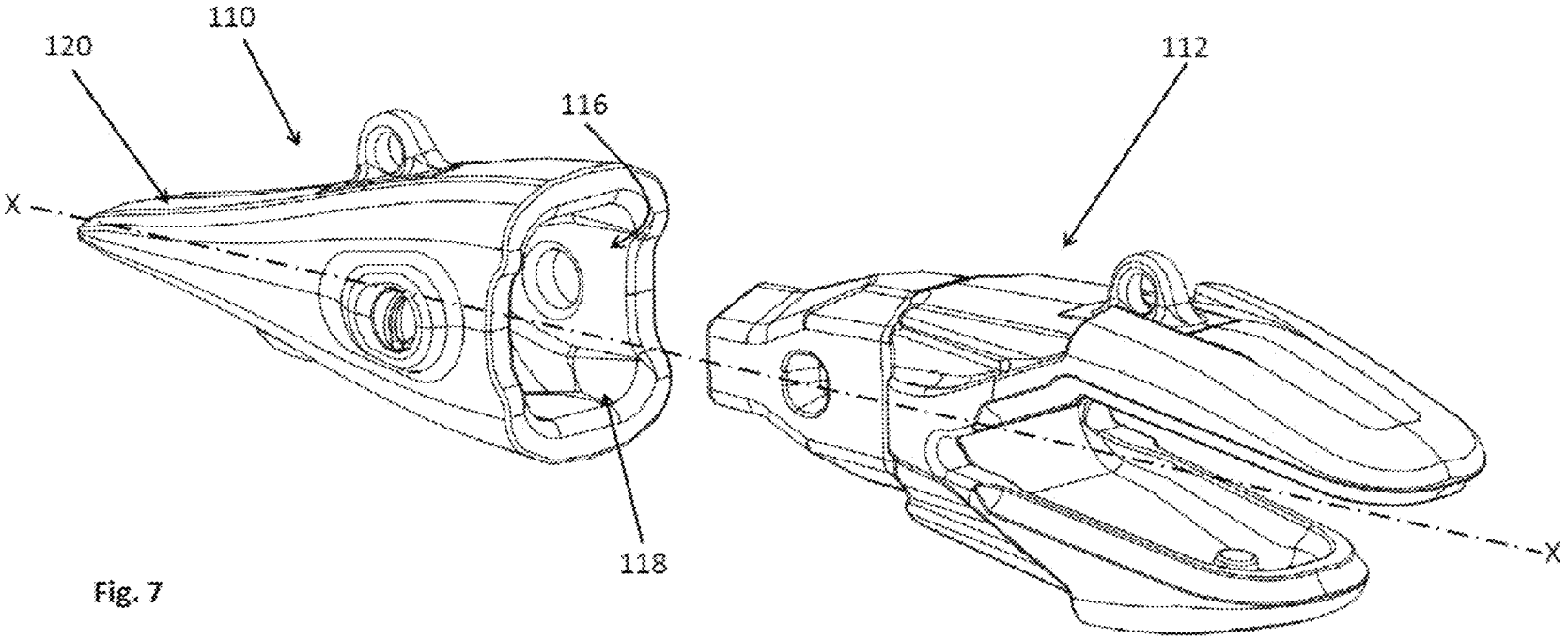
FIG. 7 is an exploded view of a second embodiment of a wear assembly.

When the wear member is mounted to the support structure, it can be secured using a lock. One embodiment of a lock was discussed above in relation to FIGS. 5 and 6. It is appreciated that many types of locks may be used to mount any of the embodiments of wear member and corresponding support structures disclosed herein. Now referring to FIGS. 22 to 39 further embodiments of locks are disclosed.

Figure 22A:
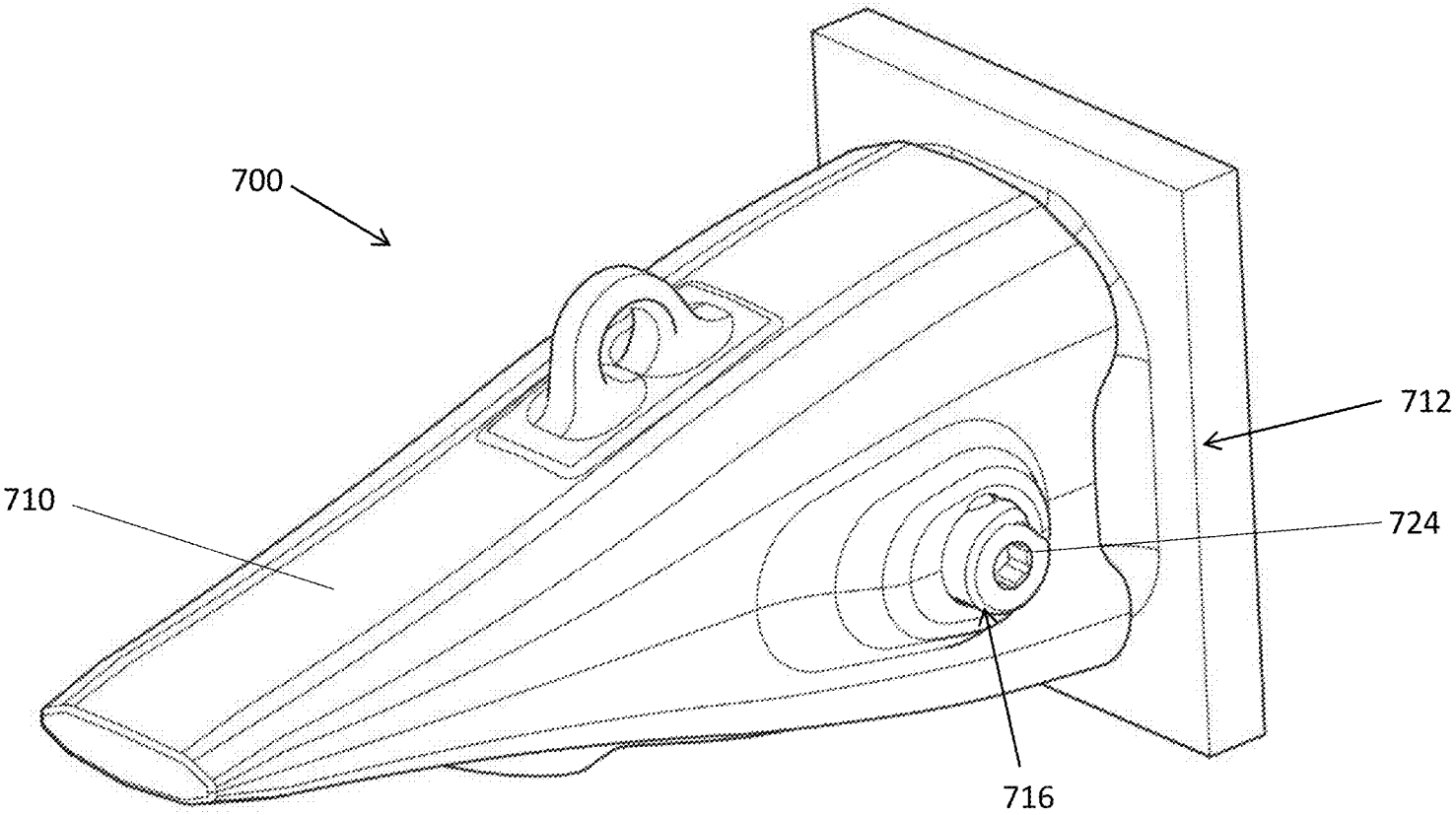
FIGS. 22*a* and 22*b* are perspective views of an embodiment of an excavation wear assembly, where the lock is in the transport position and in an extended position respectively.
Figure 22B:
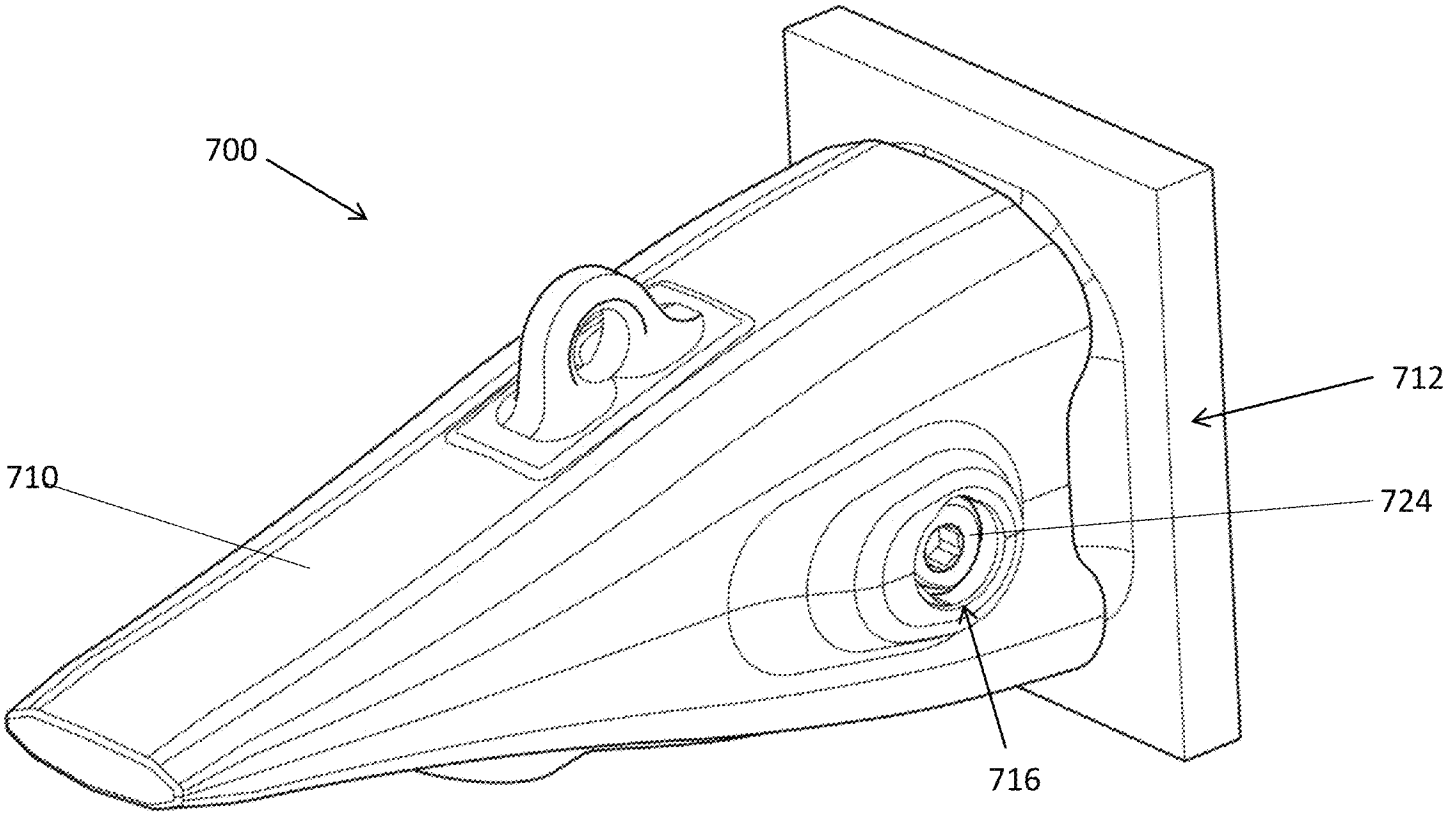
Figure 23:
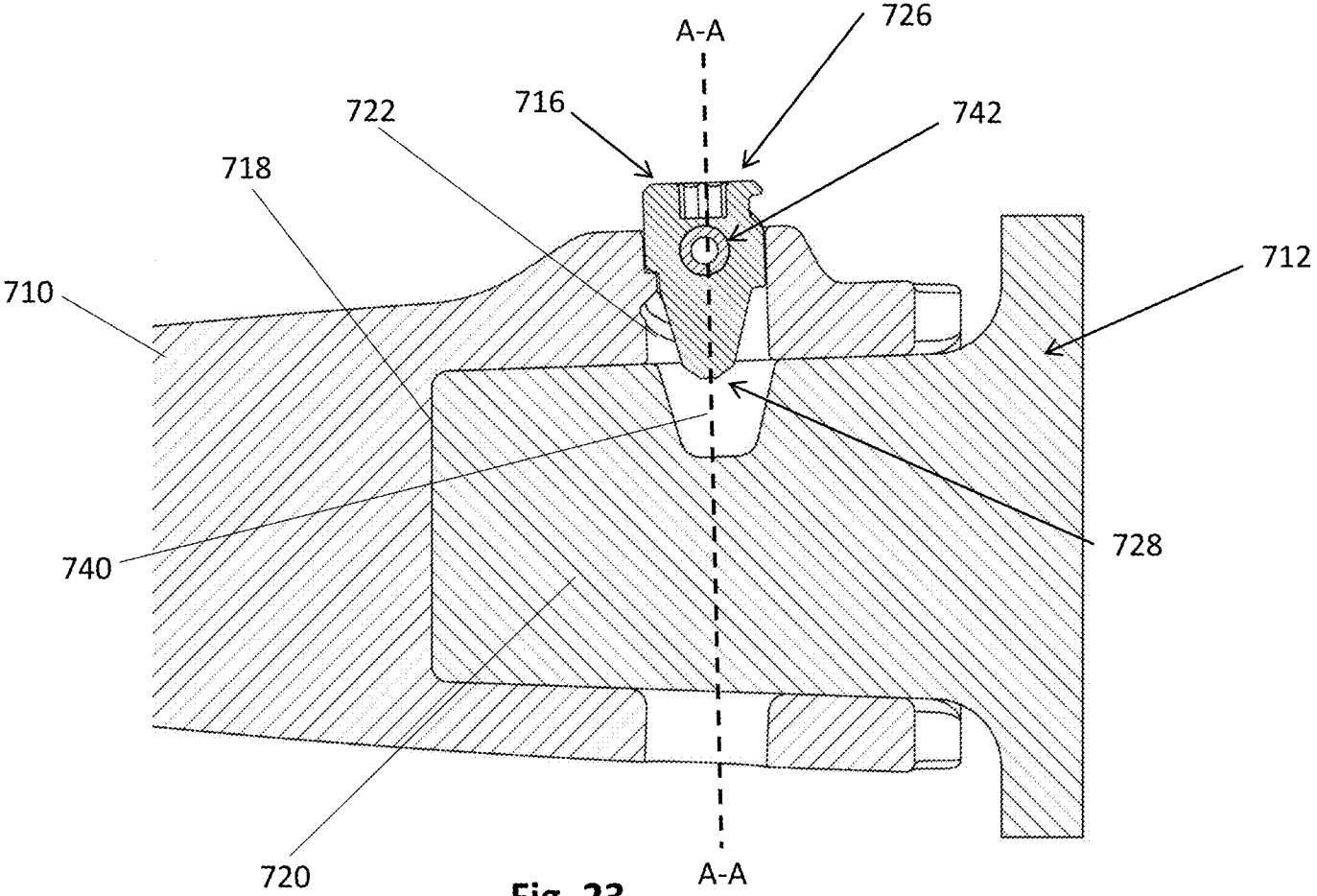
FIG. 23 is a sectional view of the embodiment of the excavation wear assembly of FIG. 22.

Referring to FIGS. 22A, 22B and 23 further embodiments of the wear assembly are shown. The wear assembly 700, comprising a wear member 710 mountable to a support structure 712, and a lock 716. The wear members and support structures disclosed herein may incorporate any of the features described above including relation to the angle, orientation and configuration of the bearing surfaces Referring specifically to FIG. 23, the wear member 710710 has a cavity or socket 718 (best shown in FIG. 23), and the support structure 712 has a nose portion 720. The lock 716 includes a locking pin 724. The locking pin 724 is inserted into a locking hole 722 formed in the wear member 710 and in one form, is disposed in place prior to mounting the wear member 710 to the support structure 712. In this way the wear member may be provided with the lock pre-installed. Various approaches to secure the lock to the wear member are disclosed below. The socket 718 of the wear member 710 is configured to receive the nose portion 720 of the support structure 712 when the wear member 710 and the support structure 712 are brought together as shown in FIG. 23. In use, the support structure 712 is attached to a digging edge or lip of excavation equipment (not shown), and the wear member 710 includes the wear surface and edge which does the digging.

Figure 24:
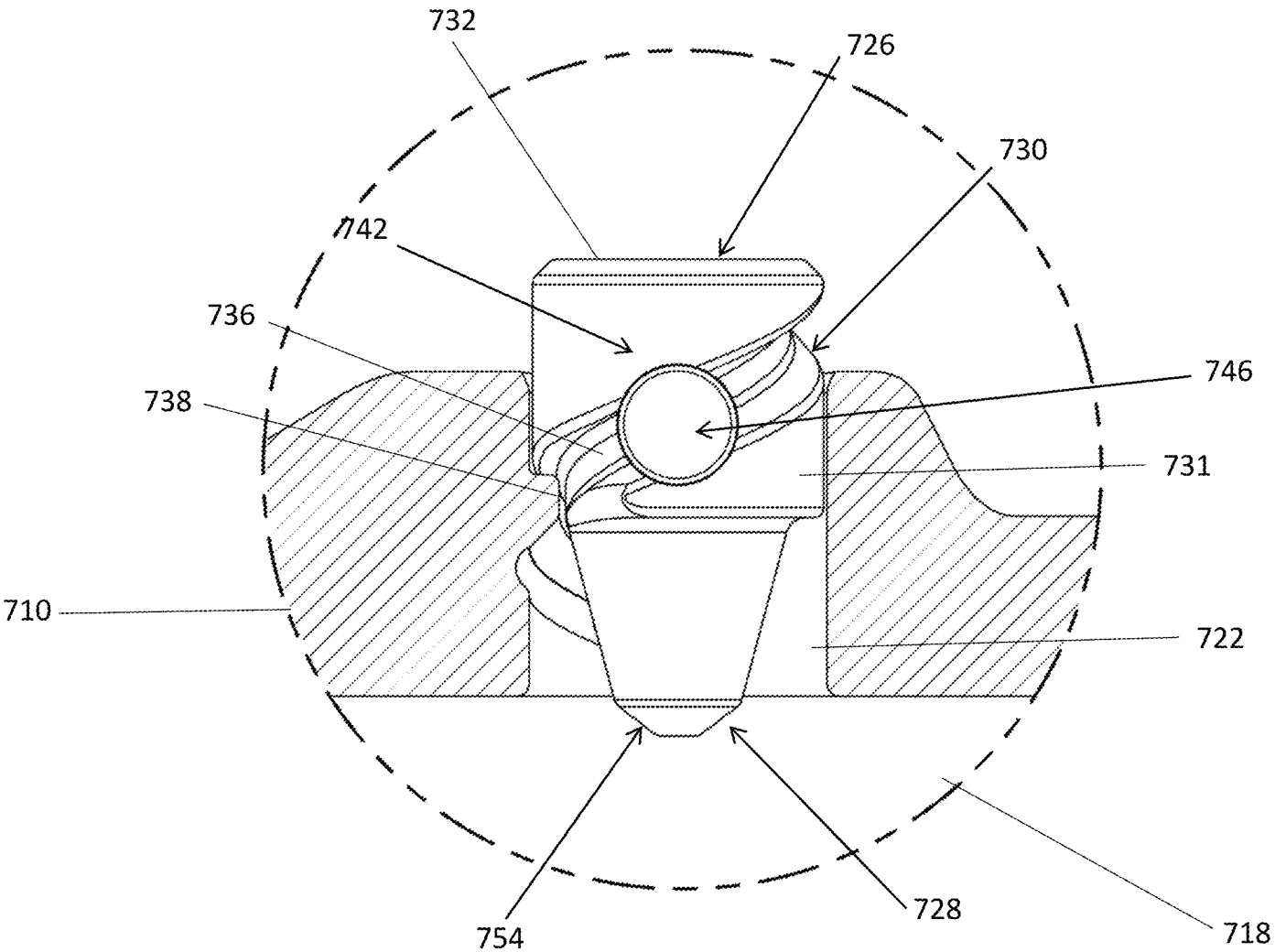
FIG. 24 is a close-up sectional view of FIG. 23 through A-A.
Figure 25B:
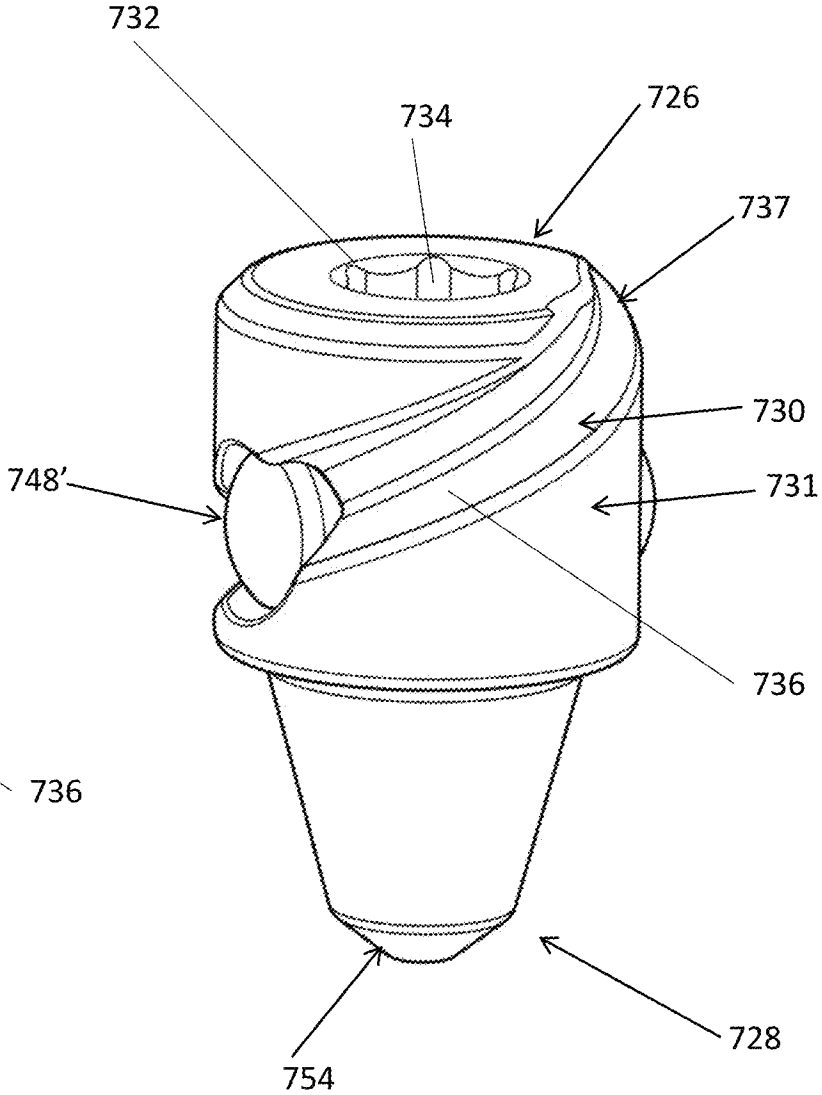
FIGS. 25*a* and 25*b* are front and rear isometric views of an embodiment of a locking assembly for the excavation wear assembly respectively.
Figure 25A:
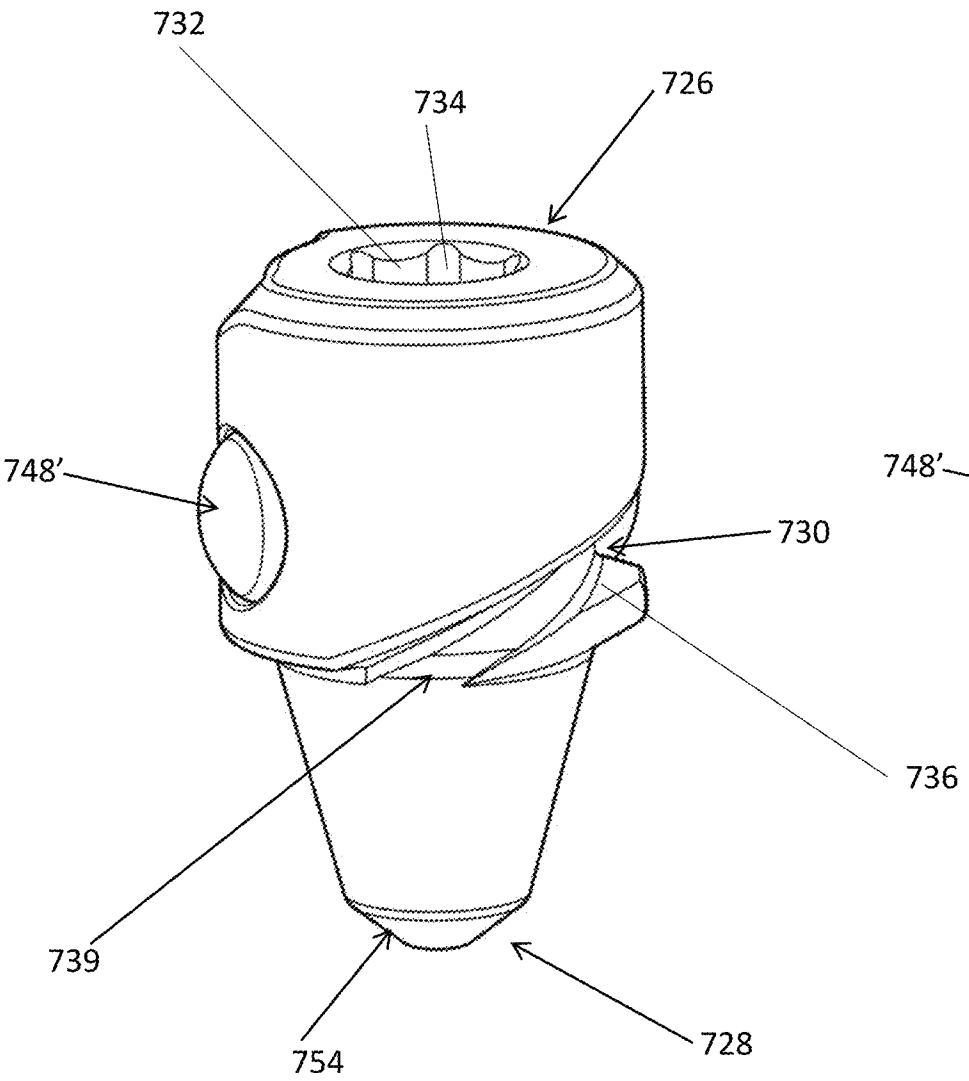

The lock 716 is arranged and designed to secure the wear member 710 to the support structure 712. As best shown in FIG. 24, the locking pin 724 extends along a pin axis and includes a first end 726 and a second end 728 that are spaced apart along the pin axis by a component of an engaging structure 730, which in the illustrated form is formed as a recess on a body portion 731 of the pin 724.

The second end 728 comprises a drive arrangement 732. In the illustrated embodiment of FIGS. 25A and 25B, the drive arrangement 732 in the form of a hexagonal recess 734 is provided in the second end of the locking pin to enable an operator to cause rotation of the locking pin 724 as required. This is carried out by the operator inserting an appropriately shaped tool into the recess 734. The manner in which the locking pin 724 is inserted into the locking hole 722, means that after it has been inserted, the hexagonal recess 734 remains exposed at the end of the locking space. This allows for easy access to the recess 734 for access to the drive arrangement 732 and for removal of the locking pin 724 from the locking hole 722 when required. However, it is to be appreciated that other forms off drive arrangements, including male drives, may be used.

The first end 726 of the pin 724 is configured as a leading end of the pin. As shown in FIG. 24, the leading end 726 comprises a taper which allows it to be extended and retracted more easily through the locking hole 722 if surrounded by fines.

The component of the engaging structure 730 engages with a complementary component of the engaging structure 730 formed on an interior surface of the locking hole and causes axial movement of the pin 724 relative to the wear member 710 on rotation of the pin. As shown in FIGS. 24 and 25, the engaging structure is a helical arrangement, formed as a part or full helix (i.e. it extends at least 360 degrees). The helical arrangement includes a pitch which corresponds to the number of rotations of the pin 724 to establish the desired axial displacement. Varying the pitch of the helical arrangement varies the rate of the axial displacement of the pin for a given rotation as well as the resisting force imparted by the engaging structure 30 to resist axial movement under the application of an axial load being applied to the locking pin 24. The locking hole 722 of the wear member 710 comprises a corresponding helical arrangement as its component of the engaging structure 730 as to engage with that of the pin 724.

The engaging structure 730 forms at least part of a retaining arrangement to inhibit axial movement of the locking pin on the application of axial loading to pin (which prevents inadvertent release of the pin in use). In some forms, this may be achieved by having a relatively flat pitch such that axial loading is resisted solely by the engaging structure. However, in the illustrated form, the pitch of the helical arrangement is quite steep so that axial loading to the pin promotes rotational and therefore axial drive to the pin. In this way, the retaining arrangement further comprises a retainer (in one form comprising a latching arrangement 742 disclosed below) to provide torsional resistance to rotation of the pin such that the combined operation of the helical arrangement and torsional resistance from the retainer inhibit axial movement of the pin under axial loading to the pin. This allows for a more controlled mechanism to resist axial movement (as it is possible to more finely control the torsional resistance) and allows the engaging structure to be directly cast into the wear member (as a more precise thread is not required).

The helical arrangement 736 of the engaging structure 730 extends over the surface of a body portion 731 of the pin between the drive arrangement 732 and the leading end 726, helically relative to the pin axis of the locking pin 724. The helical arrangement of the engaging structure 30 comprises respective recesses or grooves 736 and ribs or ridges 738. The helical groove 736 has both upper 737 and lower 739 openings. In one form, the lower opening 739 is shaped to allow any fines that have collected in the groove 736 to exit uninhibited from the wear assembly 700 when the pin 724 is rotated, for example towards the retracted position. This shaping is provided by a radial reduction of the lower wall that defines the groove. This creates a space (as best shown in FIG. 24) between the pin and the ridge 738 that allows the fines to drop out from the groove.

In the form shown, the ridge 738 on the wear member is continuous but it is appreciated that it could be in spaced sections that trace the helical path. The helical groove 736 extends approximately 360°, i.e. one revolution, from the drive arrangement 732 of the pin towards the leading end 726.

Figure 26:
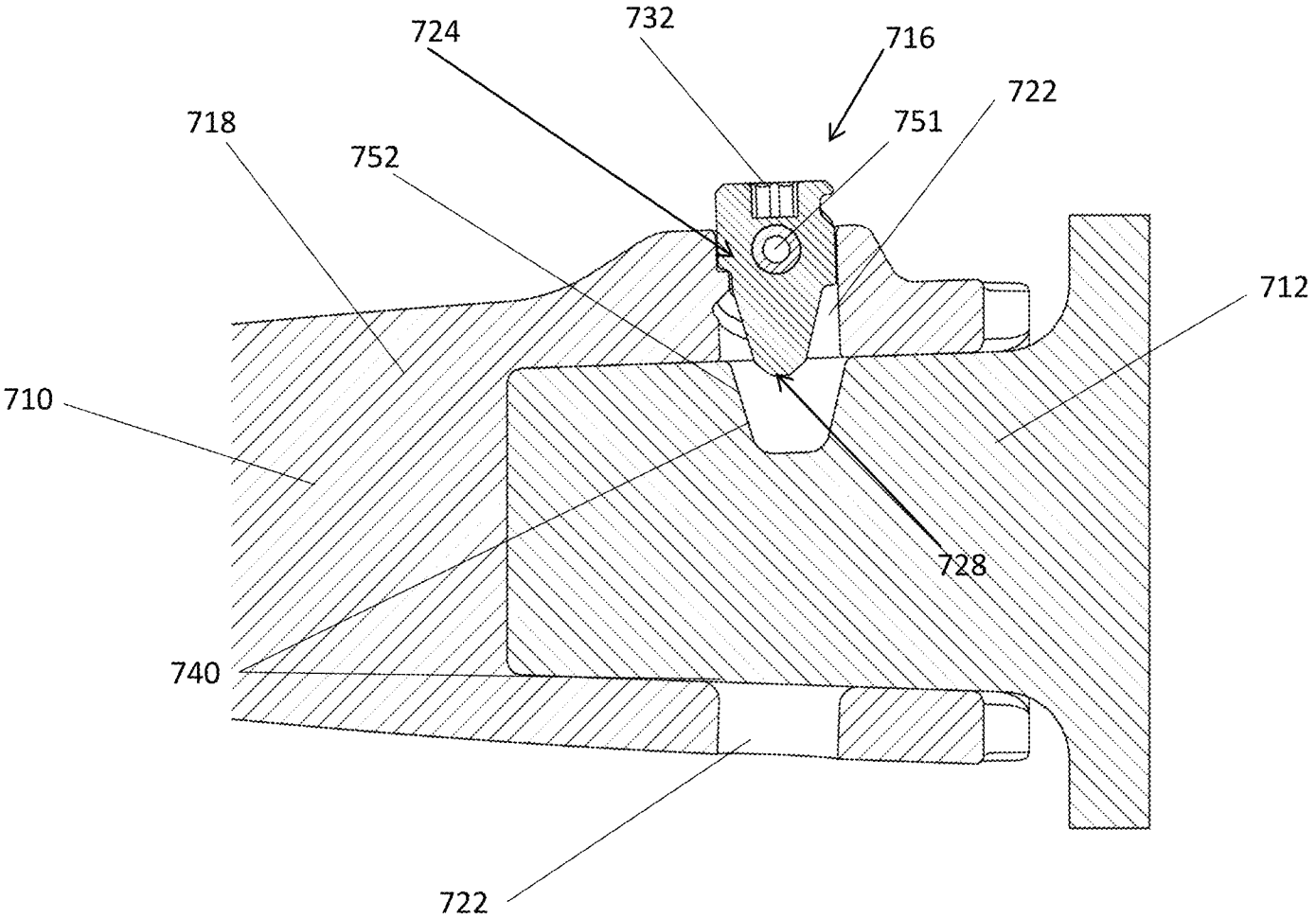
FIG. 26 is a sectional view of the embodiment of the excavation wear assembly of FIG. 1, where the lock is in the transport position.
Figure 27:
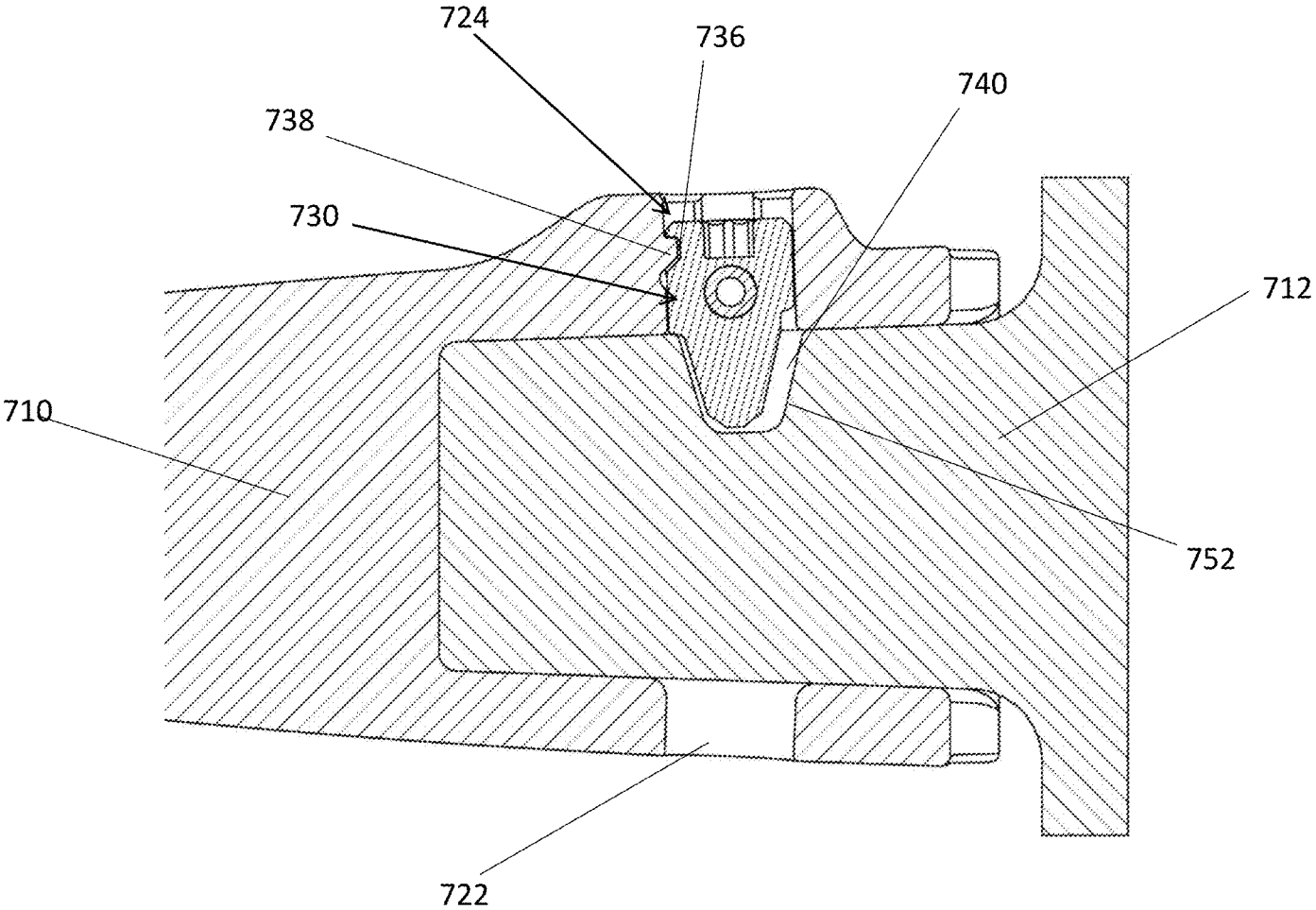
FIG. 27 is a sectional view of the embodiment of the excavation wear assembly of FIG. 22, where the lock is in an extended position.
Figures 28A, 28B:
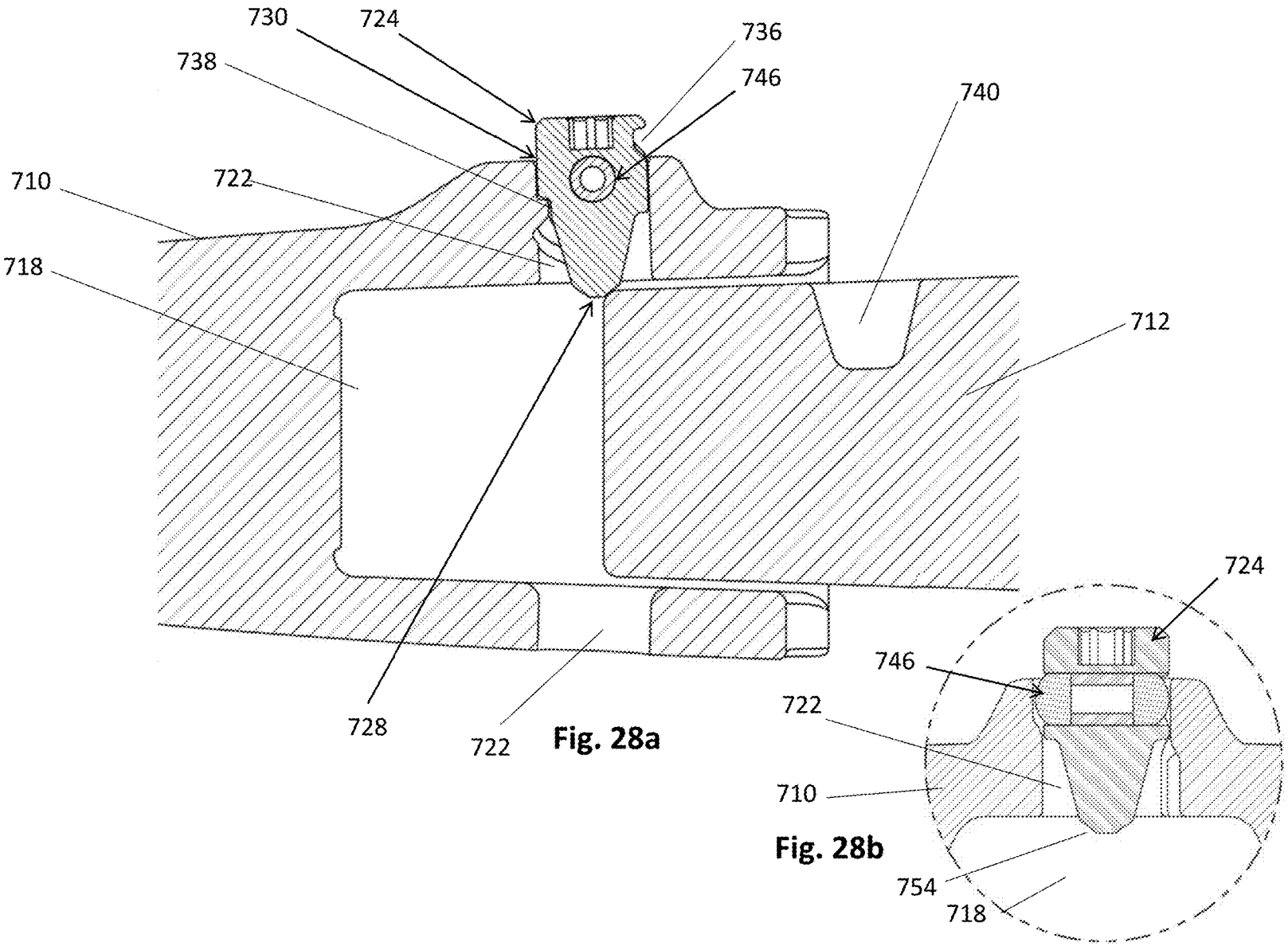
FIGS. 28*a* to 28*j* are a sequence of sectional views of the embodiment of the excavation wear assembly of FIG. 22 showing the installation of the locking pin from a transport position to an extended position.
Figures 28C, 28D:
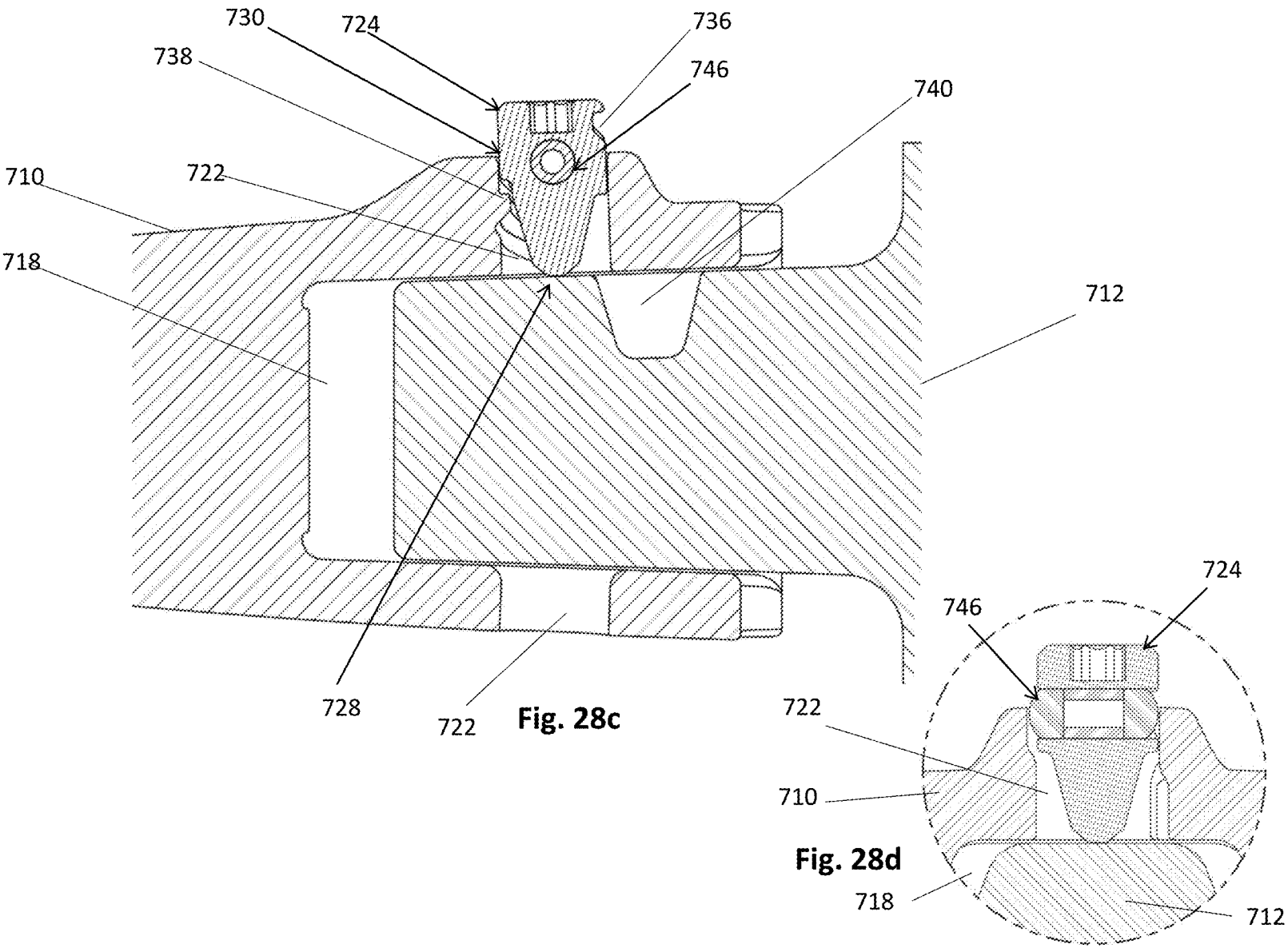
Figures 28E, 28F:
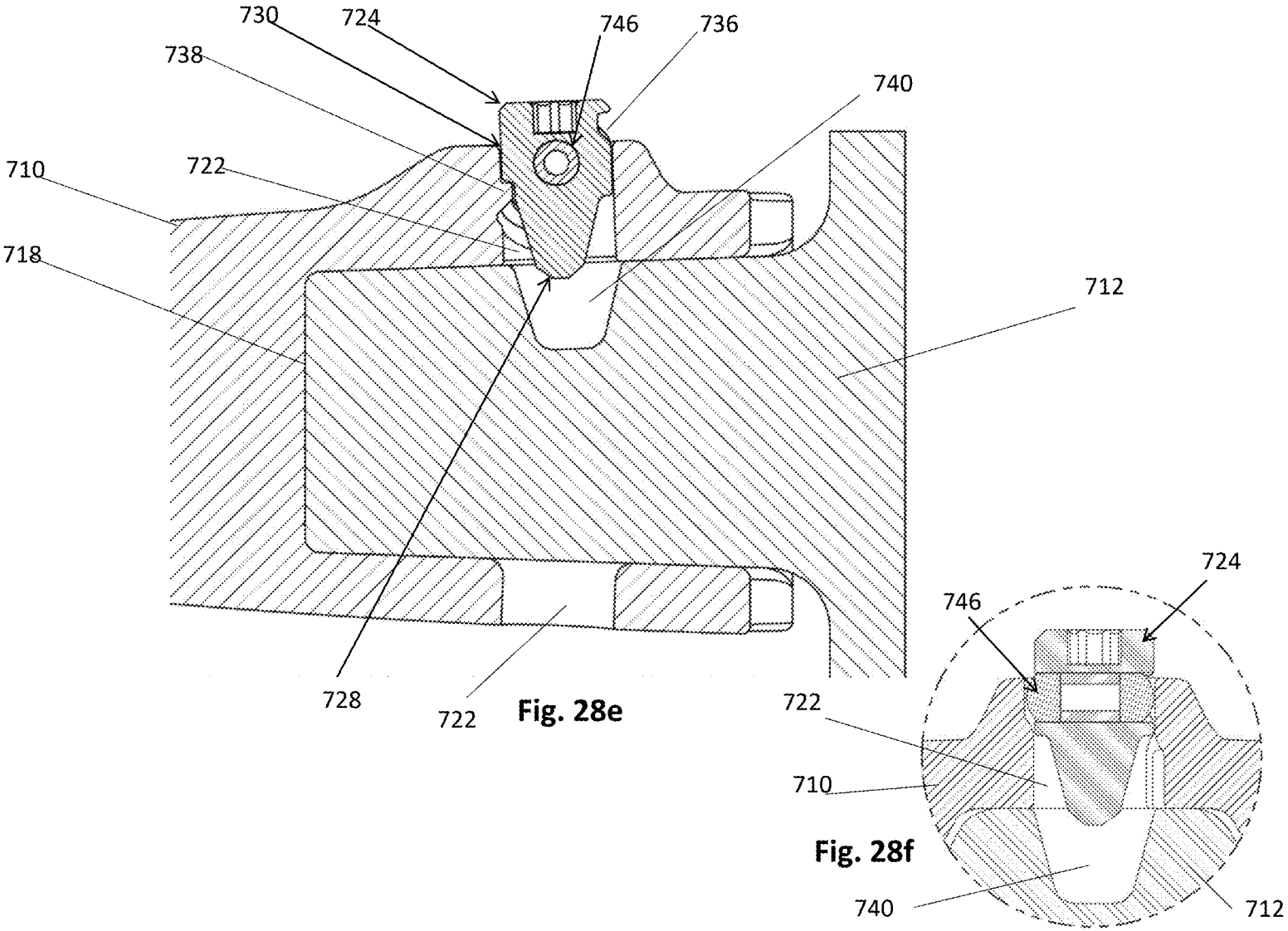
Figure 28G:
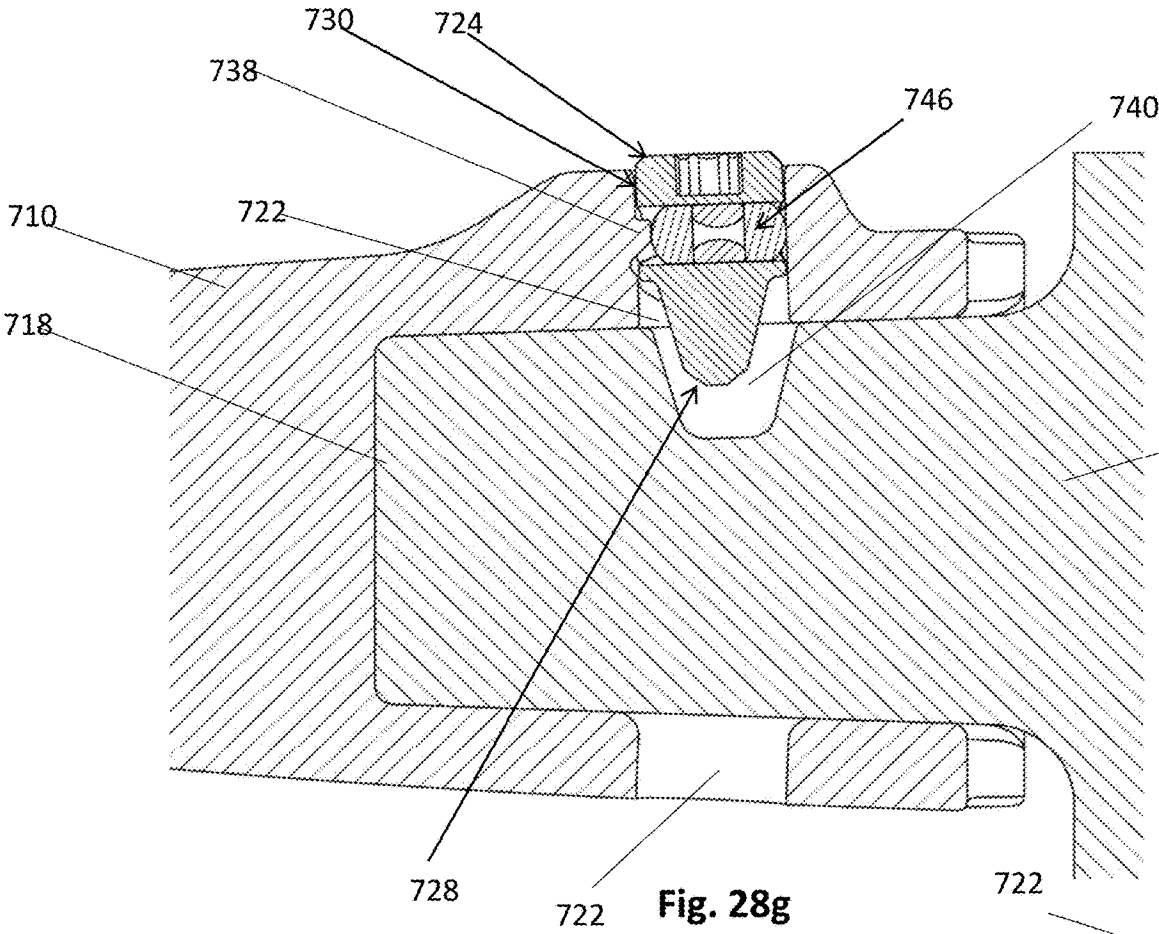
Figure 28H:
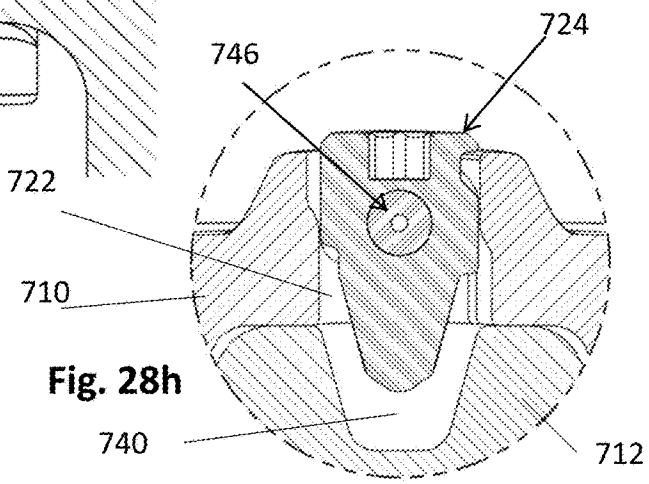
Figures 28I, 28J:
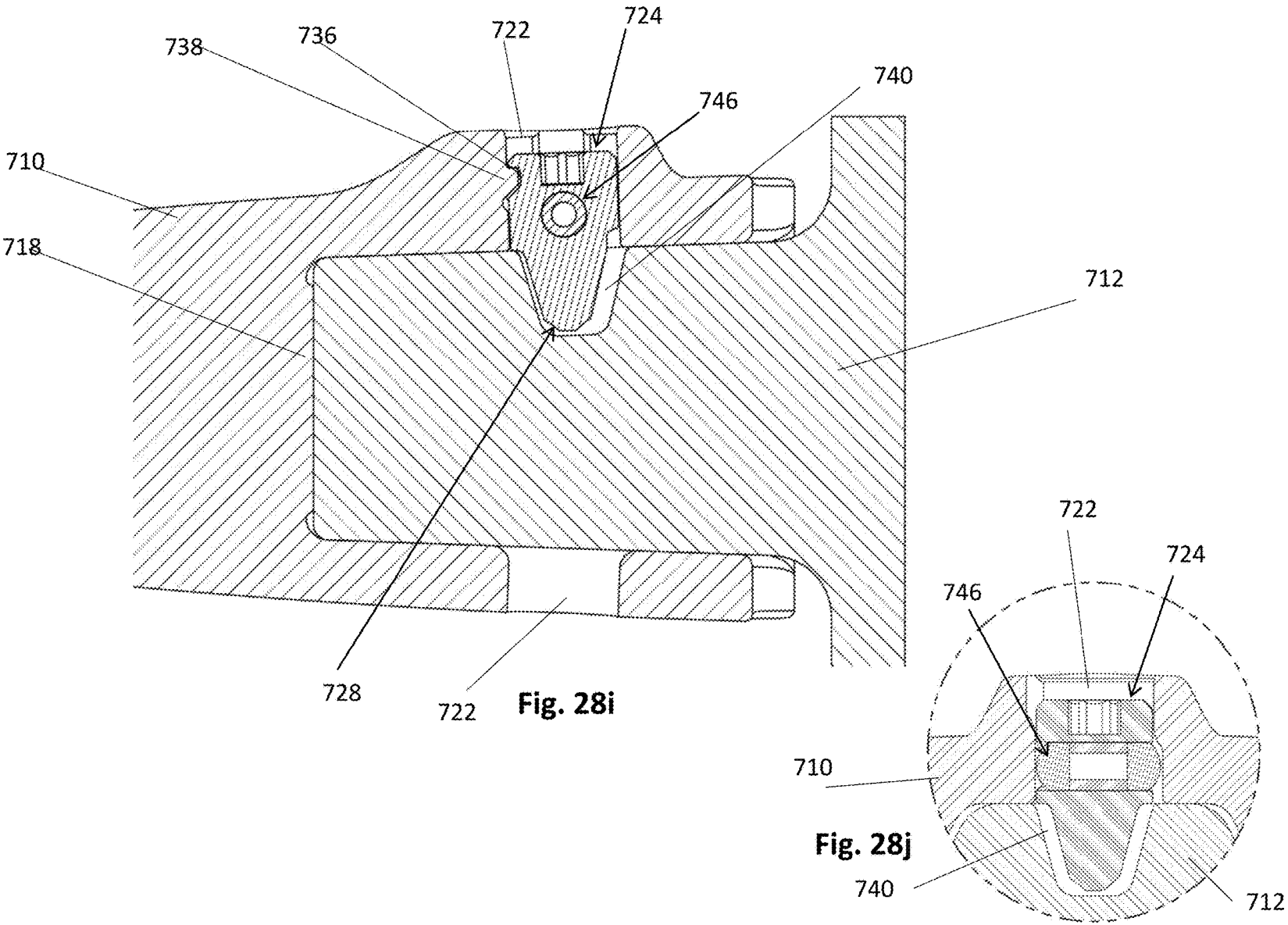
Figure 29A:
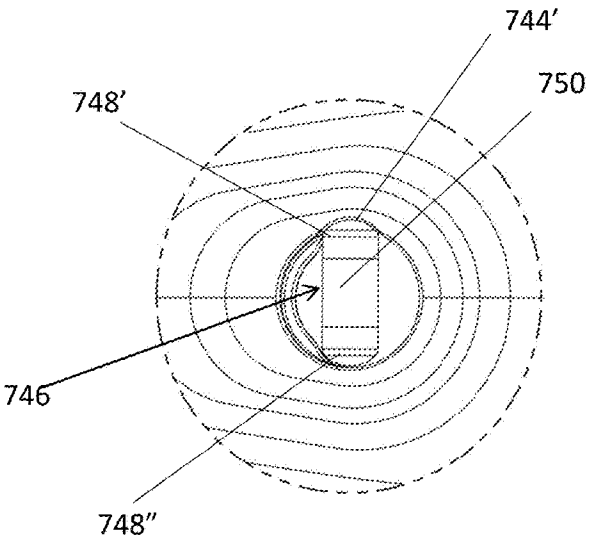
FIGS. 29*a*, 29*b* and 29*c* are plan views detailing the embodiment of the locking assembly for the excavation wear assembly of FIG. 22.
Figure 29B:
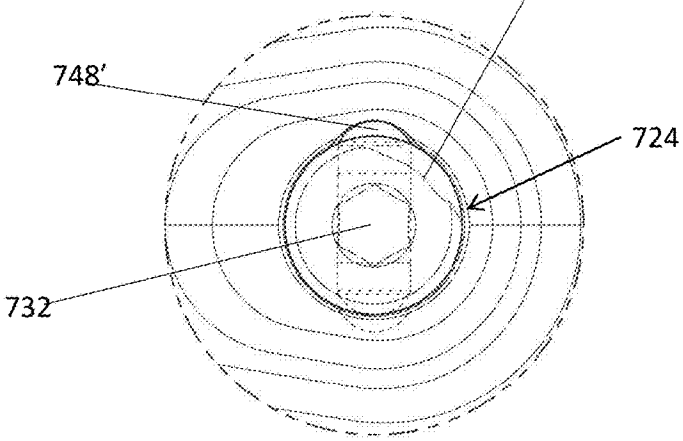
Figure 29C:
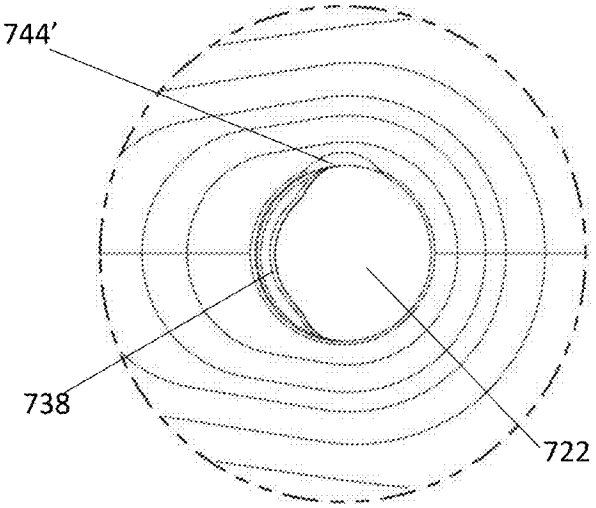
Figure 29D:
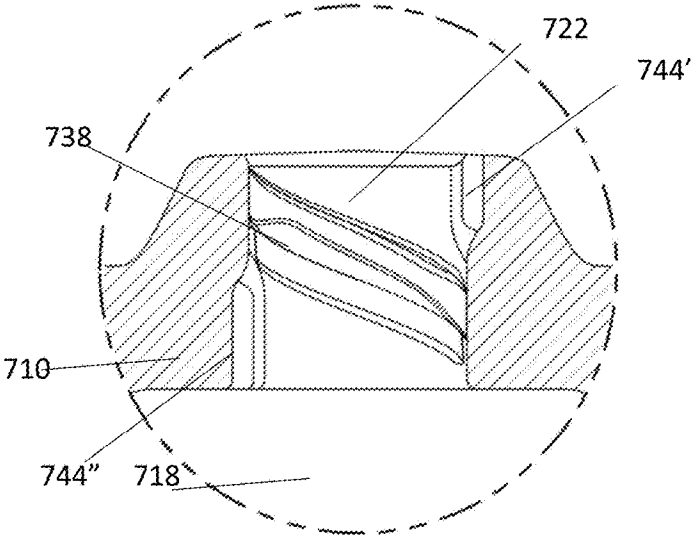
FIG. 29*d* is a side view detailing the embodiment of the locking assembly for the excavation wear assembly of FIG. 22.

Referring now to FIGS. 26 and 27 and the sequence of FIGS. 28*a* to 28*j*. In some forms, the locking pin 724 is axially movable along the helical arrangement 730 between a retracted position (best shown in FIGS. 28*c* and 28*d*) and an extended position (FIG. 27). In the retracted position the leading end 726 does not extend into the socket 718 of the wear member 710, i.e. beyond an open end of the locking space 722. In this position, the leading end of the locking pin does not impede the passage of a support structure therethrough.

In the extended position, the leading end of the pin 724 is arranged to extend into the socket 718 when mounted to a support structure. The locking pin extends into a recess 740 of the support structure 712 so as to secure the wear member 710 to the support structure 712.

The helical arrangement 730 may define a start and end locating position for the pin 724. In some embodiments, the start locating position defines the retracted position, whilst the end locating position defines the extended position.

In some forms, the pin may be positioned in a transport position. In that arrangement, the wear member is arranged to be supplied onsite with the lock preinstalled and disposed in the transport position. Whilst this transport position may correspond to the retracted position of the lock or the extended (or locking) position, it may also be a position separate from either of those position as shown in FIG. 26. In the transport position of FIG. 26, the leading end 726 partially extends from the locking hole 722 to encroach into the socket 718. In this discrete position, the locking pin 724 is arranged to prevent the wear member being installed on the support structure. The leading end is arranged so as to interfere with the support structure nose 720 when the wear member 710 is assembled onto the support structure 712. The interference created is best illustrated in the sequence of FIGS. 28*a* to 28*j*.

As shown in the sequence illustrated in FIGS. 28*a* to 28*j*, in-use, when attempting to install the wear member 710 onto a support structure 712, the leading end 726 of the locking pin would encroach into the wear member socket 718 when in its transport position. The interference of the pin prevents the wear member being installed onto the support structure when the pin is in the transport position. In other words, as the nose 720 of the support structure moves into the wear member socket, the support structure will contact the leading end of the pin. In order to allow the wear member to be fully mounted onto the support structure, the pin must be 'backed-off', i.e. moved outwards from the locking hole and away from its transport position and into the retracted position. Once the pin is moved into the retracted position so as to no longer encroach into the wear member socket, the wear member can be allowed to be installed onto the support structure.

This movement may be done manually or may occur as a consequence of fitting the wear member onto the support structure as shown in the sequence of FIGS. 28*a* to 28*j*. In particular, the leading end 728 of the pin also comprises a chamfered tip 54. The chamfered tip, when in-use and in one form of the transport position, extends into the socket 718 of the wear member by e.g. 4 mm. The chamfered tip encroaches the passage created by the socket and therefore is designed to interfere, i.e. contact with the support structure 714 when inserted therein. Because of the shape of the tip 754, it promotes a cam action on contact with the support structure to promote the desired uplift movement under the application of a transverse force applied to that surface. This causes the pin to be lifted clear and allows the support structure 714 to pass until the pin and the recess 740 in the support structure move into alignment where after the pin is able to drop (or otherwise) into the recess. From this position, the pin can then be driven into an extended position with the support structure.

Referring now to FIGS. 23 to 25, the locking assembly 716 further includes a latching arrangement 742. The latching arrangement 742 retains the pin 724 in a predetermined axial position primarily by inhibiting rotation of the pin when the helical engaging structures are engaged. The latching arrangement 742 includes at least one keeper 744, i.e. a locking notch (best shown in FIGS. 29*a* to 29*d*), and a latch 746 including one or more detents 748, which are respectively located on the wear member 710 and locking pin 224. In some embodiments, without the latching arrangement 242, the pin 222 can be retained loosely within the helical engaging structures such that the pin 222 can rotate free.

In some forms, such as illustrated, the latching arrangement is also adapted to provide the function of the retainer of the retaining arrangement to provide the torsional resistance to rotation of the locking pin.

Figure 30:
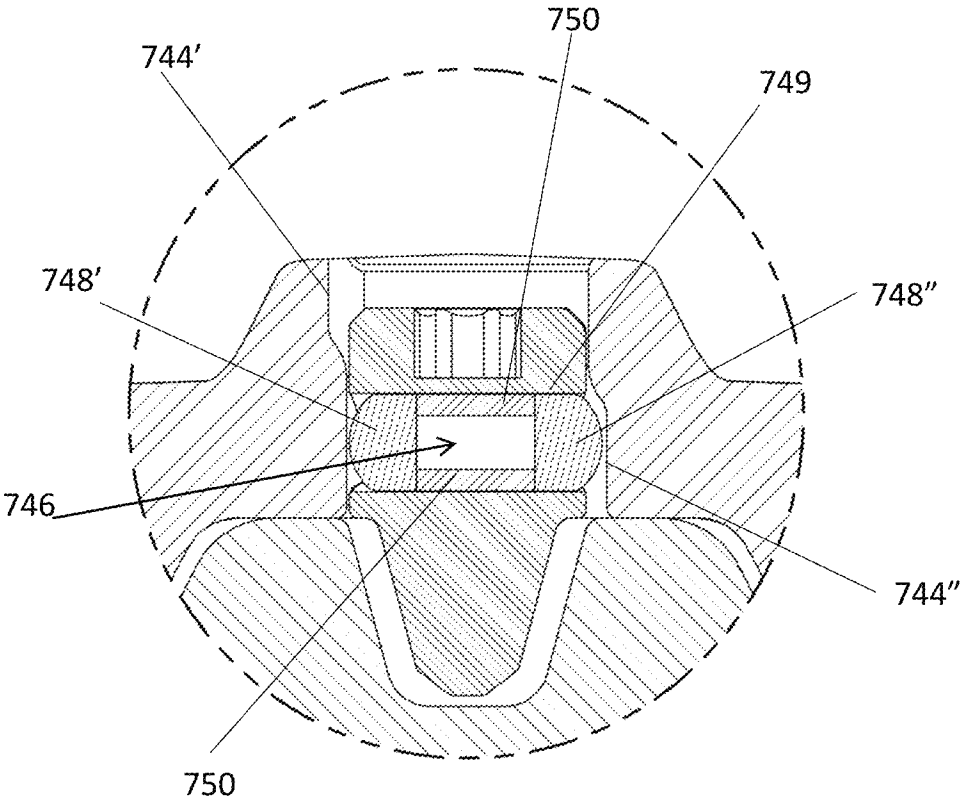
FIG. 30 is a detailed sectional view of the embodiment of a locking assembly for the excavation wear assembly of FIG. 22.

As best shown in the embodiment of FIG. 30, for each lock assembly 716, a latching arrangement 742 may be provided having a latch 746 and two notches 744',744". In one form, a first of the two keepers is arranged to retain the pin in the transport position shown in FIG. 26 and a second of the two keepers is arranged to retain the pin in the extended position shown in FIG. 30. If required, further keepers may be provided to retain the pin in other positions, such as the retracted position, or one or more further intermediate position between the retracted and extended position.

In the illustrated embodiment of FIG. 30, the latch 746 includes two detents (designated 748' and 748"), with one detent 748" being engageable with the keeper 744" in a latched position to retain the pin in the extended position and the other detent 748' being engagable with the other keeper 748' in a latched position to retain the pin in a transport position. The keepers 744',744" are formed at opposing ends of the locking hole 722. In the form shown in FIG. 30, the latch 746 includes a biasing member 750 to allow the respective detents 748',748" to be depressible to locate in the respective keepers 744',744". As shown in the illustrated embodiment of FIGS. 29*a*, 29*b*, 29*c* and 29*d*, the keeper 744' includes a recess (in view) and the detent of latch 746 locates in the recess to retain the pin 724 in the predetermined axial position. The detent of the latch is movable against the biasing member to be able to ride past the keeper and move out from the keeper.

In use, the engaging structure 730 causes the pin 724 to rotate as it moves between the retracted, transport and extended position. The keepers 744',744" arranged at opposing ends of the locking hole 722 are able to retain the pin in either of the predetermined transport or extended positions. As best shown in FIGS. 29 and 30, the latch 746 includes the detents 748' and 748" at opposites ends and formed from rigid members (forming the detents), and a resilient portion 750 (forming the biasing member) located between the detents. The latch 746 is located within a hole 749, i.e. a through-hole passing through the body portion 731 of the pin 724. In the embodiments shown in FIGS. 11 to 34, the latch 746 is generally cylindrical and the rigid detents 748 are in generally hemispherical that are shaped to locate in the recessed end of the keepers.

Figure 35B:
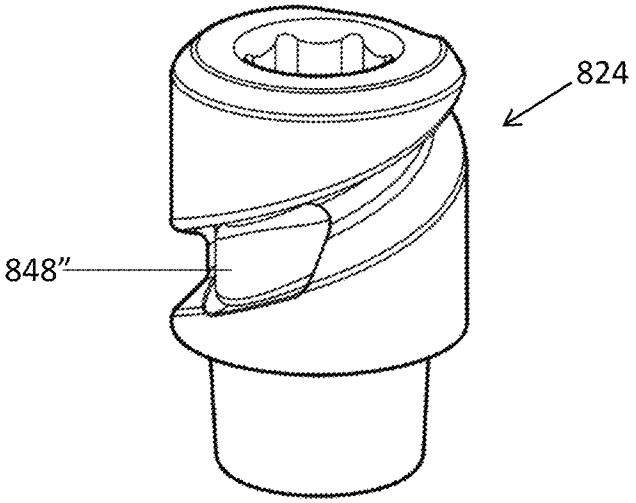
FIGS. 35*a*, 35*b* and 35*c* are isometric views of an embodiment of a locking assembly for an excavation wear assembly.
Figure 35C:
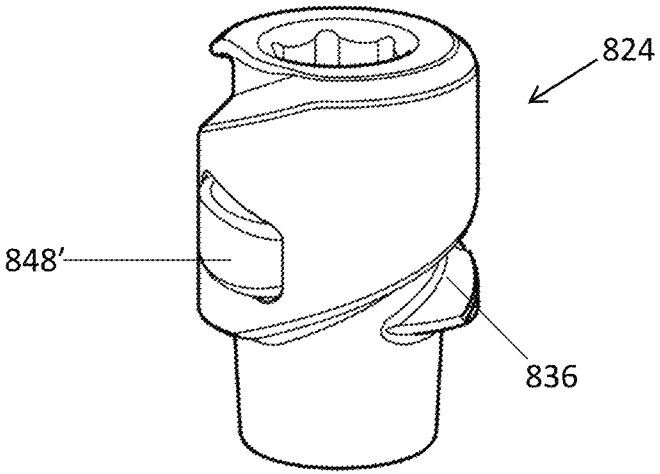
Figure 35A:
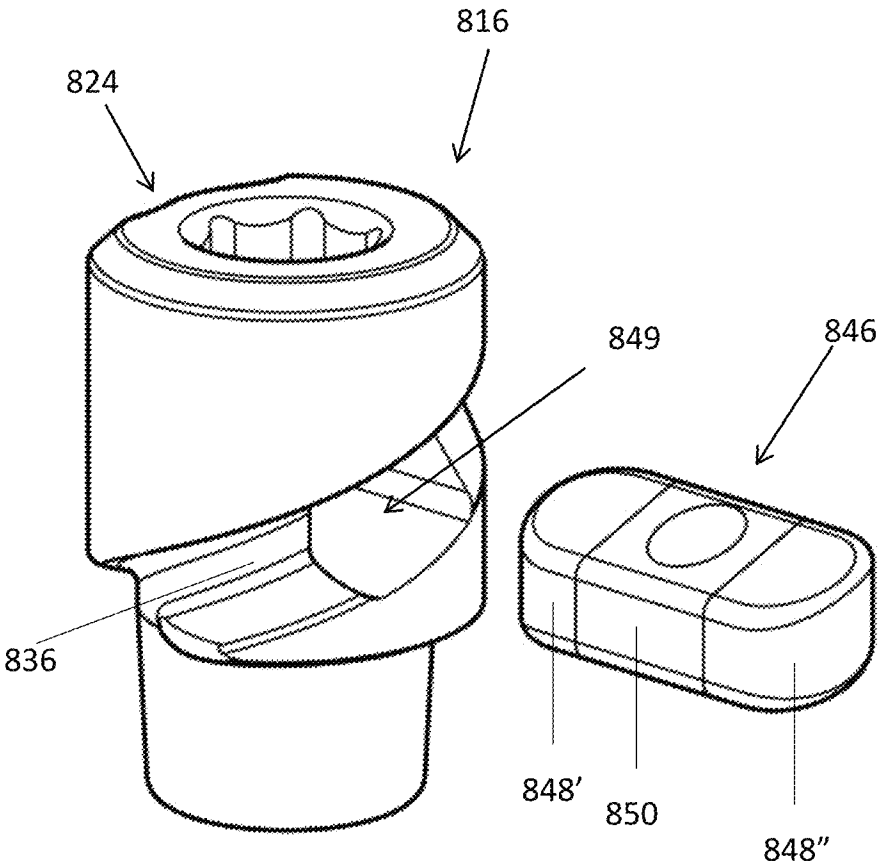

A variation of the latch is shown in FIGS. 35*a* to 35*c*. The locking assembly 816 shares many of the features of the earlier embodiments and for convenience, the same reference numerals are used for the same features of earlier embodiments but with the prefix "8" rather than "7". In the variation of FIGS. 35*a* to 35*c*, the latch 846 is more cuboid that cylindrical having an obround profile. The rigid detents 848 have a curved outer surface to facilitate location into the keepers. The hole 849 in the pin 724 and arranged to receive the latch 846 is of a complementary shape to receive the more cuboid latch 846. In other respect, the arrangement of FIGS. 35*a* to 35*c* functions in the same way as the earlier embodiments.

Turning back to FIG. 30, The rigid detents 748', 748" project radially from the hole 749 of the pin such that the hemispherical detents extend from opposing sides of the pin 724 and into the corresponding component 738 of the engaging structure 730 of the locking hole 722. In some forms one, or both, of the opposing detents can project from the groove 736 of the helically shaped engaging structure 730 in the pin 724.

The rigid detents 748' 748" of the latch engage with the locking hole 722 such that resilient portion 750 compresses. The resilient portion 750 can comprise concentric layers of elastomeric material positioned in the hole between the rigid detents 748',748". The resilient portion 750 can comprise a hollow core 751. The resilient portion 750 compresses upon engagement of the pin 724 in the locking hole 722. The locking hole 722 does not allow for the resilient portion 750 to expand outwardly when compressed. Instead, the loading induced on the rigid detents 748',748" are able to compress the resilient portion 750 whereby it resiliently expands into the empty space of the hollow core 751.

In a variation, not shown, the through hole 749 in the pin 724 comprises a void that defines a hole or groove along at least one wall surface of the hole 722. In use, the void locates adjacent the resilient portion 750, whereby when the resilient portion 750 is compressed by the rigid detents 748',748" moving inwardly towards each other, the resilient portion 750 is able to expand into the void.

Alternatively, in some variations, the resilient portion may be replaced by any resilient material, such as a spring, also compressible within the hole, or a combination of a spring and compressible material (as discussed below with reference to FIG. 37*l*).

The rigid detents 748',748" are biased by the resilient portion so as to extend into the path of the locking hole 722. In operation, as the helical groove of the pin 724 rotates through the helical ridge 738 of the locking hole 722, the rigid portions of the latch mechanism are compressed against the bias of the resilient portions to apply a radial pressure into the locking hole 722 of the wear member 710 such that the pin 724 is resistant to movement through the locking hole. Consequently, the resistance to movement of the pin can require a corresponding torque applied to the drive arrangement 732 in order to rotate the pin 724 between the extended and transport positions.

Advantageously, the radial pressure applied to the locking hole can hold the pin within the locking hole when the helical ridge and groove of the engaging structure are not engaged. This can allow the wear member to be positioned in an inverted orientation without the pin 724 falling from the locking hole because of gravity.

When one of the rigid detents 748',748" of the latch mechanism pass over one of the keepers 744', 744", the pin 724 moves into a latched position. In the latched position, the latch 746 may move into an offset position, i.e. is not centred about the pin axis. As shown in FIG. 30, in-use, the offset position is achieved by having one of the opposing detents 748',748" of the pin 724 engaged with one of the keepers 744' or 744". In this position, the latch member retains the pin in either of the keepers 744',744" in the respective transport or extended positions. Even with this offset position, the resilient member may still be partially compressed with pressure being applied on the other detent of the latch to the one that is received in the keeper.

In one form, one or both of the keepers 744', 744" may each include opposing notches so that both detents 748',748" are received in notches of that keeper. In another form, the respective keepers only include a single notch. The pin may also be arranged to rotate through less than 360 degrees and the notches of the respective keepers are offset radially from each other around the pin axis so that one detent 748' engages the notch of one keeper 744' in the transport position and the other detent 748" engages the notch of the other keeper 48" in the extended position.

In operation, rotating the pin 724 so as to move the latch member 746 away from engagement with the keeper 744' or 744" disengages the rigid detent 748',748" from the keeper. Disengagement from the keeper moves the rigid detent against its bias as it travels away from the keeper and along the groove of the helical ridge of the locking hole.

FIGS. 26 and 27 illustrate the excavation wear assembly 700 including the locking assembly 716 in respective transport and extended positions. In operation, the locking assembly 716 is inserted, i.e. threaded into the locking hole 722 of the wear member 710 prior to the wear member 710 being retained on the support structure 712.

FIG. 26 illustrates the wear member 710 received on the support structure 714 including the locking assembly 16 in the transport position. The wear member 710 and the support structure 712 extend along a longitudinal assembly axis. The lock 716 is retained in a lateral position in the locking hole 722 with respect to the assembly axis of the wear member 710 and the support structure 712.

The recess 740 in the support structure 712 extends into the support structure and is shaped to receive the corresponding leading end 726 of the locking pin 724. In operation, when the wear member is mounted to the support structure 714, the recess 740 is aligned with the locking hole 722 of the wear member. The tool (not shown) is able to access the drive arrangement 732 of the locking pin 724 to move the locking pin 724 from the transport to the extended position and vice versa.

FIG. 27 illustrates the locking pin 724 in the extended position. In the extended position, the locking pin is able to engage a wall 752 that defines the recess 740 to retain the wear member 710 on the support structure 712. The leading end 726 of the pin includes a bearing surface which engages the wall 752 of the recess 740.

As best shown in FIG. 26, the leading end 728 comprises a taper which allow it to be retracted more easily if surrounded by fines. When the pin 724 is moved from a retracted position to a transport position, or when the pin is rotated from the transport position into the extended position, the taper on the end of the pin 724 in cooperation with the angle of the wall 752 of the recess 740 are able to pull the wear member 710 onto the support structure 712 such that the locking hole 722 and the recess 740 are aligned.

Figure 31A:
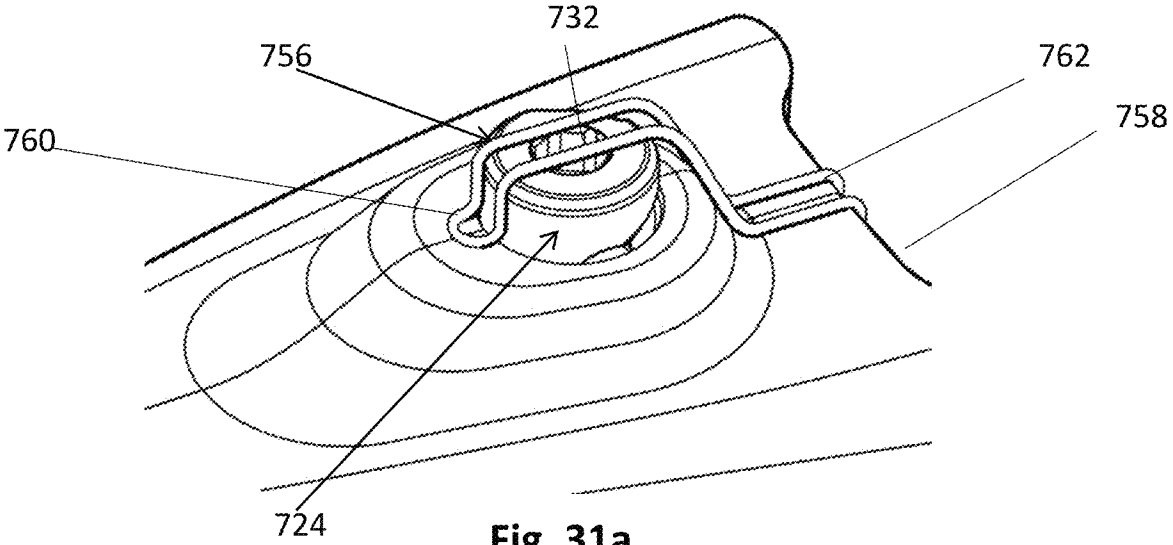
FIGS. 31*a* and 31*b* are isometric views of an embodiment of a locking assembly for an excavation wear assembly.
Figure 31B:
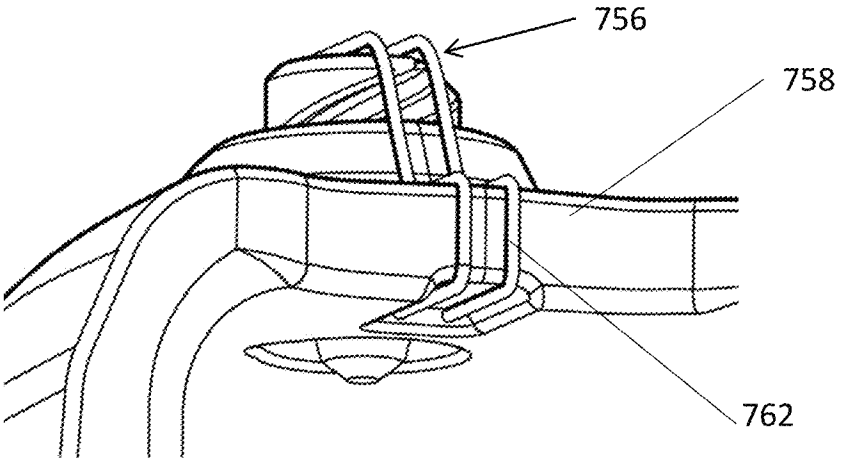

Referring now to FIGS. 31*a* and 31*b*. In some forms the locking assembly further comprises a holder in the form of a spring clip 756 for retaining the locking pin 724 within the locking hole 722. In some arrangement, when the pin 724 is in the transport or retracted positions, it is not retained in the locking hole 722 by the latch arrangement (for example by one of the detents 748' captured in a closed notch of the keeper 744'). Rather, in this arrangement the pin 724 may be retained by a holder in the form of spring clip 756. The spring clip is arranged to pass across an external opening of the locking hole. In the form shown in FIGS. 31*a* and 31*b*, the spring clip 756 is shaped to nest around the drive arrangement 732 of the pin 724 when the pin is in the transport or retracted position. The spring clip acts to retain the pin within the locking hole 722 when in a retracted position and the helical engaging structures of the pin and wear member are not engaged. Additionally, the spring clip is resilient so as to bias the pin into the locking hole and towards engagement with the support structure 714.

The spring clip can be releasably mounted about an edge 758 of the opening of the socket 718 of the wear member. In the form shown in FIG. 31*a*, the spring clip 756 is configured as a cantilever having a free end 760 for engaging with the drive arrangement 732 of the pin 724 and a fixed end 762 wrapped around the edge 758 of the wear member 710. The free end in able to deflect about the edge 758 of the wear member so as to allow the pin 724 to displace out from the locking hole 722 and away from the socket 718 when the engaging structure 730 is not engaged. Further, the cantilevered configuration allows the spring clip 756 to apply a force to the drive arrangement 732 of the pin 724 so as to retain the pin within the locking hole and apply a force to the pin so as to press the pin into engagement with the support structure 712.

In some arrangements, the pin 724 may be retained in the locking hole by the latch in one of the transport or retracted position, and retained by the holder in the other, or the locking pin may be retained by both the holder and latch in one or both of the transport or retracted positions.

In an alternative embodiment, the locking pin 724 can be retained in the transport position by a holder in the form of a single-use frangible connection. These variations are disclosed in FIGS. 32*a* to 34*b* and 36*a* to 36*c*. The locking assembly of these variations shares many of the features of the earlier embodiments and for convenience, the same reference numerals are used for the same features of earlier embodiments but with the different prefixes to distinguish between those variants. The frangible connection may take the form of a glue applied to specific interfaces between the locking pin and the locking hole to hold the pin in the locking hole during transportation and when the wear member is not mounted to a support structure. When a wear member is mounted onto a support structure, the frangible connect is designed to break, or shear, when the support structure presses against the leading end of the pin. Alternatively, the frangible connection can break upon the application of torque to the drive arrangement of the pin. Once the frangible glue connection is broken, the locking pin is only loosely retained in the locking hole.

Figure 32B:
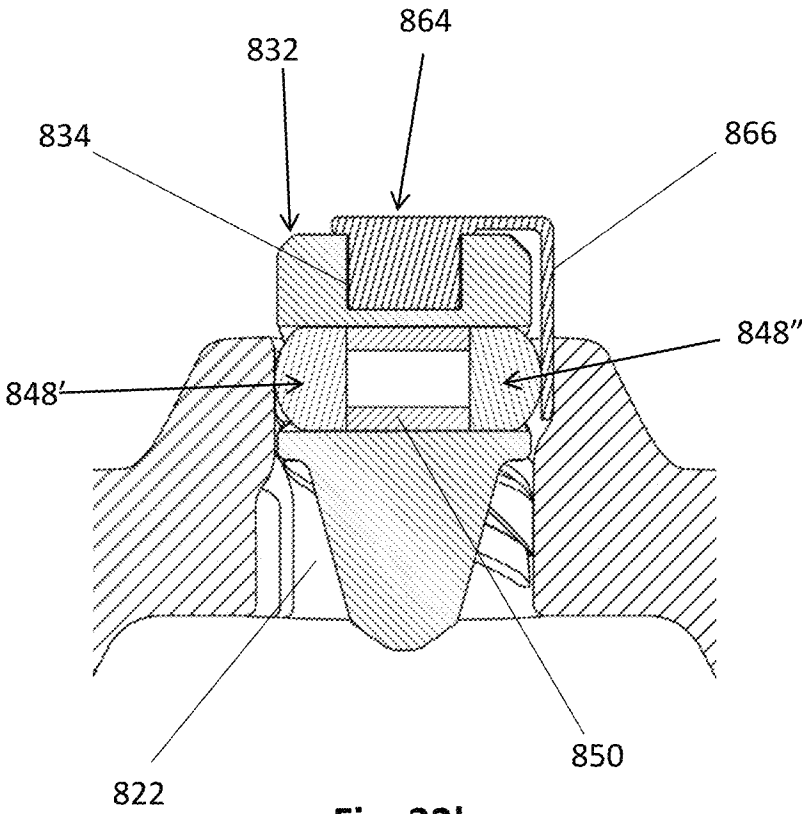
FIGS. 32*a* and 32*b* are respectively, an isometric view and a sectional side view of an embodiment of a locking assembly for an excavation wear assembly.
Figure 32A:
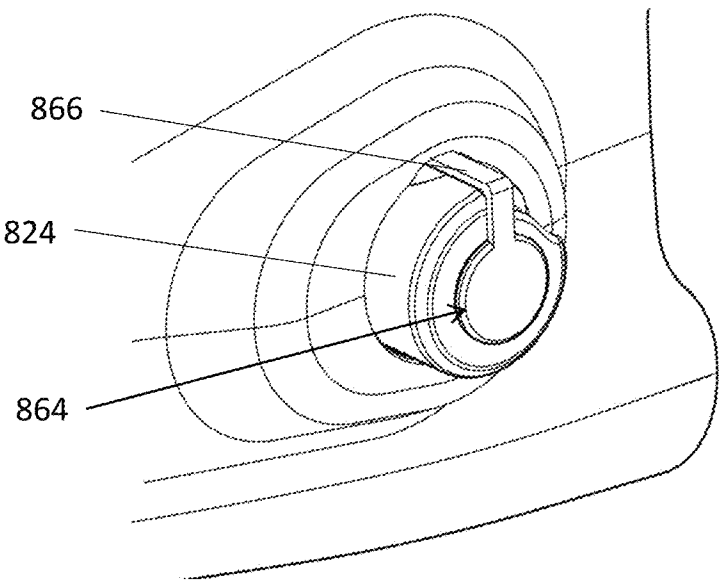

Referring now to FIGS. 32*a* and 32*b*. A single-use frangible connection may be a 'tear-off' cap 864. The tear-off cap can be designed to enclose a portion of the locking pin 824 so as to retain the pin in a transport position when not mounted to a support structure. In some forms, the cap can be releasably mounted into the hexagonal recess 834 of the drive arrangement 832.

As best shown in FIG. 32*b*, the cap can comprise an arm 866 extending from the mounted portion and retained at the interface between latch 848 of the locking pin 824 and the locking hole 822. The arm is held securely between at the interface by the pressure applied from the resilient portion 850 of the latch 848. Correspondingly, the locking pin is held in a transport position, resistant to moving from the transport position without a threshold force being applied. Once the frangible cap connection is broken, the locking pin is only loosely retained in the locking hole.

Various methods can be utilised in order to remove the cap and move the locking pin from the transport position into the extended position. In some forms, the cap can be designed to break, i.e. shear apart, if twisted from the locking hole upon when a tool rotates the pin about the drive arrangement 832. The arm may be perforated to create a weak point so as to direct the break to occur at a specific location on the arm. In this form, once torn from the arm, the cap may be re-used, i.e. reinserted into the hexagonal recess 834 to protect against the ingress of fines.

The cap may be pulled from its position by an operator. The length of the arm may be designed such that it is short enough to ensure that it pulls out from between the latch and the wall if the plug is removed by a pulling force.

Figure 36B:
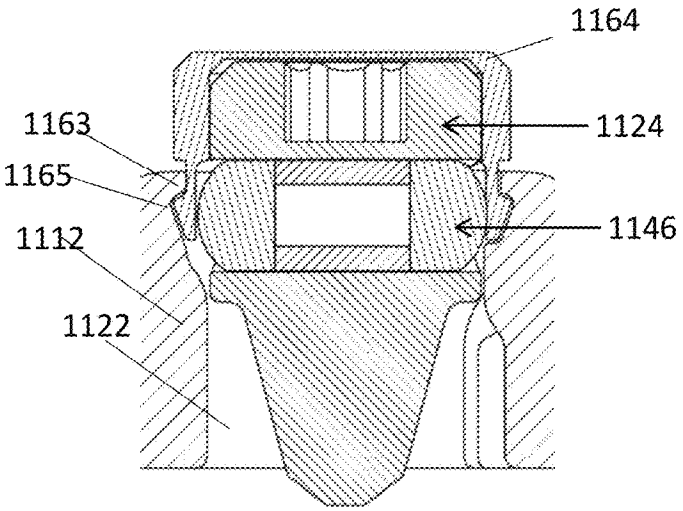
FIGS. 36*a* and 36*b* are an isometric view and a close-up side view, respectively, of an embodiment of a locking assembly for an excavation wear assembly.
Figure 36C:
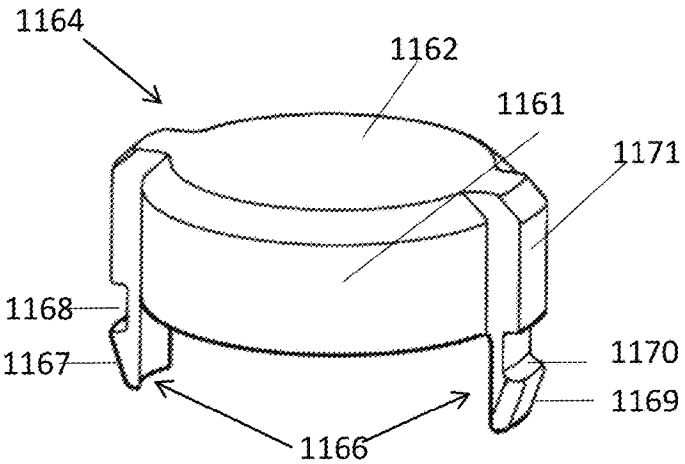
FIG. 36*c* is an isometric view of an embodiment of a locking assembly for an excavation wear assembly.
Figure 36A:
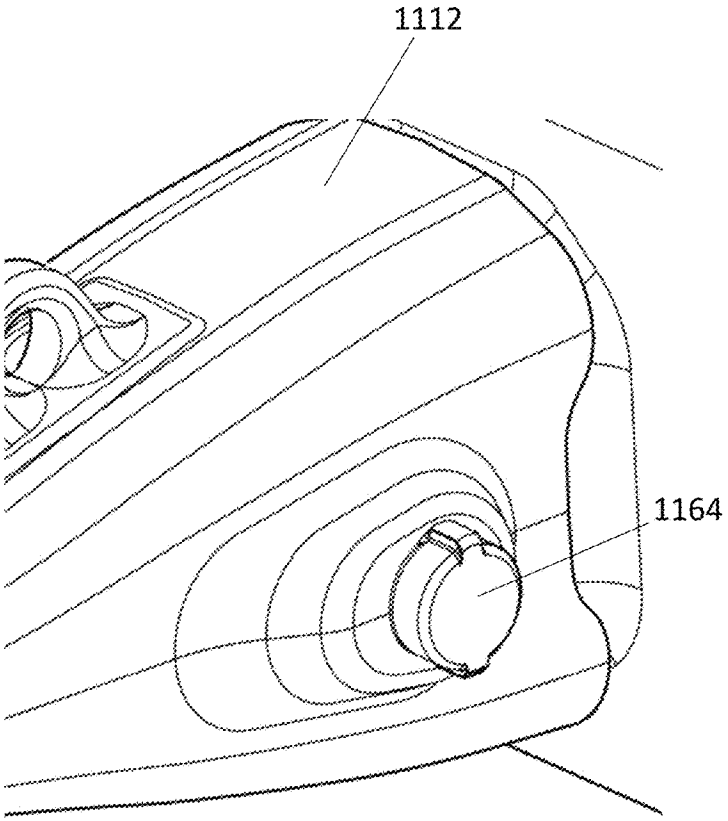

In a variation shown in FIGS. 36*a* to 36*c*, the wear member 1110 can be formed to comprise one or more holding formations in the form of re-entrant surfaces 1165 adjacent the outer rim of the locking hole 1122 such that holder in the form of a removable cap 1164 having a pair of clips 1166 with a correspondingly shaped lug 1167 can be snap fit thereat so as to cover over the pin 1124. The cap 1164 comprises a body 1162 having a diameter that covers over both the pin 1124 and locking hole 1122 in use. The side walls of the body 1161 comprises an embossed portion 1171 that aligns with each clip 1166 and extends for the length of the side wall 1161. Each clip 1166 comprises a thinner leg 1168 that extends towards the lug 1167, with the lug 1167 having a ramped body 1169 and a catching portion 1170 whereby in-use the cover 1164 can be snap fit into engagement with the re-entrants 1165, and retained thereat by the interaction between the catching portion 1170 and the inwardly projecting wall portion 1163 at the in-use outer facing side of the re-entrants 1165. The removable cap 1164, when located over the pin 1124 and locking hole 1122 in use, is thus able to be retained during transport and can protect the drive arrangement 732 and locking hole 1122 from the ingress of fines, dirt or other fouling. The thinner leg 1168 of each clip 1166 has a length such that, when the clips 1166 are engaged in the re-entrants 1165 a gap exists between the underside of the embossed portion 1171 and the outer surface of the wear member 1110 in use. Thus, in order to remove the cover 1164, the notches formed by the underside of the embossed portion 1171 can be accessed by a tool (e.g. screwdriver) so as to allow a user to push the clip 1166 inwards, out of the corresponding re-entrants 1165, and thus enable the user to pry the cover 1164 off the locking hole 1122 in a lever-like motion. After cover 1164 has been removed, the pin 1122 is able to fall out of the locking hole 1122, for example if the wear member 1112 is upended. In another form, the cover 1164 may be forced to disengage the wear member on fitting of the wear member to the support structure under movement of the locking pin due to the cam action described above.

Figures 33A, 33B, 33C:
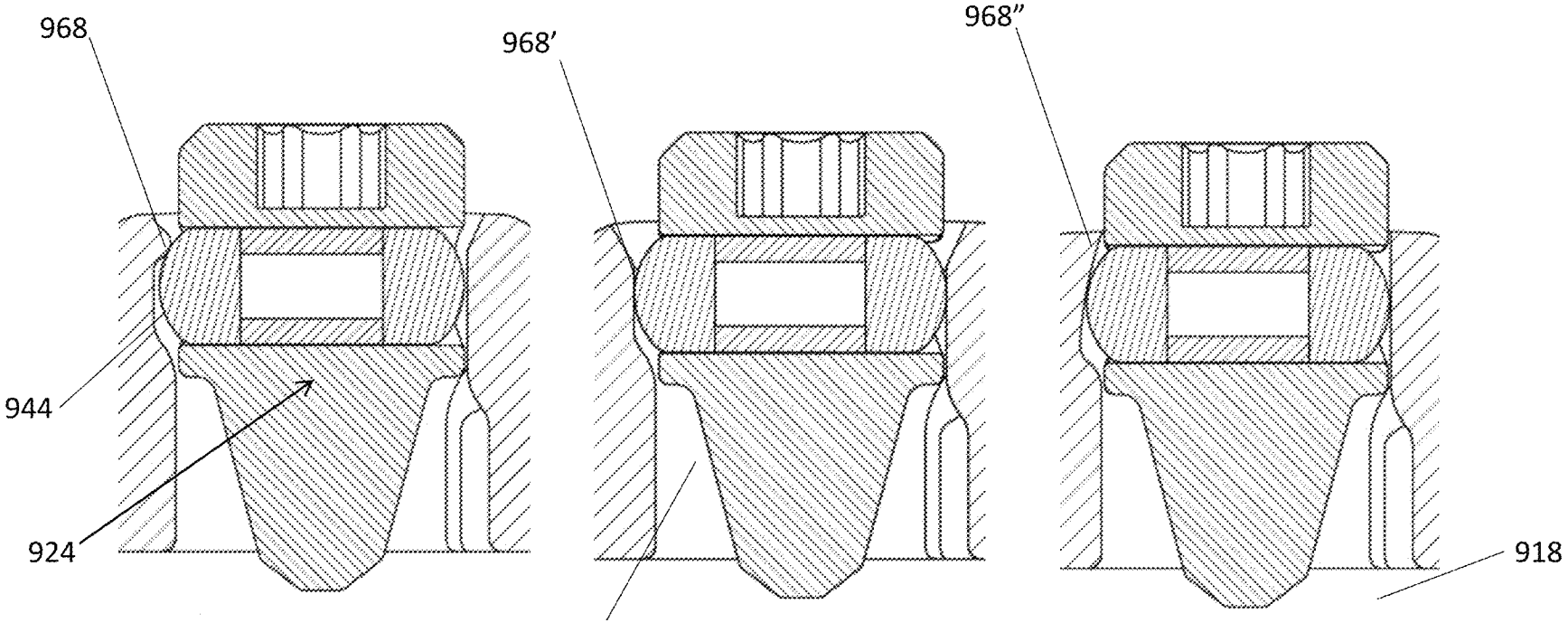
FIGS. 33*a*, 33*b* and 33*c* are sectional side views of an embodiment of a locking assembly for an excavation wear assembly.

Referring now to FIGS. 33*a* to 33*c*. A further form of the single-use frangible connection may be a detent 968 that can extend from the wall of the keeper 944.

Referring to the form shown in FIG. 33*a*, the detent can be a small protrusion from the wall of the keeper. The detent in this form can hold the pin 924 in a position so that it cannot move from the transport position when without applying a threshold force to the pin 924. In-use, once the pin has been forced, i.e. pressed into the locking hole and past the detent, the detent is sheared from its position. In other words, the interference between the latch and the detent wipes the detent from its position on the keeper. Once the pin is pushed past the detent and the detent is removed, the pin is no longer retained within the locking hole and can fall from its position the wear member is upended.

Referring now to the detent 968' shown in FIG. 33*b*. In this form, the detent mounted to the wall of the keeper 944 and is flared outwards, i.e. away from the central axis of the locking hole 922. The flared-shape of the detent narrows the diameter of the locking hole such that the latch is only compressed when the leading end of the pin encroaches the wear member socket. In this way the pin can only be retained in the locking hole when the leading edge encroaches into the socket, i.e. past the open end of the locking hole.

Referring now to the detent 968" shown in FIG. 33*c*. In this variation, the detent 268" is flared inwards, i.e. towards the central axis of the locking hole 922. This flared-shape creates a ramp that directs the locking pin towards the wear member socket 918. The ramp prevents the latch 'riding-up' and outwards from the locking hole 922 when the wear member is e.g. upended. Due to compression of the latch by the ramp, the locking pin will be pushed back automatically into a natural resting position. The neutral resting position can be determined according to the angle of the ramp. The ramp angle can be designed to ensure the leading end of the pin is always encroaching into the wear member socket. Further, the angle of the ramp can ensure that the pin will move into an axially aligned position within the locking hole.

In an alternative to the above, the detents in the wall may not shear and thus become a permanent fixture of the locking hole 922.

Figure 34B:
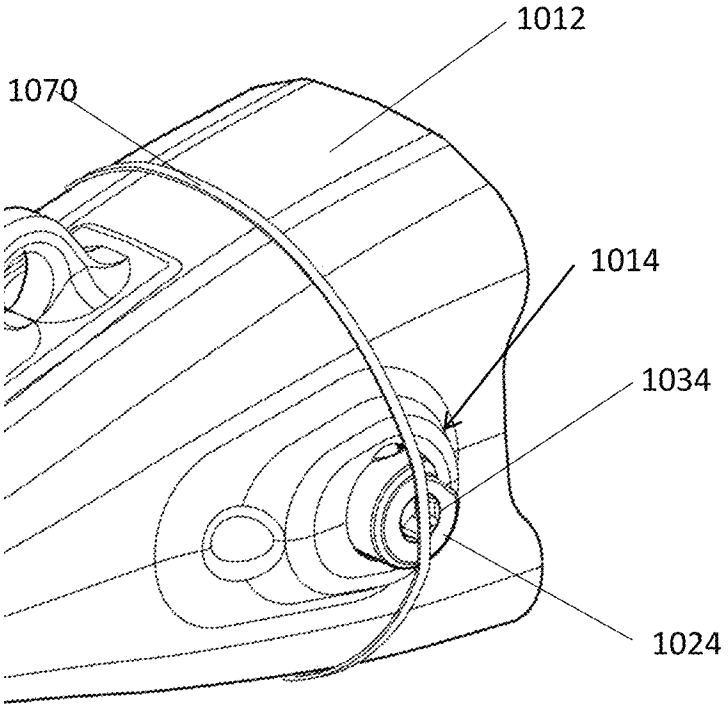
FIGS. 34*a* and 34*b* are isometric views of an embodiment of a locking assembly for an excavation wear assembly.
Figure 34A:
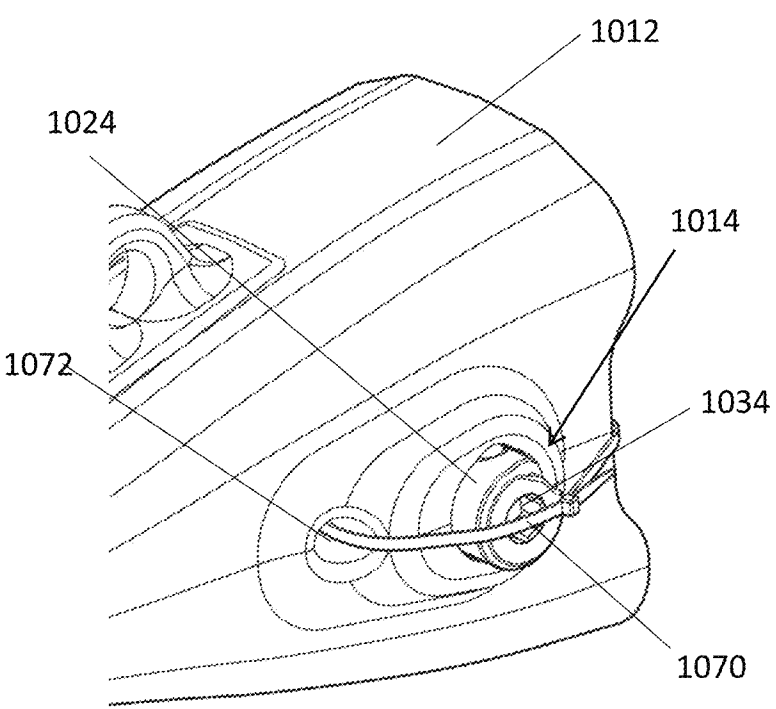

Referring now to FIGS. 34*a* and 34*b*. In some forms, the single-use frangible connection may be a tie 1070. The tie can be arranged to wrap around a portion of the wear member 1012 and the locking assembly 1014 to removably secure the pin in a transport position.

In the form shown in FIG. 34*a*, a hole 1072 is provided in the wear member 1012 for receiving the tie. In this form, the tie is threaded through the hole 1072 and the wear member socket to wrap around the pin 1024.

In another form as shown in FIG. 34*b*, the tie is wrapped externally around the wear member 1012 to hold the locking pin in a transport position.

Additionally, the tie can block access to the hexagonal recess 1034 of the drive arrangement such that the tie must be removed before the locking pin can be moved into an extended position.

Referring to FIGS. 37*a-k*, a further embodiment is disclosed of the locking assembly 1216. The locking assembly 1216 shares many of the features of the earlier embodiments and for convenience, the same reference numerals are used for the same features of earlier embodiments (e.g., earlier prefixes "7", "8", "9", "10", "11") but with the prefix "12". In this regard, the locking assembly includes locking pin 1224 that has a component 1236 of an engaging structure 1230 in the form of a helical arrangement and that engages with a complementary component of the engaging structure 1238 formed on an interior surface of the locking hole 1222 and causes axial movement of the pin 1224 relative to the wear member 1212 on rotation of the pin.

Figures 37A, 37B, 37C, 37D, 37L:
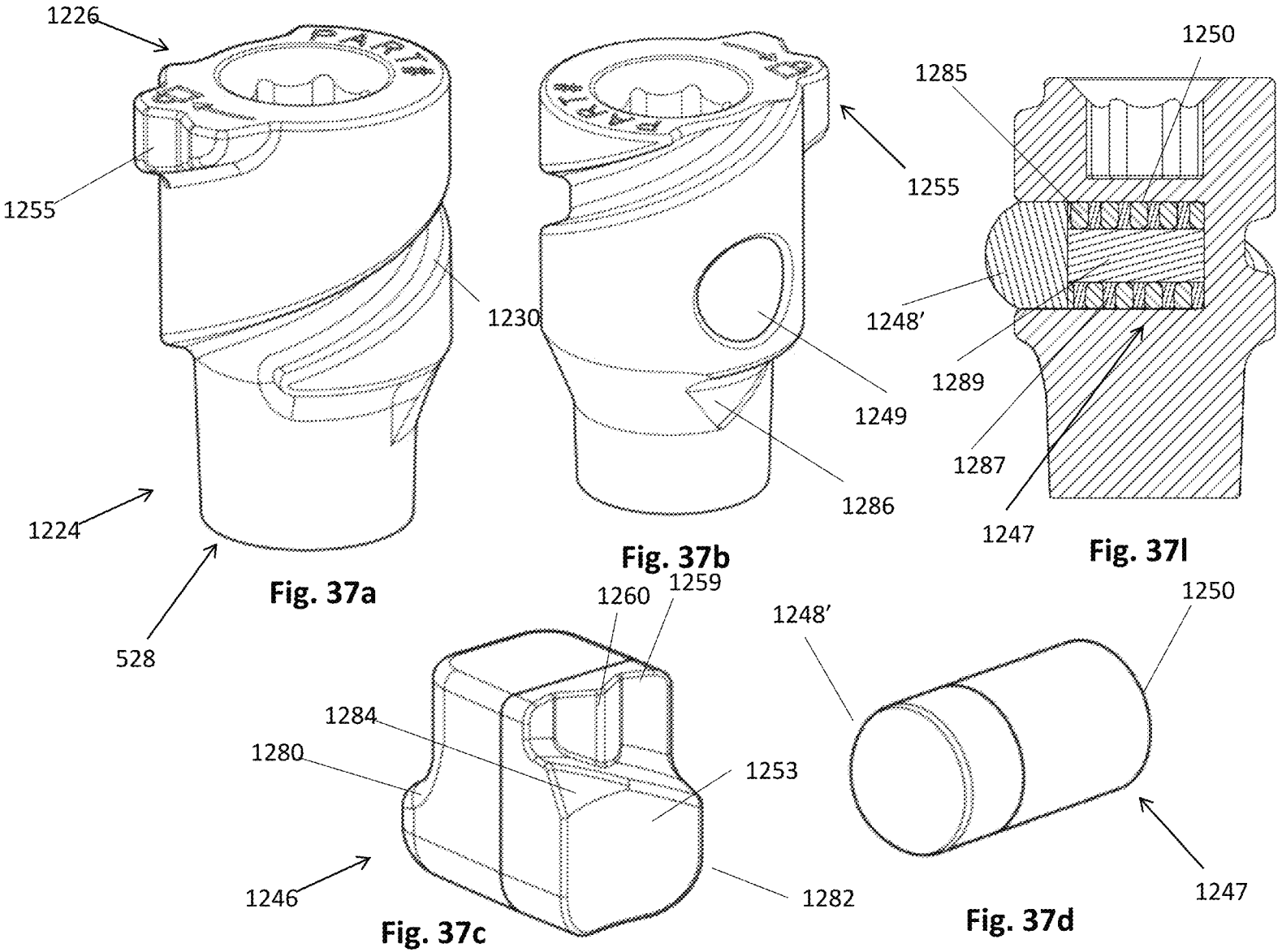
FIGS. 37*a* to 37*d* are isometric views of the components of a further embodiment of locking assembly.
FIG. 37*l* is a section view of a variation of the lock assembly of FIGS. 37 to 37*d*.

In this embodiment, the primary difference is that the retaining arrangement 1242 includes two retainers (or latches)—an upper latch 1246 (FIG. 37*c*) and a lower latch 1247 (FIG. 37*d*).

Both the upper and lower latches comprise respective resilient portions (1280, 1250) and rigid portions (1282, 1248').

The lower latch 1247 functions in a similar manner to the latch described above and has a resilient portion 1250 and a rigid detent 1248" and is arranged to shorten (compress) under load. In the illustrated form the lower latch is generally cylindrical and the detent 1248' is generally hemispherical. However, the latch is not limited to these shapes. In some forms, the resilient portion 1250 of the lower latch 1247 may include a hollow portion to enhance its ability to compress. In other forms, the resilient portion can be a solid structure.

Similar to the earlier embodiments, the lower latch 1247 is disposed in the body of the locking pin 1224. In contrast with the previously described embodiments, the locking pin 1224 includes a blind bore 1249 as opposed to a through hole and the lower latch is single sided (i.e., it has a detent 1248' only on one end of the latch 1247). In use, the resilient portion 1250 of the lower latch 1247 functions to bias the detent 1248 against the wall of the locking hole 1222 and enables the detent to locate into keepers (1244' and 1244") as discussed in more detail below.

A variation of the lower latch 1247 is disclosed in FIG. 37*l*, where the resilient member 1250 is formed as composite structure having a compression spring 1285, which is encapsulated in a resilient matrix 1287, typically a rubber or elastomeric material. The resilient material further includes a core to receive the resilient matrix as it deforms on compression of the spring 1285. In one form, the core may be formed of an open cell structure such as a foam. In manufacturing of the latch 1247, in one form, a rubber (preferably an elastomer with good thermal performance, for example silicone) is vulcanised into the voids of the spring. The internal core of the vulcanised spring incorporates a foam plug 1289 which is manually inserted. The foam plug not only allows the rubber to deform on compression, it also aids to keep fines out during service. Typically, rubber has poor elastic performance in very hot or very cold digging environments, and therefore it is desirable to use materials that can work more effectively in such conditions. A metal spring achieves this, however, a metal spring on its own has drawbacks including the gaps between the coils can fill with fines rendering the latch unusable, and it is challenging to achieve the same stiffness as a solid rubber latch-which in turn reduces the pins ability to resist unwinding in service. Having the combination of the spring in the rubber matrix addresses the shortcomings of the metal spring whilst still allowing the benefits of using the spring being that it can operate in a broader temperature range than achievable with rubber. It is to be appreciated that whilst the composite latch is disclosed in the latch assembly of FIGS. 37*a*-37*i*, a similar structure may be used as the resilient member in the other embodiments disclosed.

In the embodiment of FIGS. 37*a*-37*k*, the locking hole 1222 forms part of a more complex shaped lock receiving arrangement 1290 formed in the wear member 1212. This lock receiving arrangement 1290 further includes a cavity 1243 (see FIG. 37*h*) that opens to the locking hole 1222. This cavity is arranged to receive the upper latch 1246. The cavity includes a recessed portion 1245 which is arranged to receive a nose portion 1251 of the upper latch 1246 so as to capture the upper latch 1246 in the wear member 1212. When installed, an inner face 1253 of the latch 1246 projects into the locking hole 1222. This inner face 1253 is arranged to bear against the body region of the locking pin 1224 to assist in stabilising the locking pin 1224 in the locking hole. Moreover, the inner face may include a chamfer 1284 that is arranged to engage with a complementary chamfered surface 1286 on the locking pin 1224. This allows the latch to compress easily when the pin is inserted into the point. The two chamfers slide against each other when the pin is first installed and rotated. Without the chamfers, the lock may tend to bind or be more difficult to install.

In some forms, the upper latch 1246 is arranged to bear against the locking pin to resist lateral movement (being translation and or pivoting of the locking pin in the locking hole) which may otherwise occur under operational load. In this way, the upper latch 1246 provides some shock absorbing capability to the locking pin when installed.

In the locking assembly 1216, the primary torsional resistance to the locking pin 1224 is provided by the lower latch 1247 and its engagement in with the two keepers 1244' and 1244". As such, the locking arrangement can function without the upper latch 1246. As such in this regard, the upper latch may be considered optional to the basic latching function. The purpose of the upper latch 1246 is to provide the additional shock absorbing capability to the locking pin to enhance its function under load. It can also provide other retaining functions (as discussed below).

The use of the upper latch may be incorporated solely to provide the shock absorbing capability and therefore may not including any "latching" capability. The use of the term, "upper latch" should not be construed as limiting to the component to be used necessarily in conjunction with latching in this arrangement.

Figure 37F:
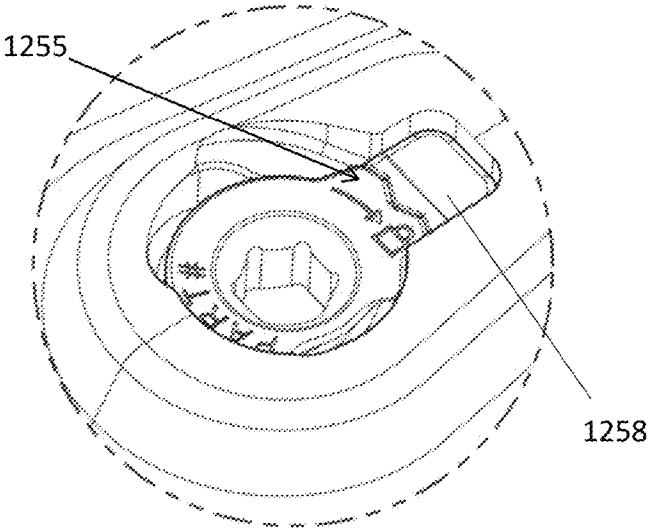
FIGS. 37*e* to 37*g* are various views of the locking assembly of FIGS. 37*a* to 37*d* installed in a wear member.
Figure 37G:
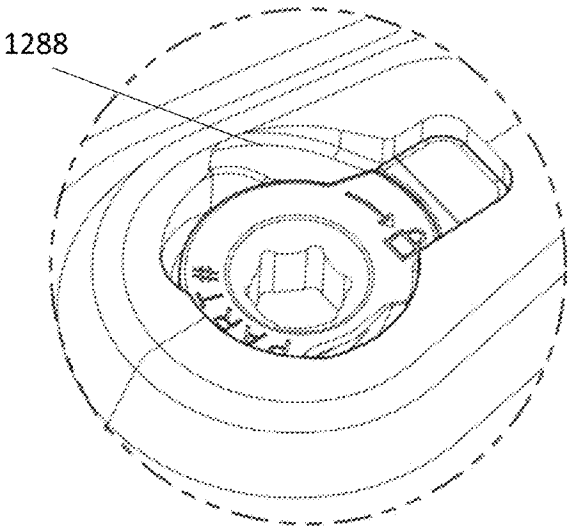
Figure 37E:
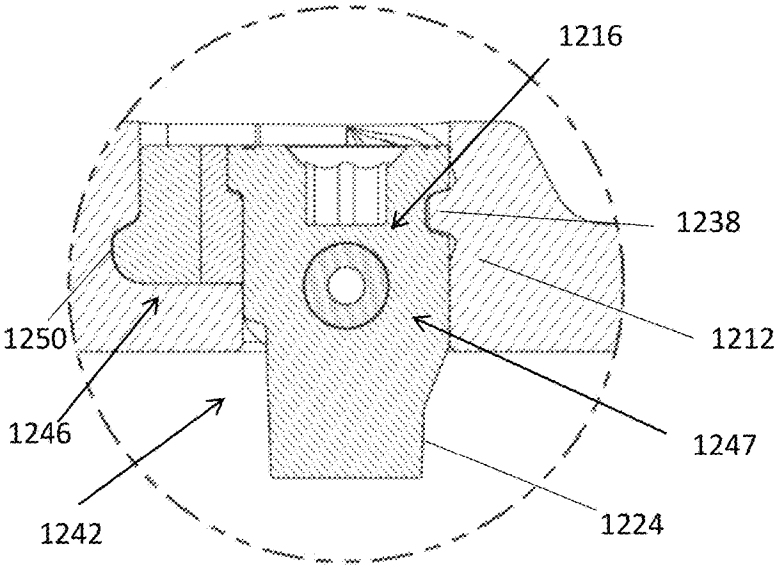
Figure 37I:
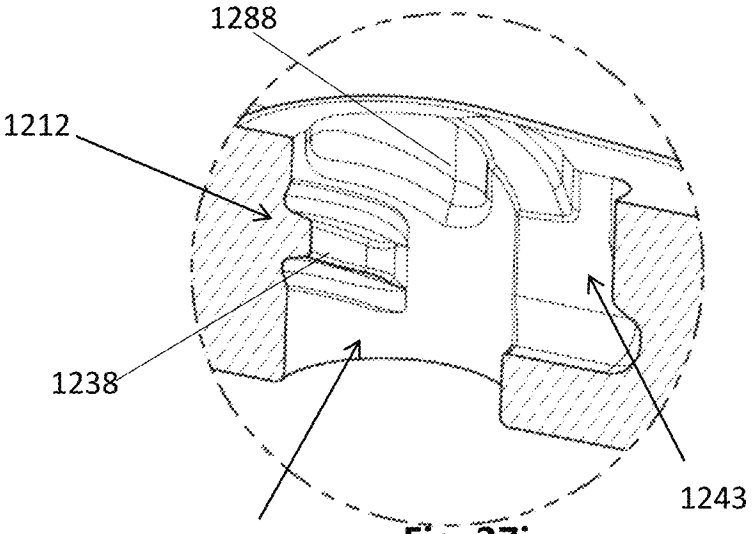
FIGS. 37*h* and 37*i* are schematic views of the locking hole structure in the wear member for the locking assembly of FIGS. 37*a* to 37*d;*
Figure 37H:
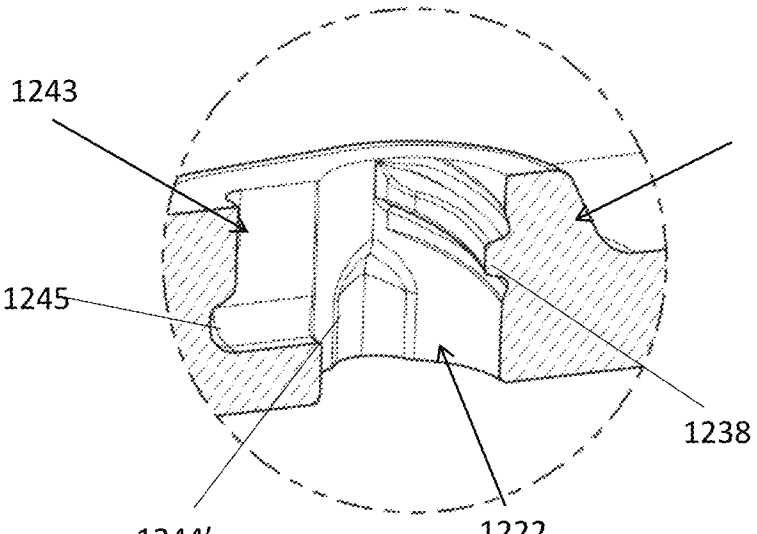
Figure 37K:
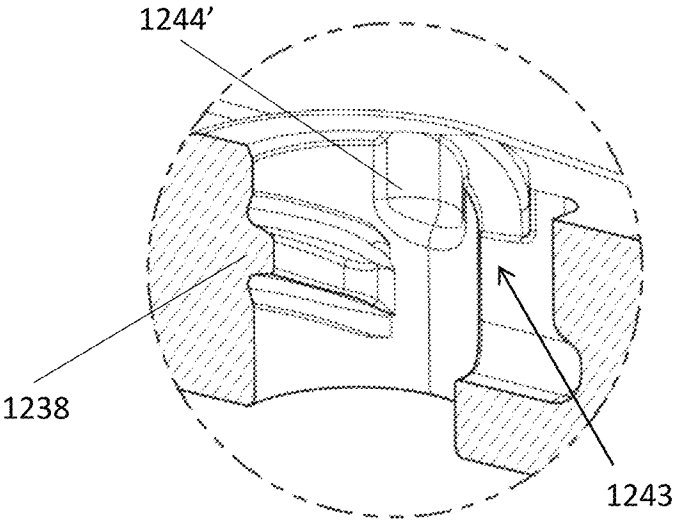
FIGS. 37*j* and 37*k* are schematic views of variations of the locking hole structure in the wear member for the locking assembly of FIGS. 37*a* to 37*d;*
Figure 37J:
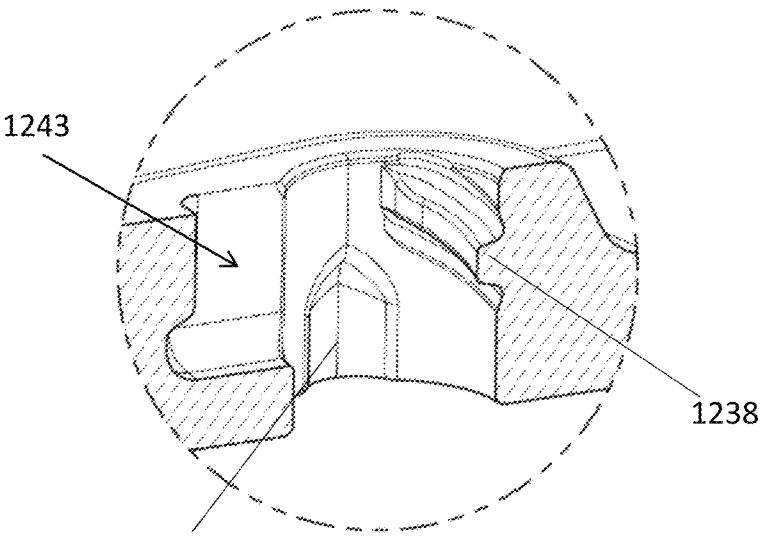
Figure 38B:
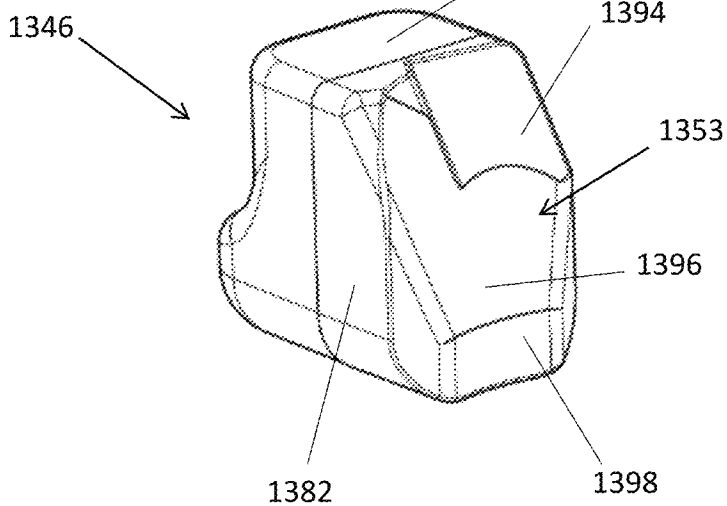
FIGS. 38*a* to 38*c* are isometric views of the components of a further embodiment of locking assembly.
Figure 38C:
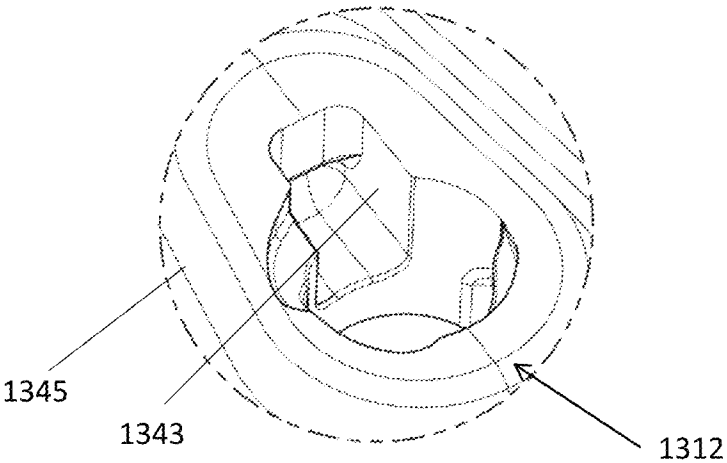
Figure 38A:
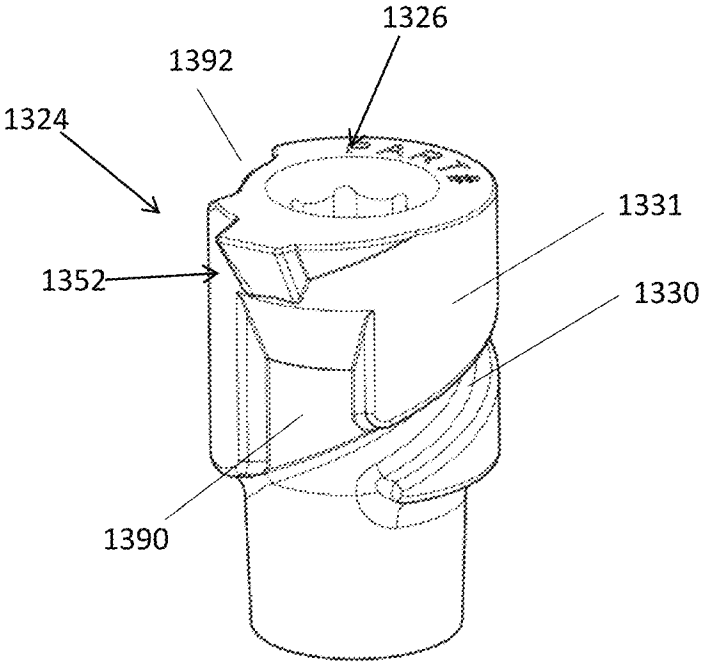
Figure 38D:
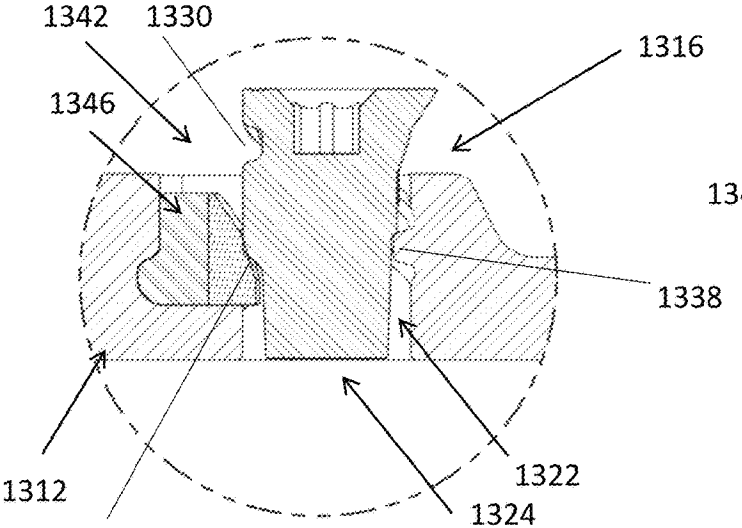
FIGS. 38*d* and 38*e* are sectional views of the locking assembly of FIGS. 17*a* to 17*c* installed in a transport and locked position respectively.
Figure 38E:
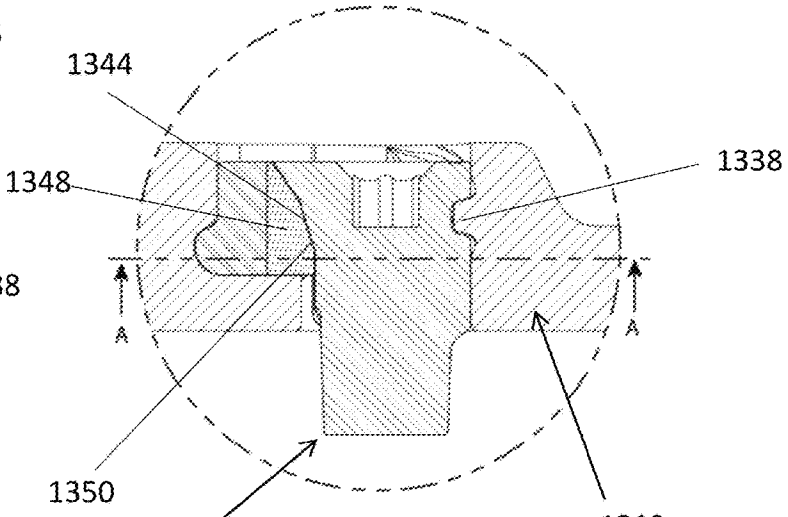
Figure 38F:
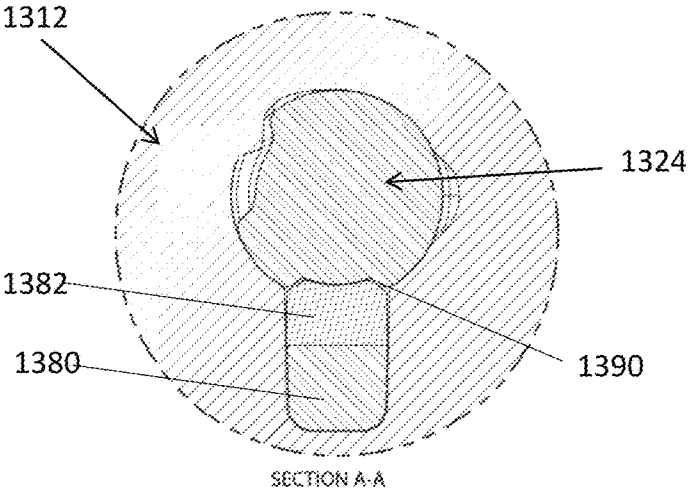
FIG. 38*f* is transverse sectional view along section line A-A of FIG. 38*e;*
Figure 38G:
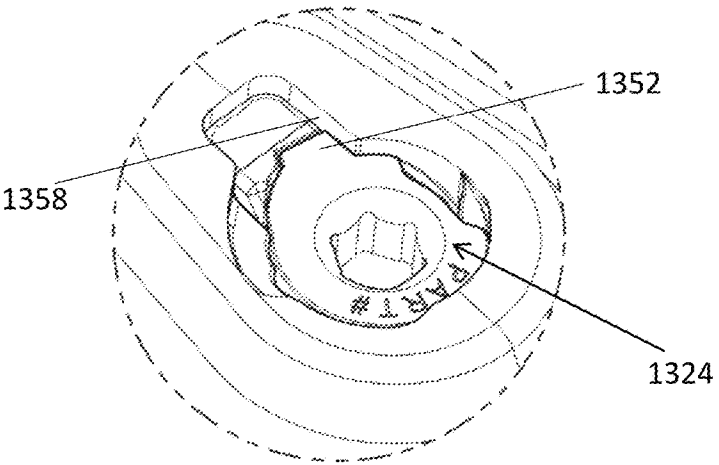
FIG. 38*g* is a schematic view of the locking assembly of FIGS. 38*a* to 38*c* in the locked position.

In one form as best shown in FIGS. 37*j* and *k*, the two keepers 1244' and 1244" are located on the wear member 1212 in spaced relation and arranged to receive the detent 1248' of the lower latch 1247 when the locking pin 1224 is moved under rotation from a retracted to an extended position. In one arrangement, for transport, the locking pin is installed in a retracted position with the rigid detent 1248' of the lower latch 1247 in engagement with the keeper 1244'. The frictional contact in this position between the rigid detent 1248' and the keeper 1244' secures the pin from further rotation during transport. Furthermore, in this position, the inner face 1253 of the upper latch 1246 is engaged under bias from its resilient portion 1280 being under compression with the pin body to maintain the locking pin 1224 in the wear member and resist its falling out.

In one form, the upper keeper 1244' may be reshaped so that it does not retain the detent 1248' when first installed in the locking hole 1222 but rather provides a clearance 1288 for the detent so that it does not engage with the wear member. This arrangement is best shown in FIGS. 37*g* and *i*. The lead in 1288 allows the pin to be inserted into the point by hand. The lead-in creates room for the lower latch 1247 to be inserted into the pin cavity. In one form the 'transport position' the pin is held only by the friction from the upper latch.

Further, in comparison between FIGS. 37*h* and 37*j*, the engaging structures (thread) 1238 can be similarly adjusted depending on whether the lead in 1288 is provided or whether a more defined notch 1244' is provided as shown in FIG. 37*k*. When the lead in 1288 is provided, the thread 1238 is extended further within the locking hole 1222 surface to provide an opposing edge to the lead in 1288 to facilitate initial installation of the locking pin 1224.

In one form, neither the upper or lower latch provide a defined position when first installed. In this way there is no defined retracted or transport position. Rather the locking pin is able to be merely inserted and becomes engaged with the upper latch 546 which provides some frictional resistance and then can be rotated and driven axially under the helical arrangement of the engaging structure 1230 as per a more conventional threaded arrangement.

Once the pin 1224 is ready to be installed to lock the wear member 1212 to the support structure 712, it is rotated (through for example approximately 180 degrees) to allow the rigid detent 1248" of the lower latch 1247 to come in contact with the second keeper 1244". This corresponds to the locked or latched position.

In some forms, the pin 1224 includes a radial projection 1251 at its second end 1228. The radial projection 1251 is configured to engage a complementary surface 1258 on the wear member 1212. In the illustrated form, the complementary surface forms part of the cavity 1243 that houses the upper latch 1246. This arrangement creates a hard stop mechanism that prevents the pin 1224 from rotating further and thus moving along the axial direction.

As best illustrated in FIG. 37*f*, this radial projection 1255 may further be configured to engage with an upper portion 1259 of the inner face 1253 of the upper latch 1246. This engagement is a camming engagement where a leading edge of the radial projection 1255 rides over a projection 1260 on the inner face 1259. Such an arrangement enables frictional contact to be established between the upper portion 1259 of the inner face 1253 and the radial projection 1255 on the pin thereby providing a further mechanism to retain the pin into locked or extended position. In this arrangement, the profile of the radial projection 1255 comprises a profile that is corrugated/undulating.

In other forms, the radial projection may not include this additional locking function. For example, as shown in FIG. 37*g*, the radial projection has a smooth profile that is complementary to a smooth profile on the upper portion 1259 of the inner face. In this case, there is no locking effect achieved and the upper latch 1246 serves to absorb impact loads.

As with previous embodiments, the latching arrangement 1242 also comprises a helical engagement structure in the form of a groove 1236 on the locking pin 1224 and thread 1238 on the wear member. However, the threads on the wear member of the illustrated embodiment are located such that during installation of the pin 1224 in the wear member 1212, the lower latch 1247 does not travel over the threads. Moreover, the threads can be positioned outside the load bearing zone between the wear member and pin that could otherwise result in crushing of the thread 1238.

During assembly, the upper latch 1246 is first installed in the cavity 1243 of the wear member 1212. Following this, the pin 124 is inserted such that the rigid detent 1248" of the lower latch 1247 comes into frictional contact with the keeper 1244'. Once the pin 1224 is ready to be installed, the pin is rotated by 1800 until the radial projection 1255 encounters the complementary surface on the wear member 710 and comes to a hard stop. At this position, the rigid detent 1248" of the lower latch 1247 will be in frictional engagement with the keeper 1244" in the pin cavity of the wear member. Simultaneously, the upper portion 1259 of the upper latch 1246 will also be in frictional engagement with the pin 1224. In this locked position, the lower and upper latches will be located at an angle of 900 to each other.

An advantage of this embodiment is that, it can allow the application of locking force in two planes. Thus, the pin can be locked using forces that act in two different directions thus allowing for a much better fit within the wear member/adapter. As discussed above, the latching arrangement 1242 can work with just the lower latch 1246 itself (i.e. without the upper latch 1247). However, the addition of the upper latch provides further advantages of this embodiment, including the ability of the upper latch 1246 to absorb impact loads, to resist lateral movement (being translation and or pivoting) of the pin 1224 within the locking hole 1222, to allow latching of the pin 1224 in transverse axial planes, and to provide redundancy to the latch function.

FIGS. 40*a* to 40*e* illustrate a variation on the wear member 1212 used in the wear assembly of FIGS. 37*a* to 37*l*. Again, as the wear member 1712 shares many of the features of the wear member 1212, like features have been given like reference numerals except that the prefixed used has been replaced by a "17".

The primary difference in the wear member is that the interior shape and features of the lock receiving arrangement 1790 is not formed directly as a casting of the wear member 1712 but is provided as part of an insert 1792 that is manufactured separately (say for example by an investment casting process) and is then placed within a mold (typically being a sand mold) and the wear member 1712 is cast around the insert. The advantage of this arrangement is that the insert can be manufactured to a finer tolerance than generally possible under the sanding casting process usually employed in wear member manufacture. This in turn can assist in improving the performance of the resulting lock assembly incorporated in the lock receiving arrangement. Other advantages may include the ability to use different material for the insert as compared to the balance of the wear member 1712 thereby allowing better control over performance and durability of the lock.

To ensure adequate performance, it is important that the insert 1792 is adequately secured to the wear member 1792. This may be achieved in a number of ways. In one form, the insert may be caused to fuse with the wear member as it is cast around the insert, such that the insert becomes intimately bonded with the wear member 1712. With this arrangement the separation between the insert and the wear member is less distinct as there is not a clear material separation between the insert the cast wear member.

Figure 40A:
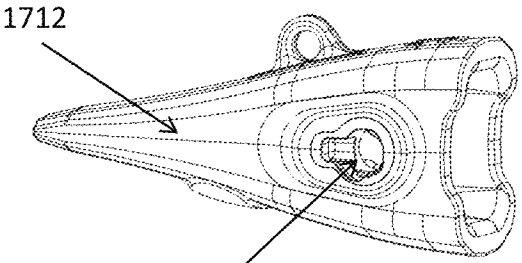
FIG. 40*a* is an isometric view of the wear member that includes the lock receiving arrangement of FIGS. 37*h* and 37*i*, where the lock receiving arrangement is formed from an insert cast into the wear member.
Figure 40B:
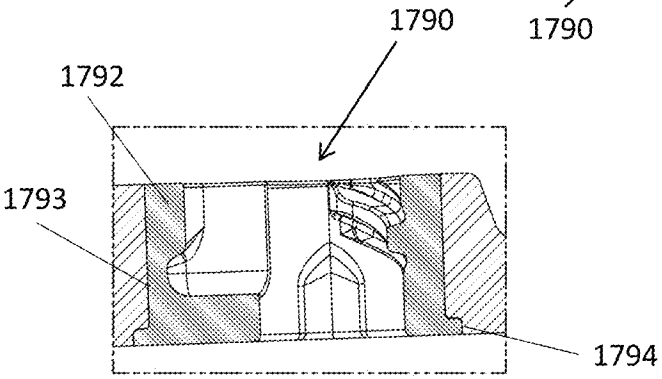
FIGS. 40*b* to 40*e* are sectional views of the lock receiving arrangement of FIG. 40*a* showing variations of the keying structure to key the insert to the cast wear member.
Figure 40C:
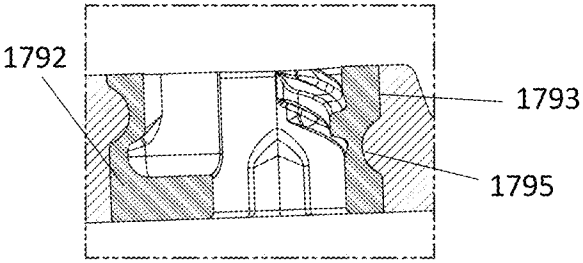
Figure 40D:
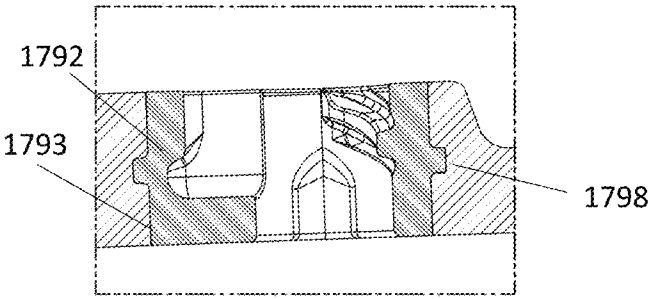
Figure 40E:
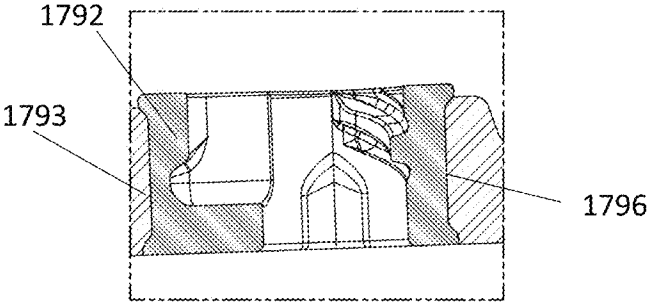

In another form, the insert may be mechanically keyed to the cast wear member as the liquid metal is able to flow around the exterior 1793 of the insert 1792. FIGS. 40*b* to 40*e* show various keyed arrangements. In FIG. 40*a*, a single flange 1794 is provided on the inner end of the insert adjacent the cavity 1718 which prevents ejection of the insert on the outer side of the wear member but may allow the insert to be knocked into the cavity if required. In the other variations shown, the insert is fully captured by accommodating a recessed profile 1795 (FIG. 40*c*) or 1796 (FIG. 40*e*) on the exterior of the insert 1792, or by one or more intermediate projecting flanges (such as flange 1798, FIG. 40*d*).

In a further form, the insert is secured by a combination of bonding (fusing) and mechanical arrangement. Further, whilst the insert has been shown in relation to the embodiment of FIG. 37*a* to FIG. 37*k*, it is to be appreciated that it may be used to define the locking hole of the wear member of other embodiments disclosed.

A further variation of the locking assembly 1216 shown in FIG. 37*a* to FIG. 37*k* is shown in FIG. 41*a* to FIG. 41*d*. As the lock 1816 shares many of the features of the lock 1216, like features have been given like reference numerals except that the prefixed used has been replaced by an "18".

The primary difference with the lock 1816 is in the design of the upper latch or retainer 1846. In the lock 1816, the retainer 1846 is formed from a spring-like or resiliently flexible material, such as spring steel into a substantially C-shaped clip.

The wear member 1812 comprises a ledge-like cavity 1892 around the inwardly facing sidewalls of the locking hole 1822, the cavity being substantially C-shaped so as to generally correspond to the shape of the retainer 1812. The retainer 1812 is sized so as to enable insertion into the cavity 1892 from outside of the wear member 1112 with the outer diameter of the retainer 1846 fitting within the inner diameter of the cavity 1892.

Figure 41A:
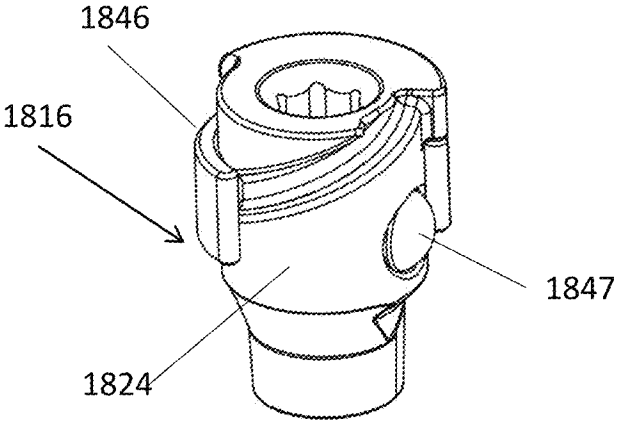
FIGS. 41*a* to 41*d* show various views of a variation of the lock assembly of FIGS. 37*a* to 37*i* where the second retainer is a resilient collar.
Figure 41B:
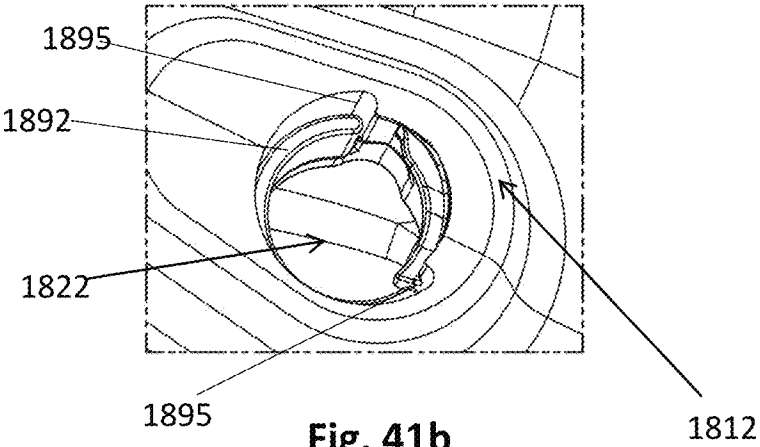
Figure 41C:
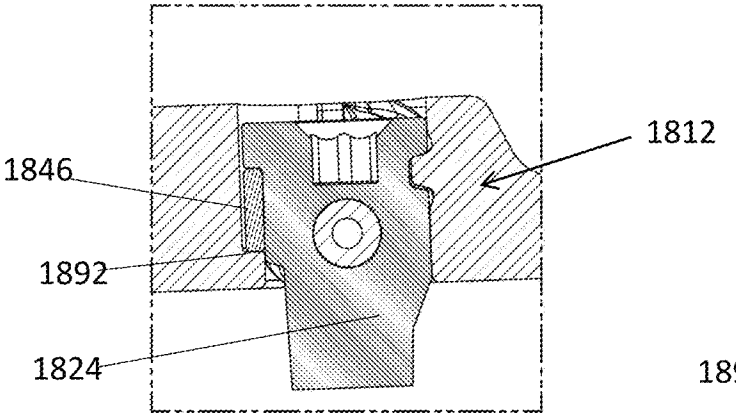
Figure 41D:
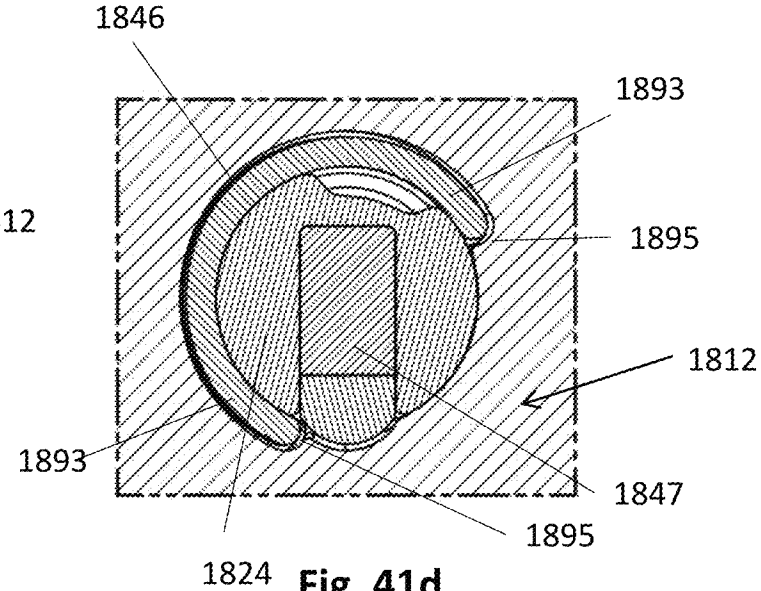

As best seen in FIG. 41*b*, a shoulder 1895 is formed on either side of a portion 1894 of the sidewalls that juts inwardly towards the centre of the locking hole 1822 from the circumference of the otherwise circular ledge-like cavity 1892 to thereby provide an interruption to the cavity. Each shoulder faces generally radially to an axis of the locking hole 1822, and is adapted such that, in use, the distal ends of each of the two arms 1893 of the C-shaped retainer 1846 locate adjacent thereto, so as to abut and/or interact with one of the two shoulders within the locking hole 1822 (e.g. FIG. 41*d*). The interaction between the shoulders 1895 and the distal ends of each of the two arms 1893 of the C-shaped retainer 1846 act to prevent the retainer 1846 from rotating around within the cavity 1892 in use.

The retainer 1846 has an interference fit with the locking pin 1824 as, in its natural state, the substantially circular aperture formed by the arms 1893 and body of the C-shaped clip has a smaller diameter than the diameter of the pin 1824. As the locking pin 1824 is engaged between the arms 1893 of the retainer 1846, the arms 1893 can be resiliently flexed outwards, with the inward bias of the arms 1893 (towards their natural state) applying a positive force that clamps against the locking pin 1824 and resists rotation of the pin by friction. The positive force of the inward bias of the arms 1893 against the locking pin 1824 can generate a friction based torsional resistance that assists the retainer 1846 in gripping and retaining the locking pin 1824 in use. This torsional resistance can help reduce the effects of vibrations that may otherwise cause the locking pin 1824 to rotate and come loose, or from moving axially towards the retracted position. The frictional resistance may therefore form part of the retaining arrangement (operating in conjunction with the lower latch 1847) to maintain the locking pin 1824 in the locking hole 1822 under axially loading on the pin 1824. The frictional resistance can be overcome with a wrench applied by an operator during installation or removal of the locking pin 1824.

A further variation of the locking assembly 1216 shown in FIG. 37*a* to FIG. 37*l* is shown in FIG. 42*a* to FIG. 42*i*. As the lock 1916 shares many of the features of the lock 1216, like features have been given like reference numerals except that the prefixed used has been replaced by an "19".

A feature of the lock 1916 is that the locking pin 1924 is inserted into the locking hole 1922 independent of the lower latch 1247. This arrangement allows the locking hole design to be simplified (as it does not require the same lead entry 588) on the interior wall of the locking hole to accommodate the lower latch when the locking pin is installed together with the lower latch. Also, it relieves compression on the lower latch during installation.

To enable this arrangement, the cavity 1943 forming part of the lock receiving arrangement 1990 is modified to accommodate the drop in of the lower latch. A complementary modification is made to the upper latch 1946 so that it fits within the cavity. In the form as shown, the cavity 1943 includes a planar back wall 1991 and does not include the undercut 1245. This assists in installing the upper latch 946 after installation of the locking pin 1924.

Figures 42A, 42B, 42C:
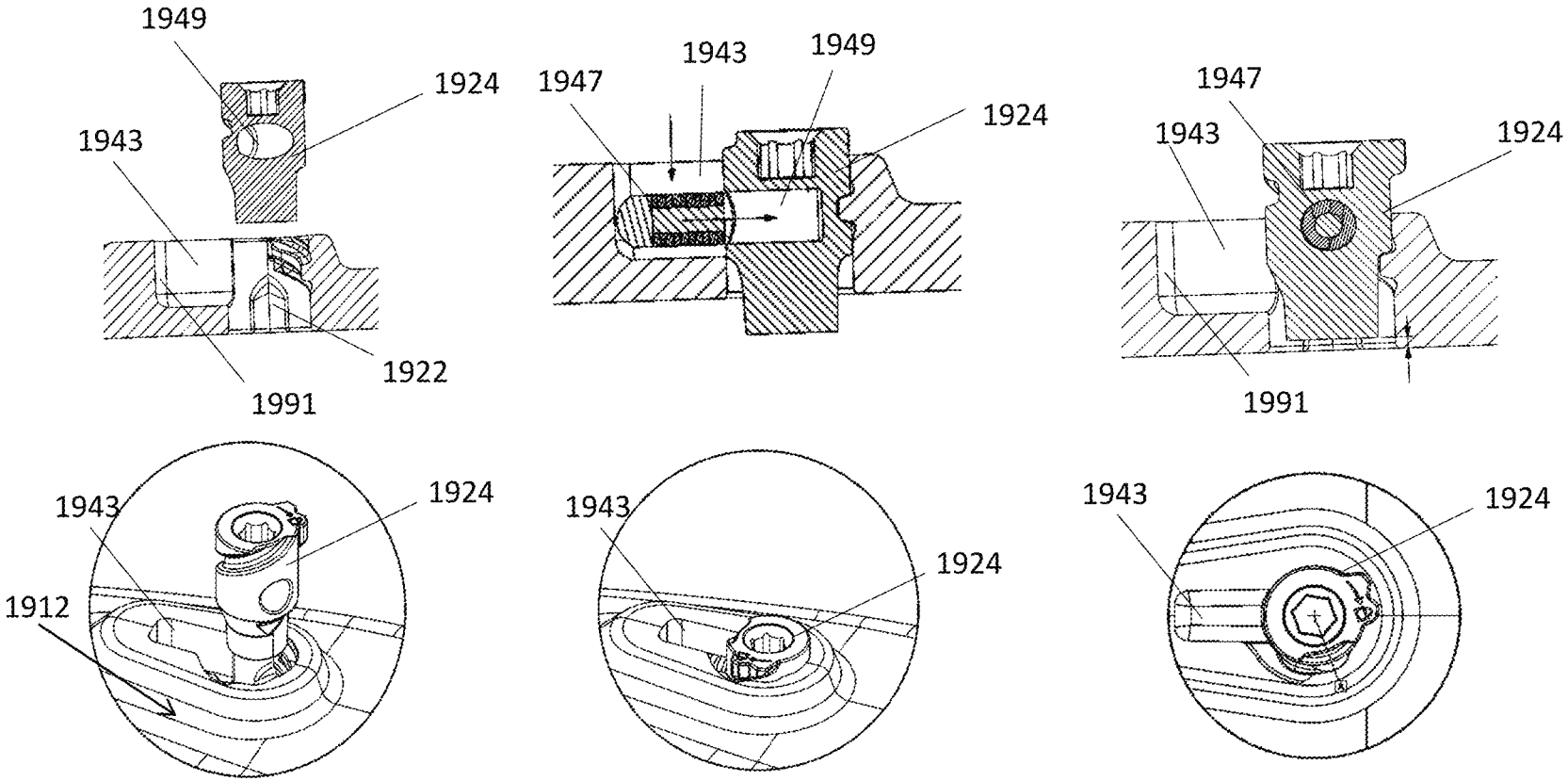

The installation sequence of the locking assembly is shown in FIGS. 42*a* to 42*f*. In a first step (FIG. 42*a*), the locking pin 1924 (without lower latch) is inserted into the locking hole and the helical components of the engaging structure 1230 on the locking pin and interior wall of the locking hole can engage. The pin can then be rotated to towards the fully extended position as shown in FIG. 42*b*. This rotation is easily made as the locking pin is not subject to torsional resistance as otherwise would be provided by the upper and lower latches (1946 and 1947).

In use, the locking pin 1924 is rotated towards the extended position to a position where the locking bore 1949 aligns with the cavity 1943 and just above the floor of the cavity. In this position, the lower latch 1946 is able to be dropped into the cavity 1943 to be aligned with locking bore 1949. Once in that position, the latch can then be translated into the bore 1949 and is thereby captured within locking pin body 1924. This sequence is best illustrated in FIG. 42*b*.

Figures 42D, 42E, 42F:
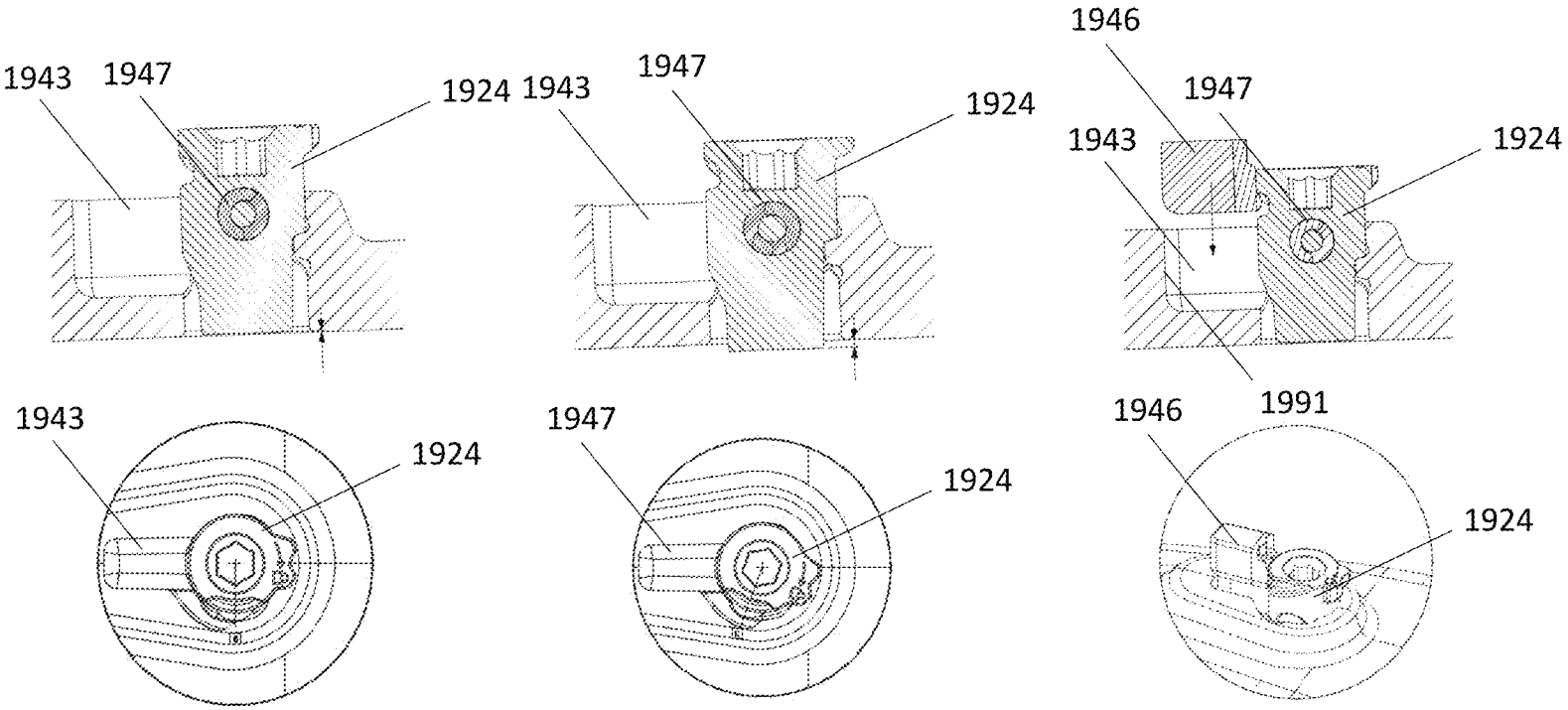
FIGS. 42*f* to 42*i* is an installation sequence of the wear assembly of FIGS. 42*a* to 42*e* onto a support structure.
Figure 42I:
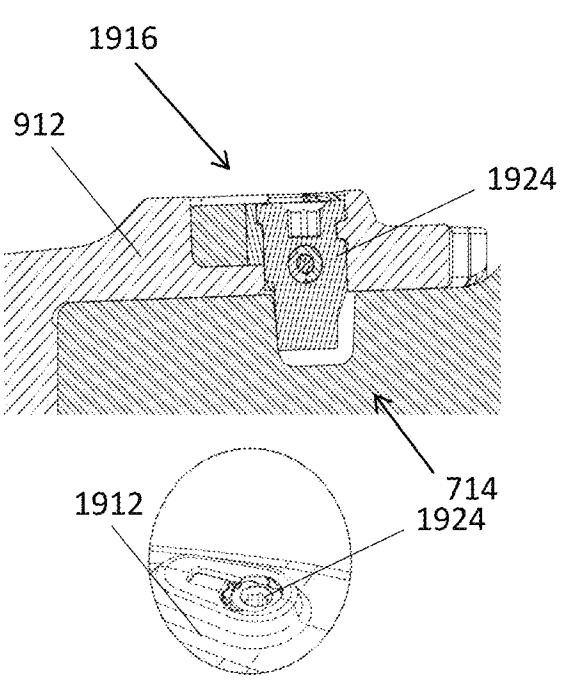
Figure 42H:
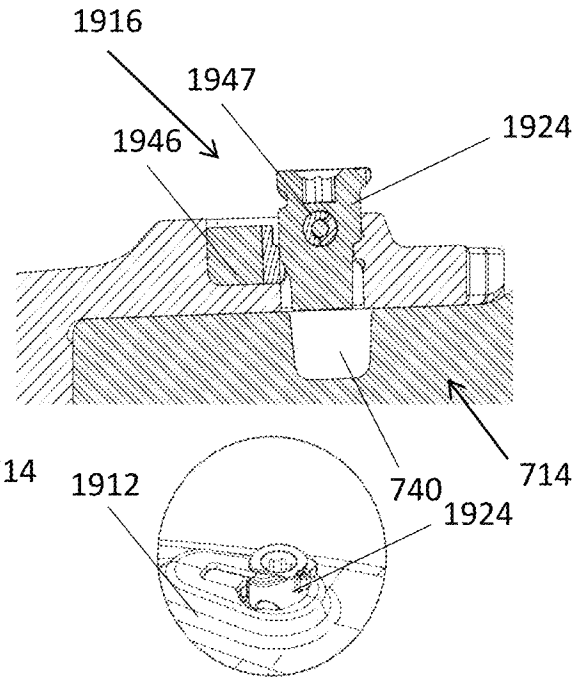
Figure 42G:
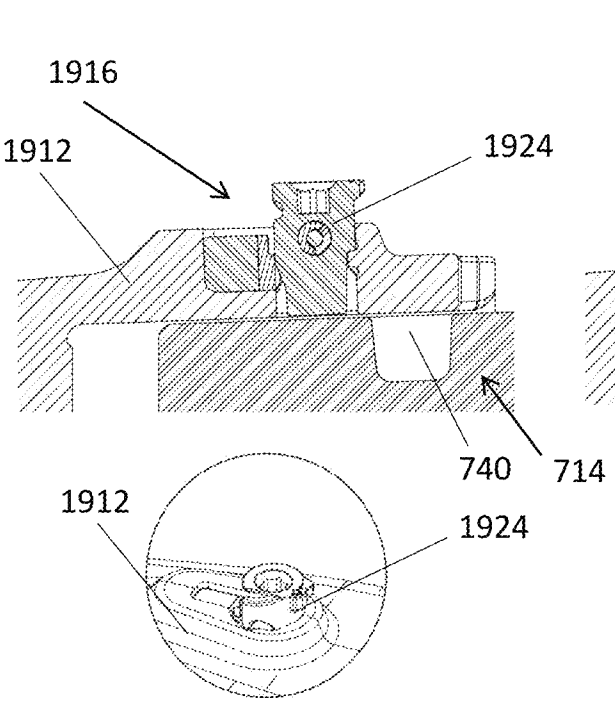

Once captured, the locking pin assembly including the locking pin 1924 and captured lower latch 1946 can then be rotated to a retracted position (FIG. 42*c*), a transport position (FIG. 42*e*) where the leading end may encroach into the wear member main cavity 1918, or an intermediate position where it is substantially flush with the inner wall of the wear member (FIG. 42*d* and FIG. 42*f*). In moving to these positions, the lower latch would compress as it moves against the inner wall of the locking hole 1922.

In the illustrated form, when in this intermediate position, the upper latch is then abled to be inserted into the cavity 1943, thus rendering the locking assembly fully operational.

Whilst the fitting of the lock assembly 1916 to the wear member 1912 may be done onsite, typically it is preinstalled and the wear member 1916 is delivered on site with the locking assembly installed as an assembly. As such once installed, the locking assembly 1916 may be moved to any one of the retracted position or transport position as required before installation on the support structure as required and as detailed above in relation to the previous embodiments.

Once in this operational state and delivered to site, the wear member can then be fitted to the support structure 714 in a similar manner as discussed above and as shown in the sequence of FIG. 42*g* to FIG. 42*i*. where the wear member 1912 is fitted over the support structure 714 with the locking pin 1924 in a retracted position and then rotationally driven into the recess 740 and into the locking position to lock the wear member to the support structure 714.

Referring now to FIGS. 38*a*-38*e*, a further embodiment of the lock 1316 is disclosed. Again, the lock 1316 shares many of the features of the earlier embodiments (for example having the prefix "7", "8", "9", "10", "11", or "12") and for convenience, like features have been given like reference numeral but with the addition of the prefix "13".

In this embodiment, the latching arrangement 1342 comprises of a single latch 1346 (similar to the upper latch '146 in the previous embodiment) that locates in a cavity '343 of the wear member 1310. However, in this case, the latch 1346 provides both the torsional resistance to the locking pin to maintain the pin in its locked position and to maintain the pin firmly within the locking hole 1322.

The latch 1346 comprises a rigid detent portion 1382 that has an inner face 1353 that bears against the pin 1324 and a resilient backing portion 1380. The latch 1346 locates in the cavity 1343 of the wear member and is retained there by in an undercut arrangement 1345, as per the earlier embodiment.

The resilient portion 1380 is arranged to compress in operation to apply a bias to the pin. Similar to the earlier embodiment, this bias provides a shock absorbing effect and is especially useful to buffer the impact of loads acting on the pin and thereby inhibit damage to the pin 1324/locking hole 1322.

To provide a latching function, the pin 1324 incorporates a keeper 1390 located on the body 1331 of the locking pin 1324 formed as a recess or notch within the pin body 1331. The keeper 1390 is arranged to move into register with the latch 1346 as the pin is moved to its locking position. As it moves into register, the inner face 1353 moves into keeper recess 1390 (under the bias of the resilient member 1380) thereby capturing the rigid detent portion 1382 resisting further rotation of the pin 1324 within the locking hole 1322. The detent portion 1382 and keeper 1390 can be formed with appropriately chamfered edges to allow adequate entry and exit to the of the latch into the keeper recess to enable release of the lock 1316 from the locking position to enable removal of the locking pin 1324.

The pin 1324 may comprise a radially extending projection 1352 at its second end 1328 similar to the previous embodiment described. This radially extending projection can engage with a complementary surface 1358 on the wear member 1312 to prevent further rotation of the pin 724 once the pin is locked into position. Further, the second end 1328 may also comprise a cut-away section 1392 or discontinuity to provide clearance for the thread 1338 (which may extend to the exterior surface of the wear member) when the pin is in its locked position. In this way the end 1326 of the pin can be located at or below the exterior of the wear member when in the locked position (see FIG. 38*e*).

During assembly, the latch 1346 is first inserted into the cavity 1343. Next, the pin 1324 is inserted in the locking hole 1322 and rotated which causes the engaging surfaces 1330 and 1338 to engage progressively brings the body 1331 of the pin into engagement with the inner face 1353 of the latch 1346 causing the resilient member 1380 to compress and increasing frictional contact between the pin 1324 and the latch 1346. In the present embodiment, the inner face 1353 may include multiple mating surface (1394, 1396, 1398) at various inclinations that facilitates this progressive engagement. The latch engages the pin on installation of the pin in the locking hole and progressively increases its retaining force as the pin is rotated into the locking hole towards the locked position and engages the different surfaces (being surface 1394 initially, then surface 1396, and finally surface 1398). For example, during transport, the pin 1324 can be rotated to a position (see FIG. 38*d*) such that only surface 1394 of the inner face 1353 of the detent 1382 engage in a frictional contact with the pin body. This may fix the position of the pin sufficiently to enable it to be moved/transported. During installation of the pin on the wear member, the pin can be rotated further to a position shown in FIG. 38*e* whereby the inner surface 653 is in full mating condition with the pin body and aligns with, and locates in, the keeper 1344 thus providing the latched arrangement. This corresponds to the locking position.

A feature of this design is that the locking pin 1324 has no bore/through hole to accommodate an integrated latch as per the earlier embodiments. This has an advantage as the bore/through hole can act as a stress raiser that forms regions of concentrated stress on the locking pin that may impact pin performance.

Figure 39B:
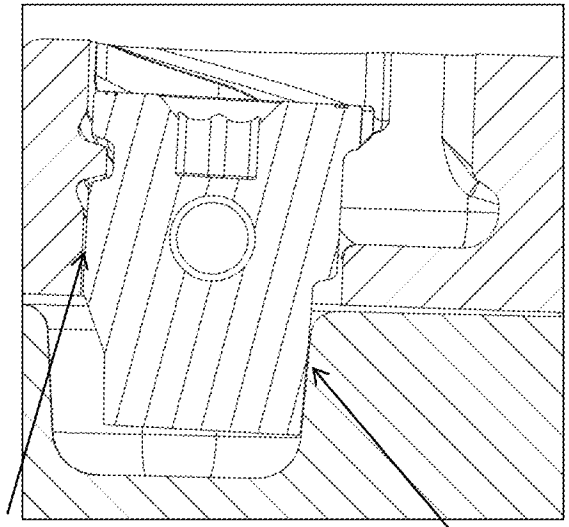
FIGS. 39*a* and 39*b* are sectional views of the locking assembly of FIGS. 37*a* to 37*d* installed in a locked position and in an unloaded and loaded condition respectively.
Figure 39A:
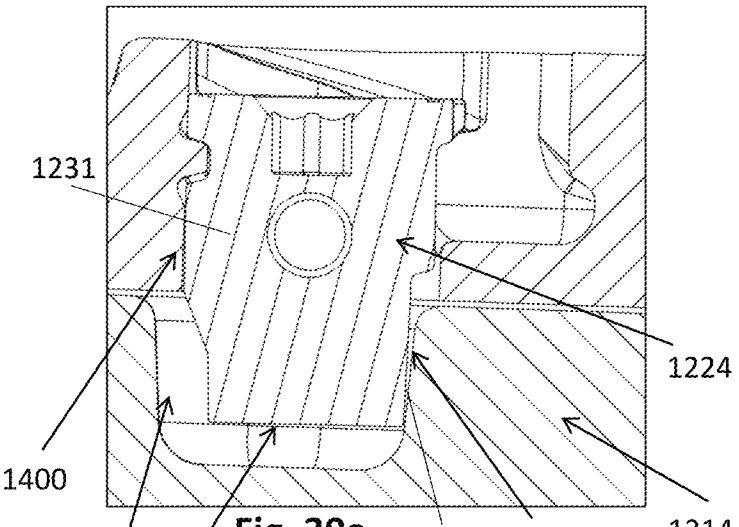
Figure 39C:
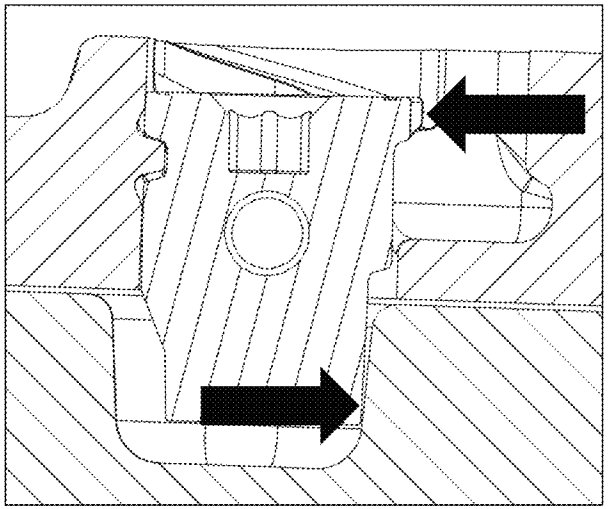
FIG. 39*c* is the sectional view of FIG. 39*a* showing loading conditions on the locking pin.

Referring now to FIGS. 39*a* to 39*c*, a further feature of the lock (in any of the forms described above) relate to the relative inclination of certain surfaces of the pin and the wear member or support structure. For convenience, this feature will be described with reference to the lock 1216 of embodiment of FIGS. 37*a*-*k*, but it will be appreciated that it is applicable to the other embodiments as well as other locking designs outside the current disclosure.

Under loading conditions on the wear member, there is a tendency that the wear member will rotate on the support structure particularly as loads parallel to the longitudinal centreline of the assembly are induced (because the taper provided on the stabilising surfaces between the support structure and wear member). The closer these stabilised flats become to horizontal, or parallel to the longitudinal centreline of the assembly, the less resultant horizontal load is placed on the wear member, which thus has to be counteracted by the resistance of the lock to maintain the wear member on the support structure. The stabilisations are not completely parallel to the longitudinal centreline for two reasons; first these parts are almost all either cast or forged and some taper, or draft, must be used on these parts or they would not be able to be removed from the mold. Secondly, if these stabilised flats both front and rear, which are generally designed to be the load bearing pads for the forces on the wear member, were completely horizontal then installing a wear member onto the support structure would require larger clearances to ensure the assembly could be completed. The wear member would also be more likely to become wedged onto the support structure making them harder to be removed. A slight taper on these bearing pads is therefore required for easier manufacture and also assembly and disassembly of the parts.

This taper and also the required clearance between the support structure and the wear member allow for a certain amount of movement between the support structure and the wear member when the wear member is loaded while in use. The larger the clearance, and the larger the taper, means that there is generally more movement of the wear member on the support structure when a load is applied to the wear member. This necessitates a very robust lock, which can hold the wear member onto the supporting structure even in the presence of these high loads.

Furthermore, with the added desirability of locks that provide a hammerless system, such as those disclosed in this disclosure, the accommodation of the horizontal loads become more problematic as the locks need to be able to be installed and removed without a hammer so as such need to have some tolerance or movement to accommodate installation and release of the locking pin.

In accordance with this further aspect of the disclosure, at least one bearing surface defined by an internal wall of the locking hole and or support structure is configured to be angularly offset from at least one corresponding bearing surface defined by an external surface of the locking pin when the wear member is installed on the support structure, and the lock is in the locked position, and without any load transfer on the wear assembly from ground penetration.

Moreover, when under loading condition, the angular offset is designed to reduce (i.e. the bearing surfaces move more into mating arrangement) as the locking pin is caused to move relative to the wear member and the support structure, particularly under the horizontal induced loads discussed above. As such, when a load is placed on the wear assembly from ground penetration in use, the bearing surfaces are biased into increased surface engagement.

With this arrangement, the surface area contact is increased under the bias of the load transfer. The profile of the at least one bearing surface of the pin and/or locking hole and/or support structure may be planar or include a radius or radii of curvature so the surface is arcuate.

Turning to FIGS. 39*a* to 39*c*, two regions are identified (1400 and 1402) in the lock 1216 where opposing surfaces are designed to have the above mentioned angular off set.

Region 1400 is a rearward section (relative to the tip of the wear member) between the body 1231 of the pin 1224 and interior surface of the locking wall 1222 (being in opposing relation to keeper 1244"). Region 1402 is a forward section between the lower end of the pin (towards the first end 1226) and a rear surface of the interior wall 1252 of the cavity 1240 of the support structure 1214.

The angle of the offset is typically less than 5 degrees but can be adjusted based on the tolerance in the lock, the expected design load conditions. In one form, the feature may increase the life of the support structure and pin by providing a larger bearing contact surface area between the parts (more contact surface area=less contact stress). Offsetting the angle between the pin and support structure accommodates for the rotation/tilt of the pin relative to the nose due to the initial gaps closing up. The pin and support structure bearing faces 'roll' into alignment when the wear member is under load. Similarly, this may be applied to the other pin bearing faces (e.g. between pin and wear member (region 1400)).

A further benefit of this arrangement when applied to the lock 1216 is that the wear member can be held firmly on the support structure by the action of the compressed/pre-loaded latch 1246 (not shown in FIGS. 39*a* to 39*c*). The biasing force applies a moment on the pin (as represented by the arrows in 39*c*). This helps maintain the initial alignment of all the parts and provides tactile feedback to the installer that the wear member is securely installed on the support member.

A further advantage of the angular off set of the bearing surfaces is that there may be greater clearance provided when the pin is installed or removed with the wear member in an unloaded condition. This can facilitate installation and removal of the pin.

Further embodiments of wear member assemblies, wear members and locking assemblies are disclosed with reference to FIGS. 43 to 55*c*.

Figure 43:
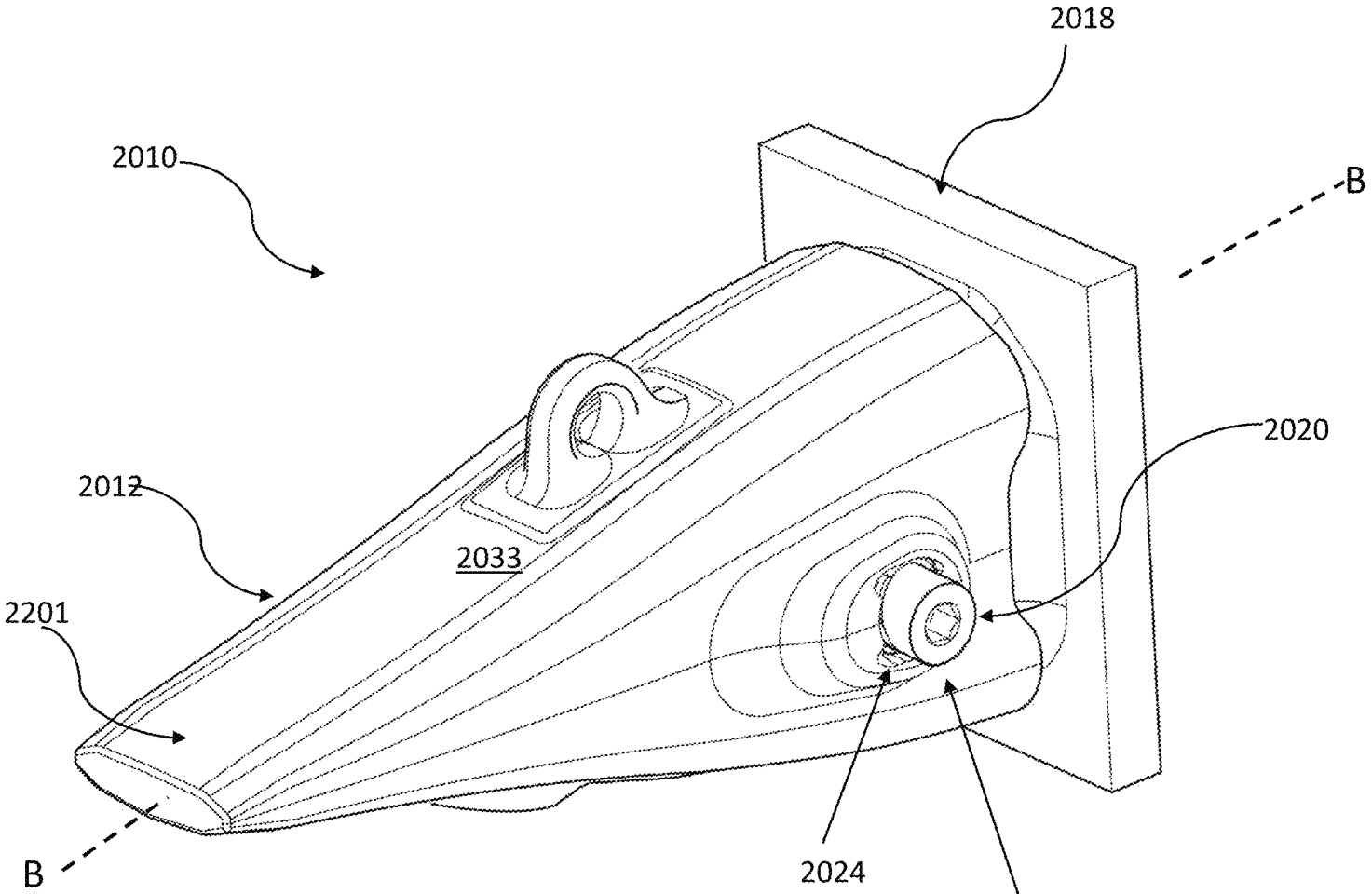
FIG. 43 is a perspective view of an excavation wear assembly including an embodiment of a locking assembly.
Figure 44A:
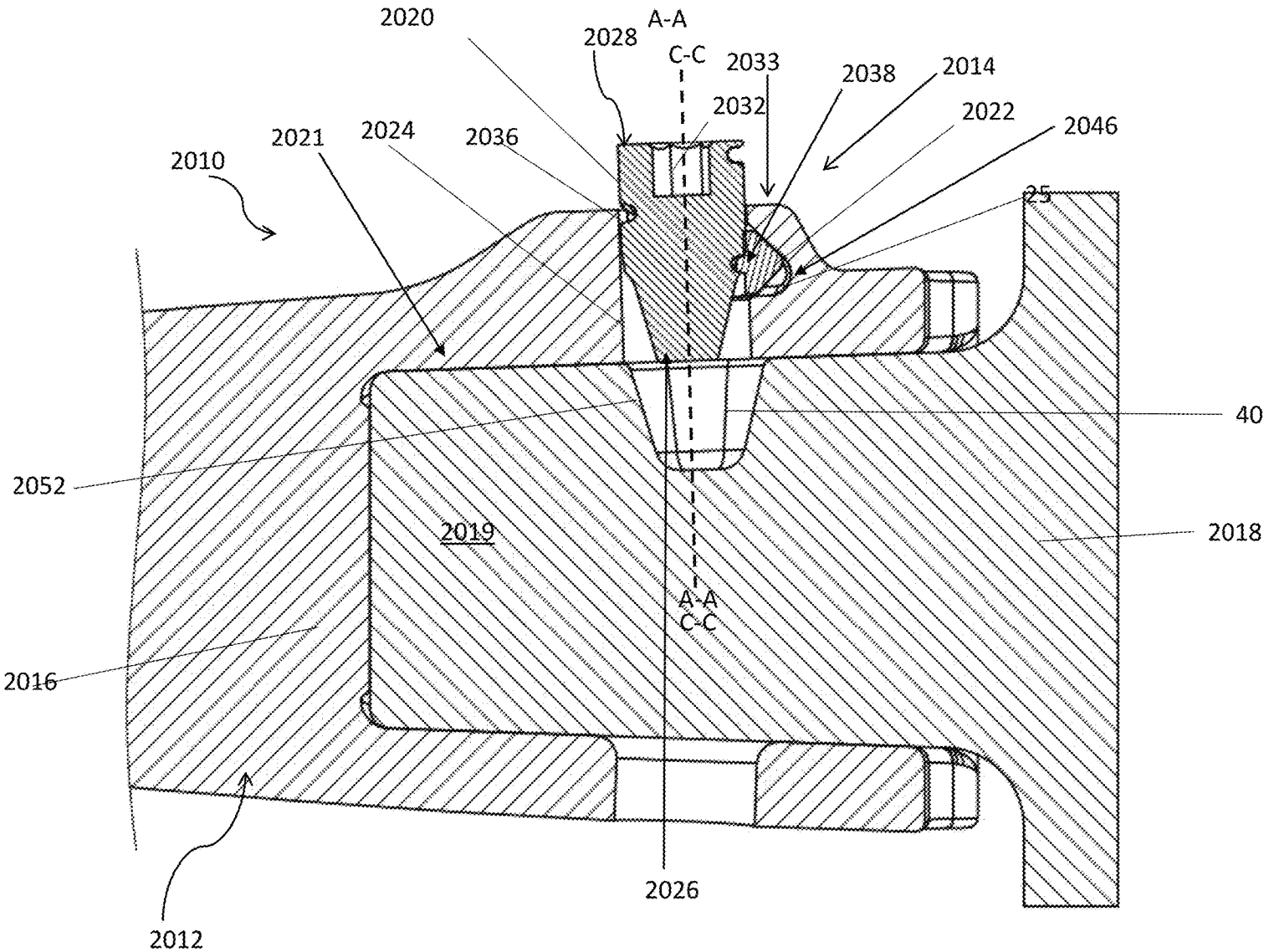
FIG. 44*a* is a sectional view of the excavation wear assembly of FIG. 43 mounted on a support structure with a locking pin in a retracted position.
Figure 44B:
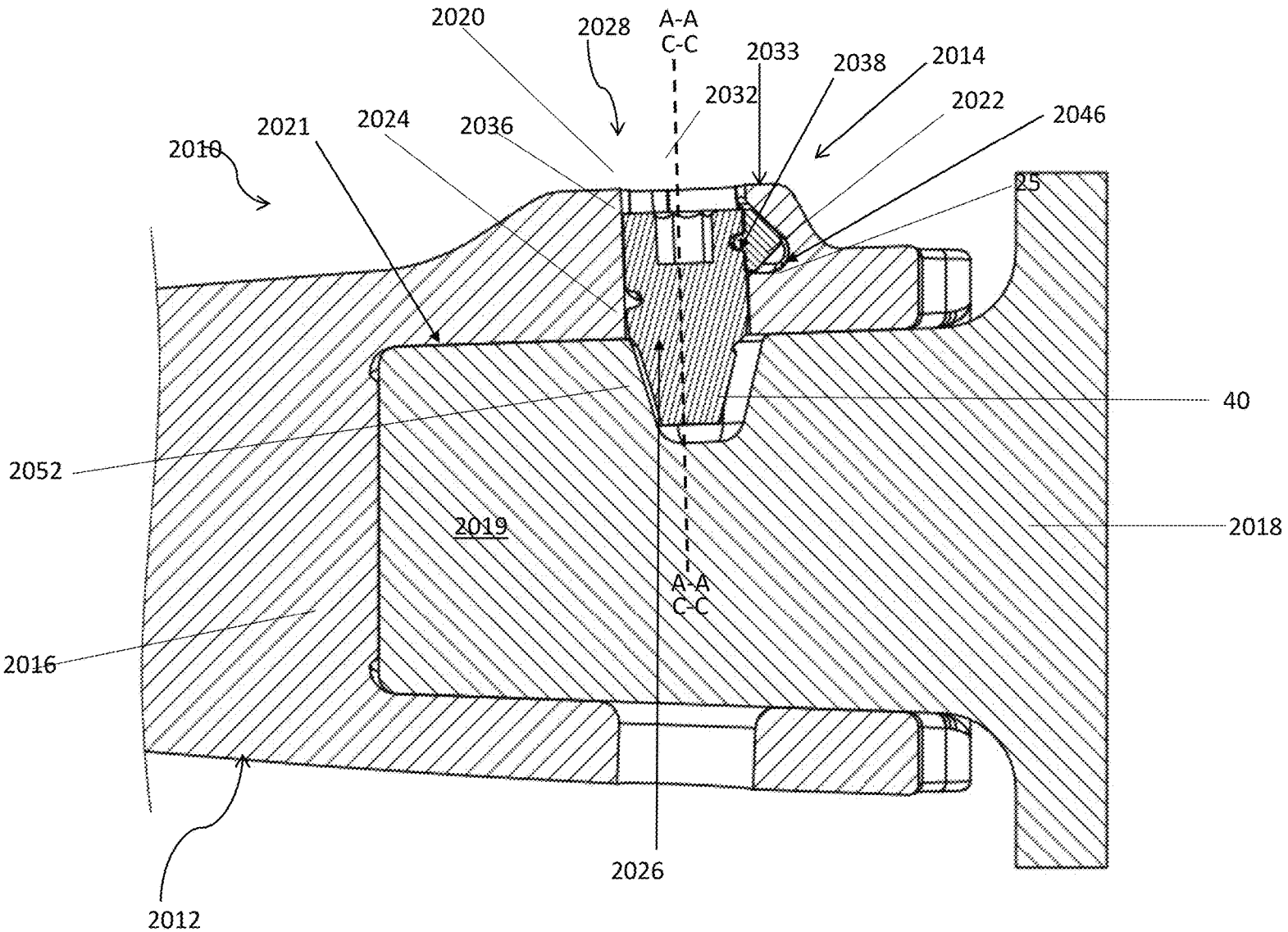
FIG. 44*b* is a sectional view of the excavation wear assembly of FIG. 43 mounted on a support structure with a locking pin in a locked position.

Referring to FIGS. 43 and 44*a* and 44*b*, there is shown a wear assembly 2010, comprising a wear member 2012 mountable to a support structure 2018, and a locking assembly 2014. Referring specifically to FIG. 44*a*, the wear member 2012 has a cavity or socket 2016, and the support structure 2018 has a nose portion 2019. The lock assembly 2014 includes a lock body shown in the form of a locking pin 2020 and retainer 2022. The locking pin 2020 is inserted into a locking hole 2024 formed in the wear member 2012 and in one form, is disposed in place prior to mounting the wear member 2012 to the support structure 2018. In this way the wear member may be provided with the lock preinstalled. Various approaches to secure the lock to the wear member are disclosed below. The socket 2016 of the wear member 2012 is configured to receive the nose portion 2019 of the support structure 2018 when the wear member 2012 and the support structure 2018 are brought together as shown in FIG. 44*a*. In use, the support structure 2018 is attached to a digging edge or lip of excavation equipment (not shown), and the wear member 2012 includes the outer wear surface 2033 and edge 2201 which does the digging.

The locking hole 2024 that extends through a wall of the wear member and is open at both ends thereof. The first end is adapted at an in-use outer surface 2033 of wear member 2012, whereas the second end of the locking hole 2024 opens into an in-use inner surface that defines the socket 2016. The locking assembly 2014 is insertable within the locking hole 2024 of the wear member 2012 and, therethrough, into a recess 40 of the support structure 2018 so as to secure the wear member 2012 to the support structure 2018. The locking pin 2020 and the inner surface of the retainer 2022 are each formed to have a substantially corresponding diameter such that the locking pin 2020 can be engaged through an engaging structure 2030 that is configured, in the embodiment shown, along the interior wall of the retainer 2022 and on the surface of the locking pin body 2027.

In use, in the illustrated form of FIGS. 43 to 46, the retainer 2022 is installed into the locking hole as a separate step to installation of the pin. In the embodiment of FIGS. 43 to 46, the retainer 2022 is able to be inserted from the outer surface 2033 of the wear member and includes a lobe 2046 that locates into a correspondingly shaped retainer cavity 2025 that provides an abutment and forms a part of a retaining structure and that is inset along the interior facing walls from the in-use outer surface 2033 and recessed into the wall of the locking hole 2024 to form a pocket therein. The retainer 2022 can be inserted through the aperture at the outer surface 2033 of the wear member 2012 (i.e. first distal end of the locking hole 2024) with the lobe 2046 extending in first, and then pivoted to locate into the retainer cavity 2025 where after, the remaining part of the retainer can drop into the locking hole 2024. A ledge, (not shown), which circumscribes at least a portion of the locking hole and faces towards the outer surface 2033, forms a part of the retaining structure and is arranged to engage with the retainer to keep within the locking hole with the lobe engaged in the retaining cavity and in an orientation where the retainer is generally perpendicular to the axis of the locking hole. With this arrangement, the retainer 2022 is stably supported in the locking hole and is prevented from rotating about the locking hole axis by interaction of the lobe 2046 in the cavity 2025. Whilst the retainer 2022 is able to be easily removed from locking hole by a reverse pivoting action to the way it is installed, once the locking pin 2020 is inserted via the outer surface 2033, the pivoting action of the retainer is prevented, and thus the retainer and pin are fully captured within the wear member.

While the embodiment of FIGS. 43 to 46 illustrates the retainer 2022 as a single piece, it is to be appreciated that the retainer could be made from multiple pieces, or segments that are each locatable within the locking hole (in one form by having respective lobes that locate in one or more recessed section of the locking hole 2024) that together function as the retainer 2022. If formed from multi segments, these segments may have different material properties (such as elastic, or ability to compress) that could further refine the performance characteristics of the assembly.

The lock body 2020 and retainer 2022 can both be secured in place prior to the mounting of the wear member 2012 to the support structure 2018.

Figure 45B:
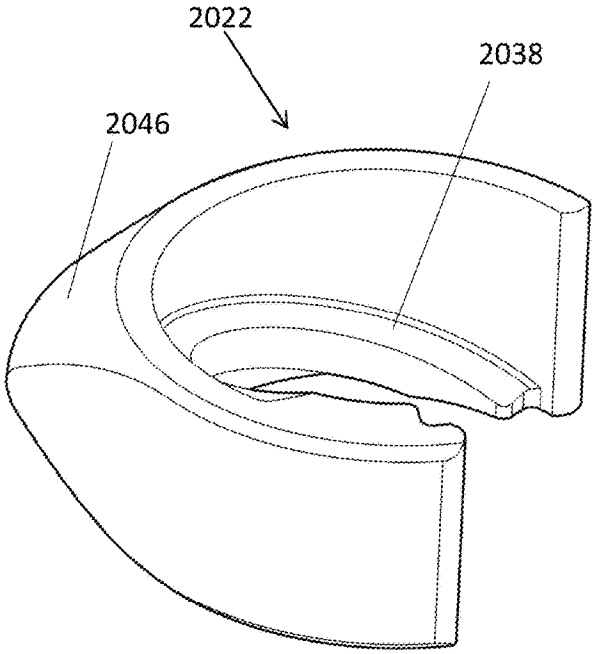
FIG. 45*b* is a perspective view of an embodiment of a locking assembly for an excavation wear assembly.
Figure 45A:
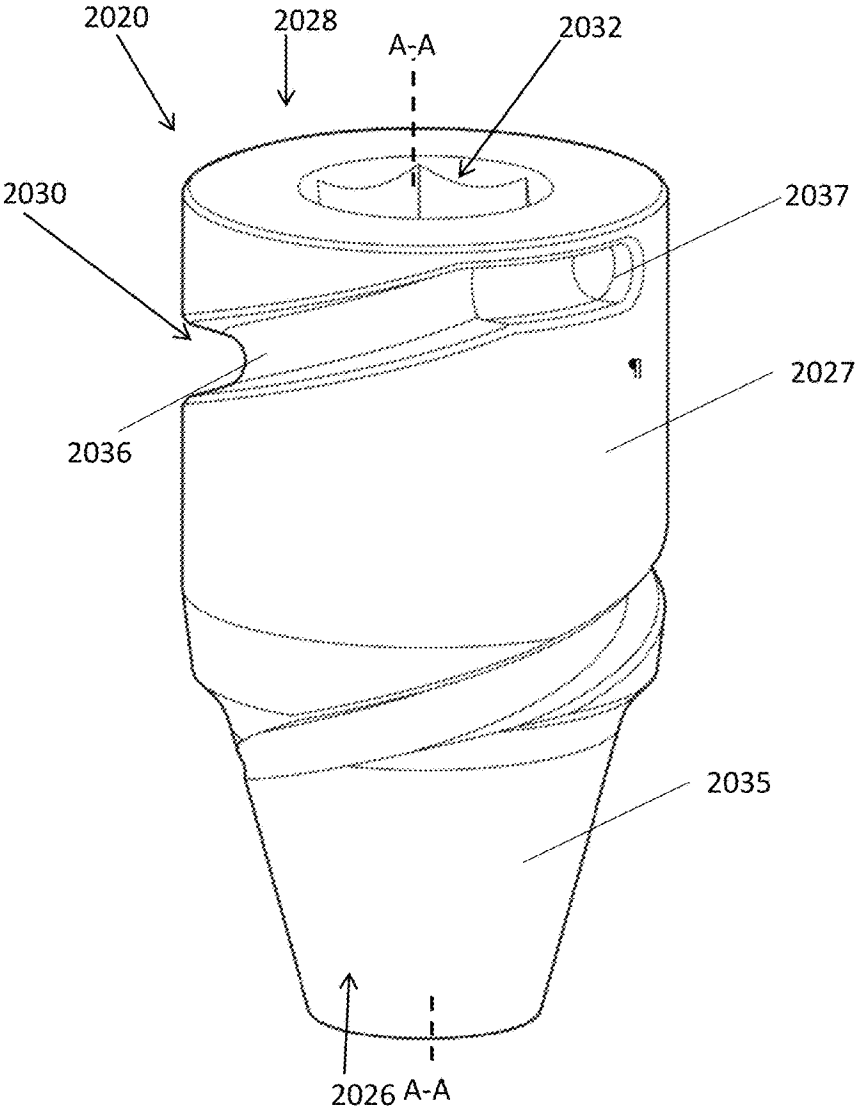
FIG. 45*a* is a perspective view of a locking pin for an embodiment of a locking assembly.
Figure 45C:
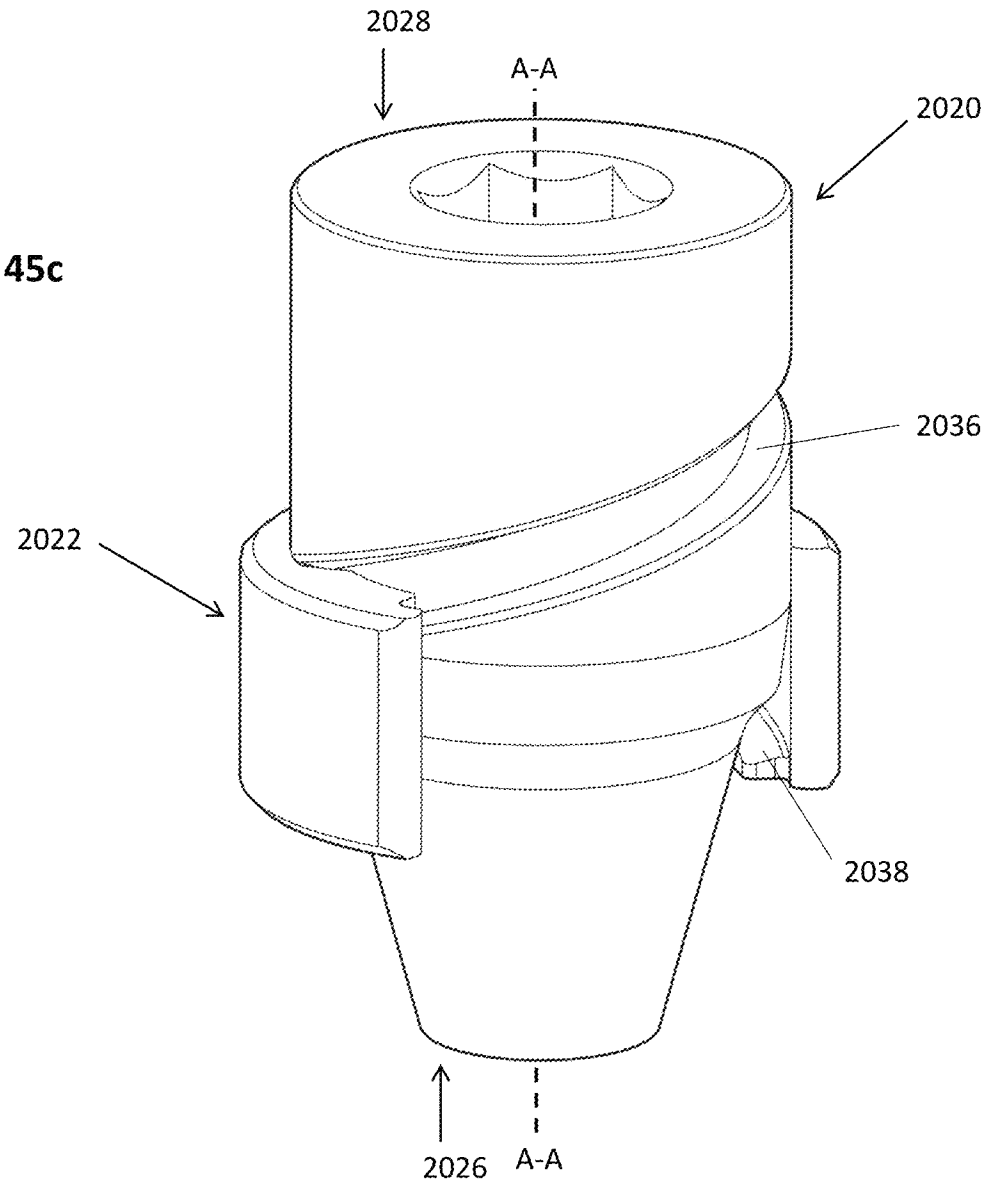
FIG. 45*c* is a perspective view of a retainer for an embodiment of a locking assembly.
Figure 46:
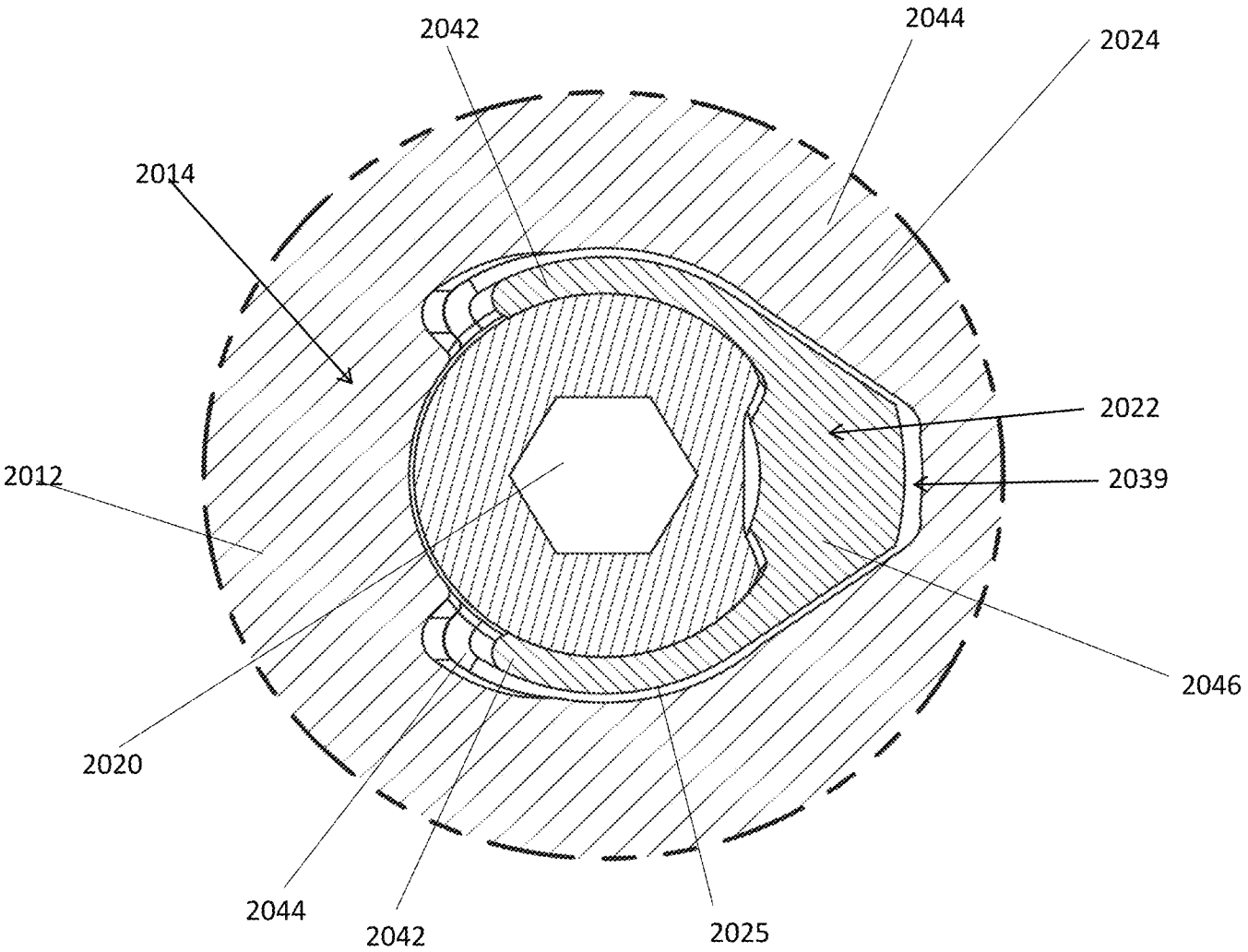
FIG. 46 is a sectional plan view of a perspective of a locking assembly for an excavation wear assembly.

As best shown in FIGS. 45*a* and 45*c*, the lock body 2020 extends along a centrally aligned pin axis A-A and includes a first end 2026 and a second end 2028 that are spaced apart along the pin axis A-A by a pin body 2027 that comprises one part 2036 of the engaging structure 2030 that interconnects the pin and retainer. The engaging structure 2030 can be generally helical, i.e. a threaded arrangement such that the one part 2036 extends at least partially along the length of the pin body 2027. In this way the engaging structure can promote axial movement of the pin relative to the retainer under rotation of the lock body 2020.

The pin body 2027 is formed to taper frustoconically towards the first end 2026. The first end 2026 of the lock body 2020 is thus configured to act as the leading end of the pin 2020. This can improve the ease with which the lock body 2020 is able to be inserted or removed from the locking hole 2024 in general, and in particular the taper may improve the ability of the lock body 2020 removal when the locking hole 2024 contains some material fines that may ingress into the locking hole on operation of the excavating equipment.

The engaging structure 2030 in the embodiment of FIGS. 43 to 46, comprises the one part in the form of groove 2036 that extends helically around the surface of the pin body 2027, and that extends for at least part of the length of the lock body 2020 between the first end 2026 and a second end 2028. In some forms, such as in FIGS. 45*a* to 45*c*, the helical groove 2036 wraps at least approximately 360°, i.e. one revolution, around the pin body 2027 as it traverses from the second end 2028 towards the first end 2026. The retainer 2022 is formed to comprise a helical ridge 2038 that corresponds to the other part of the engaging structure 2030 that engages with, the groove 2036 of the helical arrangement 2030 of the pin 2020 (e.g. FIGS. 45*b* and 45*c*). In some forms, the groove 2036 is open at its opposite ends. Such that the engaging structures do not limit the extent of axial travel of the pin. However, in the illustrated form, and as best illustrated in FIG. 45, the upper end 2037 of the groove is closed which provides a rotational stop and limits the travel of the pin into the wear member.

The engaging structure 2030 enables the locking pin 2020 to move axially into the locking hole 2024, and relative to the wear member 2012, when the pin 2020 is rotated. In addition, the engaging structure 2030 prevents axial separation and therefore enables the locking assembly to withstand loading that may be induced on the pin that could otherwise cause ejection of the pin from the locking hole. For example, in use a rotation force can be applied via the drive arrangement 2032 that is configured at the second end 2028 of the locking pin 2020. The helical groove 2036 engages with the ridge 2038 of the retainer 2022, causing the locking pin 2020 to be axially displaced relative to the retainer 2022 that is captively retained within the retainer cavity 2025 of the wear member 2012. The number of rotations that the locking pin 2020 can be turned through within the locking hole 2024 is defined by the length of the pitch. The pitch of the helical arrangement can be varied in order to vary the axial displacement. The helical threaded arrangement of the engaging structure 2030 can thus be formed to have a pitch that corresponds with the desired axial displacement of the locking pin 2020 within the locking hole 2024 such that the pin 2020 can be axially displaced to protrude from the locking hole 2024 and extend into the recess 40 of the support structure 2018.

The drive arrangement 2032 can be formed as a hexagonal recess 2034 or other shaped drive at the second end 2028 of the locking pin 2020. Using a correspondingly shaped tool inserted within the recess 2034, an operator is thereby able to effect a rotational force on the locking pin 2020, as required, so as to rotate and drive the locking pin 2020 during installation or removal of the locking pin 2020 from the locking hole 2024. When the locking pin 2020 is inserted into the locking hole 2024, the drive arrangement 2032 remains uncovered. This allows for easy access to the drive arrangement 2032 when removal of the locking pin 2020 from the locking hole 2024 is desired. For example, when the wear member 2012 needs to be replaced, the locking pin 2020 can be removed by rotating the drive arrangement 2032 in a direction that is opposite from the direction of rotation used when inserting the locking pin 2020 until the locking pin 2020 has reached a retracted position within the locking hole 2024.

In general, the locking pin 2020 is movable axially under continual rotation so that the pin is able to locate in different functional positions including a retracted position and an extended position as explained below.

As shown in FIG. 44*a*, in the retracted position the leading first end 2026 of the locking pin 2020 does not extend into the socket 2016 of the wear member 2012, or does not substantially protrude beyond an in-use inner surface 2201 of the wear member 2012, where the inner surface 2021 is the side of the wear member 2012 that locates adjacent to the support structure 2018. In the retracted position, because the leading first end 2026 of the locking pin does not extend into recess 40 of the support structure 2018, the pin 2020 is thus configured such that it does not impede the passage, movement, or removal of the wear member 2012 from the support structure 2018 being received within the wear member socket 2016. Thus, when the locking pin 2020 is in the retracted position the wear member 2012 can be installed on, or removed from, the support structure 2018.

In the extended or locked position, shown in FIG. 44*b*, the leading first end 2026 of the pin 2020 is arranged to extend into the recess 40 of the support structure 2018. This can be achieved by rotating the pin 2020 in a positive direction whereby the locking pin 2020 moves axially until the locking pin 2020 extends into the recess and secures the wear member 2012 to the support structure 2018. To revert the locking pin 2020 to the retracted position, the pin 2020 can be rotated in a reverse direction along the helical threaded arrangement of the engaging structure 2030 whereby the locking pin 2020 moves axially in the opposite direction, away from support structure 2018 until the locking pin 2020 no longer extends into, and is disengaged from, the recess 40.

The first end 2026 of the locking pin 2020 includes a bearing surface 2035 that is arranged to engage with the wall 2052 of the recess 40. For example, the bearing surface 2035 can comprise a threaded arrangement that is adapted to engage with a correspondingly threaded arrangement formed along the walls 2052 of the recess 40. When in the extended position, the locking pin 2020 can engage with the adjacent interior facing walls 2052 that define the recess 40. The engagement between the locking pin 2020 and interior facing walls 2052 of the recess 40 is sufficient to retain the wear member 2012 on the support structure 2018.

The pin 2020 is formed to have a frustoconical taper as the pin body 2027 approaches the first end 2026. This can improve the ease with which the pin 2020 can be retracted from the wear member 2012 and/or support structure 2018 when surrounded by residue such as material fines. When the pin 2020 is moved from the retracted position to the extended position, the taper on the leading first end 2026 of the pin 2020, in cooperation with the angle of the wall 2052 of the recess 40, can pull together and align the locking hole 2024 and the recess 40, whereby the wear member 2012 is secured in position on the support structure 2018.

The recess 40 is correspondingly shaped so as to receive the leading first end 2026 of the locking pin 2020. In use, when the wear member 2012 is mounted to the support structure 2018, each recess 40 can be aligned with a correspondingly spaced locking hole 2024. For example, the wear member can comprise a plurality of locking holes that are each spaced apart so as to align and locate adjacent, in use, with a plurality of recesses on the support structure. In a further example, a support structure can be formed to comprise a plurality of recesses that are each spaced from one another so as to align with a single locking hole of a wear member, with a plurality of wear members being located adjacent one another so as to collectively sacrificially protect the support structure from damage during excavation. Variations of the size, shape and number of locking holes per wear member are contemplated, as would be appreciated by one skilled in the art. Similarly, variations of the size, shape and number of recesses per support structure are also contemplated, as would be appreciated by one skilled in the art.

If required, the pin 2020 may also be positioned in other functional positions other than the retracted or extended position. For example, it may be desirable to define a discrete transport position where the pin of the locking assembly installed on the wear member is located for transport to site. For example, whilst not shown, a transport position may be such that the leading first end 2026 partially protrudes from the locking hole 2024 so to extend and encroach into the socket 2016 of the wear member 2012. When the pin 2020 is in the transport position, the locking pin 2020 is configured to prevent the wear member 2012 from being installed to the support structure 2018. Instead, when an operator attempts to assemble the wear member 2012 onto the support structure 2018 there exists an interference fit therebetween preventing the installation. This would then necessitate the need for the pin to be "backed off" to be installed. This may be achieved by unwinding the pin from the locking hole or by other means (such as through a cam action that causes the pin and or the locking assembly to lift)

In the embodiment of FIGS. 43 to 46, The retainer 2022 may be formed from a spring-like or resiliently flexible material, such as spring steel, into a C-shaped spring collar. The retainer 2022 comprises the lobe 2046 that protrudes from the otherwise generally circular C-shape (see FIGS. 45*b* and 46). As described above, when the retainer 2022 is inserted within the locking hole 2024, the lobe 2046 locates within the cavity 2025 so as to align therein and captively retain the retainer 2022 in the desired position and orientation within the locking hole 2024, in use. The interaction between the lobe 2046 and the enlarged portion 2039 can prevent the retainer 2022 from rotating within the cavity 2025 when installed therein, for example, when a rotational force is applied via the locking pin 2020 against the helical ridge 2038 of the retainer 2022.

The C-shaped spring clip includes two arms 2042. The resiliently flexible material enables the two arms 2042 to be biased towards a natural or rest position when deflected away therefrom. When the retainer 2022 is located inside the cavity 2025, the rest position of the two arms 2042 provides that a gap 2044 exists between each arm 2042 and the in-use adjacent wall of the cavity 2025. Furthermore, in the rest position of the retainer 2022 the arms 2042 are spaced from one another such that when a locking pin 2020 is inserted therebetween, the arms 2042 form an interference fit around the pin 2020. In other words, in the resting position the substantially circular aperture formed by the arms 2042 and body of the C-shaped clip has a smaller diameter than the diameter of the pin 2020. In this way, the arms 2042 of the spring clip 2022 can partially block the locking hole 2024 for the incoming locking pin 2020. As the locking pin 2020 is engaged between the arms 2042 of the retainer 2022, the arms 2042 can be resiliently flexed outwards, with the inward bias of the arms 2042 (counteracting the outward flex of the arm 2042) applying a positive force against the locking pin 2020. The positive force of the inward bias of the arms 2042 against the locking pin 2020 can generate a friction based torsional resistance that assists the retainer 2022 in gripping and retaining the locking pin 2020 in use. This torsional resistance can help reduce the effects of vibrations that may otherwise cause the locking pin 2020 to rotate and come loose, or from moving axially towards the retracted position.

The C-shaped spring clip retainer 2022 can thus resist rotation of the locking pin 2020 within the locking hole 2024 and also through the engaging structure, resists axial movement of the pin. As such, the retainer 2022 acts to maintain the locking pin 2020 in the desired configuration, in use.

When the locking pin 2020 is installed into the C-shaped spring-clip retainer 2022, the arms 2042 of the retainer 2022 block the entry of the locking pin 2020 into the locking hole 2024 until a force above the required threshold force is applied by the pin 2020 to force the locking pin to engage the arms 2042 and flex the arms 2042 against their bias towards the natural position of the retainer 2022. Subsequently, once the threshold force is reached, the pin 2020 is able to ride past (or through) the arms 2042 of the retainer 2022 by flexing the arms 2042 against their bias away from one another. As the arms 2042 flex open, the each of the arms 2042 respectively move into the adjacent gaps 2044 and towards the interior facing walls of the locking hole 2025. This movement occurs until the engaging structure 2030 engages where after rotation of the pin is required to allow continued travel of the pin. This allows the pin 2020 to move axially through the retainer 2022 into the transport position or extended position, as required.

In use, as the helical groove 2036 of the pin 2020 rotates around the helical ridge 2038 of the retainer 2022, the inward bias of the arms 2042 applies a radial pressure such that the pin 2024 is resistant to the movement. Consequently, a corresponding torque needs to be applied to the drive arrangement 2032 in order to rotate the pin 2020 between the retracted position and the extended position. If the rotational force applied to the pin 2020 is less than the resistance force generated by the interaction of the retainer arms 2042 around the pin 2020, the pin 2020 is retained in the retracted or extended positions, or in any position therebetween.

The radial pressure applied to the retainer arms 2042 can hold the pin 2020 within the locking hole 2024, even when the helical ridge 2038 and groove 2036 of the engaging structure 2030 are not engaged. This can allow the wear member 2012 to be positioned in an inverted orientation without the pin 2020 falling from the locking hole 2024 because of gravity.

In use, the resilient retainer may be specifically shaped to assume the desired position within its natural (unstressed) state. In this way it can simplify the manufacturing process as it avoids the need for a multi-step process (such as a post deforming step) to alter the shape of the retainer, or the need to add material (such as an inner liner) to assume that desired shape and performance characteristics.

Referring now to FIG. 44*a*. The wear member 2012 is shown in a received configuration on the support structure 2018, with a locking assembly 2014 inserted within the locking hole 2024 of the wear member 2012. The locking assembly 2014 is configured in the retracted position. The wear member 2012 and the support structure 2018 both generally extend along a longitudinal assembly axis B-B. The locking hole 2024 is formed to extend along a lateral axis C-C, that can be substantially perpendicular relative to the assembly axis within the locking hole 2024. For example, the pin axis A-A can be colinear with the lateral axis of the locking hole 2024, and both axis A-A, C-C can be perpendicular to the wear assembly axis B-B (see FIG. 43).

Figure 47A:
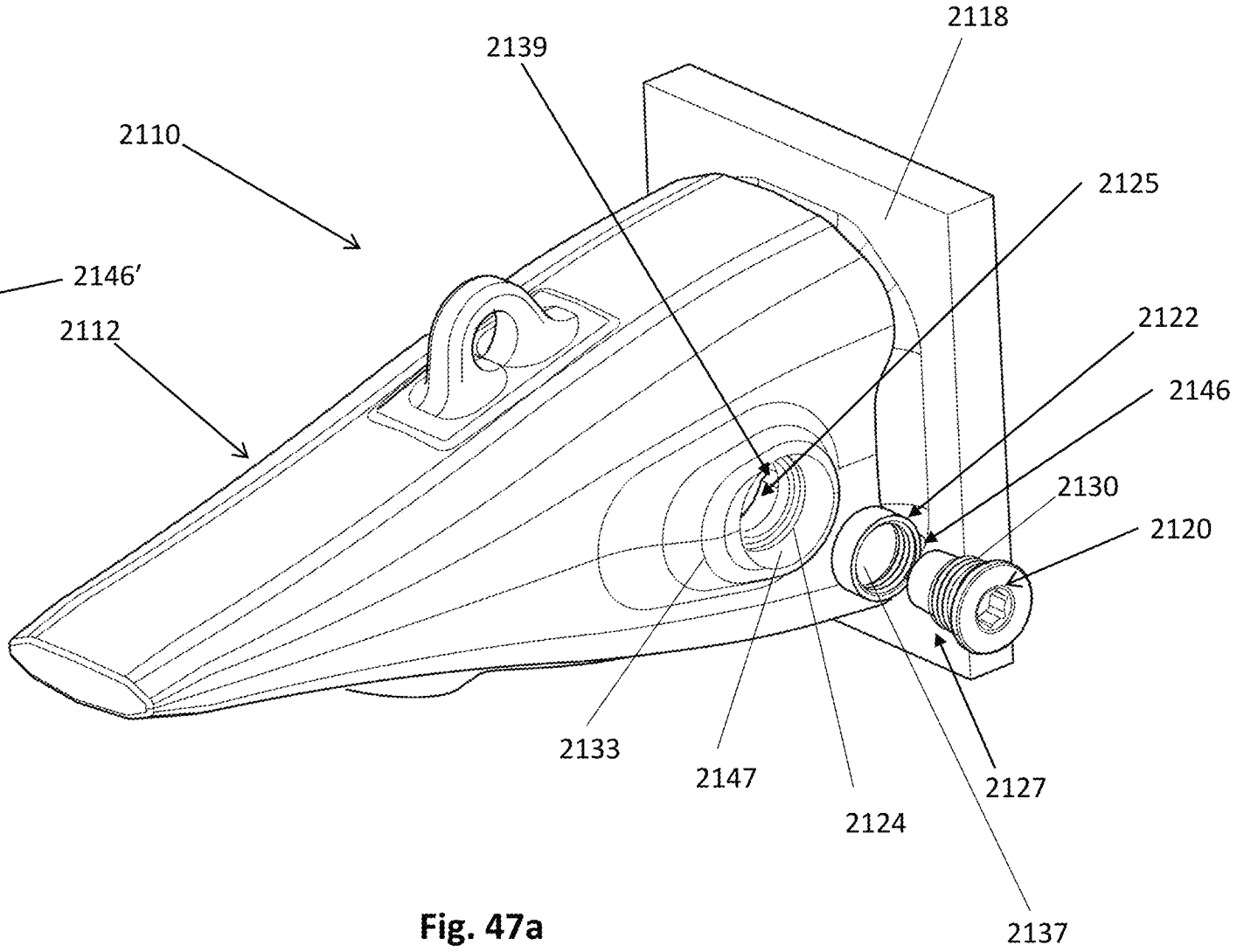
FIG. 47*a* is a perspective view of a second embodiment of a locking assembly for an excavation wear assembly.
Figure 47B:
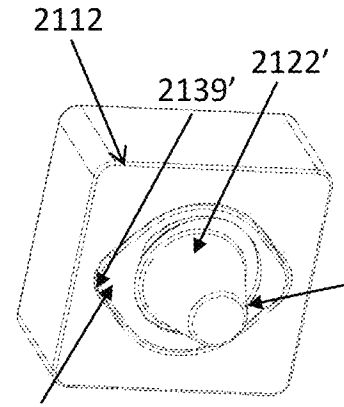
FIG. 47*b* is a perspective view of a variation of the locking assembly of FIG. 47*a;*

FIG. 47*a* illustrates a second embodiment of a locking assembly 2110 in accordance with the present disclosure. Similar reference numerals, but with the addition of the prefix "21" instead of "20", are used when referring to features that are the same unless described as being otherwise.

In the second embodiment, the retainer 2122 is a nut that is fully enclosed, i.e. not an open C-shape. The enclosed retainer 2122 can be formed to comprise a resilient material, for example a spring steel. When the enclosed retainer 2122 is deflected, the resilient material is biased so as to substantially return the enclosed retainer 2122 to its original shape.

In some forms, the enclosed retainer 2122 can be formed to have a substantially circular ring shape, with a central hollow 2137 that has a diameter smaller than the diameter of the locking pin 2120. In-use, the central hollow 2137 thus protrudes into the path of the locking pin 2120 so as to provide an interference fit over the pin 2120. The enclosed retainer 2122 can therefore apply a pressure force against the locking pin 2120 that restrict the rotation or free movement of the locking pin 2120 through the locking hole 2124, thereby improving the retention of the locking pin 2120 within the locking hole 2124.

In some forms, the central hollow 2137 can be an ovular shape such that only a portion of the central hollow 2137 forms an interference fit with the locking pin 2120. The ovular shape, i.e. elliptical shape, has a major and minor axis, wherein the minor axis is smaller than the major axis. For example, the minor axis can be shaped to have a diameter smaller than the locking pin 2120. As such, the central hollow 2137 of the retainer 2122 provides an interference fit when engaged by the locking pin 2120. The interference can thus be isolated to the two regions of the central hollow 2137 that locate proximal to the contact point between the minor axis and the locking pin 2120. The two regions of the central hollow 2137 that contact the locking pin 2120 are biased towards one another as a result of the diametral interference and outward deflection caused by the engagement of the locking pin 2120. In other words, the opposing sidewalls of the retainer 2122 are spaced from one another such that when the retainer 2122 is fitted to the locking pin 2120, the opposing sidewalls are in interference with the pin 2120. In this way, the two regions of the retainer 2122 somewhat impede the passage of the pin 2120 through the locking hole 2124.

The inwardly facing wall of the central hollow 2137 of the enclosed retainer 2122 is helically threaded to correspond to, and engage with, the threaded arrangement of the engaging structure 2130 adapted along at least a portion of the pin body 2127.

In use, the enclosed retainer 2122 is normally inserted into the locking hole 2124 via the interior of the wear member. In an alternative form, the retainer may be resiliently flexed so as to be pass through the aperture at the outer surface 2133 of the wear member 2112 (i.e. first distal end of the locking hole 2124) and into the locking hole 2124. The enclosed retainer 2122 is thus located within a correspondingly shaped retainer cavity 2125 that is inset along the interior facing walls of the locking hole 2124 from the in-use outer surface 2133 and recessed into the circumference of the walls.

The retainer 2122 can comprise at least one lobe 2146 that projects from the external facing wall of the retainer 2122 into correspondingly shaped niche 2139 of the retainer cavity 2125. The interaction between the at least one lobe 2146 and the correspondingly shaped niche 2139 forms an abutment and can assist with aligning the retainer within the cavity 2125. The interaction can also assist with preventing the retainer 2122 from rotating within the cavity 2125 when installed therein, for example, when a rotational force is applied via the locking pin 2120 against the enclosed retainer 2122. In use, the retainer 2122 is arranged to be inserted via the interior surface of the wear member (ie. within the socket) and locates against a ledge 2147 which prevents the retainer 2122 from being removed via the outer surface of the wear member.

FIG. 5*b* illustrates a variation on the retaining lobe 2146 of the retainer 2122 and correspondingly shape niche 2139 in the wear member. In this arrangement, the retainer 2122' has opposite lobes 2146' that are generally tear shaped and locate in correspondingly shaped niches 2139'. The retainer is located in place from within the cavity of the wear member 2112. the more gradually curved design of the loads provides good stress flow through the retainer without high stress concentrations whilst resisting rotation of the retainer in the locking hole.

Figure 48:
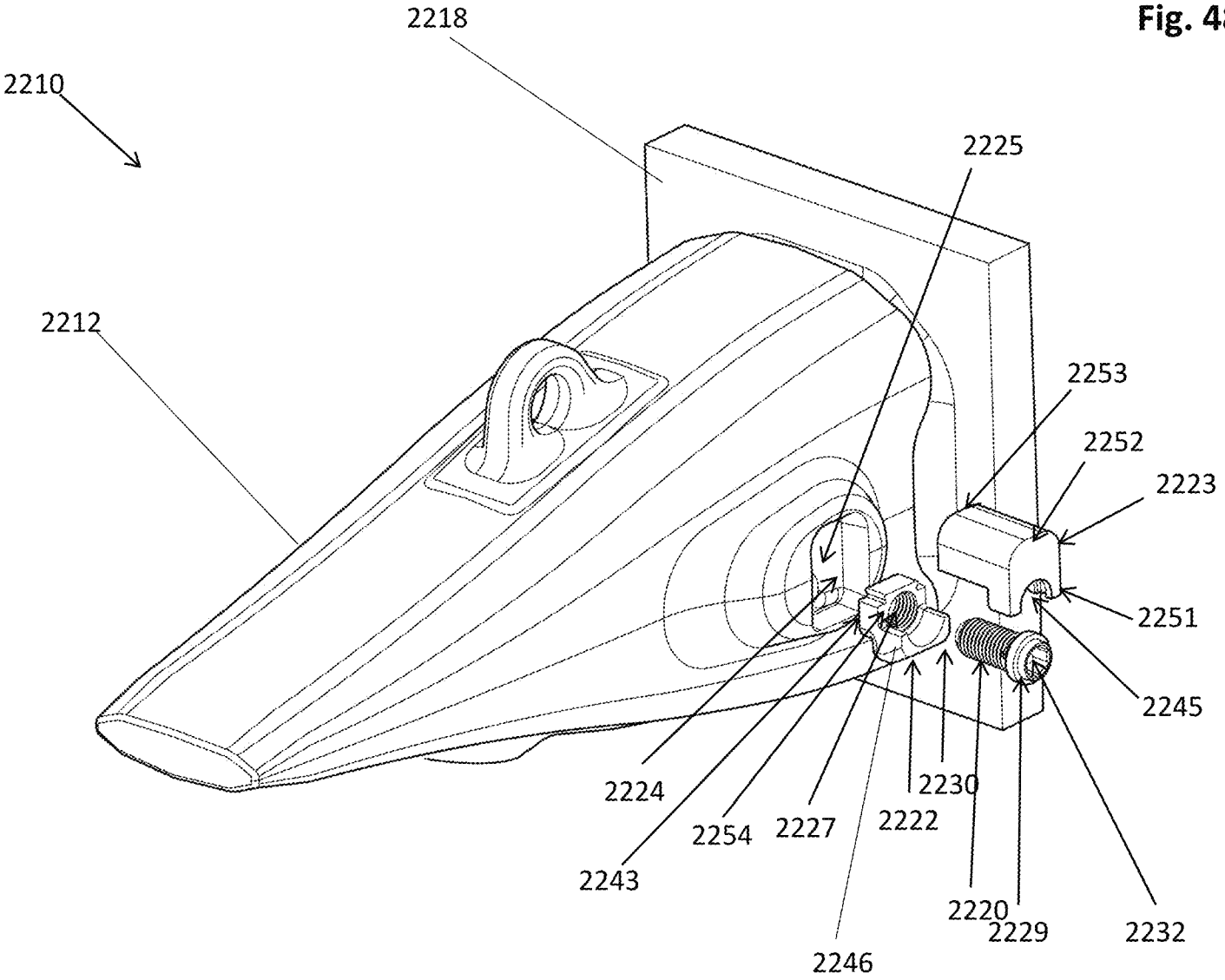
FIG. 48 is a perspective view of a third embodiment of a locking assembly for an excavation wear assembly.
Figure 49A:
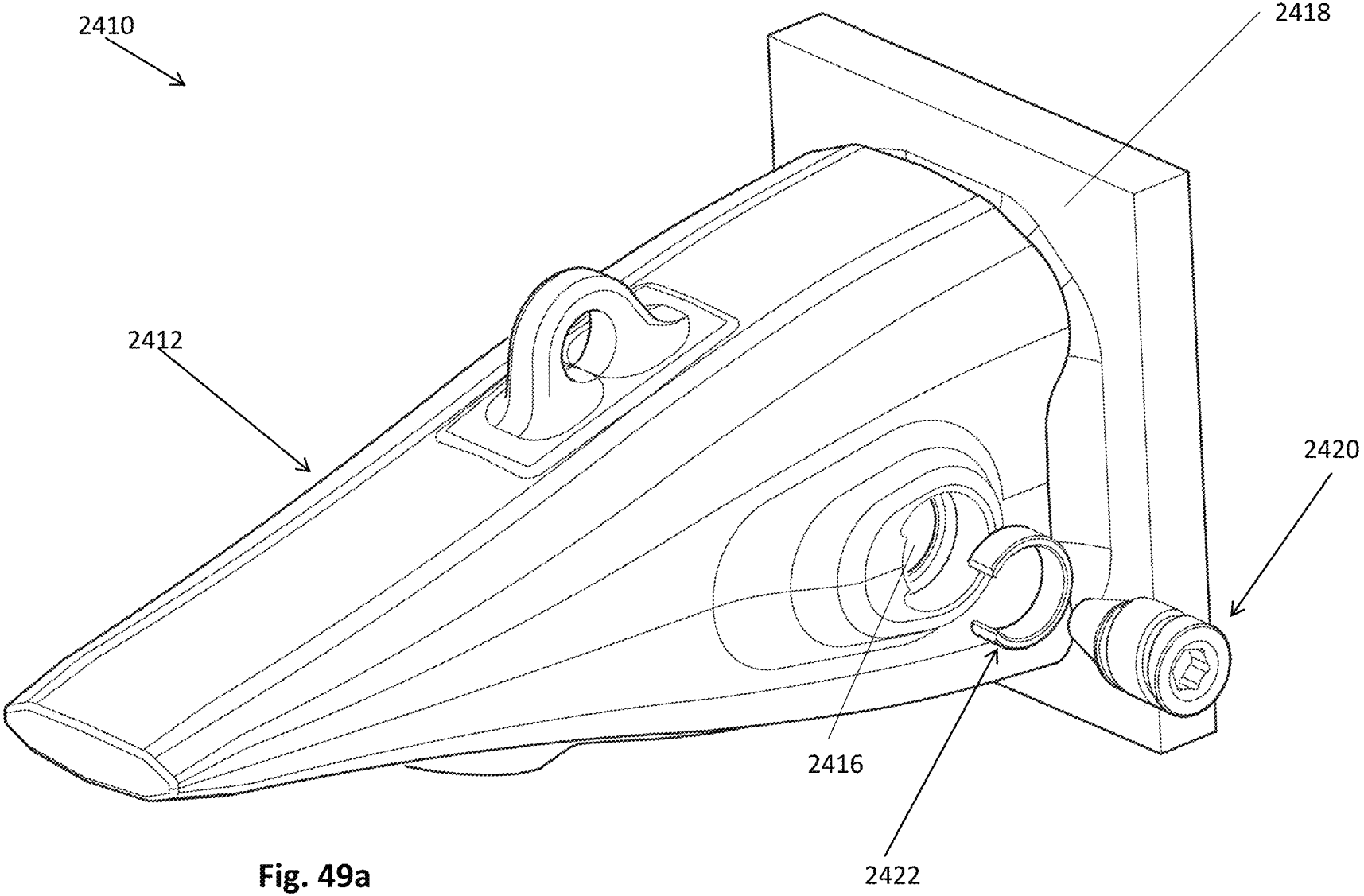
FIG. 49*a* is an exploded perspective view of a fourth embodiment of a locking assembly for an excavation wear assembly.
Figure 49B:
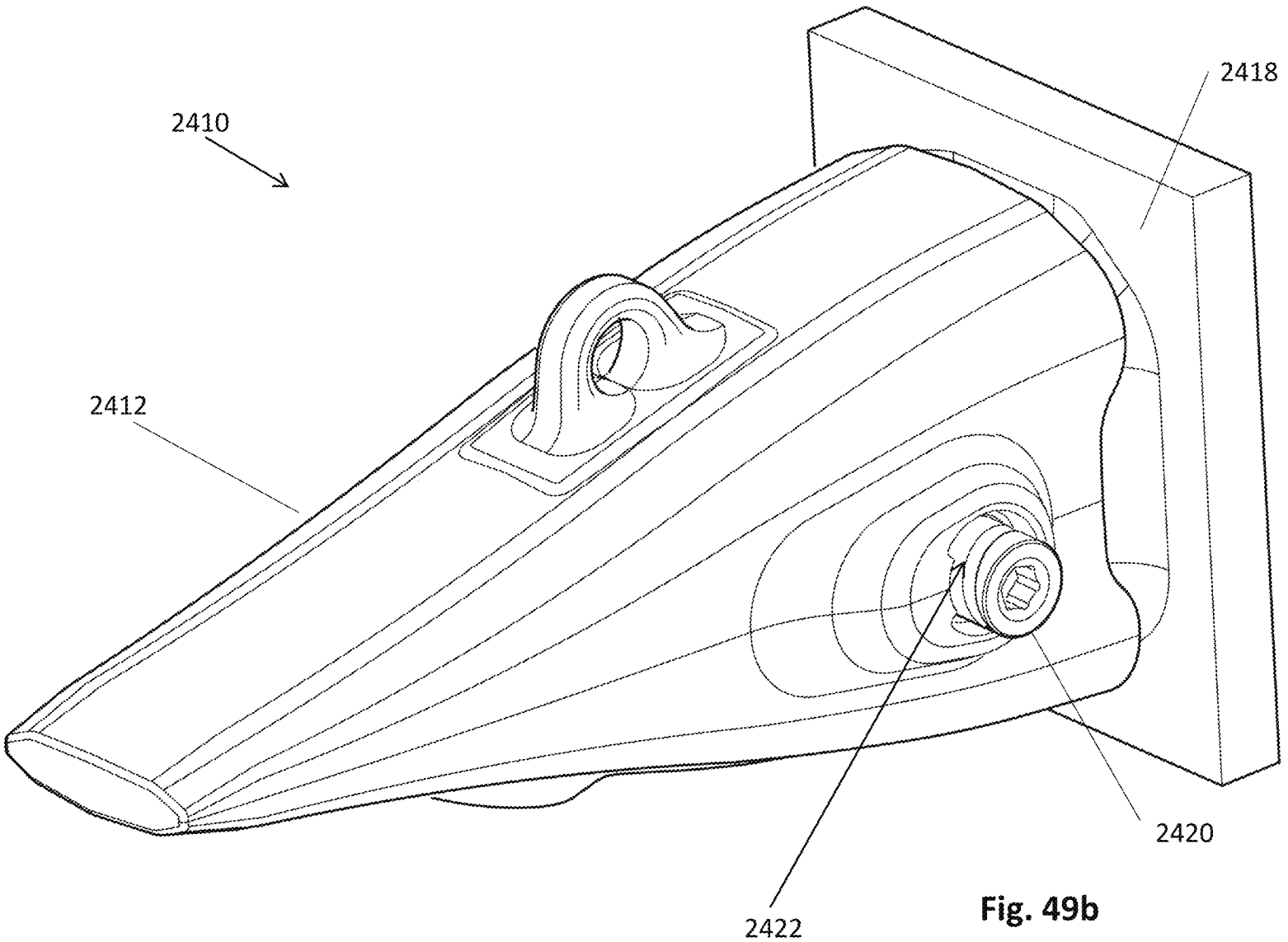
FIG. 49*b* is a perspective view of the fourth embodiment of a locking assembly for an excavation wear assembly, with the locking pin in in a retracted position.
Figure 49C:
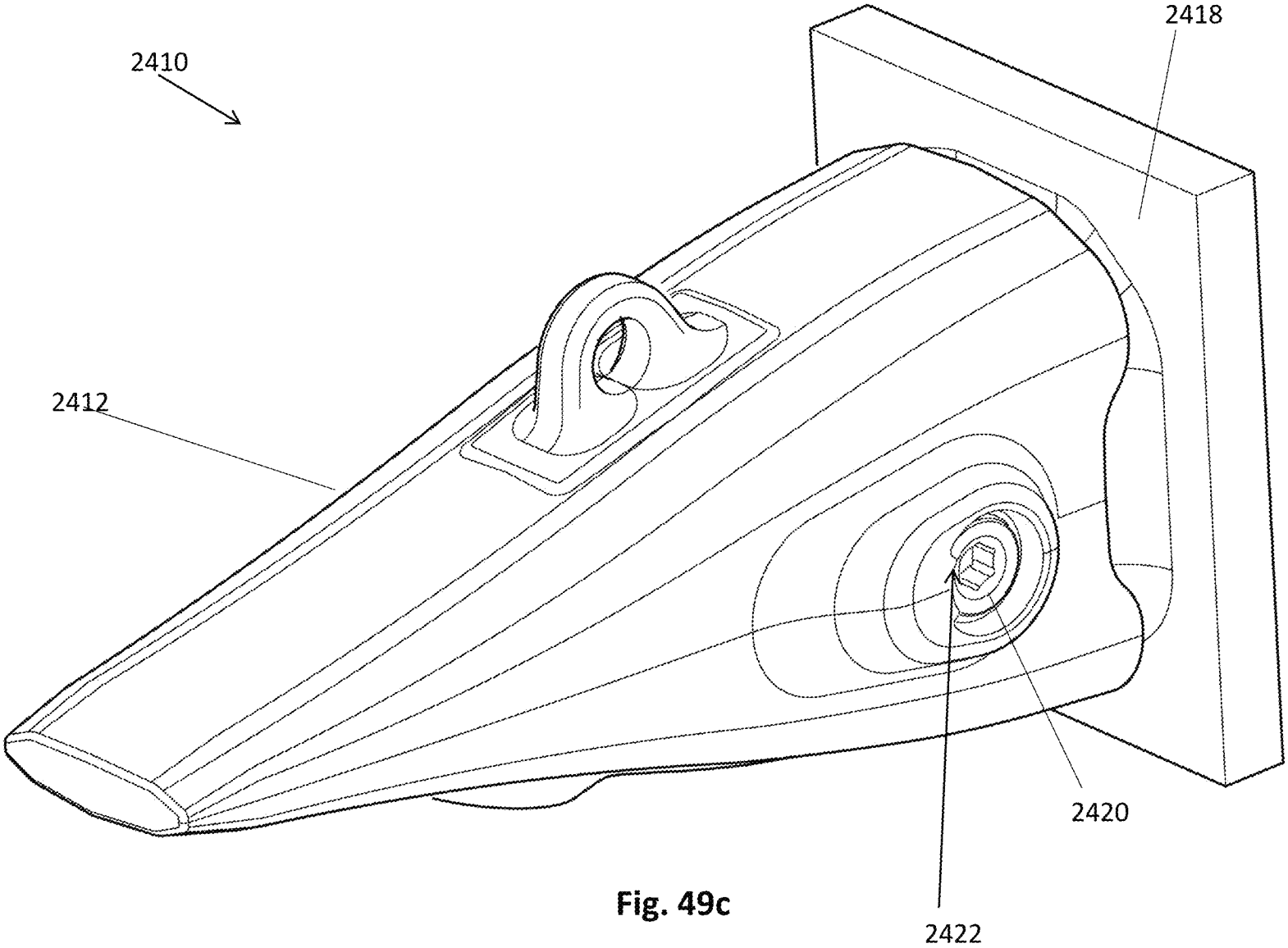
FIG. 49*c* is a perspective view of the fourth embodiment of a locking assembly for an excavation wear assembly, with the locking pin in in an extended position.

FIG. 48 illustrates a third embodiment of the locking assembly 2210. Similar reference numerals, but with the addition of the prefix "22" instead of "20", are used when referring to features that are the same unless described as being otherwise.

In the third embodiment, the retainer 2222 is fully enclosed in a manner similar to that described above with regards to the retainer 2122 of the second embodiment. However, in the third embodiment the central hollow 2227 of the retainer 2222 is shaped to allow for a clearance fit around a locking pin 2220.

The cavity 2225 in the wear member 2212 forms a stepped portion that is inset along a sidewall of the locking hole 2224 of the wear member 2212. The retainer 2222 comprises an enlarged lobe 2246 that projects laterally side-ways from an in-use outer surface 2254 of the retainer 2222, so as to form a step-like overhang that corresponds to the stepped portion of the cavity 2225. In-use, the lobe 2246 locates the retainer 2222 in a stepped-relation over the cavity 2225, whilst the base-portion 2243 of the retainer 2222 is received within a portion of the locking hole 2224. The retainer 2222, including the lobe 2246 can be polygonally-shaped in cross-section, e.g. a rectangular prism, this can assist with preventing the retainer 2222 from rotating within the locking hole 2224 when installed therein. The interaction of the lobe 2246 with the cavity 2225 can further prevent the retainer 2222 from rotating within the locking hole 2224 and allows it to be captured within the locking hole. In addition, when the locking pin 2220 is in the extended position in use, the overhang of the lobe 2246 can be held in fixed relation against the cavity 2225, thereby assisting with locking the wear member 2212 to the support structure 2218 in a fixed orientation and alignment.

The locking assembly 2210 comprises a further retaining component in the form of a collar 2223. The collar 2223 comprises a female groove 2245 at the in-use outer end 2252 of the collar 2223. In use, the correspondingly shaped male shoulder 2229 of the locking pin 2220 nests within the groove 2245. The shoulder 2229 of the locking pin 2220 can be rotated within the female groove 2245 about the longitudinal axis A-A of the locking pin 2220, whilst being captively retained within the groove 2245. Thus, when the locking pin 2220 is rotated to move along the engaging structure 2230, for example from a retracted position to an extended position, the locking pin 2220 and collar 2223 both move longitudinally along the longitudinal axis A-A together. For example, as the locking pin 2220 is rotated from a retracted position towards the support structure 2218, the collar 2223 also moves towards the support structure 2218. When the drive arrangement 2232 of the locking pin 2220 rotates the locking pin 2220 to move it from a retracted position into the extended position, the collar 2223 also moves from the retracted position to the extended position so as to engage with the recess of the support structure (not shown).

The engaging end 2251 of the collar 2223 is shaped to interlock with the retainer 2222, like two adjacent puzzle pieces, with the collar 2223 configured to slidably move in the longitudinal direction (i.e. along longitudinal axis A-A) relative to the retainer 2222. The in-use outer end 2252 of the collar 2223 comprises a ledge 2251 within which the groove 2245 is formed. The ledge 2251 protrudes from the main body of the collar 2223 so as to wrap at least part of the way around the shoulder 2229 of the locking pin 2220, in use. In the extended position, the ledge 2251 of the collar 2223 rests on the in-use outer surface 2254 of the retainer 2222, with the ledge protruding to a length whereby they locate proximal to the sidewalls of the lobe 2246.

The recess 2240 within the support structure 2218 is shaped so as to correspond to the cross-sectional profile of the combined collar 2223 and retainer 2222. In addition, the collar 2223 is formed to have a depth that is at least as long as the length of the collar 2223, whereby the engaging end 2253 of the collar 2223 can be extended therein in the extended position. In use, when the locking pin 2220 is moved into the extended position, the engaging end 2253 of the collar 2223 slots within the recess 2240 of the support structure 2218 and assists with retaining the wear member 2212 on the support structure 2218.

In a variation, the semi-circular groove 2245 of the collar 2223 can be sized to have a diameter that is slightly smaller than the diameter of the shoulder 2229 of the locking pin 2220. The groove 2245 of the collar 2223 thus can create an interference fit against the shoulder 2229 of the pin 2220. The pressure applied to the pin 2220 by the collar 2223 can improve the retention of the locking pin 2220 within the locking hole 2224.

In a fourth embodiment, with reference to FIGS. 49 to 52, the retainer 2422 is formed from a spring-like or resiliently flexible material, such as spring steel into a substantially C-shaped clip.

The wear member 2412 comprises a ledge-like cavity 2425 around the inwardly facing sidewalls of the locking hole 2424, the cavity being substantially C-shaped so as to generally correspond to the shape of the retainer 2422. The retainer 2422 is sized so as to enable insertion into the cavity 2425 from outside of the wear member 2412 with the outer diameter of the retainer 2422 fitting within the inner diameter of the cavity 2425.

Figure 50A:
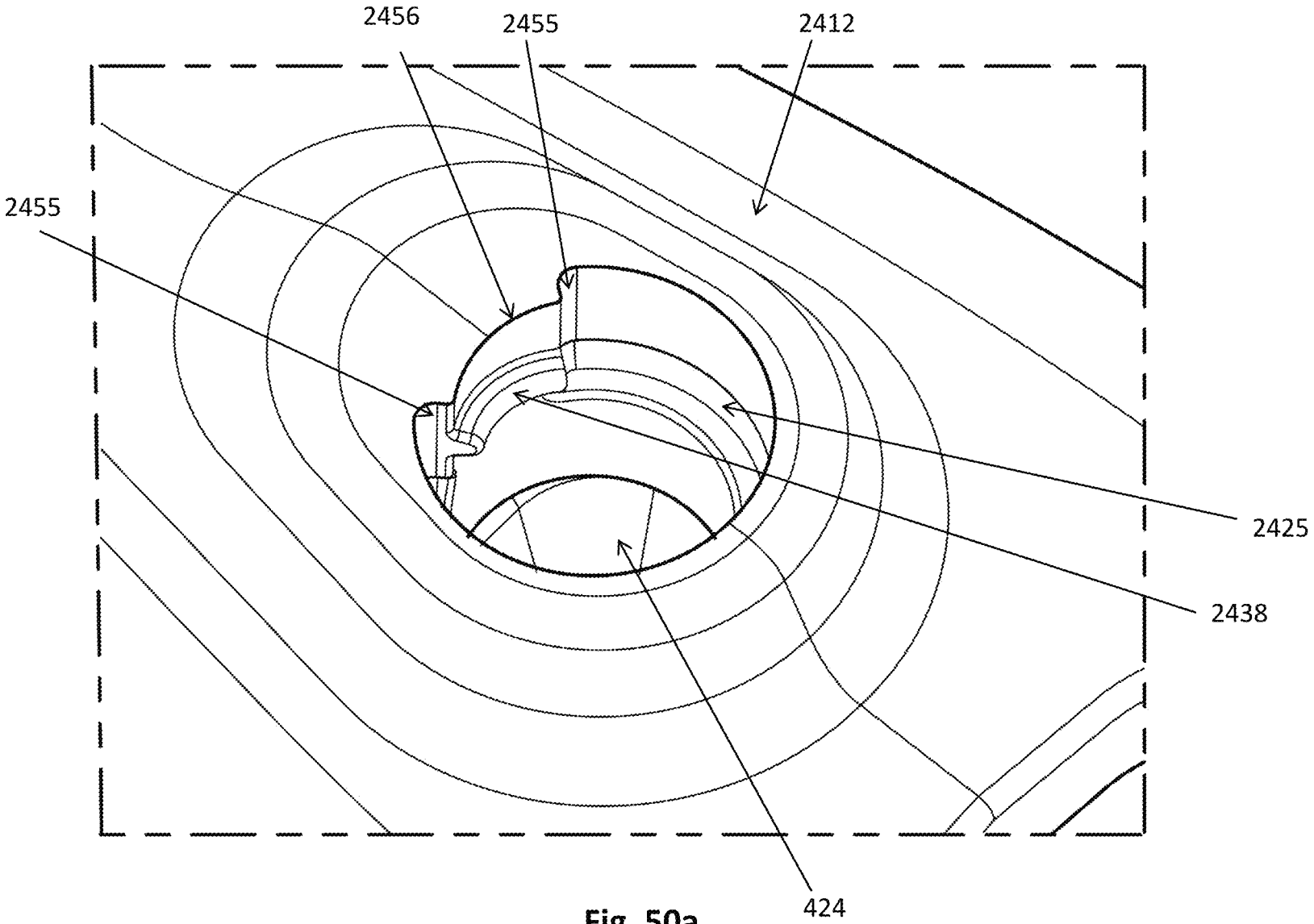
FIG. 50*a* is a close-up perspective view of the locking hole of the fourth embodiment of a locking assembly for an excavation wear assembly.

As best seen in FIG. 50*a*, a shoulder 2455 is formed on either side of a portion 2456 of the sidewalls that juts inwardly towards the centre of the locking hole 2424 from the circumference of the otherwise circular ledge-like cavity 2425 to thereby provide an interruption to the cavity. Each shoulder 2455 faces generally radially to an axis of the locking hole 2424, and is adapted such that, in use, the distal ends of each of the two arms 2442 of the C-shaped retainer 2422 locate adjacent thereto, so as to abut and/or interact with one of the two shoulders 2455 within the locking hole 2424 (e.g. FIG. 51). The interaction between the shoulder 2455 and the distal ends of each of the two arms 2442 of the C-shaped retainer 2422 act to prevent the retainer 2422 from rotating around within the cavity 2425 in use.

The retainer 2422 has an interference fit with the locking pin 2420 as, in its natural state, the substantially circular aperture formed by the arms 2442 and body of the C-shaped clip has a smaller diameter than the diameter of the pin 2420. As the locking pin 2420 is engaged between the arms 2442 of the retainer 2422, the arms 2442 can be resiliently flexed outwards, with the inward bias of the arms 2442 (towards their natural state) applying a positive force that clamps against the locking pin 2420 and resists rotation of the pin by friction. The positive force of the inward bias of the arms 2442 against the locking pin 2420 can generate a friction based torsional resistance that assists the retainer 2422 in gripping and retaining the locking pin 2420 in use. This torsional resistance can help reduce the effects of vibrations that may otherwise cause the locking pin 2420 to rotate and come loose, or from moving axially towards the retracted position. The frictional resistance is sufficient to prevent the locking pin 2420 from coming undone during service. The frictional resistance can be overcome with a wrench applied by an operator during installation or removal of the locking pin 2420.

The interior facing surface of the portion 2456 that juts into the locking hole 2424 comprises a helical thread therealong in the form of a ridge 2438. The ridge 2438 forms part of the engaging structure 2030 and corresponds with, so as to engage with, the groove 2436 of the helical arrangement 2430 of the locking pin 2420. This enables the locking pin 2420 to be installed within the locking hole 2420 and engaged at the ridge 2438.

Accordingly, in the embodiment of the FIGS. 49 to 52, the engaging structure 2030 which resists axial movement of the pin 2420 in the locking hole is formed directly between the pin and the wear member wall, whereas the retainer is arranged to provide solely torsional resistance to the pin. In use, the pin can operate in a manner consistent with the other embodiments disclosed with the pin being axially displaceable within the locking hole.

In the form as shown in FIG. 50*a*, the pitch of the engaging structure as shown by the helical ridge 2438 is relatively flat such that axial loading on the lock body is resisted solely by the engaging structure.

Figure 50B:
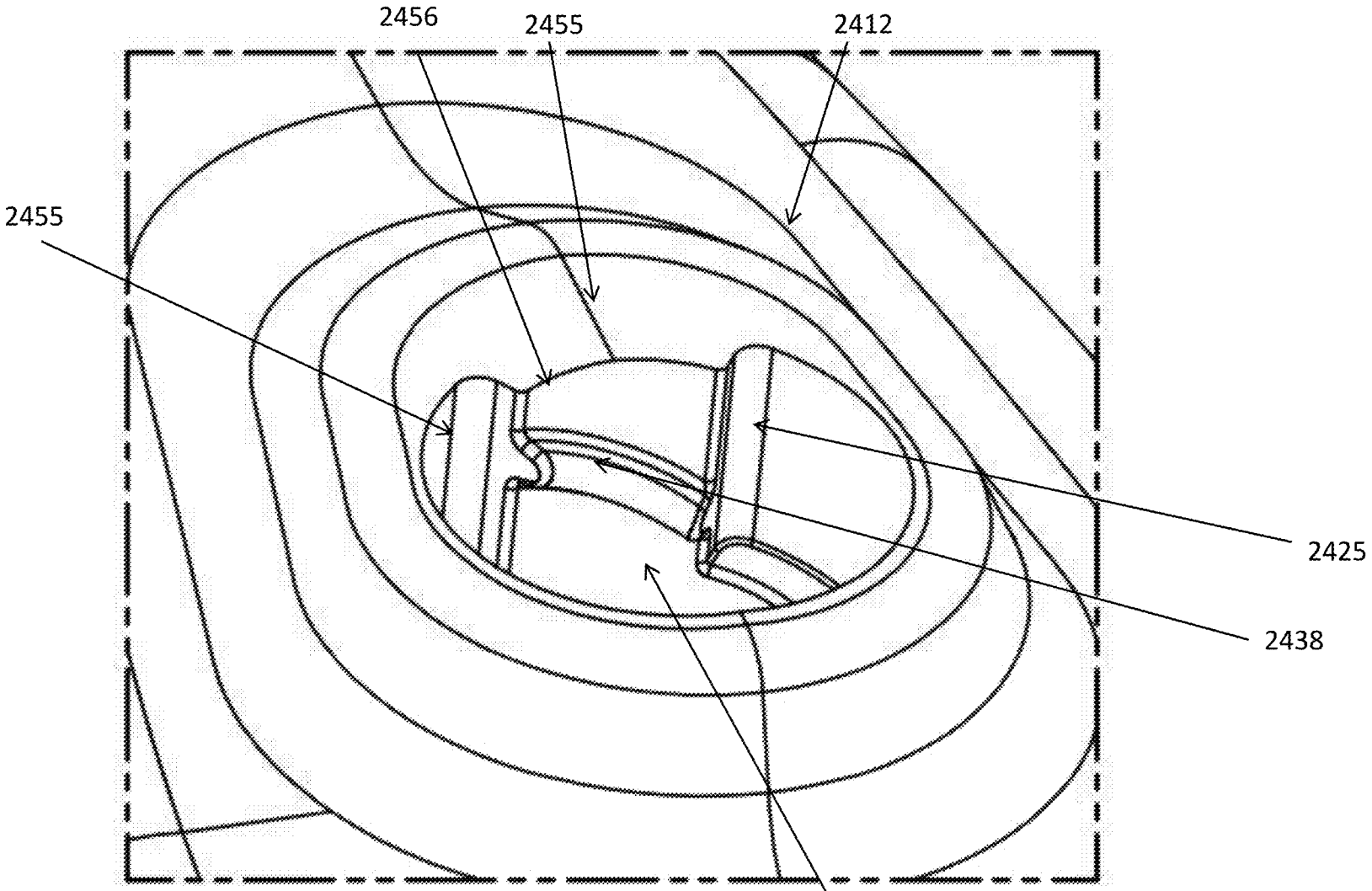
FIG. 50*b* is a close-up perspective view of a variation of the locking hole of the fourth embodiment of a locking assembly for an excavation wear assembly.
Figure 52:
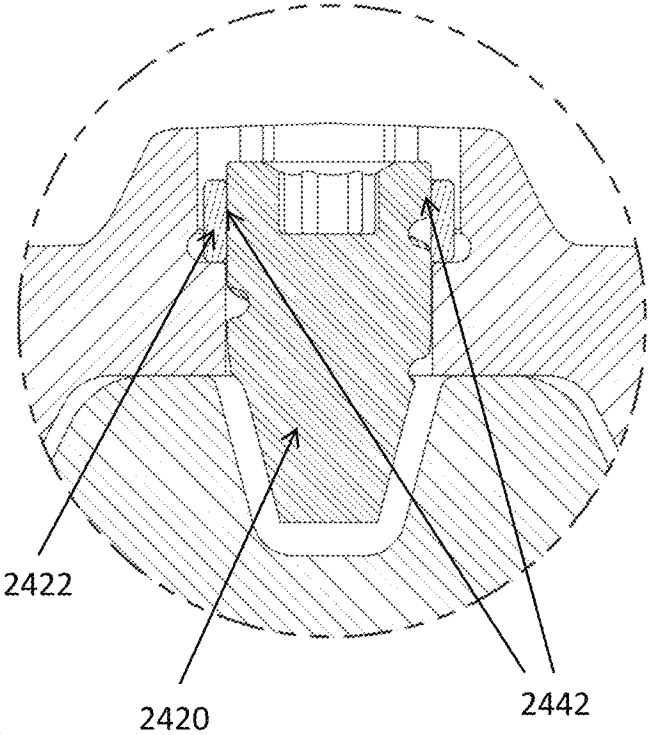
FIG. 52 is a close-up section side view of the locking hole of the fourth embodiment of a locking assembly for an excavation wear assembly, with the locking pin in in an extended position.
Figure 51:
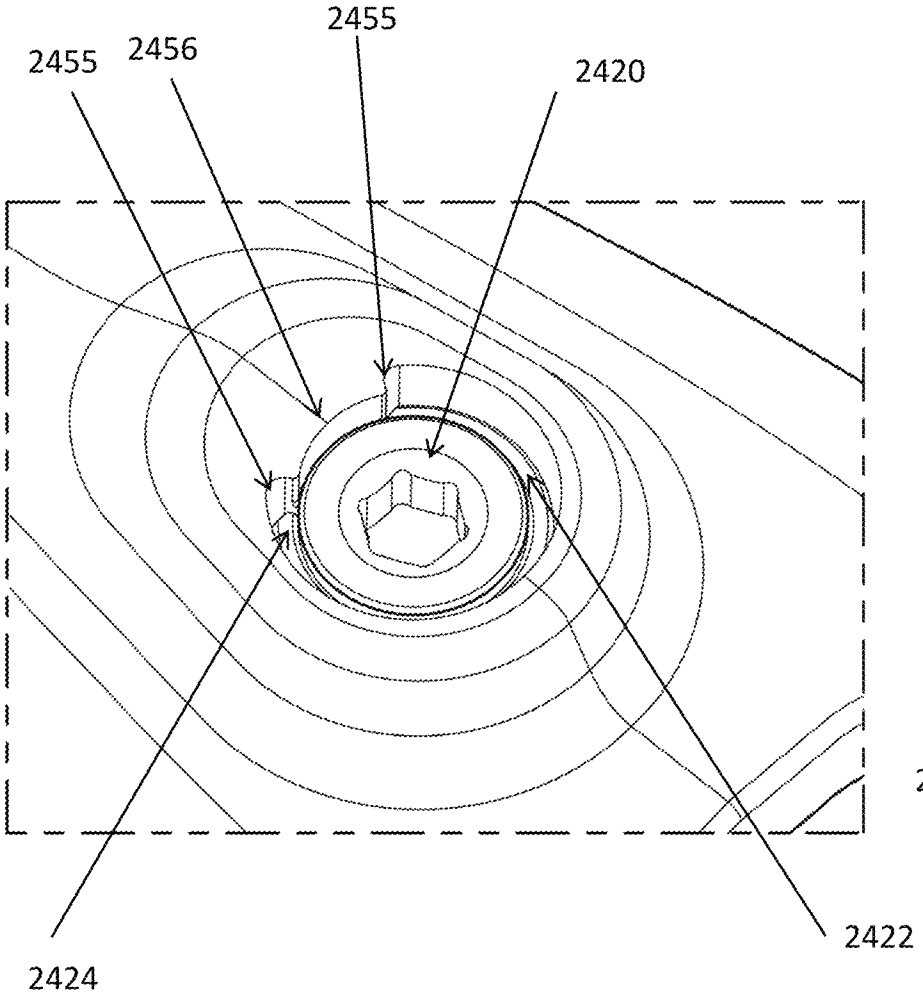
FIG. 51 is a close-up perspective view of the locking hole of the fourth embodiment of a locking assembly for an excavation wear assembly, with the locking pin in in an extended position.

In an alternative arrangement as shown in FIG. 50*b*, the pitch of the helical ridge may be made quite steep so that axial loading to the lock body promotes rotational and therefore axial drive to the lock body. With this arrangement, the retainer 2422 has a further function to assist in resisting axial movement of the lock body. In particular, loading in the direction of the lock axis which may occur during operation is resisted by the combined operation of the retainer 2422 and the engaging structure 2430; the retainer being operative to provide torsional resistance of the lock body in the locking hole and the engaging structure operative to inhibit axial movement of the lock body when the lock body is restrained from rotating in the locking hole. An advantage of this arrangement is that the control of the axial resistance can by more finally controlled between the degree of the pitch and the amount of torsional resistance provided. Also, the steeper pitch can limit the amount of rotation required to move between the retracted and locking position and be less prone to binding.

Figures 53A, 53B, 53C:
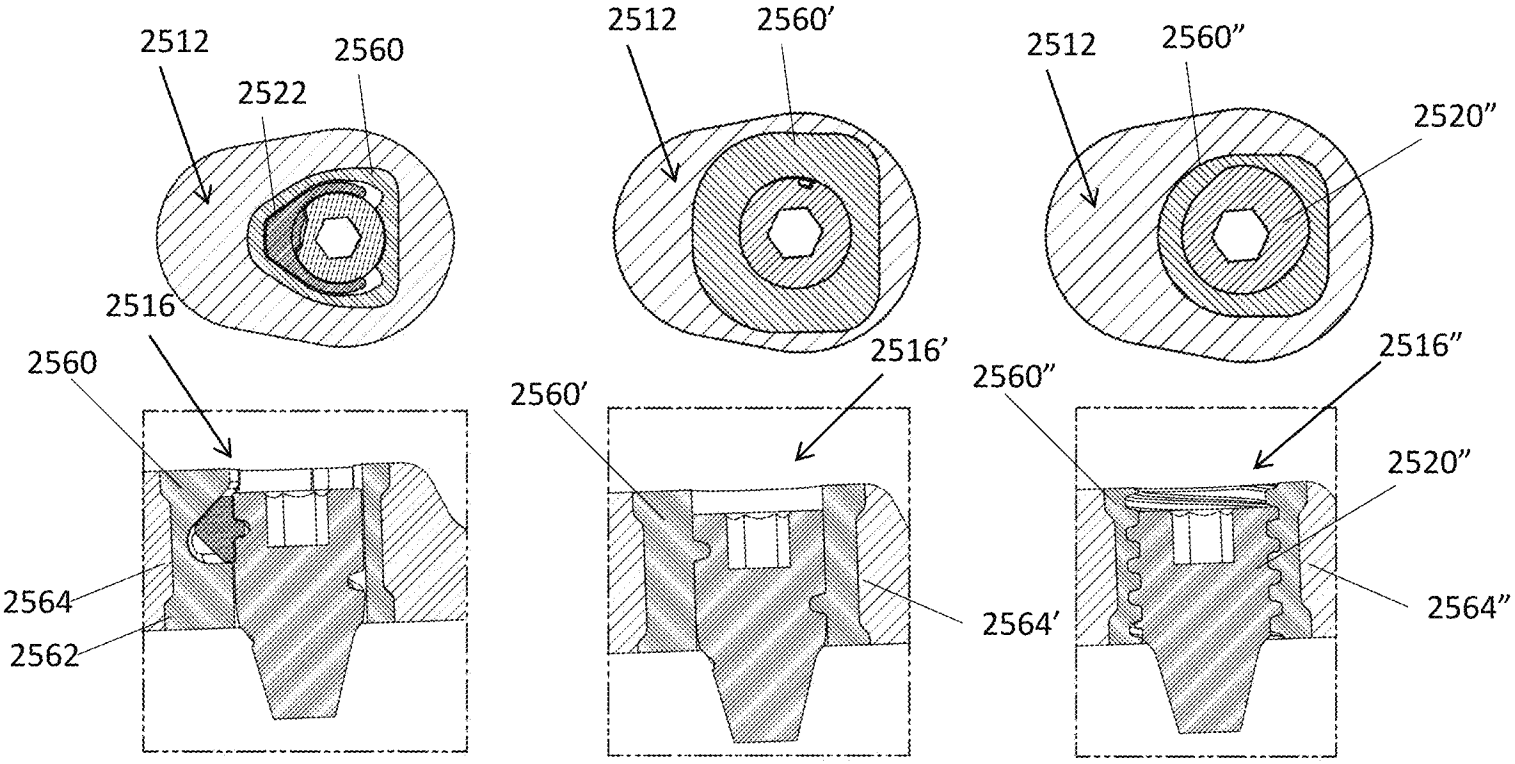
FIGS. 53*a* to 53*c* are plan and sectional views of variations of embodiments of the locking assembly with cast inserts.

FIG. 53*a* to FIG. 53*c*, shows variations on locking assemblies and/or wear member disclosed above. As the arrangements shares many of the features of the locking assemblies or wear members above, like features have been given like reference numerals except that the prefixed used has been replaced by a "25" rather than "20".

In FIG. 47*a*, the primary difference in the wear member 2512 is that the interior shape of the locking hole 2524 (in this case being the version shown in FIGS. 47 to 52 above) is not formed directly in the wear member 2512 but is provided as part of an insert 2560 that is manufactured separately (say for example by an investment casting process) and is then placed within a mold (typically being a sand mold) and the wear member 2512 is cast around the insert. The advantage of this arrangement is that the insert can be manufactured to a finer tolerance than generally possible under the sanding casting process usually employed in wear member manufacture. This in turn can assist in improving the performance of the resulting lock assembly incorporated in the lock receiving arrangement. Other advantages may include the ability to use different material for the insert as compared to the balance of the wear member 2512 thereby allowing better control over performance and durability of the lock.

To ensure adequate performance, it is important that the insert 2560 is adequately secured to the wear member 2512. This may be achieved in a number of ways. In one form, the insert may be caused to fuse with the wear member as it is cast around the insert, such that the insert becomes intimately bonded with the wear member 2512. With this arrangement the separation between the insert and the wear member is less distinct as there is not a clear material separation between the insert the cast wear member.

In another form, the insert may be mechanically keyed to the cast wear member as the liquid metal is able to flow around the exterior 2562 of the insert 2560. In FIG. 53*a*, a recessed profile 2564 is provided on the exterior 2562 of the insert 2560.

In a further form, the insert is secured by a combination of bonding (fusing) and mechanical arrangement. Further, whilst the insert has been shown in relation to selected embodiments disclosed above, it is to be appreciated that it may be used to define the locking hole of the wear member of the other embodiments disclosed.

In addition to ensure that the insert does not rotate, it has a non-circular cross-section (as best illustrated in the plan view).

In the embodiments shown in FIGS. 53*b* and 53*c*, the retainer 2522 itself is formed as a cast insert. In this form, the lock assembly is similar to the version disclosed above with reference to FIGS. 47*a* and 47*b* above. In the embodiment of FIG. 53*b*, the pitch of the helical engaging structure of the lock assembly 2516' is steep whereas in FIG. 53*c* a more conventional thread pitch is used with the inner profile of the thread non-circular to create the required torque resistance. Again, the inserts 2560', 2560" have non-circular external profiles and also include mechanical profiling on the exterior wall 2562', 2562" to mechanical key the insert into the wall of the wear member. Further, in the arrangements of FIGS. 53*b* and 11*c*, the locking hole is defined by the retainer insert as the insert itself includes the locking hole with the wear member being in turn, cast around that insert.

Figure 54B:
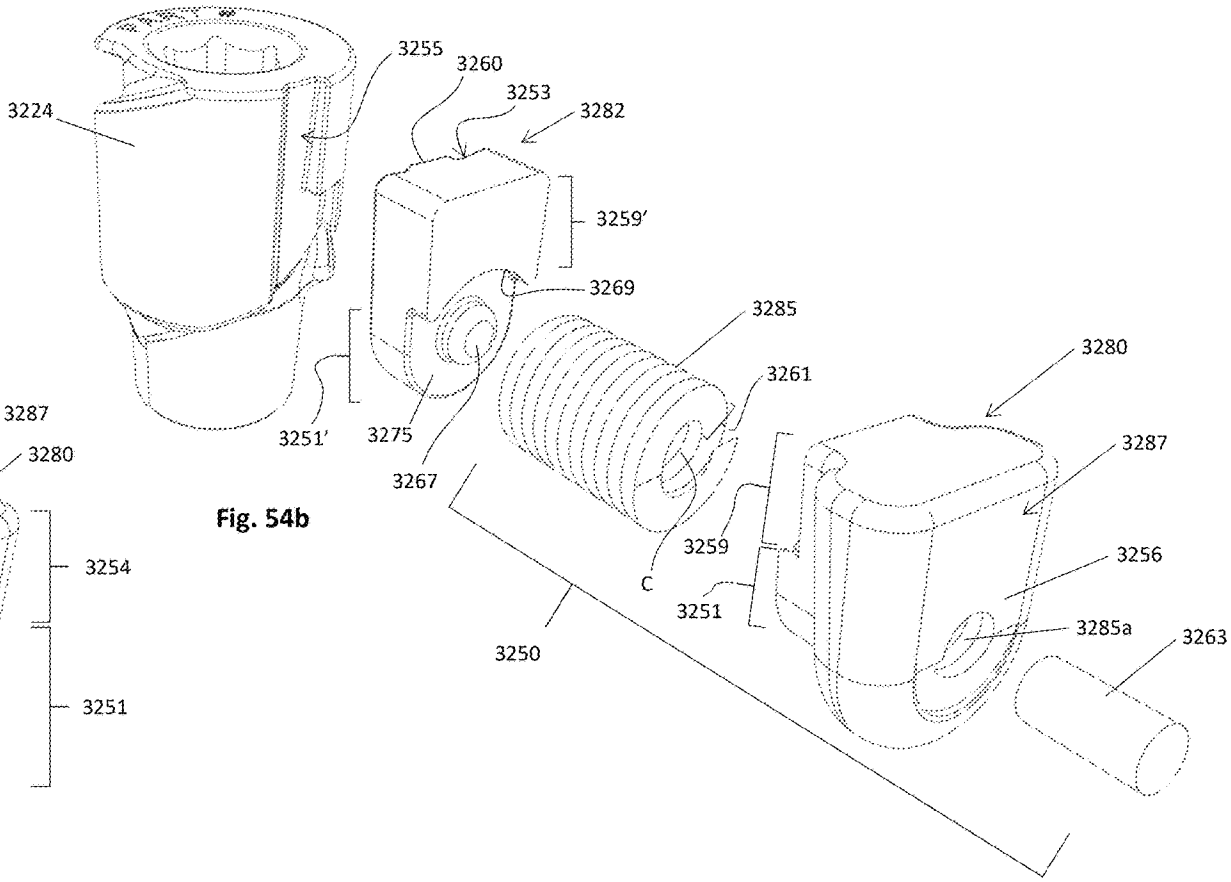
FIG. 54*b* is an in-line for assembly view of the upper latch of FIG. 54*a*.
Figure 54A:
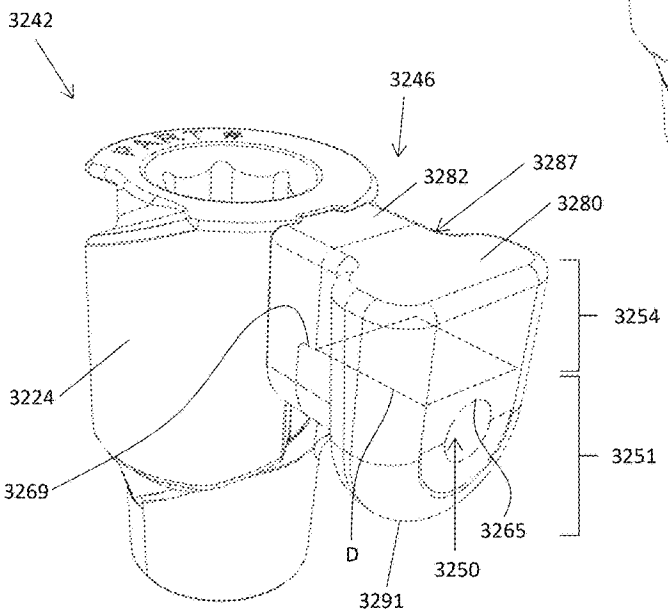
FIG. 54*a* is perspective view of an upper latch of a lock retaining arrangement.
Figure 54E:
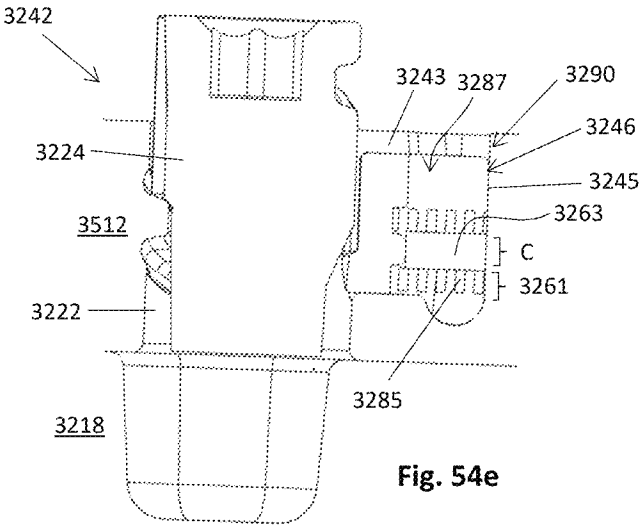
FIGS. 54*e* and 54*f* are sectional side views of the lock retaining arrangement of FIG. 54*a*, in respective transport and extended positions with respect to a support structure and wear member.
Figure 54F:
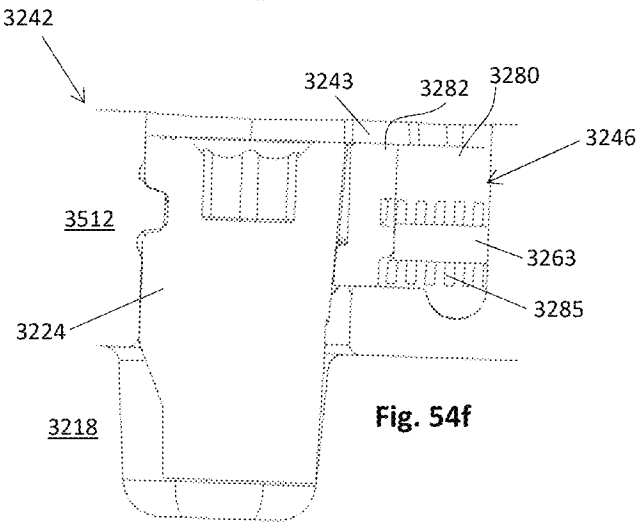
Figure 54D:
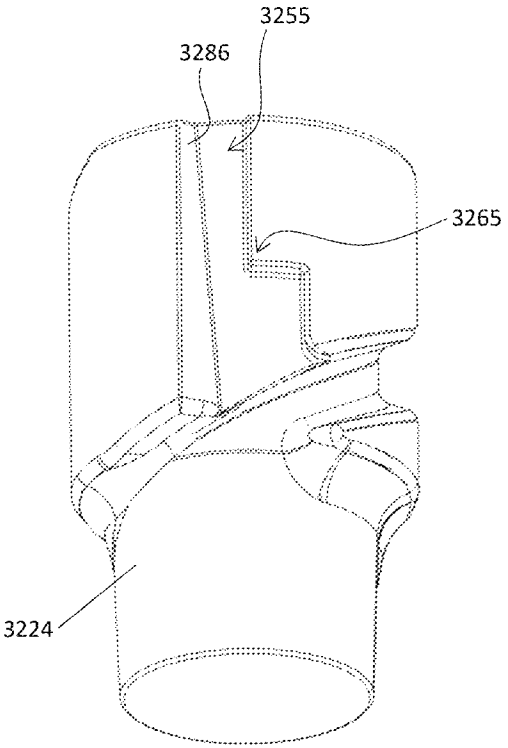
FIGS. 54*c* and 54*d* are perspective views of components of the lock retaining arrangement of FIG. 54*a*.
Figure 54C:
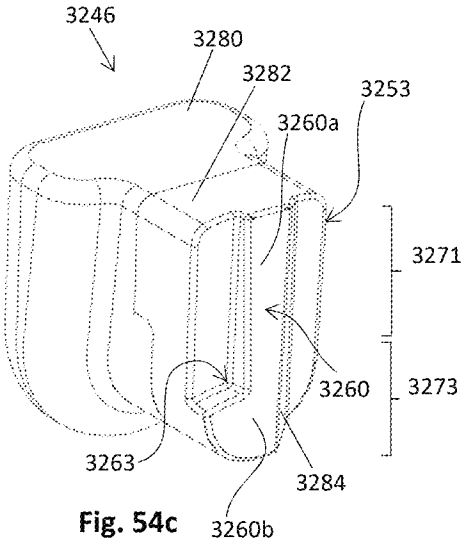
Figure 55:
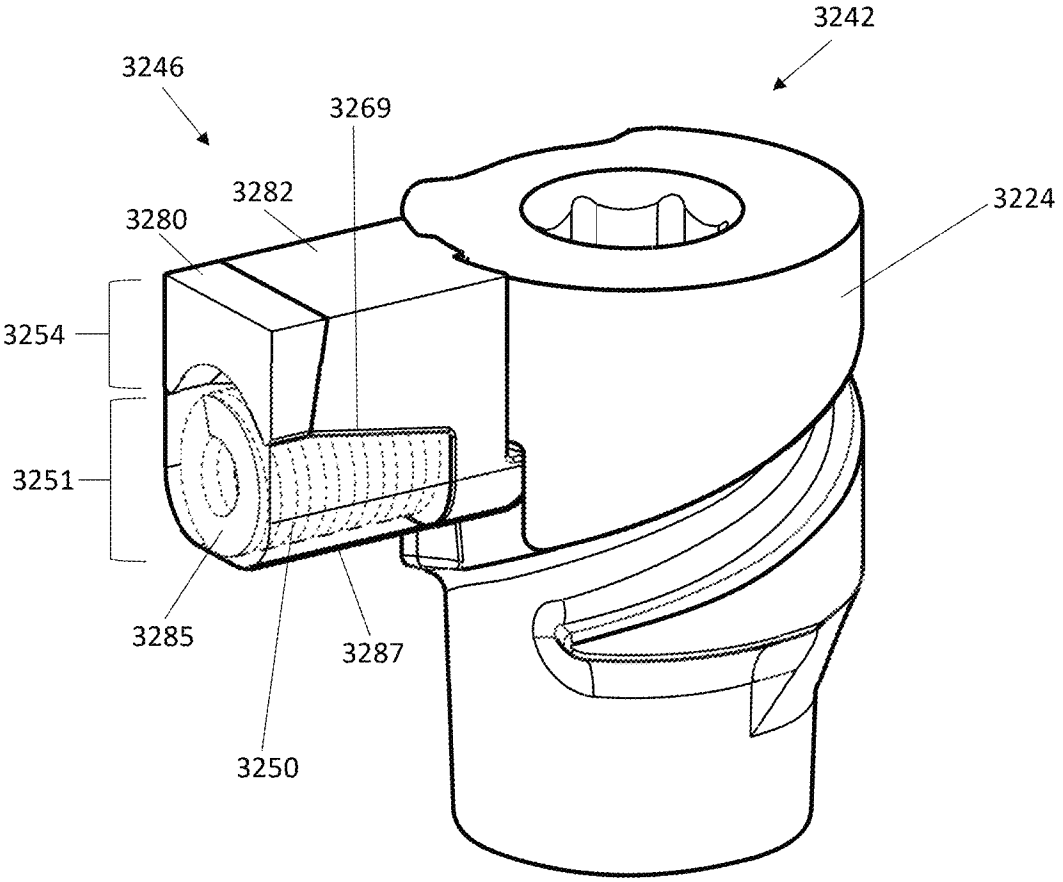
FIG. 55 is a perspective view of a variation of the upper latch of a lock retaining arrangement of FIG. 54*a*.

In the embodiments shown in FIGS. 54 to 56, the lock retaining arrangement 3242 (i.e. latch and/or biasing arrangement) primarily differs from the embodiment shown in FIGS. 37*a*-37*k* in that the upper latch 3246 includes a resilient member 3250. In the form shown, the resilient member 3250 is formed as composite structure, i.e. a composite biasing arrangement, having a compression spring 3285, which is encapsulated in a resilient matrix 3287.

The upper latch 3246 of the embodiments shown in FIGS. 54 to 56 comprise a resilient portion 3280 and a rigid portion 3282. When installed in a cavity 3243 (e.g. as shown in FIG. 54*d*) of a lock receiving arrangement 3290, a closed end 3245 of the cavity is arranged to receive the resilient portion 3280 of the upper latch 3246 and the rigid portion 3282 of the latch is arranged to project into a locking hole 3222.

The embodiment of FIGS. 54 and 55 further differs from the embodiment shown in FIGS. 37*a*-37*k* in that the lock retaining arrangement 3242 does not comprise a lower latch within the pin. Alternatively, in the embodiment of FIG. 56, the lock retaining arrangement 4242 comprises a lower latch 4247 (as previously set forth in the embodiment of FIG. 37*a*-37*k*).

Referring firstly to the embodiment shown in FIG. 54*a*-54*f*. The resilient portion 3280 comprises an upper portion 3254 and lower portion 3251, each formed of the resilient matrix 3287. In the form shown in FIG. 54, the upper and lower portions are defined by an imaginary boundary (indicated as a dotted line 'D') extending generally from a transverse ledge 3269. In the form shown, the upper portion 3254 and the lower portion 3251 can both be formed of a vulcanised rubber (or an elastomeric material), such that the upper and lower portions are continuous across the resilient portion of the upper latch. That is, the upper and lower portions form a continuous body.

In alternative forms, as set forth in a variation shown in FIG. 55, the upper portion 3254 is separate to the lower portion 3251, whereby the upper portion can be formed of a vulcanised rubber or elastomeric material and the lower portion 3251 can be formed of a different material, e.g. a closed cell foam.

In the form shown in FIG. 54, the lower portion 3251 is configured to include the resilient member 3250, and as set forth above, the resilient member 3250 is formed as composite structure whereby the compression spring 3285 is encapsulated, i.e. encased, by the resilient matrix 3287.

The resilient matrix 3287 is formed, e.g. cast around the compression spring 3285 such that the resilient matrix encapsulates an outer 3261 and central C portion of the spring, so as to fill the spaces, i.e. voids, between the spring coils and centre of the spring, respectively.

The resilient matrix of the resilient portion 3280 is arranged to encapsulate the coils of the outer portion 3261 of the spring 3285. In this way, an outer portion of the spring can correspond to an outer portion 3285*a* of the resilient matrix. As shown in FIGS. 54*d* and 54*e*, the resilient matrix 3287 of the outer portion 3285*a* extends around, and between, the spring coils. For example, the outer portion 3285*a* can be 'over-moulded' such that, e.g. the vulcanised rubber can encase around the coils of the spring. For this reason, the profile of the resilient portion 3280 shown in FIG. 54*b* includes a 'negative' mould 3285*a* of the spring coils.

A core structure, i.e. a central portion 3263 of the resilient matrix, is arranged to extend through a centre C of the spring 3285, from end to end, i.e. from a first end of the spring to a second end of the spring.

In the form shown, the resilient matrix of the central portion 3263 fills, i.e. occupies the space between an inner diameter of the spring (indicated at C). With this arrangement of the central portion 3263, the outer portion 3285*a* of the e.g. vulcanised rubber can be cast around the central portion such that outer portion contacts, e.g. adheres to the central portion at an interfacing surface 3265 of the central portion defined by the inner diameter of the spring.

The spring 3285 is arranged in the lower portion 3251 to extend from the outer face 3256 of the resilient portion 3280, towards an outer face 3275 of the rigid portion 3282. The outer face 3275 of the rigid portion can comprise a nodule 3267 extending from the outer face 3275 for receipt into the central portion 3263 of the spring. The nodule can be sized to extend only partly into the central portion, so as to align the spring in centrally, i.e. in an optimal position, during assembly of the latch, i.e. before the resilient portion is cast.

As best shown in FIGS. 54*e* and 54*f*, the central portion, in-use, i.e. when assembled in the upper latch, can be a foam core inserted into the spring. The foam core 3263 can extend from the end of the spring adjacent to an outer face 3256 of the resilient portion 3280, towards the nodule 3267.

In the form shown, resilient portion and the rigid portion can have a 'stepped' interface, whereby respective interfacing ends of the resilient and rigid portions, i.e. ends meeting at the outer face 3275, have upper 3259,3259' and lower 3251,3251' regions spaced apart by the transverse ledge 3269. As set forth previously, the transverse ledge 3269 defines the imaginary boundary between the upper and lower portions of the 3254,3251. As shown in FIG. 54*b*, the imaginary boundary is indicated by a dotted line 'D', whereby the boundary is a simplified planar shape. It is anticipated that the boundary could be curved, e.g. to follow the spring profile, or otherwise shaped according to the particular design of the upper latch.

The upper and lower regions are offset from each other to form the 'stepped' or 'overlapping-type' interface of the resilient and rigid portions, whereby the upper region 3259', i.e. overlying portion, of the rigid portion 3282 extends toward the resilient portion 3280 so as to be positioned above, i.e. over, the lower portion 3251, i.e. underlying portion, of the resilient portion 3280 (which extends under, i.e. below, the extending upper region 3259' of the rigid portion 3282).

In the form shown, the upper region 3259 of the resilient portion 3280 is smaller in size, i.e. volume, than the adjacent upper region 3259' of the rigid portion 3282. Conversely, the lower portion 3251 of the resilient portion 3280 is larger in size than the adjacent lower portion 3251' of the rigid portion 3282. Advantageously, this configuration of differently sized rigid and resilient portions 3282, 3280, together with the properties imparted by the encased spring 3285, provides specific dynamic properties to the upper latch 3246 which will be described in more detail later. As such, it is envisaged that the upper and lower regions of the respective rigid and resilient portions can vary in relative size according to the specific functional properties required for the upper latch 3246.

The spring 3285 may be encapsulated within the resilient matrix such that an outer end of the spring, proximal to the outer face 3256 of the resilient portion 3280, is in contact with the closed end 3245 of the cavity 3243. An opposing inner end of the spring proximal to the rigid portion 3282 (i.e. distal to the outer face 3256) may be in contact with the outer face 3275 of the rigid portion 3282. In alternative forms, the outer end of the spring 3285 may be spaced, i.e. inset from the respective outer face 3256 of the resilient portion 3280. In this form, the resilient matrix, e.g. vulcanised rubber 3287 extends around the spring end to be spaced between the outer end of the spring and the respective outer face 3256.

As set forth previously with regard to the embodiment shown in FIGS. 37*a*-37*k*, an inner face 3253 of the rigid portion 3282 of the present embodiment (of FIG. 54-56) is arranged to bear against the body region of the locking pin 3224 to assist in stabilising the locking pin 3224 in the locking hole 3222. The inner face 3253 may include a projection 3260 arranged to engage with a complementary recess 3255 on the locking pin 3224.

As best shown in FIGS. 54*c* and 54*d*, the projection 3260 is arranged on the inner face 3253 to extend from an upper face 3271 to a lower face 3273 of the inner face 3253. The projection 3260 is generally 'L' shaped, whereby the projection comprises a straight portion 3260*a* at the upper face and a protruding portion 3260*b* extending from the straight portion at the lower face of the inner face 3253.

The projection 3260 may include a chamfered trailing edge 3284 that is arranged to pass over a complementary chamfered edge 3286 on the recess 3255 of the locking pin 3224.

In-use, as the pin 3224 is rotated (e.g. from the transport position towards the extended position, as shown in FIGS. 54*e* and 54*f*) until the recess 3255 is aligned with the projection 3260, the projection can move into, i.e. insert within, the recess so as to engage the pin 3224 in the extended position. A leading-edge pocket 3263 formed on the 'L' shaped projection 3260 is shaped to engage with a complementary corner 3265 of the projection 3260 to prevent the latch 3246 from moving, i.e. ejecting, out from the cavity 3243 (i.e. out from engagement with the locking pin). Additionally, the corner 3265 provides a hard stop (i.e. for the protrusion to contact against) to prevent further rotation (e.g. over-rotation) of the pin 3224 into the locking hole 3222, i.e. beyond the extended position.

Referring to FIG. 54*e*, the upper latch 3246 is biased by the resilient portion 3280 so as to extend into the path of the locking hole 3222. As such, the inner face 3253 of the rigid portion 3282 is engaged under bias from the resilient portion 3280 to apply a radial pressure against the pin 3224. As set forth previously with regard to the embodiment shown in FIGS. 37*a*-37*k*, radial pressure applied to the locking pin 3224 can maintain the locking pin in the wear member 3512 and resist its counter-clockwise rotation, i.e. unwinding, from the locking hole 3222 (so as to fall out).

In-use, the upper latch 3246 is designed, i.e. configured, to be mounted in the cavity 3243 together with the pin 3224 (in the locking hole 3222), such that the spring 3285 is pre-compressed by the pin 3224, prior to e.g. the pin 3224 being moved into the extended position. That is, the upper latch is configured to apply a radial pressure to the pin when the pin is in the transport position, as shown in FIG. 54*e*.

When the pin is in the transport position (as shown in FIG. 54*e*), or when moved into the extended position (as shown in FIG. 54*f*), the spring 3285 of the upper latch is at least partially compressed between the pin and the closed end 3245 of the cavity 3243. In these conditions, the spring 3285 is compressed within the resilient portion to apply a radial pressure against the pin 3224. As the resilient portion 3280 of the upper latch 3246 is compressed by the pin 3224 (either in the transport or extended position) the outer portion 3285*a* of the resilient matrix 3287 deflects towards, i.e. into material of the central portion 3263. In particular, the outer portion 3285*a* of the resilient matrix extending around and between the spring coils, can be compressed between adjacent coils such that the resilient matrix, e.g. vulcanised rubber, between the coils deforms towards, i.e. into, the central portion 3263 of the spring. Advantageously, the material, e.g. foam, of the central portion 3263 is able to compress, i.e. deform, as the material e.g. vulcanised rubber, of the outer portion 3285*a* moves into, i.e. displaces, the material of the central portion 3263.

Advantageously, applying radial pressure to the pin in the transport position stabilises the pin, preventing the pin from rotating during transport. Furthermore, the radial pressure can stabilise the pin 3224 under various load conditions (as set forth previously) placed on the wear assembly from ground penetration. For example, radial pressure applied by the upper latch can prevent lateral movement of the pin 3224 when in-use, as loading conditions move, i.e. bias, the bearing surfaces of the wear member into, and away from, bearing contact with corresponding bearing surfaces of the support structure 3218. Advantageously, the radial pressure can apply a damping force to limit shear loading applied to the pin as a result of the abovementioned loading conditions, i.e. load vectors.

The radial pressure applied by the resilient portion 3280 also acts to maintain the projection 3260 in engagement with the corresponding recess 3255. Advantageously, this can assist in preventing the upper latch 3246 from moving out from the cavity 3243 when engaged with the pin 3224, as set forth in more detail below.

The chamfered trailing edge 3284 of the projection 3260 and the chamfered edge 3286 of the recess 3255 are angled such that, together with the radial pressure, frictional contact (i.e. torsional resistance) is established between the projection 3260 of the inner face 3253 and the recess 3255 on the pin. Advantageously, this provides a further mechanism to resist counter-rotation, i.e. unwinding, of the locking pin 3224, i.e. to retain the pin 3224 in e.g. the extended position.

In this way, the upper latch 3246 combines at least some features of both the upper and lower latches defined in the embodiment of FIGS. 37*a*-37*k*, such that the upper latch 3246 performs the function of the upper and lower latches (i.e. in absence of the lower latch).

In the form shown in FIG. 54*b*, the spring 3285 is a straight compression spring, however, other types of springs, e.g. convex springs, may be used. The resilient matrix 3287 of the upper and lower portion 3254,3251, i.e. vulcanised rubber and foam, are cast around the spring so as to encapsulate the spring, thereby filling the spaces between the spring coils and centre of the spring. Advantageously, this prevents ingress of fines becoming trapped between the coils so as to limit, i.e. impair, the compression of the spring, i.e. ability to apply radial pressure.

The type of material utilised for the resilient matrix 3287 of the central portion 3263, e.g. foam, is selected so as to minimise interference with the compression of the spring, in-use. In other words, the material is selected to maximise displacement of the spring when in-use, such that a force-displacement correlation of the spring is as close to linear as possible. Advantageously, this allows the latch pin to be less sensitive to geometry variations in the lock retaining arrangement. The foam allows the spring to readily compress when positioned in contact with the pin, such that the pressure applied by the upper latch is maximised.

The material utilised for the resilient matrix 3287 of the upper and lower portion 3254,3251, e.g. vulcanised rubber, can be used together with the spring to control the stiffness of the spring. That is, the outer portion 3285*a* positioned between coils of the spring, can stiffen the spring such that the upper latch can apply a greater radial pressure to the pin. Advantageously, this can increase resistance on the pin to prevent unwinding during use.

The vulcanised rubber, can also be utilised to protect the e.g. foam of the central portion 3263 from wear during use. Movement of the upper latch 3246 within the cavity 3243, in-use, can wear away the material of the central portion. This can be a result of the material, e.g. foam, having material properties that minimise interference with the compression of the spring. Such materials may have low wear resistance. Advantageously, by providing the upper and lower portions with a material (e.g. vulcanised rubber) having a greater wear resistance, the material of the central portion will experience less wear during use. In other words, the vulcanised rubber of the upper and lower portions limits wear of the foam-core central portion.

In some forms, the resilient matrix 3287 of the upper and lower portion 3254,3251, e.g. vulcanised rubber, is configured, e.g. dimensioned, so as to apply minimal radial pressure against the pin 3224 when in-use. That is, the vulcanised rubber applies significantly less radial pressure against the pin 3224 than the biasing of the spring 3285. In this way, the primary function of the upper and lower portion, i.e. the vulcanised rubber, can be to protect the central portion from wear as a result of movement, and in turn, abrasive contact, within the cavity 3243.

In the form shown in FIGS. 54*a* to 54*f*, the lower portion comprises a nose portion 3291 configured to be captured by a correspondingly shaped recessed portion 3293 at a closed end 3245 of the cavity 3243. The nose portion 3291 can assist in stabilising the upper latch 3246 in-use. For example, the nose portion can limit movement of the upper latch and further, can assist in preventing the upper latch moving laterally outwards from the cavity (i.e. towards the locking hole 3222).

Referring now to FIG. 55, in a variation of the embodiment shown in FIG. 54, the upper and lower portions 3254,3251 can be separate portions, formed of different materials. In this form, the upper portion 3254 can be formed of a vulcanised rubber or elastomeric material. The lower portion 3251 is configured to include the resilient member 3250 as set forth above, however, the compression spring 3285 is entirely encapsulated, i.e. encased, in a foam material.

The resilient matrix 3287 of the lower portion 3251 is cast around the spring so as to encapsulate the spring, thereby filling the spaces between the spring coils and centre of the spring. As set forth previously, this material minimises interference with the compression of the spring, while preventing ingress of fines becoming trapped between the coils so as to limit, i.e. impair, the compression of the spring, i.e. ability to apply radial pressure.

Similarly, the material utilised for the resilient matrix of the upper portion 3254, e.g. vulcanised rubber, is selected to protect the foam of the lower portion 3251 from wear, when in-use.

Referring now to the embodiment shown in FIGS. 56*a* to 56*d*, the lock retaining arrangement 4242 primarily differs from the embodiment of the lock retaining arrangement 3242 shown in FIG. 54 in that the upper latch 4246 is configured such that the spring 4285 of the resilient portion 4280 is generally aligned with a central, elongate axis 'A' of the upper latch 4246. Further, the spring 4285 extends from the resilient portion 4280 into the rigid portion 4282 of the upper latch 4246, such that the spring 4285 is inset within a recess 4251 of the rigid portion 4282.

In the form shown in FIG. 56, the lock retaining arrangement 4242 also comprises a lower latch 4247, as previously set forth in the embodiment of FIGS. 37*a*-37*k*. The lower latch 4247 of the present embodiment is arranged to function in a similar manner to the embodiment of FIGS. 37*a*-37*k*, i.e. having a resilient portion 4250 which functions to bias a detent 4748 against a wall of the locking hole 4222 for locating into a keeper (not shown). The lower latch 4247 functions together with the upper latch 4246, as set forth below.

Figure 56A:
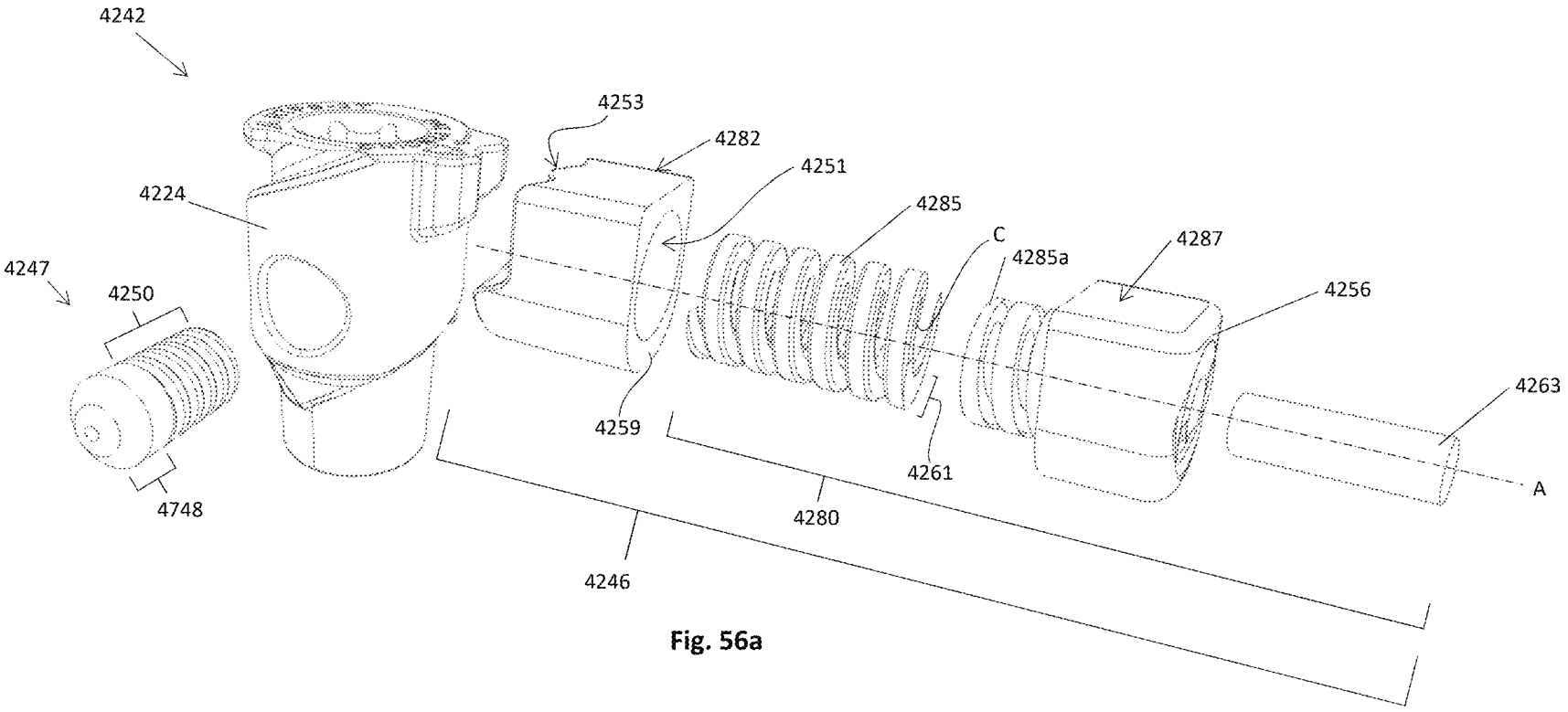
FIG. 56*a* is perspective view of an upper latch of a lock retaining arrangement.
Figure 56C:
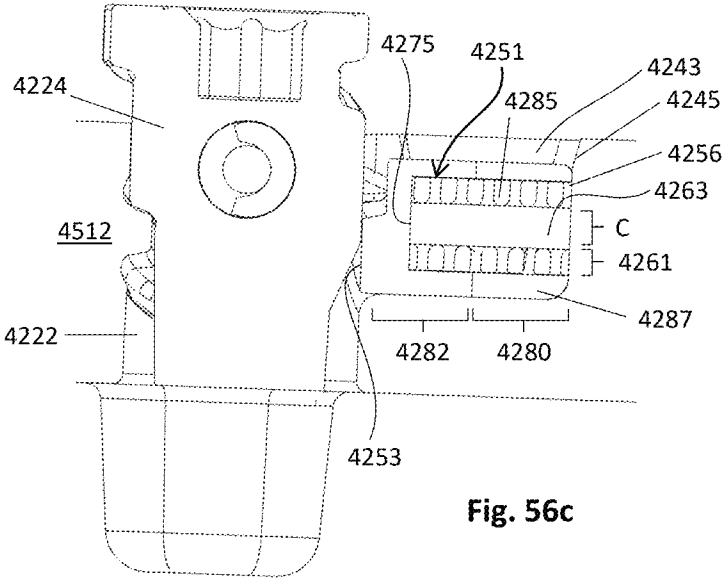
FIGS. 56*c* and 56*d* are sectional side views of the lock retaining arrangement of FIG. 56*a*, in respective transport and extended positions with respect to a support structure and wear member.
Figure 56D:
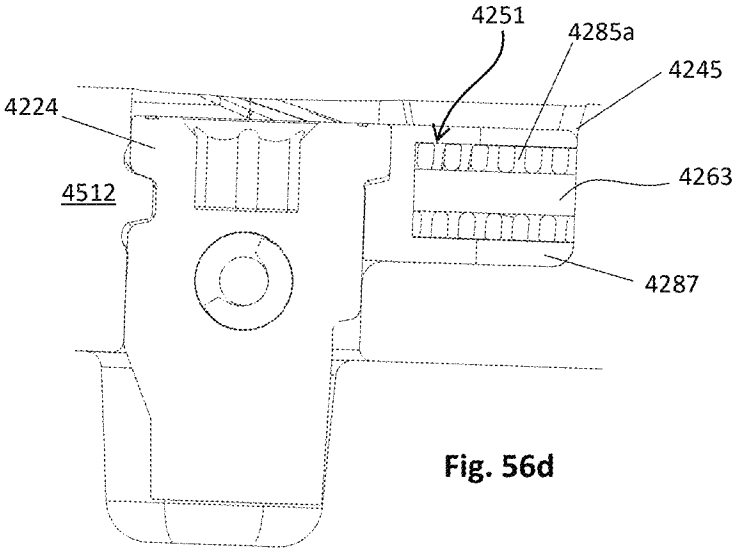
Figure 56B:
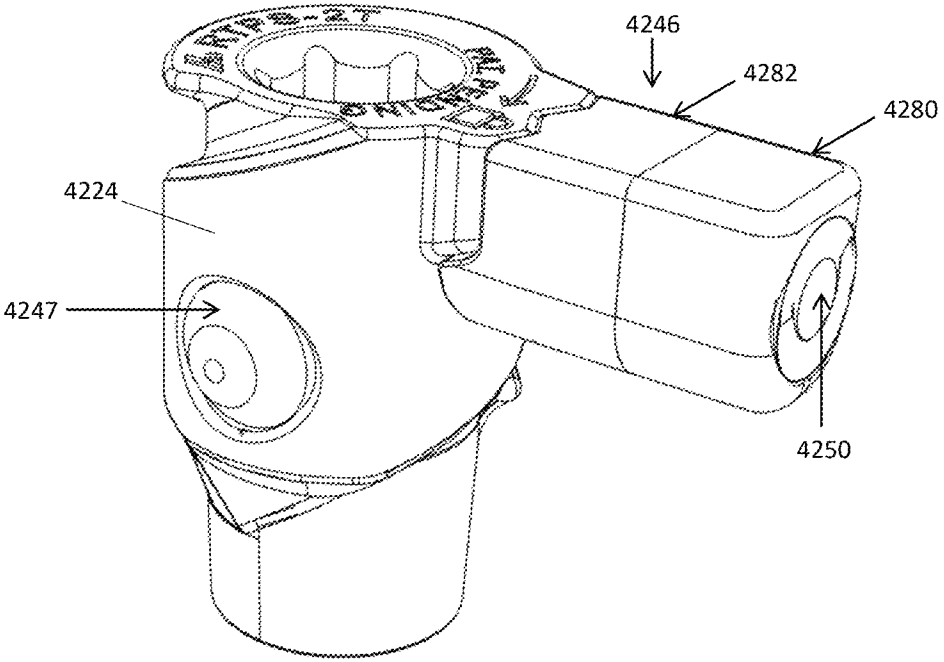
FIG. 56*b* is an in-line for assembly view of the upper latch of FIG. 56*a*.

As best shown in FIGS. 56*c* and 56*d*, the upper latch is configured such that at least a portion, e.g. two turns of the spring 4285 is received in the recess 4251, whereby the remainder of the spring extends into, and is encapsulated by, the resilient matrix 4287 of the resilient portion 4250. In this way, the spring 4285 is arranged in the upper latch 4246 to extend from an outer face 4256 of the resilient portion 4280, towards an internal surface 3275 of the recess 4251 of the rigid portion 4282.

The resilient matrix 4287 is formed, e.g. cast around the compression spring 4285 such that the resilient matrix encapsulates an outer 4261 and central C portion of the spring, so as to fill the spaces between the spring coils and centre of the spring.

The resilient matrix of the resilient portion 4280 is arranged to encapsulate the coils of the outer portion 4261 of the spring 3285. In this way, an outer portion of the spring can correspond to an outer portion 4285*a* of the resilient matrix. As shown in FIGS. 56*c* and 56*d*, the resilient matrix of the outer portion 4261 extends around, and between, the spring coils such that the outer portion 4285*a* of the resilient matrix is received in the recess 4251 of the rigid portion 4282. In this way, when the outer portion 4285*a* is cast, the resilient matrix 4287 of the outer portion contacts, e.g. adheres, against internal surfaces of the recess 4251 and a perimeter surface 4259 of the rigid portion. As best shown in FIG. 56*a*, the profile of the resilient portion 4285*a* is formed as a 'negative' mould of the spring coils.

The central portion 4263 of the resilient matrix is arranged to extend through a centre C of the spring 4285, from end to end, i.e. from the outer face 4256 of the resilient portion 4280, to the internal surface 4275 of the recess 4251. In the form shown, the resilient matrix of the central portion 4263 fills, i.e. occupies the space between an inner diameter of the spring. With this arrangement of the central portion 4263, the outer portion 4285*a* can be cast around the central portion such that outer portion contacts, e.g. adheres with the central portion at an interfacing surface of the central portion defined by the inner diameter of the spring.

As set forth previously in the embodiment of FIG. 54, the type of material utilised for the resilient matrix 4287 of the central portion 4263, e.g. foam, is selected so as to minimise interference with the compression of the spring, in-use.

The material utilised for the resilient matrix of the resilient portion 4280, e.g. vulcanised rubber, is selected to protect the foam of the central portion 4263 from wear when in-use.

In the arrangement shown in FIG. 56, each of the outer portion 4285*a*, central portion 4263, and spring 4285 of the resilient portion 4280 can be in contact with a closed end 4245 of the cavity 4243 when in-use.

The rigid portion 4282 of the upper latch 4246 is arranged to project into a locking hole 4222 of the wear member 4512. As set forth previously with regard to the embodiment shown in FIGS. 37*a*-37*k*, an inner face 4253 of the rigid portion 4282 is arranged to bear against the body region of the locking pin 4224 to assist in stabilising the locking pin 4224 in the locking hole 4222. In the form of the present embodiment, as shown in FIG. 56, the inner face 4253 and the locking pin 4224 are configured in a camming engagement as previously set forth in the embodiment of FIGS. 37*a*-37*k*.

Further, the wear assembly may be manufactured to suit a particular digging application. For example, specific bearing surfaces may be predetermined to be angularly offset relative to the corresponding support structure bearing surfaces in the installed position. These are the surfaces that are anticipated to wear the most in the particular digging application, and it may be any combination of corresponding bearing surfaces.

It is understood that the various embodiments of the lock disclosed in FIGS. 22 to 53 may be used in combination with any one of the embodiments of the cavities of the wear member or the embodiments of the support structure disclosed in FIGS. 1 to 21.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A wear member for excavation equipment, the wear member comprising a digging end for ground penetration and a cavity defined by an internal surface that opens into a rear of the wear member, the cavity being configured for receiving a support structure of the excavation equipment and extending along a longitudinal axis from an open end to a front end, the internal surface of the cavity further comprising:

an upper wall and a lower wall each extending in the direction of the longitudinal axis from the open end to the front end; and a front portion positioned adjacent the front end and a rear portion positioned adjacent the open end;

at least one of the upper wall and the lower wall of the front portion including bearing surfaces for bearing against corresponding surfaces of the support structure, the front portion including:

two bearing surfaces being inclined relative to one another and extending directly from one another disposed in the upper wall and two bearing surfaces being inclined relative to one another extending directly from one another disposed in the lower wall, the inclined bearing surfaces extending in substantially the same direction as the longitudinal axis of the wear member, and the rear portion including:

opposing bearing surfaces in facing relation for bearing against corresponding surfaces of the support structure, and the opposing bearing surfaces extending substantially in the direction of the longitudinal axis.

2. The wear member according to claim 1, wherein the opposing bearing surfaces include a bearing surface positioned in the upper wall that opposes a bearing surface positioned in the lower wall.

3. The wear member according to claim 1, wherein the opposing bearing surfaces of the rear portion extend in a different plane and are spaced from the inclined bearing surfaces of the front portion.

4. The wear member according to claim 3, wherein the plane of the opposing bearing surfaces extends laterally relative to the front end.

5. The wear member according to claim 1, further comprising side bearing surfaces configured to bear against corresponding side walls of the support structure, and wherein the side bearing surfaces extend from the open end to the front end, and the upper wall and the lower wall are spaced apart by the side bearing surfaces.

6. The wear member according to claim 5, wherein the opposing bearing surfaces of the rear portion are configured as a central bearing surface disposed in the upper wall opposing a central bearing surface disposed in the lower wall, the central bearing surfaces being equally spaced in a lateral direction between the side bearing surfaces.

7. The wear member according to claim 6, wherein the central bearing surfaces are perpendicular to the side surfaces.

8. The wear member according to claim 1, wherein the surfaces of the front portion include an end bearing surface generally laterally extending across the front end.

9. The wear member according to claim 1, wherein the front and rear portions are spaced apart by an intermediate portion including non-bearing surfaces.

10. The wear member according to claim 1, wherein the front portion further comprises a radiused transition region extending between the inclined bearing surfaces.

11. The wear member according to claim 10, wherein the radiused transition region of the front portion and the opposing bearing surfaces of the rear portion extends in line with one another and the longitudinal axis.

12. The wear member according to claim 1, wherein the surfaces of the front portion have a hexagonal shape in cross-section.

13. A wear assembly for excavation equipment, the wear assembly comprising a wear member, the wear member comprising a digging end for ground penetration and a cavity defined by an internal surface that opens into a rear of the wear member extending along a longitudinal axis from an open end to a front end and for receiving a correspondingly shaped support structure of the excavation equipment, the internal surface of the cavity further comprising:

an upper wall and a lower wall each extending in the direction of the longitudinal axis from the open end to the front end; and a front portion positioned adjacent the front end and a rear portion positioned adjacent the open end;

at least one of the upper wall and the lower wall of the front portion including bearing surfaces for bearing against corresponding surfaces of the support structure, the front portion including:

two bearing surfaces being inclined relative to one another and extending from one another disposed in the upper wall and two bearing surfaces being inclined relative to one another extending directly from one another disposed in the lower wall, the inclined bearing surfaces extending in substantially the same direction as the longitudinal axis of the wear member, and the rear portion including:

opposing bearing surfaces for bearing against corresponding surfaces of the support structure, and the opposing bearing surfaces extending substantially in the direction of the longitudinal axis; and the wear assembly further comprising a locking hole extending along a locking hole axis to the cavity:

a lock movable within the locking hole, the lock comprising a lock body having a first end region for engaging with the support structure to secure the wear member with the support structure.

14. The wear assembly according to claim 13, wherein the wear assembly further comprising a correspondingly shaped support structure.

15. The wear assembly according to claim 13, wherein the locking hole is disposed in the wear member extending from an external surface to the internal surface of the cavity, the lock further comprises a retaining arrangement configured to resist movement of the lock body in the wear member under loading in the direction of the locking hole axis.

16. The wear assembly according to claim 15, wherein the lock body extends along a lock body axis and the retaining arrangement comprises at least one latch disposed on the lock body and a detent movable transverse to the lock body axis and being arranged in use to restrain movement of the lock in the locking hole.

17. The wear assembly according to claim 15, wherein the retaining arrangement comprising: an engaging structure on an exterior surface of the lock body which is arranged to engage with a complementary engaging structure disposed on an interior wall defining at least part of the locking hole, and one or more retainers operative to provide torsional resistance of the lock body in the locking hole, wherein the engaging structure is operative to inhibit axial movement of the lock body when the lock body is restrained from rotating in the locking hole.

18. The wear assembly according to claim 15, wherein the lock and the support structure include respective bearing surfaces that oppose one another when the lock is in a locked position, and are angularly offset from one another when the wear assembly is not placed under load.

19. A support structure for excavation equipment, the support structure being configured for receiving a cavity defined by an internal surface of a wear member of the excavation equipment, the wear member comprising a digging end for ground penetration, the support structure extending along a longitudinal axis from a rear end to a front end, the support structure comprising:

an upper wall and a lower wall each extending in the direction of the longitudinal axis from the rear end to the front end; and a front portion positioned adjacent the front end and a rear portion positioned adjacent the rear end;

at least one of the upper wall and the lower wall of the front portion including bearing surfaces for bearing against corresponding surfaces of the cavity, the front portion including: two bearing surfaces being inclined relative to one another disposed in the upper wall and two bearing surfaces being inclined relative to one another disposed in the lower wall and extending directly from one another, the inclined bearing surfaces extending in substantially the same direction as the longitudinal axis of the wear member, the rear portion including opposing bearing surface for bearing against corresponding surface of the cavity, and the opposing bearing surfaces extending substantially in the direction of the longitudinal axis, wherein the bearing surfaces are arranged so as to support load transfer from the corresponding surfaces of the cavity in more than one direction relative to the direction of the longitudinal axis.

20. The support structure according to claim 19, wherein the opposing bearing surfaces include a bearing surface positioned in the upper wall that opposes a bearing surface positioned in the lower wall.

21. The support structure according to claim 19, wherein the opposing bearing surfaces of the rear portion extend in a different plane and are spaced from the inclined bearing surfaces of the front portion.

22. A wear assembly according to claim 18, wherein, when the wear assembly is placed under load, the lock is biased to move relative to the support structure to cause the opposing bearing surfaces to move to reduce the angular offset so as to provide increased surface engagement between the bearing surfaces.

* * * * *